US005528352A

United States Patent [19]

Ichinokawa et al.

[11] Patent Number: 5,528,352

[45] Date of Patent: Jun. 18, 1996

[54] ELECTROPHOTOGRAPHIC APPARATUS HAVING ORIGINAL SEPARATION MEANS

[75] Inventors: Kazuhiro Ichinokawa; Kenichiro Otsuka; Satoshi Hokamura, all of Saitama-ken; Eiichi Ito, Kanagawa-ken; Takaaki Yano, Hokkai-do; Masatoshi Takano, Tokyo; Masakazu Hirano, Tokyo; Motohiro Maseki, Tokyo; Tatsuya Yoshida, Saitama-ken; Mikio Horie, Saitama-ken; Masami Shirai, Saitama-ken, all of Japan

[73] Assignee: Asahi Kogaku Kogyo Kabushiki Kaisha, Tokyo, Japan

[21] Appl. No.: 400,020

[22] Filed: Mar. 6, 1995

Related U.S. Application Data

[63] Continuation of Ser. No. 36,391, Mar. 24, 1993, abandoned.

[30] Foreign Application Priority Data

| | | | |
|---|---|---|---|
| Mar. 24, 1992 | [JP] | Japan | 4-024499 U |
| Apr. 8, 1992 | [JP] | Japan | 4-029934 U |
| Apr. 8, 1992 | [JP] | Japan | 4-029967 U |

[51] Int. Cl.[6] ..... G03G 21/00

[52] U.S. Cl. ..... 355/308; 271/121

[58] Field of Search ..... 355/317, 320, 355/308, 309, 75; 271/121, 124, 109; 358/473, 474, 476, 400

[56] References Cited

U.S. PATENT DOCUMENTS

| | | | |
|---|---|---|---|
| 4,113,245 | 9/1978 | Coglazier | 271/121 X |
| 4,192,497 | 3/1980 | Perun et al. | 271/121 X |
| 4,872,061 | 10/1989 | Uchiyama | 358/474 X |
| 4,952,974 | 8/1990 | Mori . | |
| 4,962,526 | 10/1990 | Kotani et al. | 358/473 X |
| 5,016,029 | 5/1991 | Mori et al. . | |
| 5,045,892 | 9/1991 | Morisawa et al. . | |
| 5,052,676 | 10/1991 | Shiina et al. | 271/121 |
| 5,083,766 | 1/1992 | Osawa | 271/121 |
| 5,116,034 | 5/1992 | Trask et al. | 271/121 X |
| 5,120,042 | 6/1992 | Goto et al. | 271/121 X |
| 5,274,477 | 12/1993 | Mori et al. . | |
| 5,276,536 | 1/1994 | Hokamura . | |
| 5,321,479 | 6/1994 | Yoshida et al. . | |
| 5,338,021 | 8/1994 | Shirai . | |

FOREIGN PATENT DOCUMENTS

| | | | |
|---|---|---|---|
| 60-178136 | 9/1985 | Japan | 271/124 |
| 2-215627 | 8/1990 | Japan | 271/121 |
| 3-026618 | 2/1991 | Japan | 271/121 |
| 3-026626 | 2/1991 | Japan | 271/121 |
| 4-350034 | 12/1992 | Japan | 271/121 |

*Primary Examiner*—A. T. Grimley
*Assistant Examiner*—Shuk Y. Lee
*Attorney, Agent, or Firm*—Greenblum & Bernstein

[57] ABSTRACT

An electrophotographic apparatus is provided with an original separation mechanism which is disposed on a lower side of the inlet port of a feeding path. The original separation mechanism is pressed to an original pick-up roller, and is provided for separating one original, which contacts the original pick-up roller, from at least one following original. The original separation mechanism includes a unit body, and a friction member attached to the upper surface of a unit body, extending toward a downstream side of the feeding direction of the original so as to intersect the feed path at a predetermined angle, and having an upper surface with a prescribed friction coefficient. The original separation mechanism further includes a pair of supporting members attached to both sides of the unit body with respect to the friction member, and each formed of a spring material having an upper surface which extends so as to intersect the upper surface of the lower original guide member at a predetermined angle. Each of the supporting members intersects the friction member at the distal end thereof.

30 Claims, 71 Drawing Sheets

ELECTROPHOTOGRAPHIC APPARATUS HAVING ORIGINAL SEPARATION MEANS

This application is a continuation of application Ser. No. 08/036,391, filed Mar. 24, 1993, now abandoned.

BACKGROUND OF THE INVENTION

The present invention relates to an electrophotographic apparatus having imaging device utilizing an electrophotographic process.

Conventionally, an electrophotographic apparatus having imaging device utilizing an electrophotographic process is provided with an image reading mechanism for reading an image on an original. The conventional image reading mechanism is provided with an original pick-up roller disposed at an inlet port of an original transport path and an original separation unit contacting the original pick-up roller, in order to transport the originals in a condition where the originals are certainly separated one by one to an image reader.

In the original separating mechanism, the contacting condition between the original pick-up roller and the original separation unit must be maintained in a constant condition, for accomplishing the certain or stable original separating condition. The contacting condition, however, must be changed since the outer periphery of a friction roller portion of the pick-up roller and a separating member of the original separation unit are worn out when the original separating operation is repeatedly executed, thereby deteriorating the separating function of the original separating mechanism. If the separating function has once been deteriorated, the so-called mis-feed would occur.

The separation conditions differ between a case where a number of the originals is small and a case where a number of the originals is large. Accordingly, the separation condition where a number of the originals is small would become worse when the separation condition where a number of the originals is large has been set to be good, and vice versa.

SUMMARY OF THE INVENTION

It is therefore a main object of the present invention to provide an electrophotographic apparatus which can ensure the certain separation of the originals, regardless of the number of the originals.

It is another object of the present invention to provide an electrophotographic apparatus which can take out an original upon rotation of an original pick-up roller.

It is a different object of the present invention to provide an electrophotographic apparatus which can mount on and/or detach from an original pick-up roller and/or a white roller, without deteriorating the separating operation.

It is a further object of the present invention to provide an electrophotographic apparatus which can easily, detachably mount an original separation means, without deteriorating the separating operation.

In order to accomplish the above-mentioned object, according to a first aspect of the present invention, there is provided an electrophotographic apparatus which includes upper and lower original guide members which define a feed path for an original therebetween and which includes an inlet port and an outlet port, an original pick-up roller, disposed on an upper side of the inlet port of the feed path, for picking up the original in a feeding direction along the feed path one by one, and an original separations device, disposed on a lower side of the inlet port of the feeding path. The original separation device is pressed to the original pick-up roller, for separating one original which contacts the original pick-up roller from at least one following original. The original separation device includes a unit body, and a friction member attached to the upper surface of the unit body, extending toward a downstream side of the feeding direction of the original so as to intersect the feed path at a predetermined angle, and having an upper surface with a prescribed friction coefficient. The original separation device further includes a pair of supporting member attached to both sides of the unit body relative to the friction member, and each formed of a spring material having an upper surface which extends so as to intersect the upper surface of the lower original guide member at a predetermined angle. Each of the supporting members intersect the friction member at the distal end thereof.

Also, in order to accomplish the above-mentioned object, according to a second aspect of the present invention, there is provided an electrophotographic apparatus which includes upper and lower original guide members which define a feed path for an original therebetween, and which includes an inlet port and an outlet port, an original pick-up-roller, disposed on an upper side of the inlet port of the feed path, for picking up the original in a feeding direction along the feed path one by one, and an original separation device, disposed on a lower side of the inlet port of the feeding path. The original separation device is pressed to the original pick-up roller, for separating one original which contacts the original pick-up roller from at least one following original. The upper original guide member includes a through hole through which the said pick-up roller is to be inserted. The original pick-up roller is provided so as to protrude the lower part thereof into the feed path through the through hole. The separation device includes a separation surface in such a manner that it contacts the outer peripheral surface of the lower part of the original pick-up roller.

Further, in order to accomplish the abovementioned object, according to a third aspect of the present invention, there is provided an electrophotographic apparatus which includes upper and lower original guide members which define a feed path for an original therebetween, and which includes an inlet port and an outlet port, an original pick-up roller, disposed on an upper side of the inlet port of the feed path, for picking up the original in a feeding direction along the feed path one by one, and an original separation device, disposed on a lower side of the inlet port of the feeding path. The original separation device is pressed to the original pick-up roller, for separating one original which contacts the original pick-up roller from at least one following original. Image reading means are arranged on the downstream side of the feeding direction relative to the original pick-up roller, for reading an imaged of the original fed thereto. A white roller is disposed on an opposite side of the image reading means interposing the feed path therebetween. An and attaching device for detachably attaching the original pick-up roller and the white roller to the lower original guide member.

The above, and other objects, features and advantages of the present invention will become apparent from the following detailed description which is to be read in conjunction with the accompanying drawings.

DESCRIPTION OF THE ACCOMPANYING DRAWINGS

Figure 68:
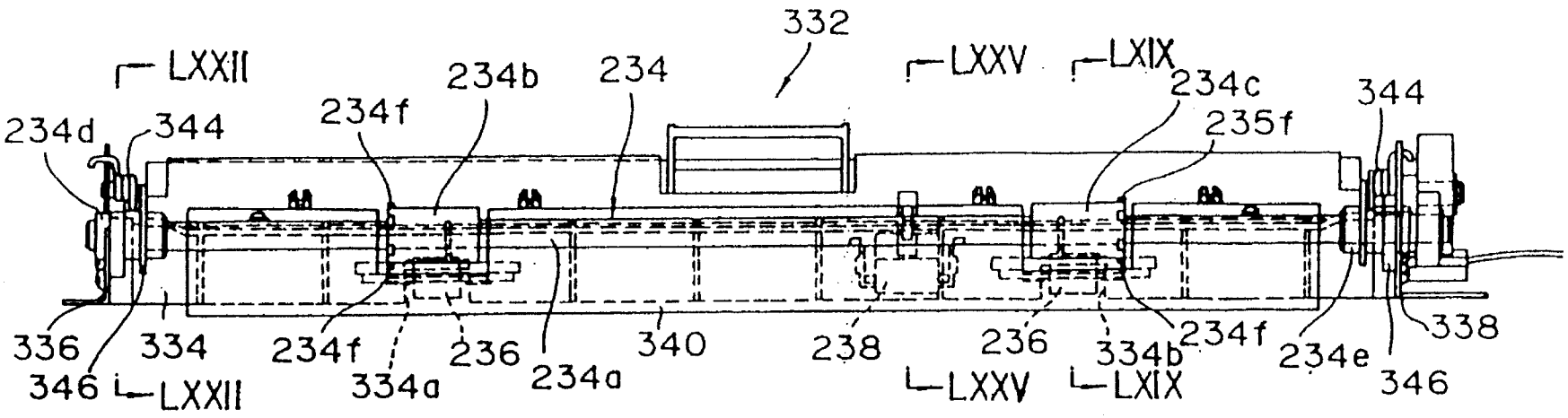
FIG. 68 is a front elevational view of the sheet discharging mechanism.
Figure 71:
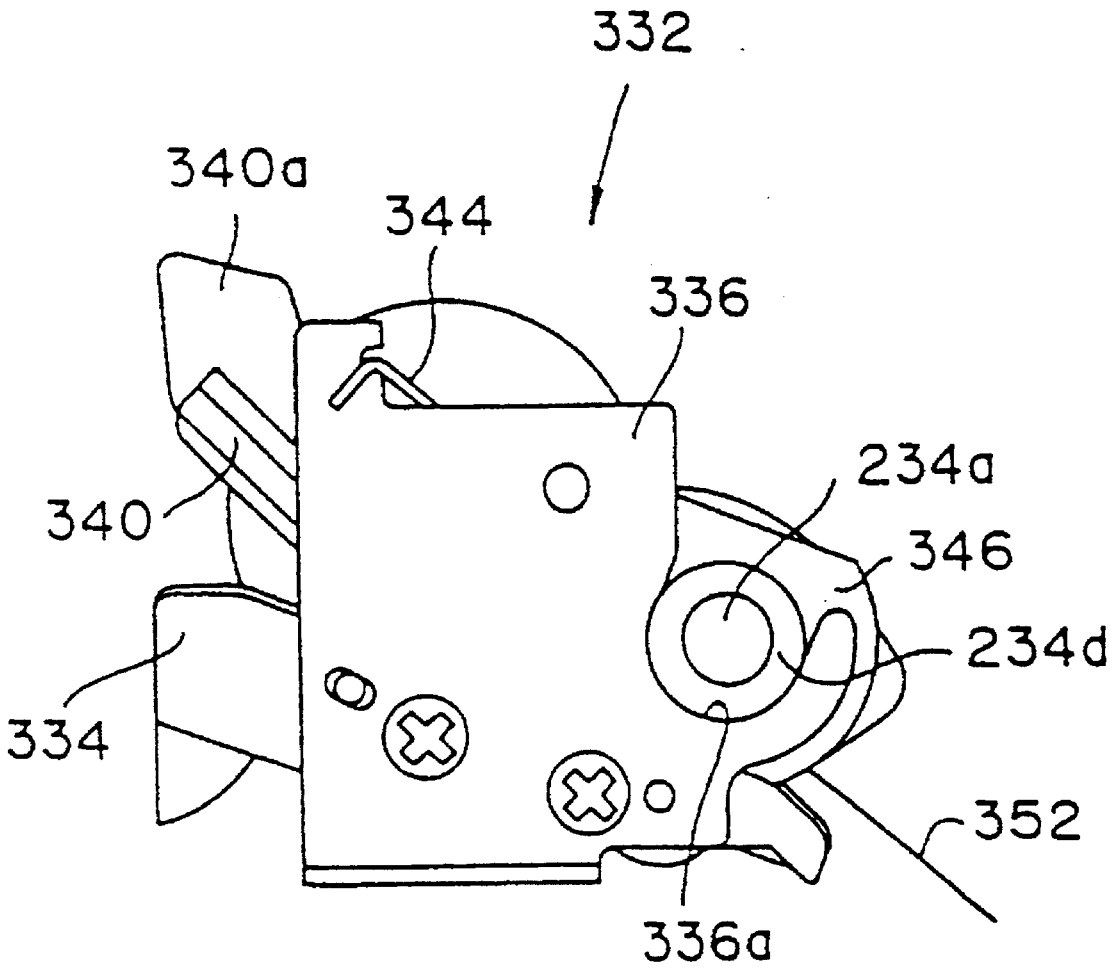
Figure 72:
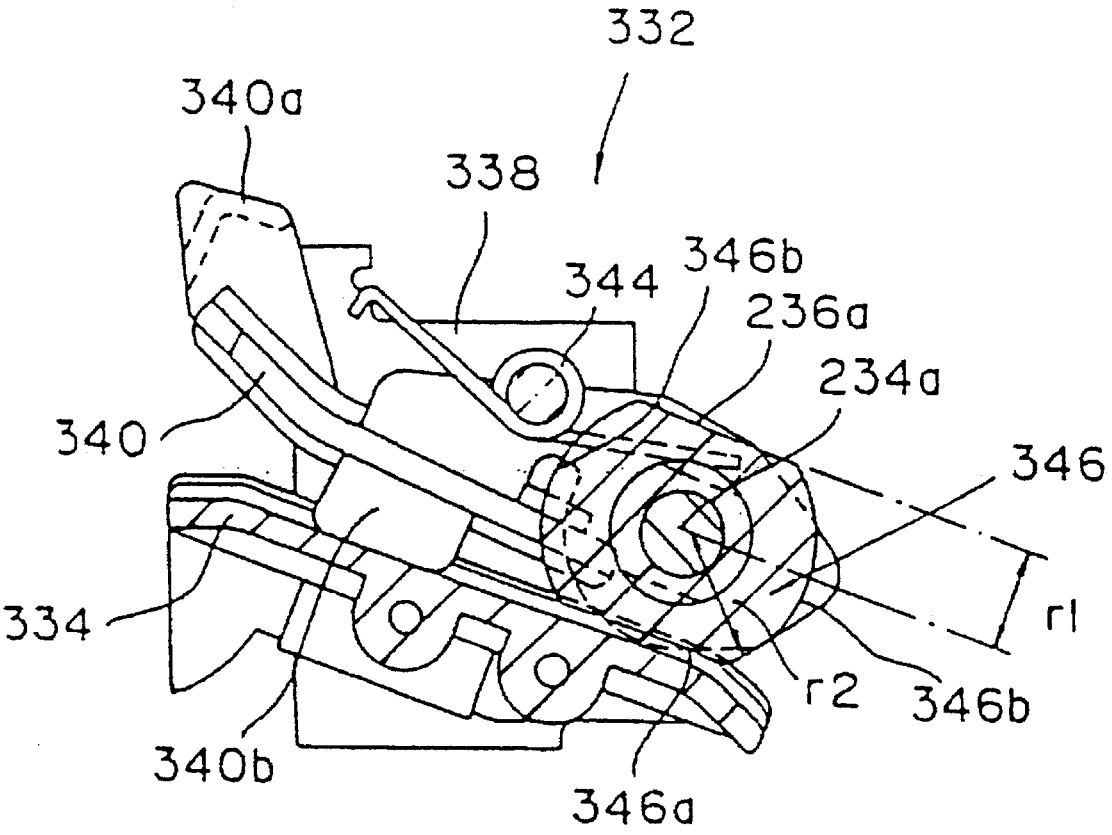
Figure 73:
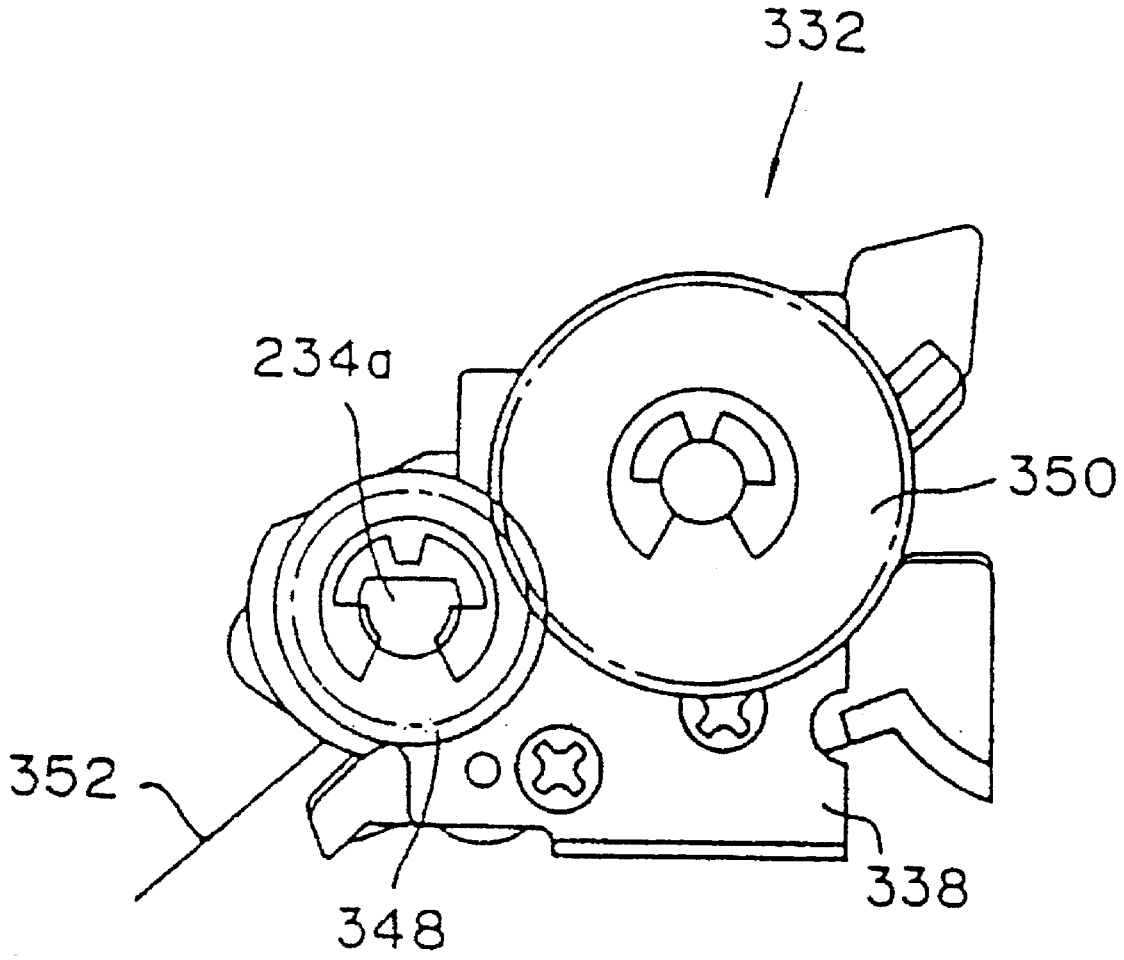
Figure 74:
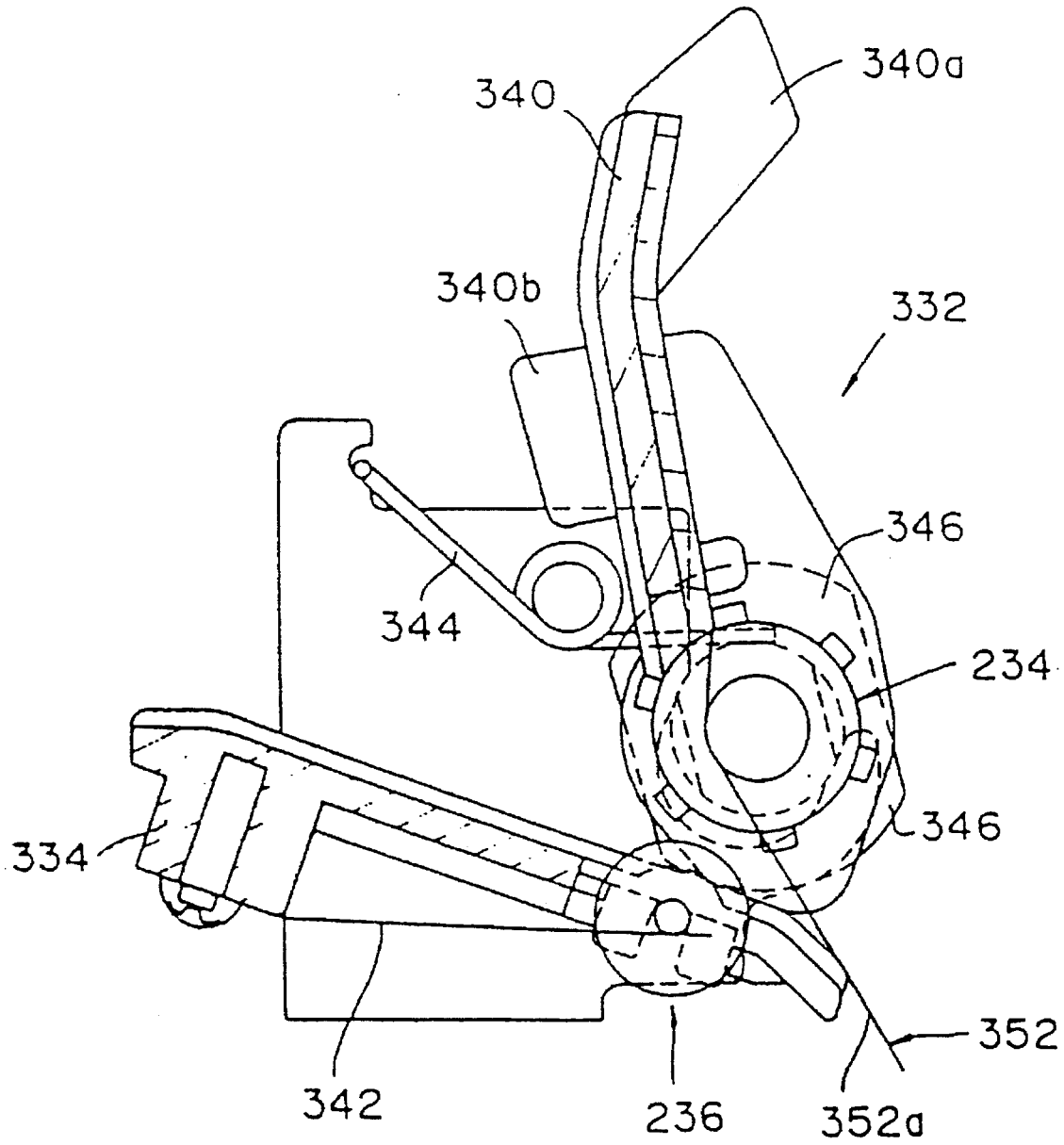
Figure 75:
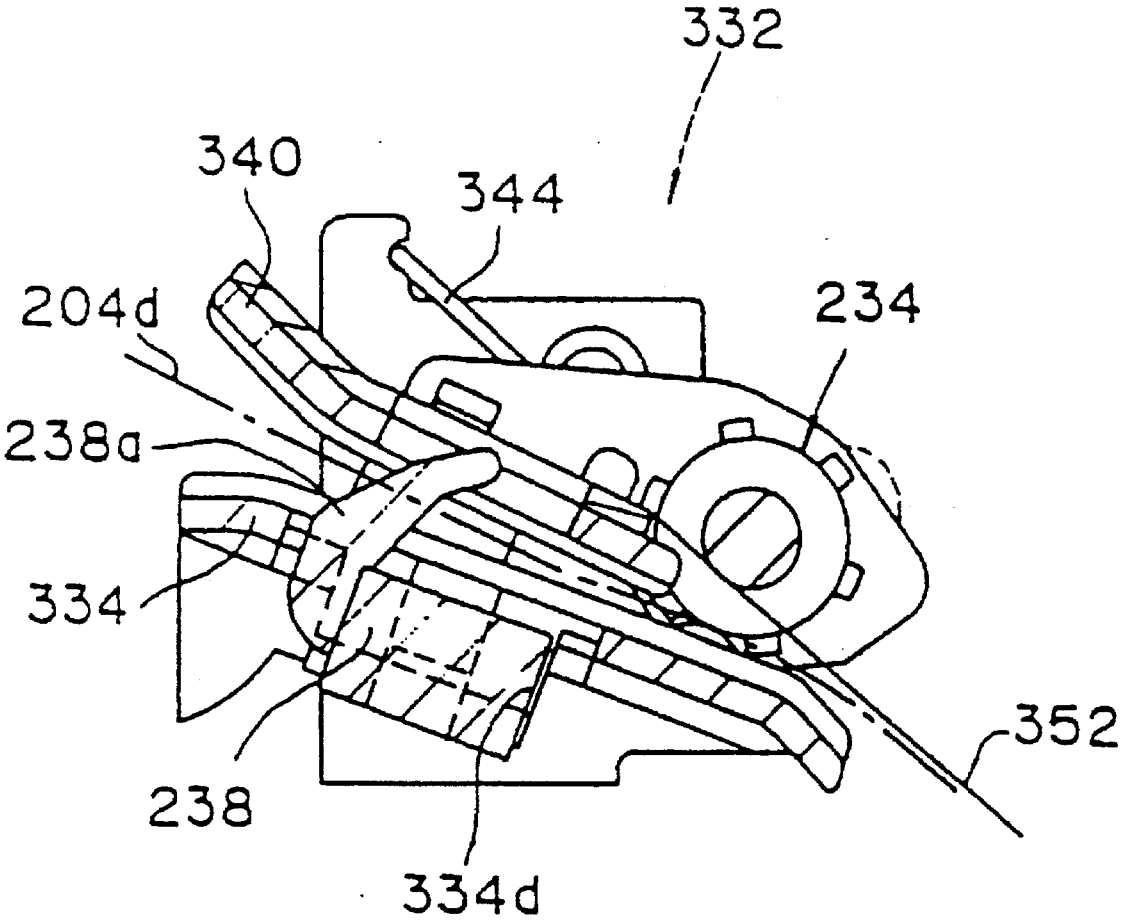
Figure 76:
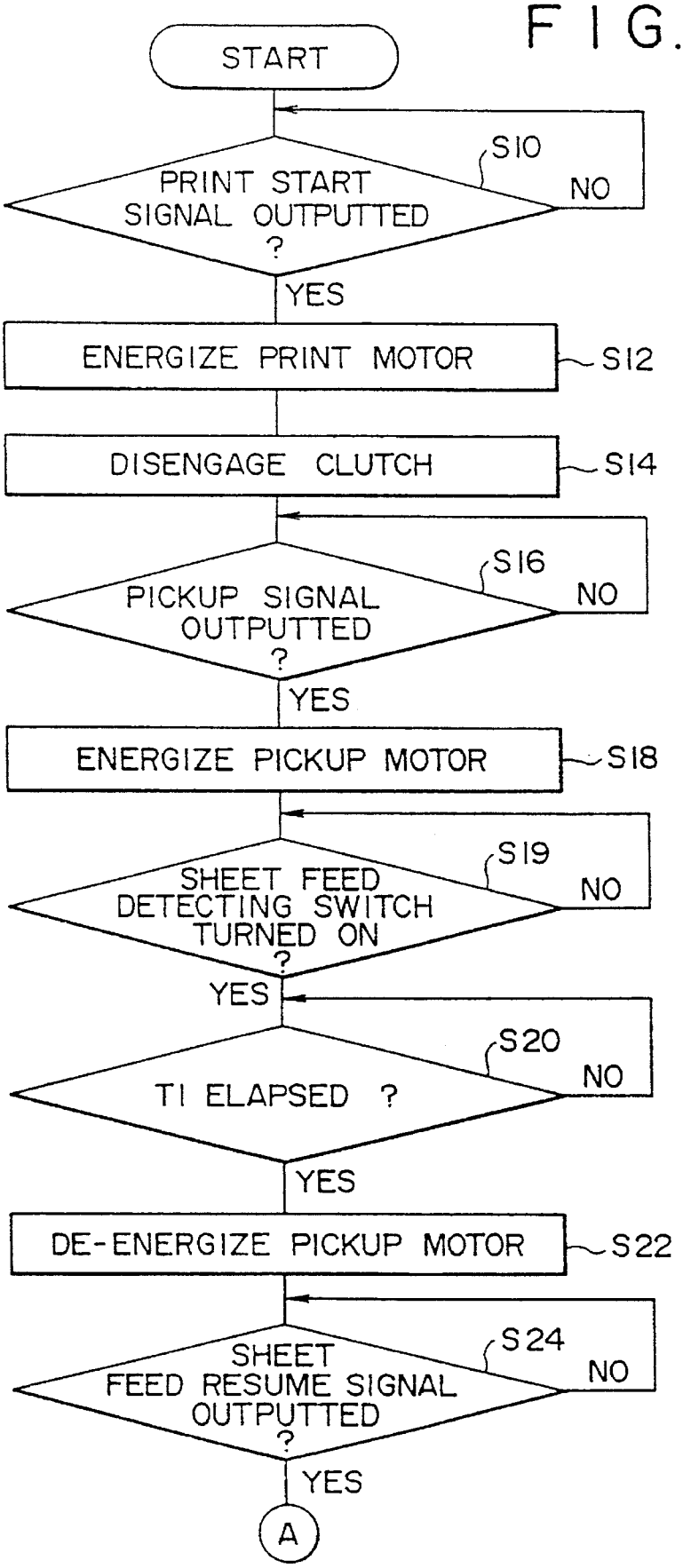
Figure 77:
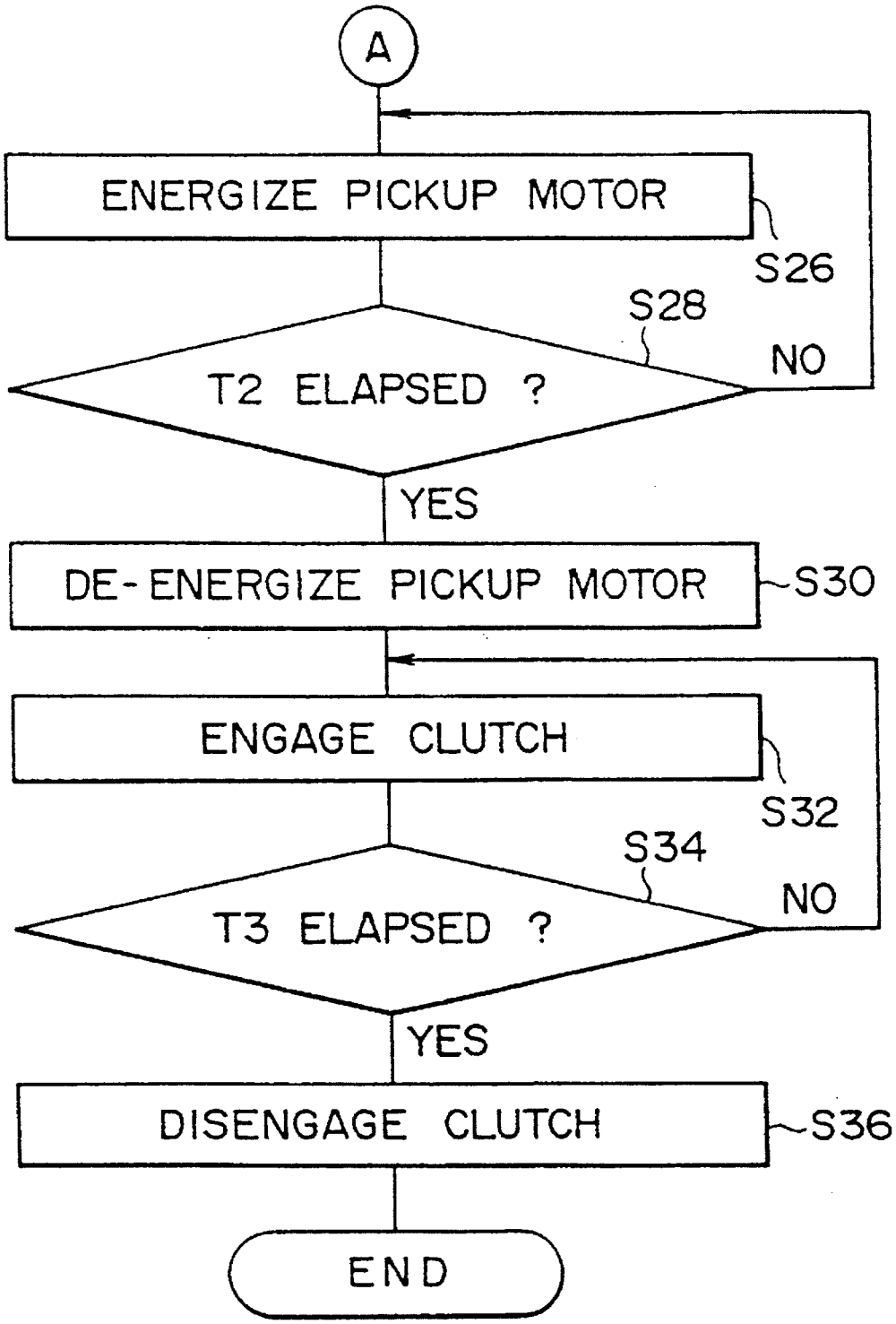
Figure 78:
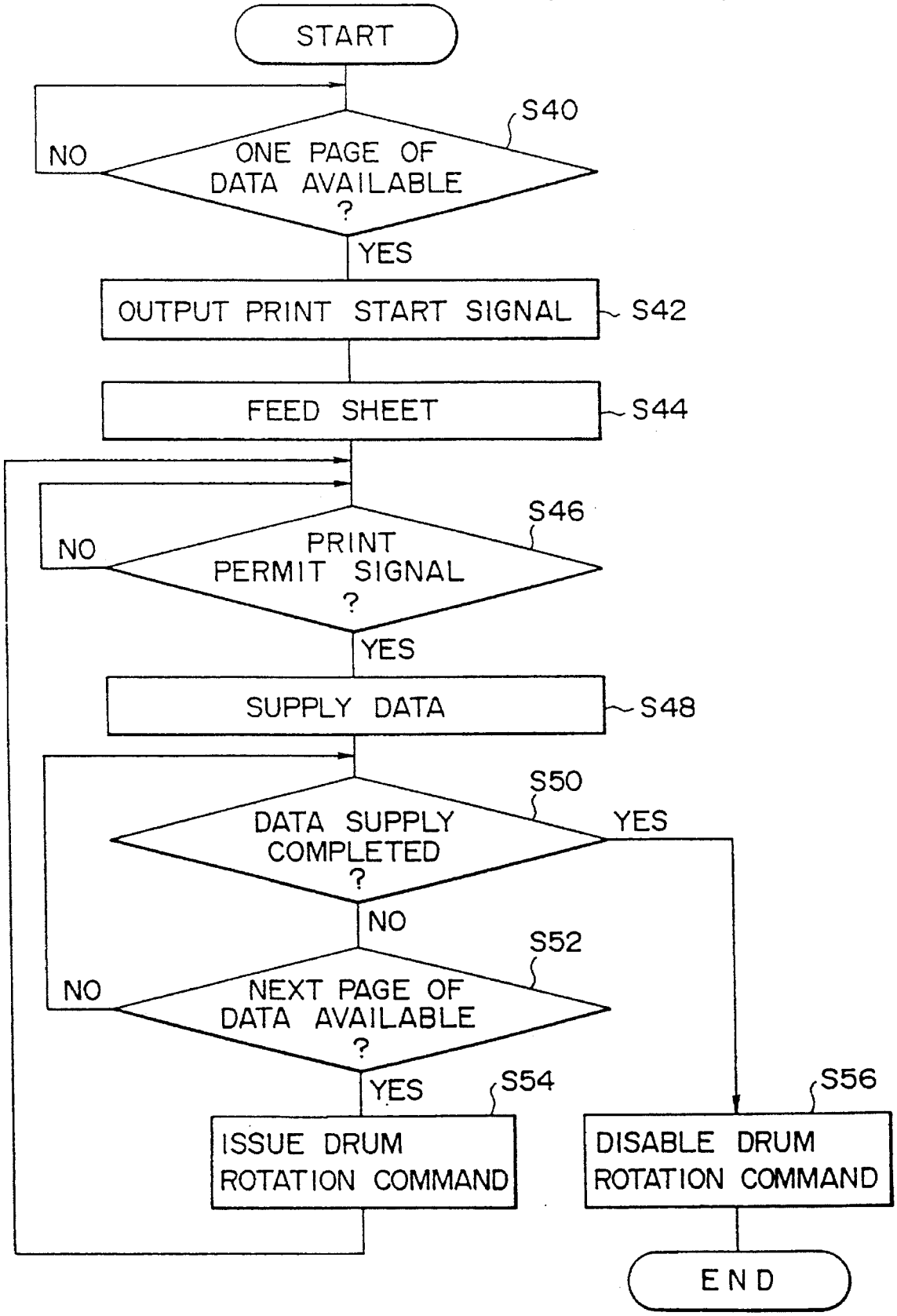
Figure 79:
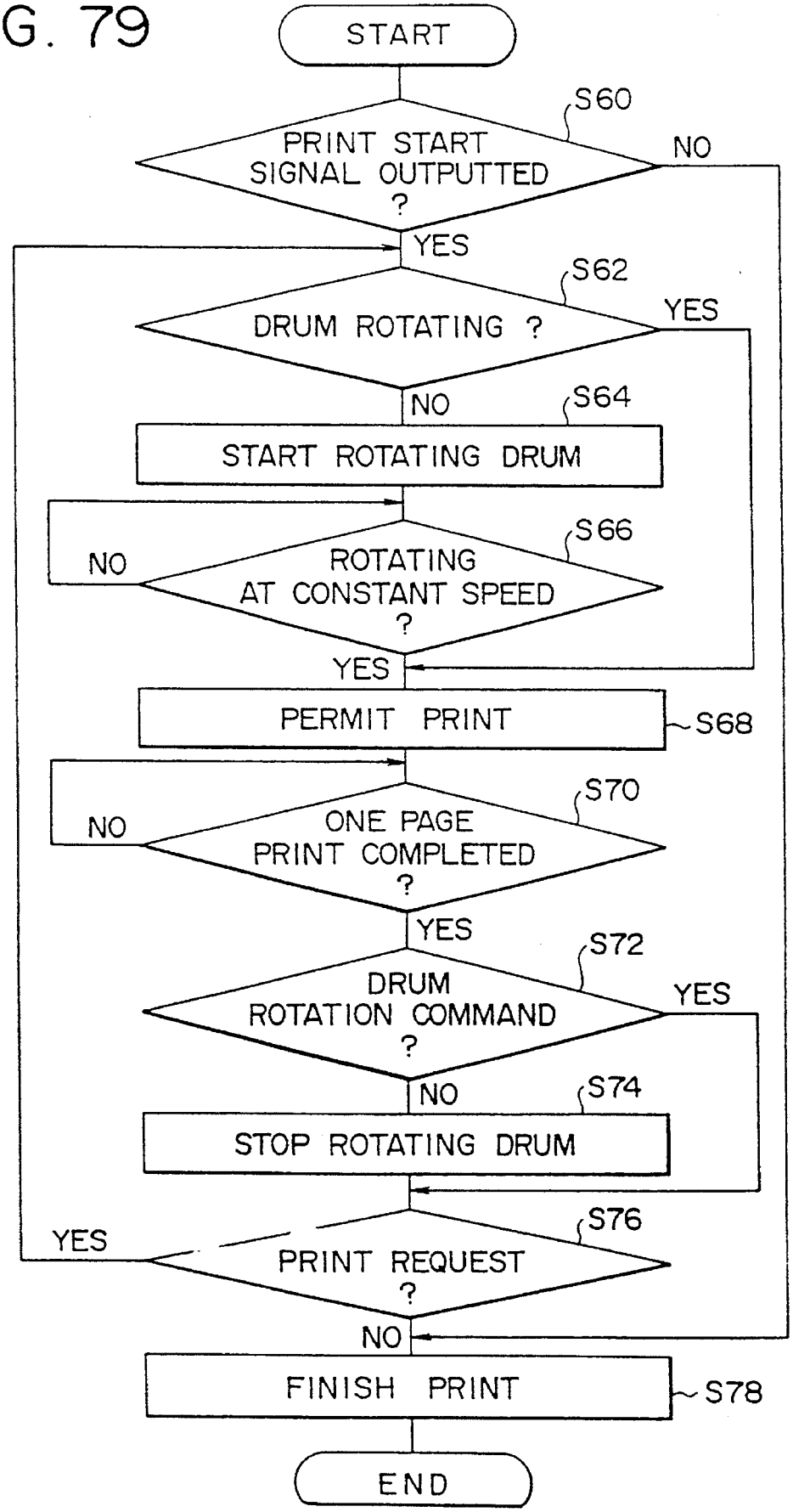
Figure 80:
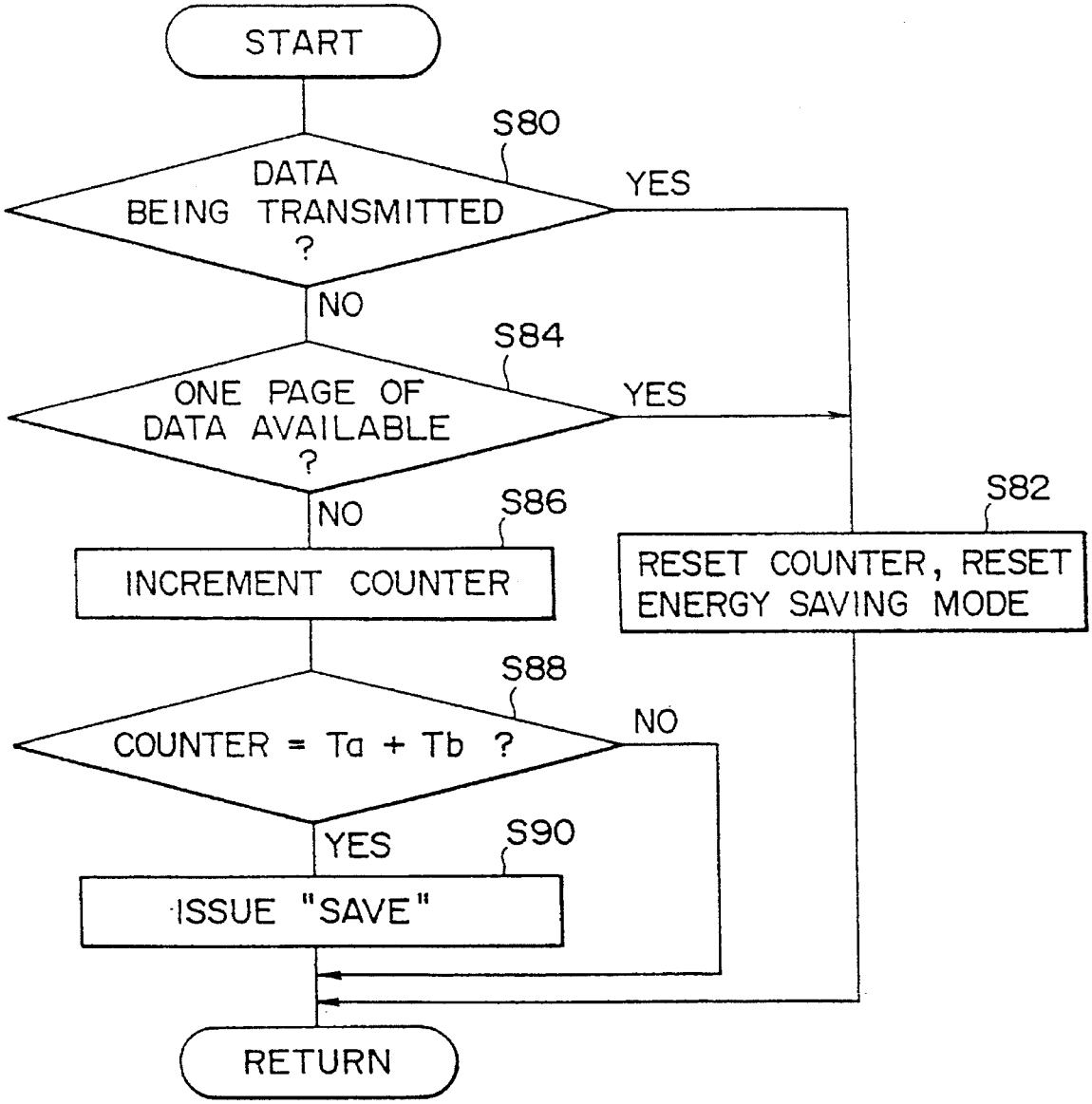
Figure 81:
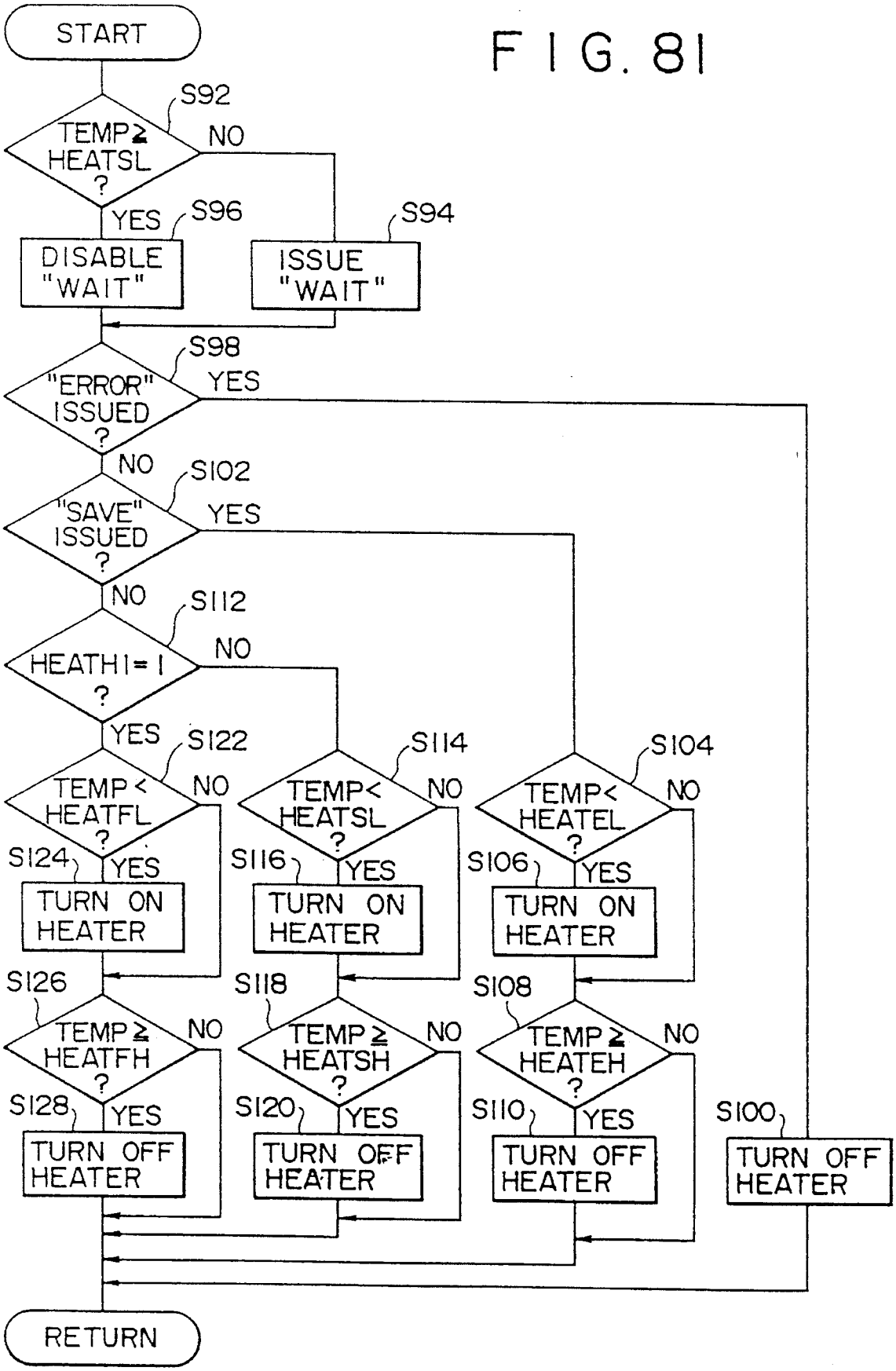
Figure 82:
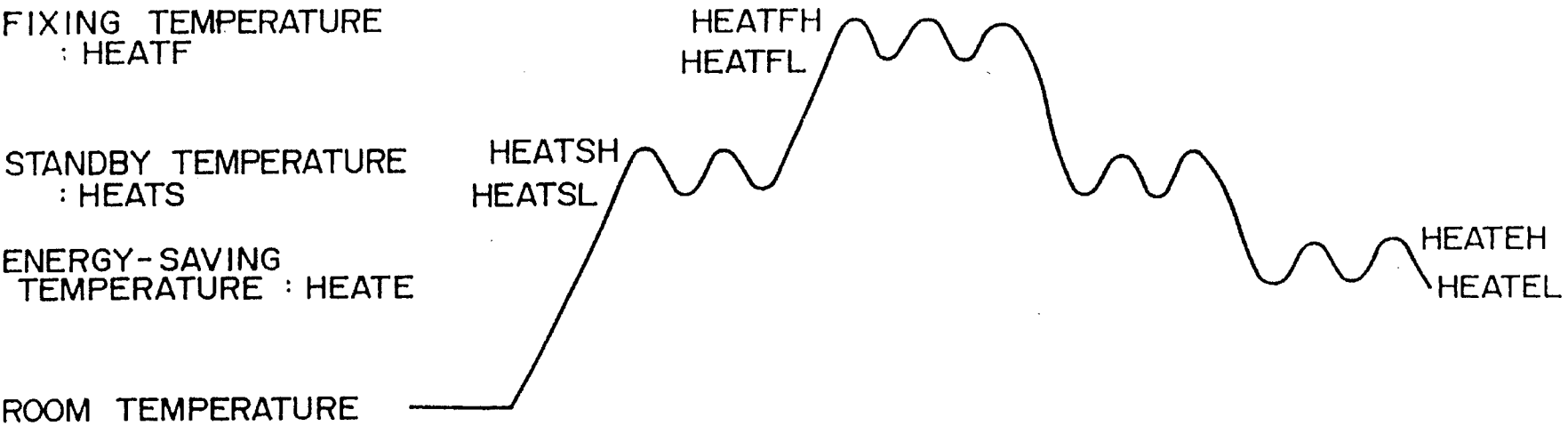

FIG. 71 side elevational view of the sheet discharging mechanism;

FIG. 72 is a cross-sectional view taken along line LXXII—LXXII of FIG. 68;

FIG. 73 is a side elevational view of the sheet discharging mechanism;

FIG. 74 is a side elevational view, partly in cross section, of the sheet discharging mechanism with the upper movable sheet discharge guide lifted;

FIG. 75 is a cross-sectional view taken along line LXXV—LXXV of FIG. 68;

FIGS. 76 and 77 are a flow chart of a control sequence for picking up a sheet and feeding the sheet to the image fixing unit;

FIG. 78 is a flow chart of a control sequence for supply print data;

FIG. 79 is a flow chart of a control sequence of printing operation;

FIG. 80 is a flowchart of a control sequence of basic heating operation in the image fixing unit;

FIG. 81 is a flowchart of a control sequence of heater energization in the image fixing unit; and FIG. 82 is a diagram showing the manner in which the temperature of a lower fixing roller of the image fixing unit varies.

DESCRIPTION OF THE EMBODIMENT

[OVERALL STRUCTURE]

Figure 1:
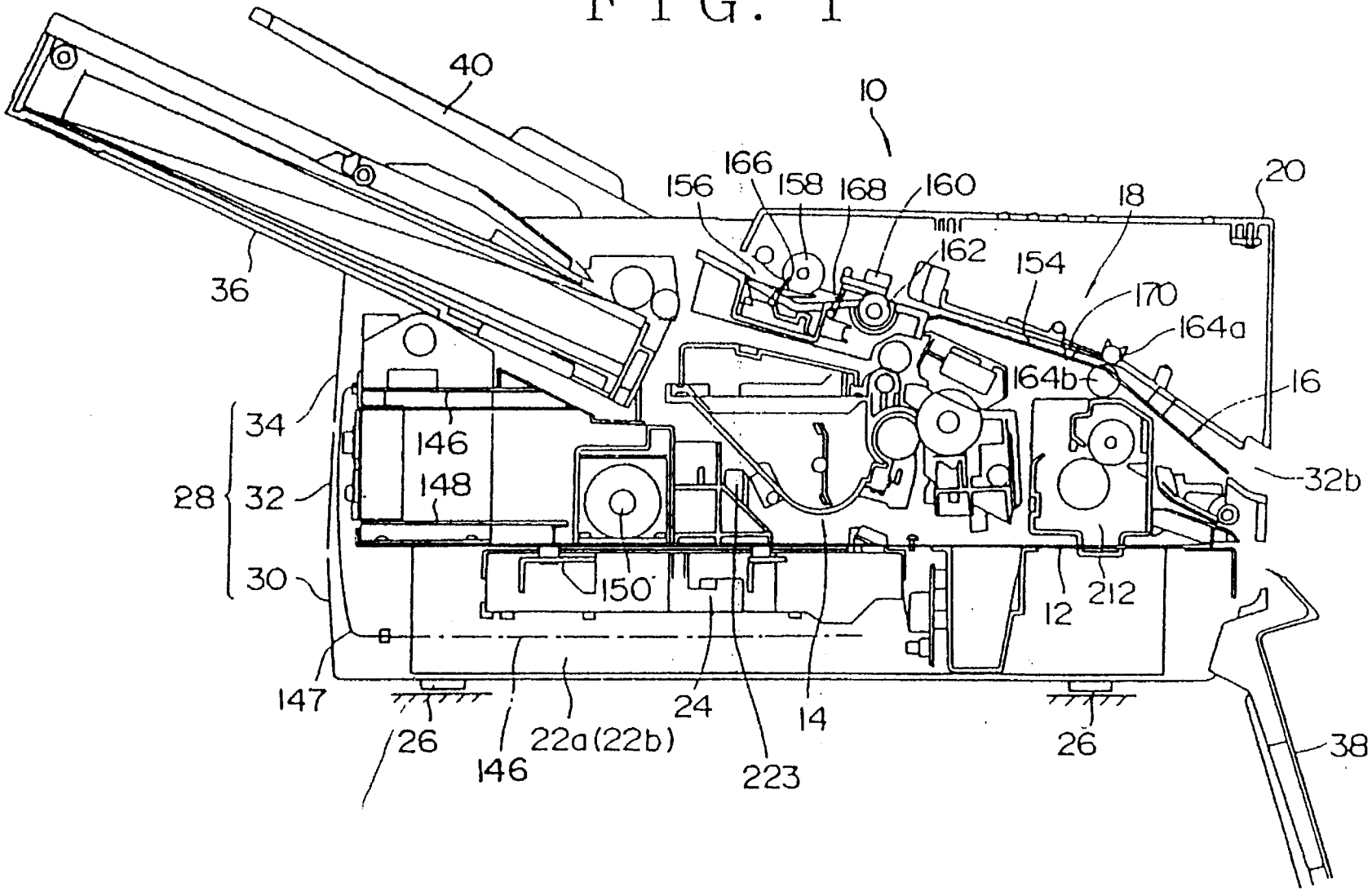
FIG. 1 is a schematic side elevational view of an internal structure of a facsimile apparatus embodying an electrophotographic apparatus according to the present invention.

A facsimile apparatus 10, according to the present invention as shown in FIG. 1, automatically reads image information one document at a time from plurality of documents to be transmitted that have been positioned for transmission. The fascimile apparatus 10 transmits the read image information over a telephone line to another facsimile apparatus, or receives image information transmitted over a telephone line from another facsimile apparatus. Then, the fascimile apparatus 10 transfers the received image information, i.e., forms a corresponding image, on a sheet (a cut sheet of plain paper) stored in the facsimile apparatus 10 by way of electrophotography combined with laser beam scanning. The facsimile apparatus 10 is also capable of electrophotographically copying image information read from a document, i.e., forming a corresponding image, on a sheet stored in the facsimile apparatus 10. Furthermore, the facsimile apparatus 10 can function as a printer for transferring image information transferred from an information processing system, for example, over a connecting line other than a telephone line, i.e., forming a corresponding image, on a sheet stored in the facsimile apparatus 10.

As shown in FIG. 1, the facsimile apparatus 10, that is placed on a support surface, generally includes a main plate 12 lying parallel to and spaced upwardly from the support surface, an image printing mechanism 14 mounted on an upper surface of the main plate 12 for forming an image on a sheet, a swing frame 16 angularly movably supported on a rear end of the main plate 12 for swinging movement with respect to the main plate 12, and an image reading mechanism 18 disposed on an upper surface of the swing frame 16 for reading image information from a document. The fascimile apparatus 10 further includes a control panel 20 angularly movably supported at a rear end thereof on an intermediate portion of the swing frame 16 for swinging movement with respect to the swing frame 16, a pair of laterally spaced lower frames **22*a*, 22*b* fixed to opposite lateral sides of a lower surface of the main plate 12 and extending in the longitudinal direction of the main plate 12, a laser scanning unit 24 disposed in a space between the lower frames 22***a*, 22*b* and mounted on the lower surface of the main plate 12 for forming a latent image on the outer circumferential surface of a photosensitive drum (described later on) of the image printing mechanism 14, and four legs 26 fixed respectively to the longitudinal ends of lower surfaces of the lower frames 22*a*, 22*b* for being supported on the support surface.

[ENCLOSURE 28]

Figure 2:
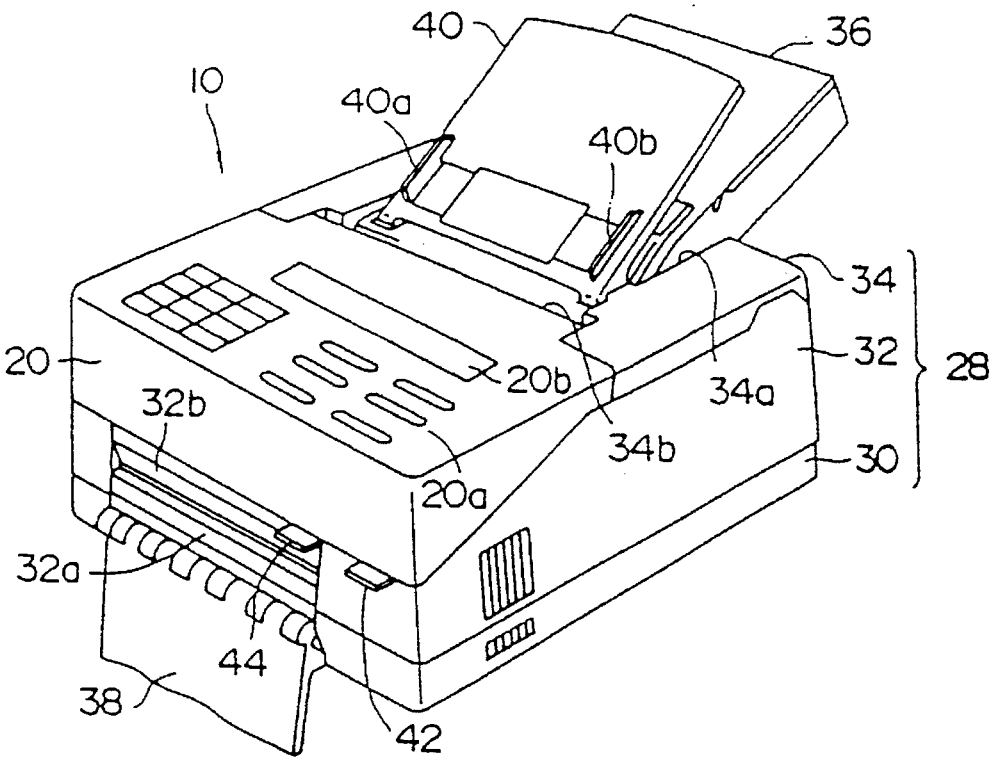
FIG. 2 is a perspective view of the facsimile apparatus shown in FIG. 1.
Figure 3:
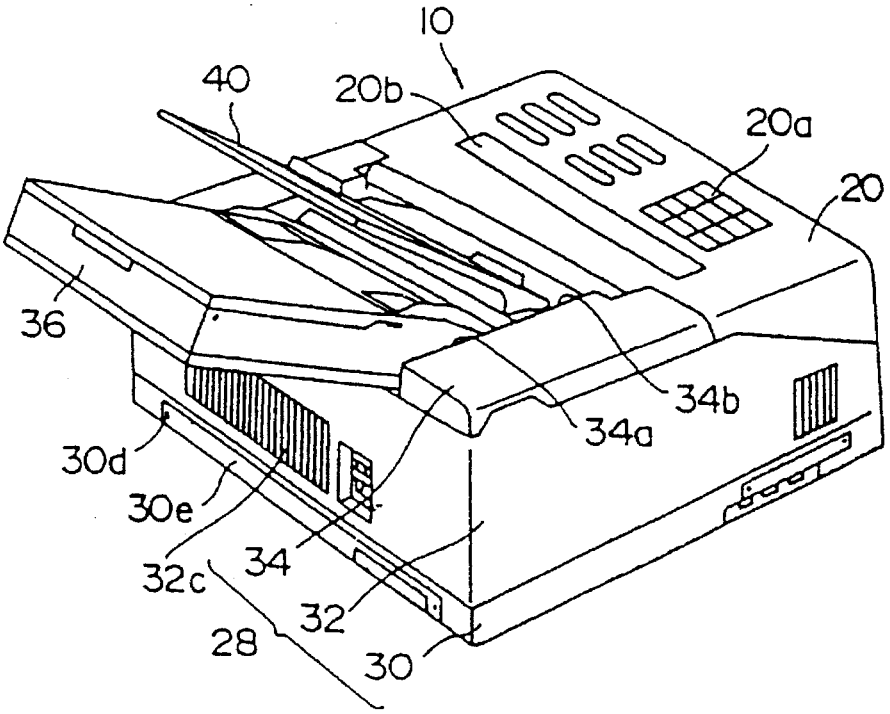
FIG. 3 is a perspective view of the facsimile apparatus shown in FIG. 1.

As shown in FIGS. 2 and 3, the facsimile apparatus 10 has an enclosure 28 which defines all outer surfaces of the facsimile apparatus 10. Specifically, the enclosure 28 includes three separable housings, i.e., a lower housing 30 disposed beneath the main plate 12 and surrounding a region around the space between the lower frames 22*a*, 22*b*, i.e., a region beneath the main plate 12, a middle housing or printer housing 32 disposed above the main plate 12 and positioned directly above the lower housing 30 contiguously thereto in surrounding relationship to the image printing mechanism 14, and an upper housing 34 positioned directly above the printer housing 32 and fixed to the swing frame 16 for openably closing an upper opening of the printer housing 32. The control panel 20 is swingably supported on a rear edge of a front opening defined in a front portion of the upper housing 34 for openably closing the front opening of the upper housing 34.

Since the enclosure 28, defining the outer surfaces of the facsimile apparatus 10, is composed of the lower housing 30, the printer housing 32, and the upper housing 34 that are separable from each other, the enclosure 28 may be assembled after the internal structure of the facsimile apparatus 10 has been assembled. Consequently, the facsimile apparatus 10 can be assembled with increased efficiency.

Figure 4:
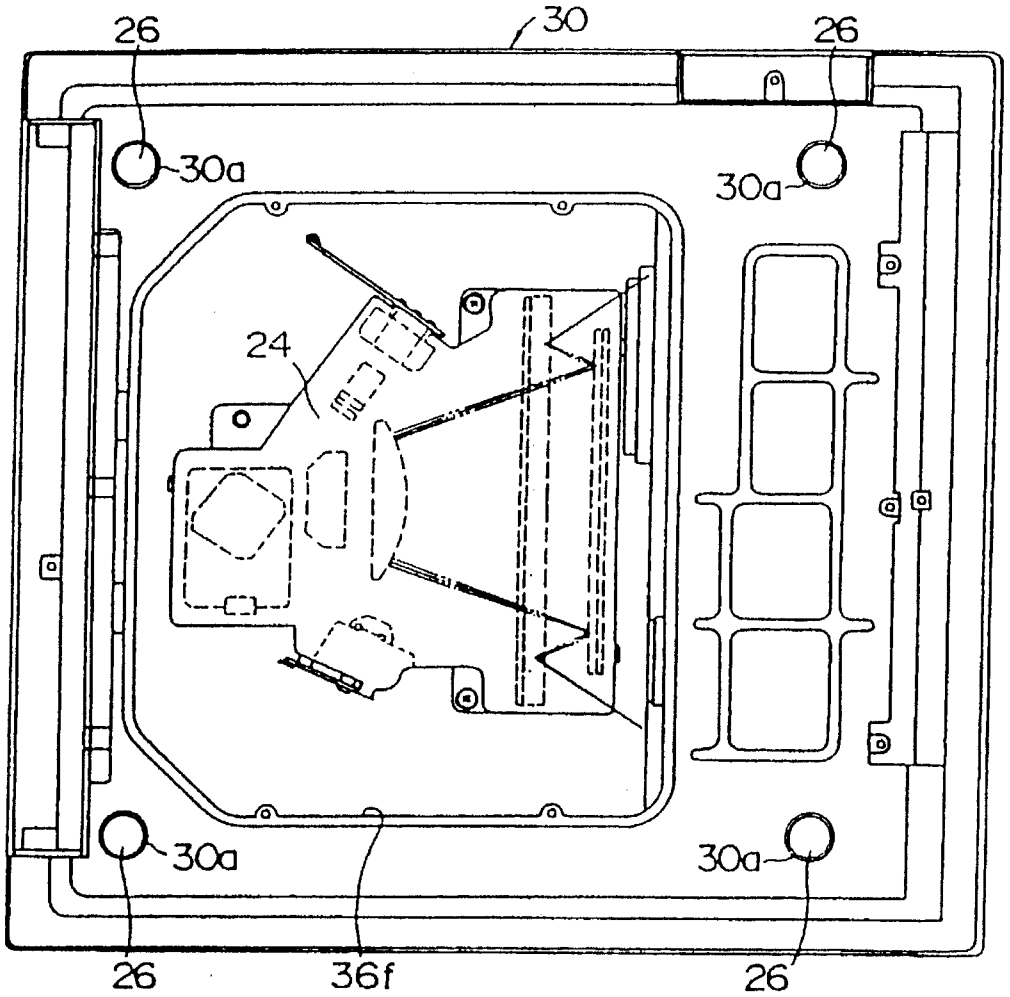
FIG. 4 is a bottom view of the facsimile apparatus shown in FIG. 1, with a bottom cover removed.
Figure 5:
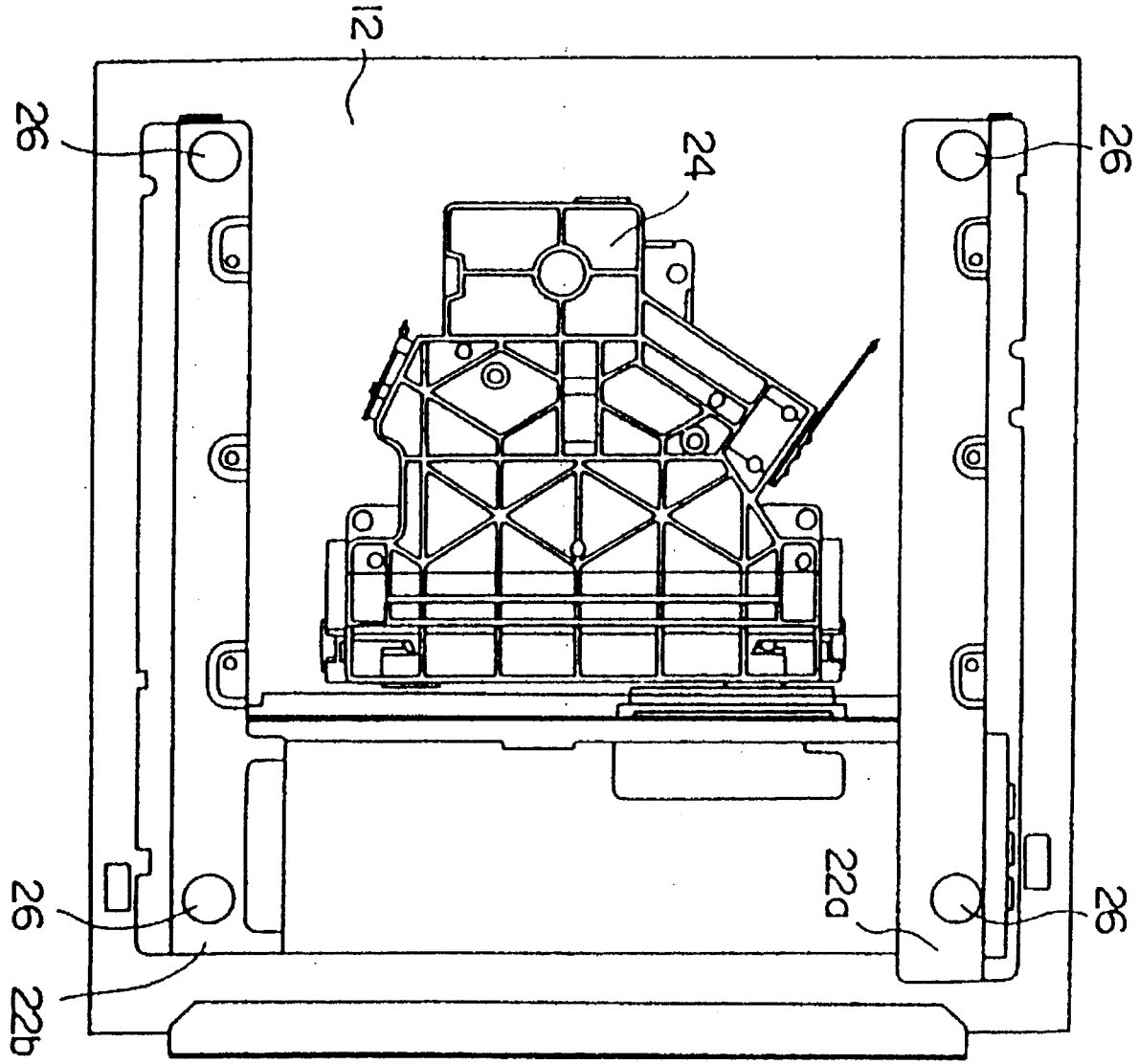
FIG. 5 is a bottom view of a main plate of the facsimile apparatus shown in FIG. 1.
Figure 6:
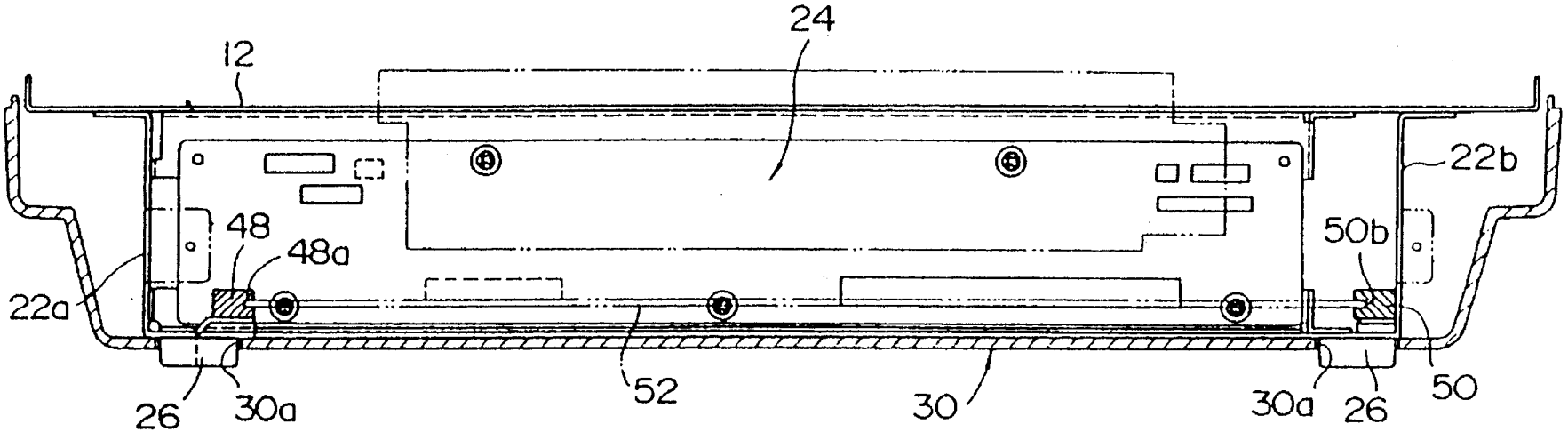
FIG. 6 is a rear elevational view, partly in cross section, of a structure below the main plate shown in FIG. 5.

The legs 26 are positioned respectively on the four corners of a rectangular bottom panel of the facsimile apparatus 10, as shown in FIG. 4, and fixed to the lower surfaces of the lower frames 22*a*, 22*b*, as shown in FIGS. 5 and 6. Therefore, even before the enclosure 28, particularly the lower housing 30 thereof, is assembled, the main plate 12 can stably be placed on an assembly table as a result of the legs 26 that are secured to the lower surfaces of the lower frames 22*a*, 22*b*, which are attached to the lower surface of the main plate 12. The main plate 12 remain stably placed on the assembly table while the internal structure of the facsimile apparatus 10 is being assembled.

With the lower housing 30 attached to the lower frames 22*a*, 22*b*, the legs 26 project downwardly through respective clearance holes 30*a* that are defined in the lower housing 30 in registry with the legs 26. When the facsimile apparatus 10 is placed on the assembly table, the weight of the facsimile apparatus 10 is borne by the main plate 12 through the lower frames 22*a*, 22*b*, and does not act on the enclosure 28, particularly the lower housing 30 among other housings. Consequently, no undesirable load or weight is applied to the enclosure 28. Since the enclosure 28 is free from load-induced deformations, it may be reduced in thickness, and hence the overall weight of the facsimile apparatus 10 may also be reduced.

As shown in FIG. 5, the laser scanning unit 24 is mounted on the lower surface of the main plate 12. As shown in FIG. 6, the laser scanning unit 24 has a portion, specifically, a slot for applying a laser beam to expose a photosensitive drum to an image, projecting upwardly beyond the upper surface of the main plate 12. If the legs 26 were attached to the lower housing 30 for imposing the load of the facsimile apparatus 10 on the lower housing 30 through the legs 26, it would be difficult or impossible to install the laser scanning unit 24 unless the lower housing 30 were assembled prior. Therefore, the sequence of assembling operation would greatly be limited, and its efficiency would be lowered. In this embodiment, however, since the load-bearing legs 26 are fixed to the lower frames 22*a*, 22*b*, the lower scanning unit 24 may be mounted on the lower surface of the main plate 12 anytime after the lower frames 22*a*, 22*b* have been attached to the main plate 12. The facsimile apparatus 10 can therefore be assembled with increased flexibility for higher assembling efficiency.

As illustrated in FIGS. 2 and 3, the upper housing 34 has a sheet cassette slot 34*a* defined in its rear central region for receiving a sheet cassette 36 and introducing a sheet of transfer paper. A document inlet slot 34*b* is also defined in the rear central region immediately in front of the sheet cassette slot 34*a* for introducing a document to be transmitted. The sheet cassette 36 is arranged to store a number of stacked sheets of paper having a predetermined size. The printer housing 32 has a sheet discharge slot 32*a* defined in a front panel thereof for discharging a sheet of transfer paper with transferred image information recorded on their lower surfaces. A document discharge slot 32*b* is also defined in the front panel above the sheet discharge slot 32*a* for discharging a document to be transmitted, that has been read. As shown in FIGS. 1 and 2, a sheet tray 38 is detachably connected to a front panel of the lower housing 30 for receiving a sheet which is discharged from the sheet discharge slot 32*a* and a document which is discharged from the document discharge slot 32*b*. In the document inlet slot 34*b*, there is detachably inserted a document tray 40 for holding a document to be transmitted for delivery into the document inlet slot 34*b*. The document tray 40 has a pair of laterally spaced guides 40*a*, 40*b* (see FIG. 2) mounted thereon which are movable transversely toward and away from each other to respective laterally spaced positions depending on the size of the document.

Figure 7:
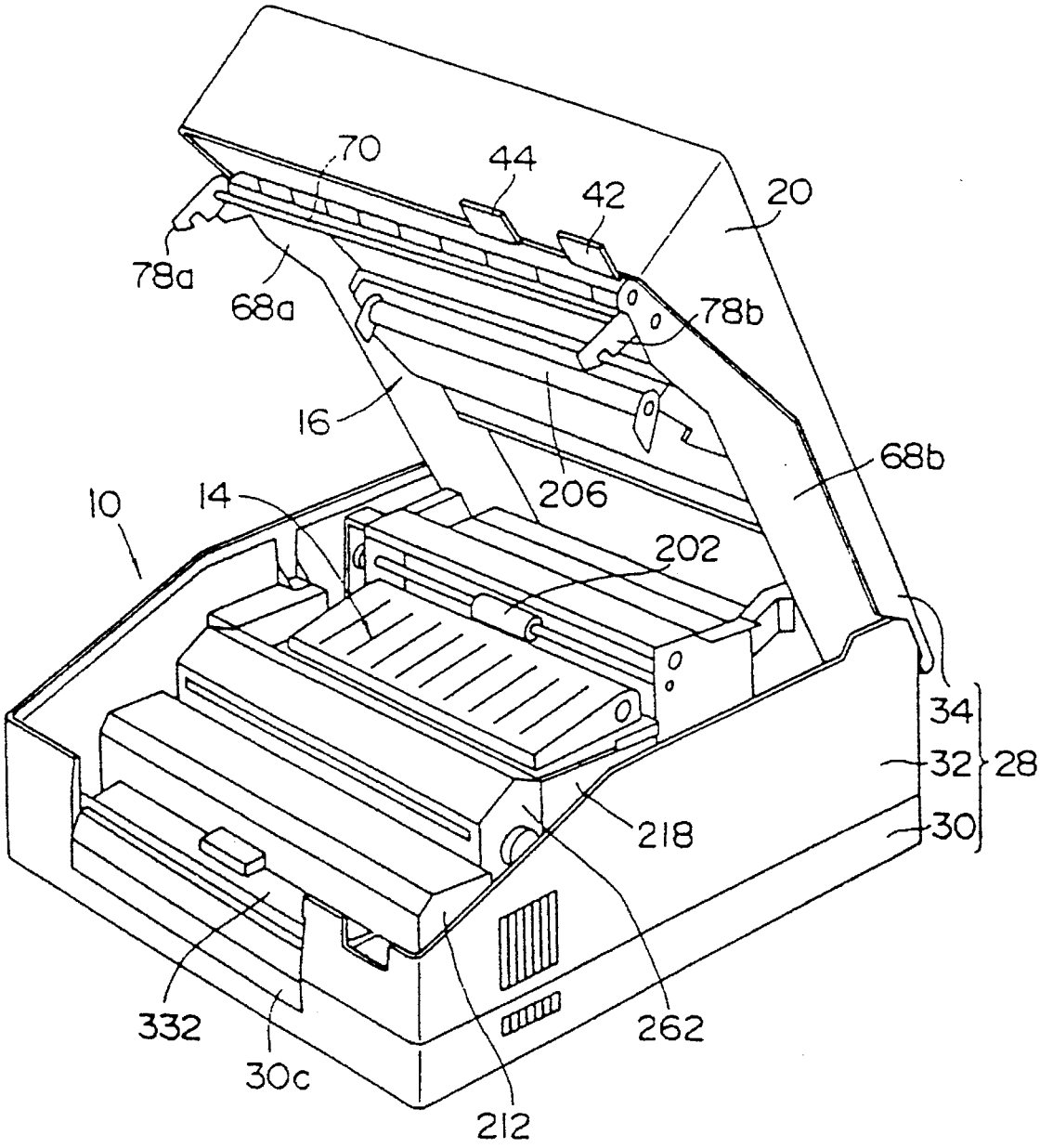
FIG. 7 is a perspective view of the facsimile apparatus as shown in FIG. 2, with a swing frame and an upper housing being open.

The control panel 20 has a variety of control buttons 20*a* pressingly disposed on its upper surface and a display window 20*b* having a liquid crystal display unit for displaying information for the user of the facsimile apparatus 10. The control panel 20 also has an upper housing opening button 42 on a right hand portion of a front wall thereof. The upper housing opening button 42 is angularly movably attached to the swing frame 16. When the upper housing opening button 42 is turned upwardly, it unlocks the swing frame 16 from a closed position over the main plate 12, and the swing frame 16 and the upper housing 34 fixed thereto can then be turned upwardly as shown in FIG. 7. With the swing frame 16 turned upwardly, the upper opening of the printer housing 32, i.e., the upper surface of the image printing mechanism 14, is substantially entirely opened for easy removal of a sheet jammed in its feed path, and servicing of various components of the image printing mechanism 14.

Figure 8:
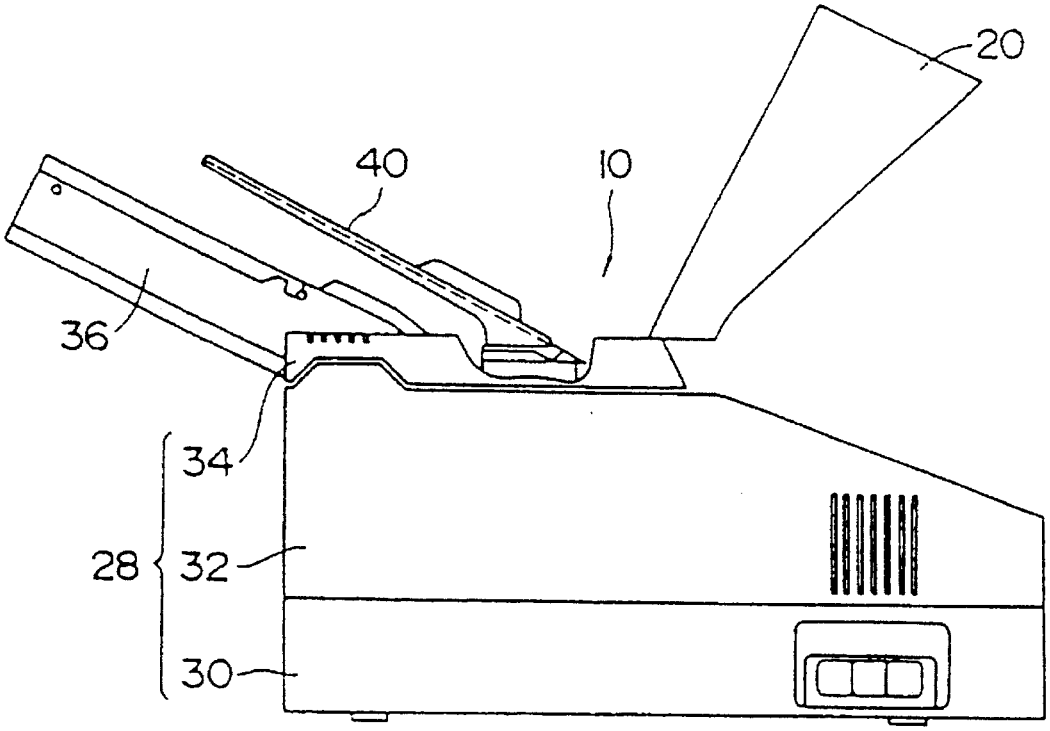
FIG. 8 is a side elevational view of the facsimile apparatus shown in FIG. 7.

The control panel 20 also has a control panel opening button 44 positioned immediately leftward of the upper housing opening button 42. The control panel opening button 44 is angularly movably attached to the control panel 20. When the control panel opening button 44 is turned upwardly, it unlocks the control panel 20 from a closed position over the swing plate 14, and the control panel 20 can then be turned upwardly as shown in FIG. 8. With the control panel 20 turned upwardly, the front opening of the upper housing 34, i.e., the upper surface of the image reading mechanism 18, is substantially entirely opened for easy removal of a sheet jammed in its feed path, and servicing of various components of the image reading mechanism 18.

Figure 9:
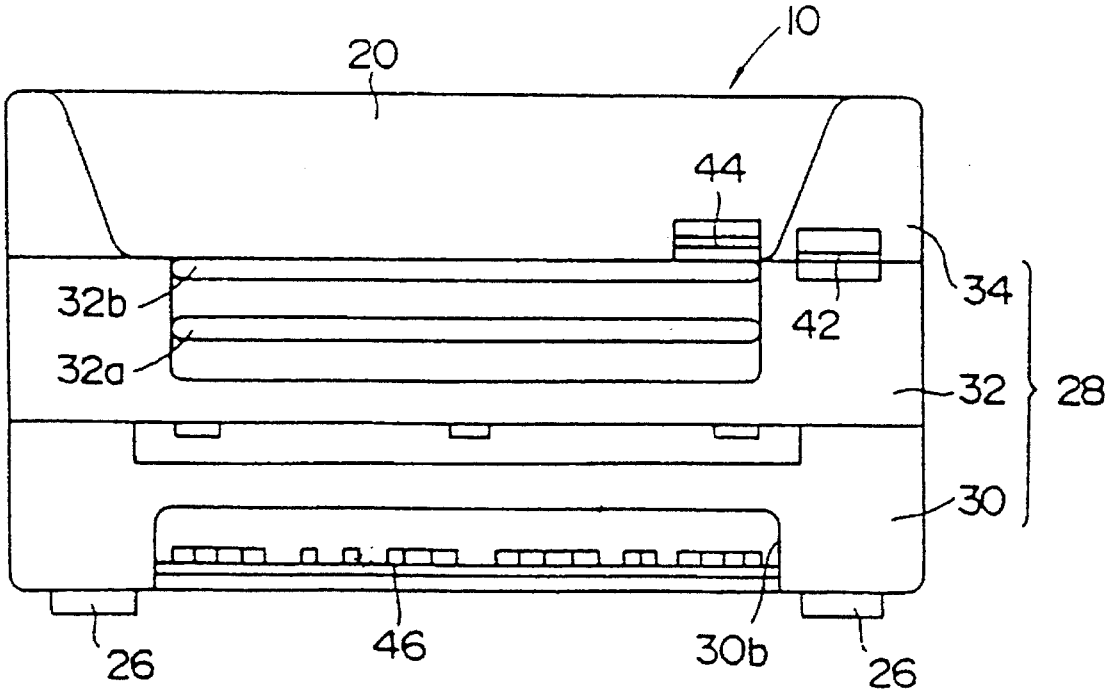
FIG. 9 is a front elevational view of the facsimile apparatus shown in FIG. 1.

As shown in FIG. 9, the lower housing 30 has a front opening 30*b* defined in a front panel thereof in communication with a front interior space in a lower space that is surrounded by the lower housing 30. The front opening 30*b* is openably closed by a front opening cover 30*c* (see FIG. 7). The front interior space houses therein an adjustment board 46 for adjusting DC resistance values, electrostatic capacitance values, etc. to meet standards in any of various countries to which the facsimile apparatus 10 is to be shipped. Such adjustments can be made when the front opening cover 30*c* is opened and removed.

As shown in FIG. 3, the lower housing 30 has a rear opening 30*d* defined in a rear panel thereof, in communication with a rear interior space in the lower space surrounded by the lower housing 30. The rear opening 30*d* is openably closed by a rear opening cover 30*e*. As shown in FIG. 6, the rear interior space, communicating with the rear opening 30*d*, accommodates therein a pair of laterally spaced parallel board guide rails 48, 50 mounted on and extending along respective lower surfaces of the lower frames 22*a*, 22*b*. The board guide rails 48, 50 have respective guide grooves 48*a*, 50*a* defined in respective confronting surfaces thereof.

A main control board 52 for controlling overall operation of the facsimile apparatus 10 has opposite marginal edges slidably riding in and guided by the guide grooves 48*a*, 50*a*, respectively. When the rear opening cover 30*e* is removed, the main control board 52 can easily be removed out of the enclosure 28 through the rear opening 30*d* for replacement.

As shown in FIG. 4, the lower housing 30 has a bottom opening 30*f* defined in a lower panel thereof with, the bottom opening 30*f* being larger than the laser scanning unit 24. The bottom opening 30*f* is openably closed by a bottom cover (not shown). When the bottom cover is removed, the laser scanning unit 24 can easily be placed into or out of the lower space surrounded by the lower housing 30, through the bottom opening 30*f*. Stated otherwise, in the process of assembling the facsimile apparatus 10, the assembly may be turned over, and the laser scanning unit 24 may easily be fastened to the lower surface of the main plate 12, even after the lower housing 30 has been attached in place. Furthermore, in case the laser scanning unit 24 is to be replaced due to a fault, it can easily be replaced simply by removing the bottom cover without detaching the lower housing 30. Accordingly, the laser scanning unit 24 can be installed and replaced highly efficiently.

[DOCUMENT TRAY 40]

The structure of the document tray 40 and the structure of the printer housing 32 for holding the document tray 40 will be described below with reference to FIGS. 10 through 18.

Figure 10:
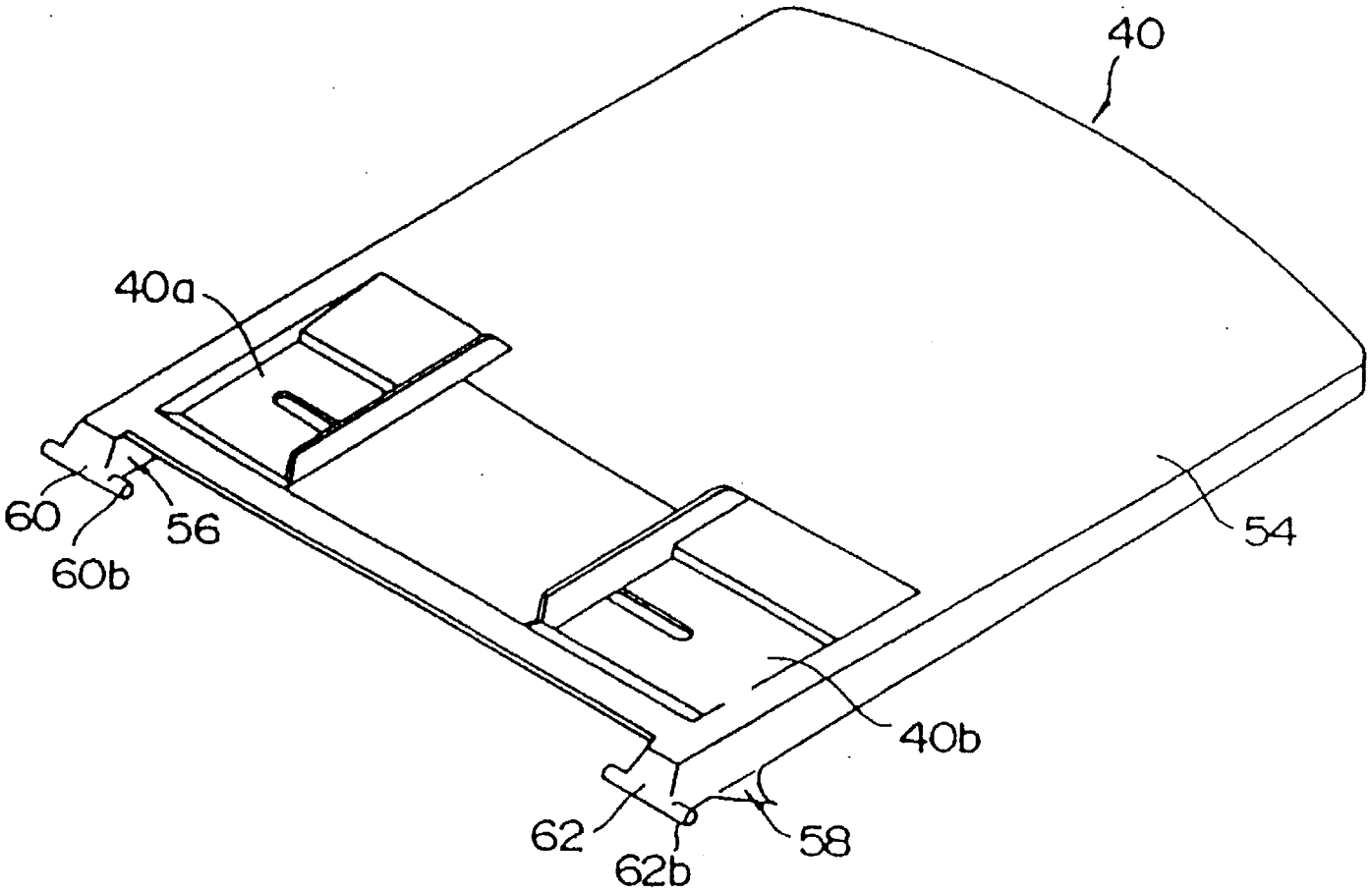
FIG. 10 is a perspective view of a document tray of the facsimile apparatus shown in FIG. 1.
Figure 11:
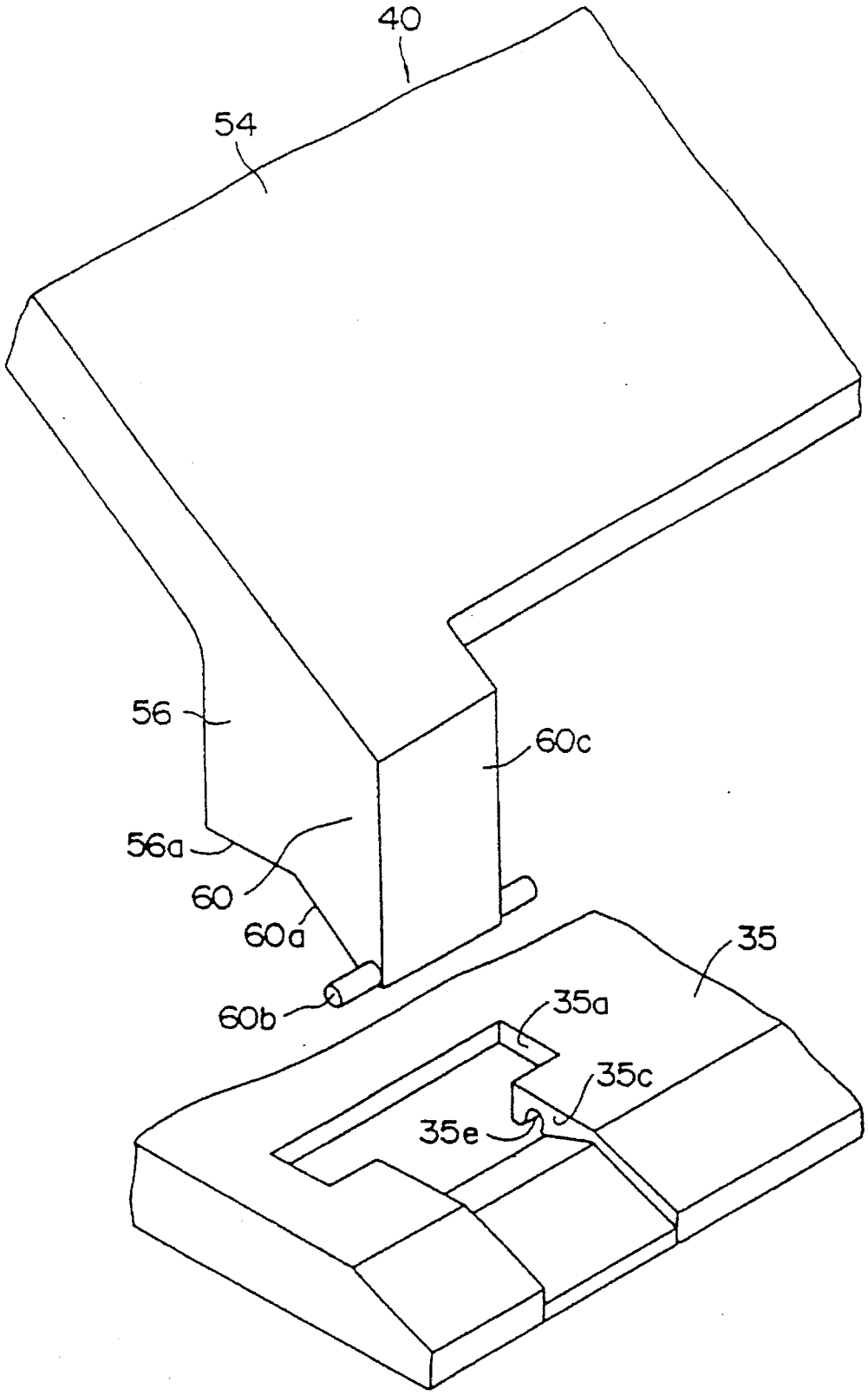
FIG. 11 is an enlarged fragmentary perspective view of the document tray as it is separated from a tray support on the upper housing.
Figure 12:
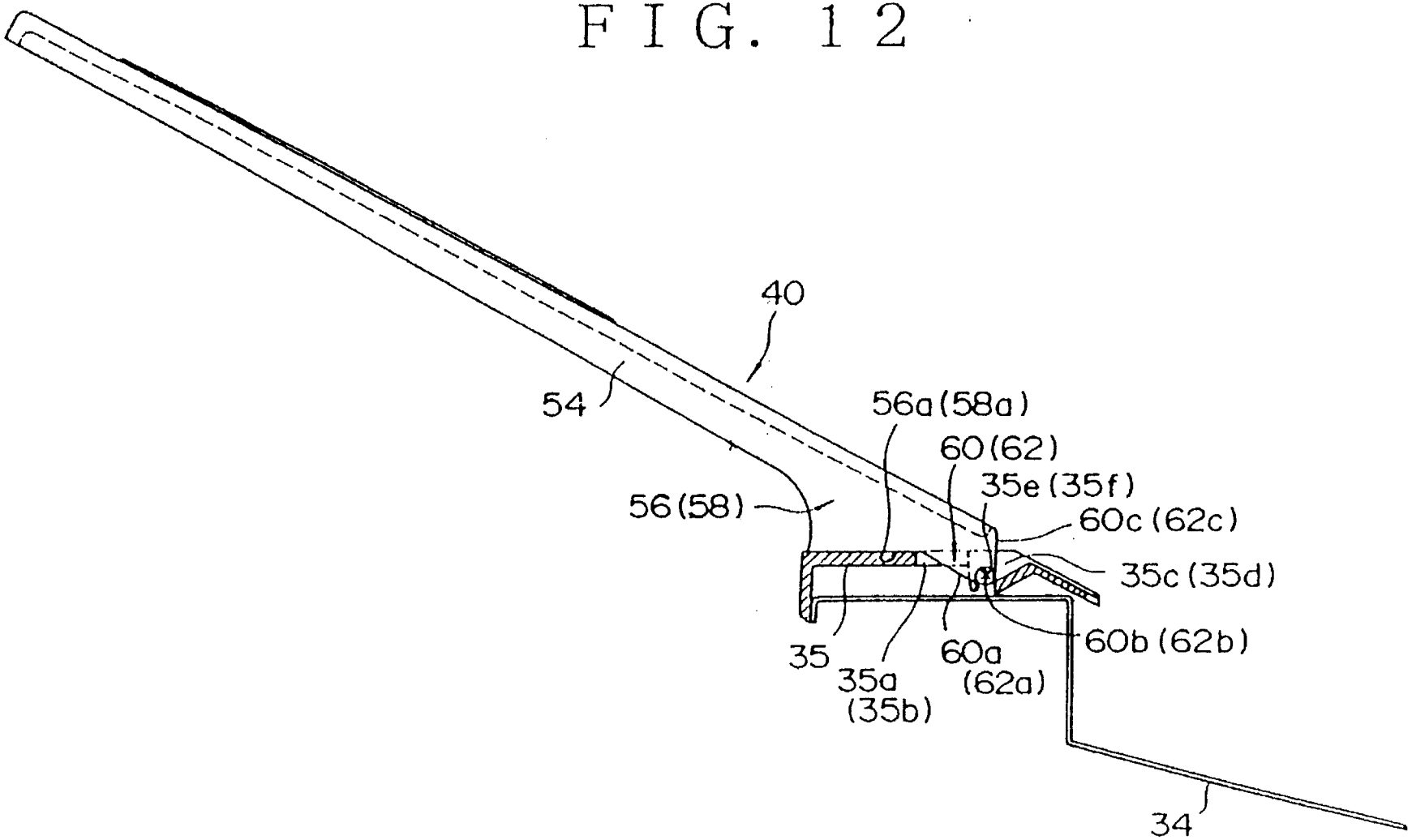
FIG. 12 is a side elevational view, partly in cross section, of the document tray as it is held by the tray support.

As shown at an enlarged scale in FIG. 10, the document tray 40 has a flat document support base 54 for placing a document thereon, with the laterally spaced guides 40*a*, 40*b* mounted thereon for transverse movement toward and away from each other. The document support base 54 has a pair of inclined bosses 56, 58 integrally formed therewith at respective laterally spaced ends of a front portion of the document support base 54 for supporting the document support base 54, obliquely on the upper housing 34. As shown in FIGS. 11 and 12, the inclined bosses 56, 58 have respective rear lower surfaces as support surfaces 56*a*, 58*a* that are inclined at a certain angle to the plane of the document support base 54, i.e., the surface thereof for supporting a document thereon. When the support surfaces 56*a*, 58*a* are held against an upper surface of the upper housing 34, the document support base 54 is supported on the upper housing 34 and inclined at the angle to the upper surface of the upper housing 34.

The inclined bosses 56, 58 also have respective downwardly projecting portions 60, 62 in front of the support surfaces 56*a*, 58*a*. The downwardly projecting portions 60, 62 have respective inclined lower surfaces 60*a*, 62*a* extending substantially parallel to the plane of the document support base 54 and projecting downwardly below the support surfaces 56*a*, 58*a*, respectively. A pair of horizontal pins 60*b*, 62*b* are integrally formed with the lower ends of the downwardly projecting portions 60, 62,respectively. The horizontal pins 60*b*, 62*b* project transversely from opposite sides of the downwardly projecting portions 60, 62, respectively.

As illustrated in FIG. 12, a tray support 35 for supporting the document tray 40 is mounted on the upper surface of the upper housing 34. The tray support 35 has a pair of slots 35*a*, 35*b* defined therein at laterally spaced positions for passing the respective pins 60*b*, 62*b* that are inserted downwardly into the respective slots 35*a*, 35*b*. The tray support 35 also has a pair of holes 35*c*, 35*d* defined therein immediately in front of and in communication with the respective slots 35*a*, 35*b*. The holes 35*c*, 35*d* serve to receive the respective downwardly projecting portions 60, 62. The holes 35*c*, 35*d* are of a size large enough to provide a certain space in front of front surfaces 60*c*, 62*c* of the respective downwardly projecting portions 60, 62, when they are received in the respective holes 35*c*, 35*d*. The tray support 35 also has a pair of downwardly open grooves 35*e*, 35*f* of semicircular cross section which are defined in a lower surface of the tray support 35 across the respective holes 35*c*, 35*d*, i.e., at opposite side edges that define the respective holes 35*c*, 35*d*. The downwardly open grooves 35*e*, 35*f* serve to receive the pins 60*b*, 62*b*, respectively, when the downwardly projecting portions 60, 62 are received in the respective holes 35*c*, 35*d*.

Figure 13:
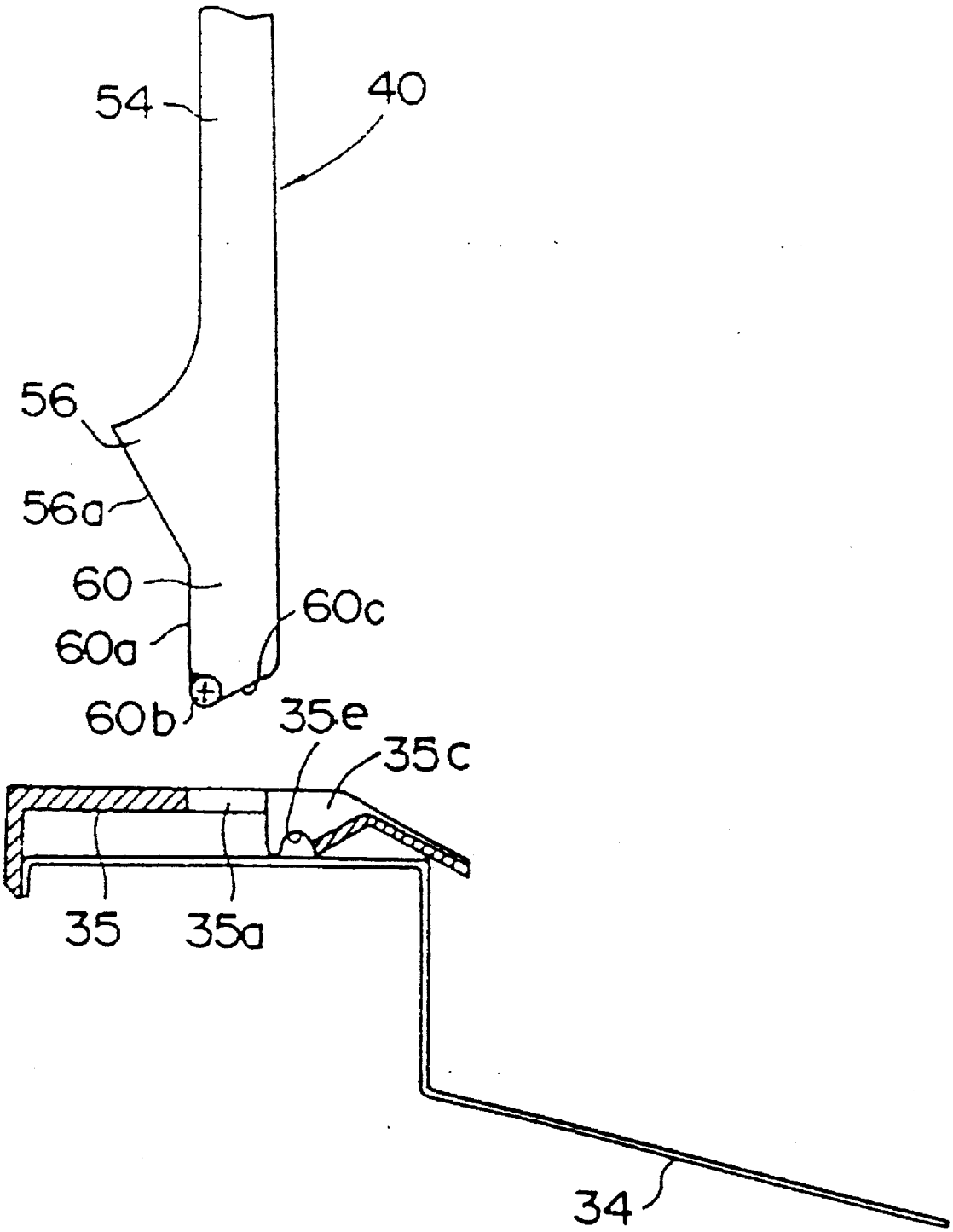
FIG. 13 is a fragmentary side elevational view, partly in cross section, showing the document tray as it is held in an upstanding position prior to being installed on the tray support.
Figure 14:
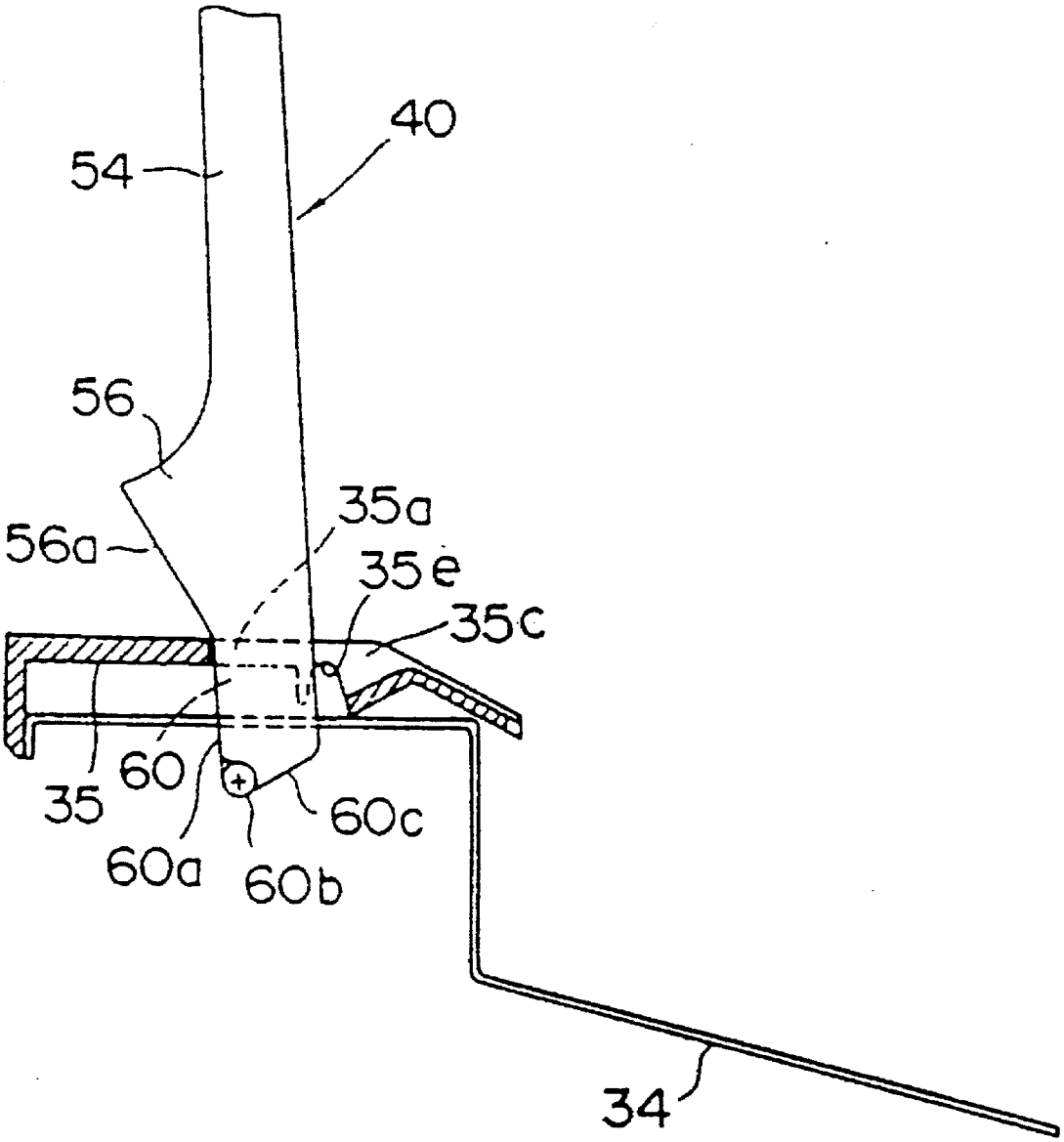
FIG. 14 is a fragmentary side elevational view, partly in cross section, showing the document tray as it is inserted into the tray support.
Figure 15:
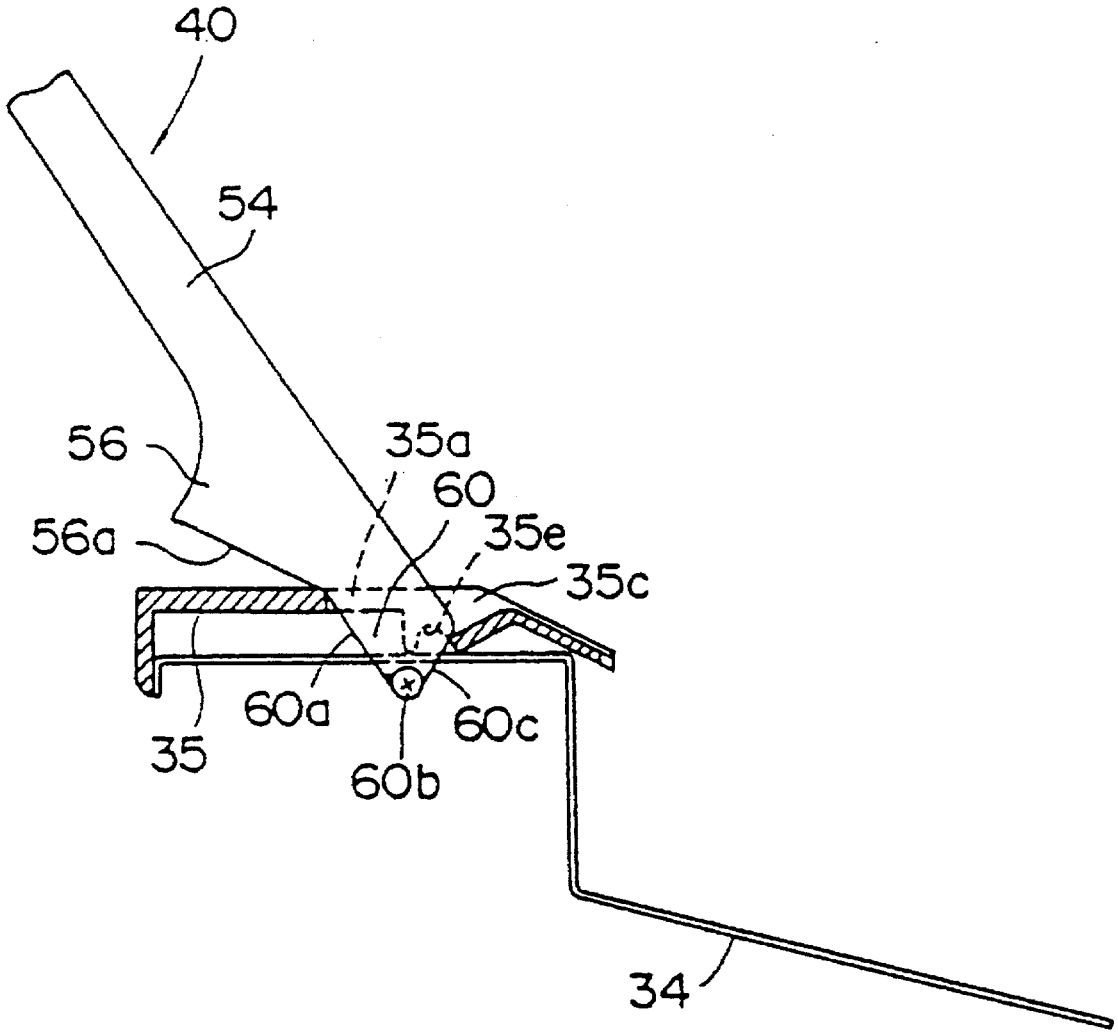
FIG. 15 is a fragmentary side elevational view, partly in cross section, showing the document tray as it starts being turned with respect to the tray support.

The document tray 40 is installed on the tray support 35 as follows: First, as shown in FIG. 13, the document tray 40 is held in a substantially upstanding position. Then, as shown in FIG. 14, the document tray 40 is lowered to insert the pins 60*b*, 62*b* into the respective slots 35*a*, 35*b* until the downwardly projecting portions 60, 62 are received in the slots 35*a*, 35*b*, respectively. At this time, the pins 60*b*, 62*b* are positioned downwardly of a lower surface of the upper housing 34. Thereafter, as shown in FIG. 15, the document tray 40 is turned counterclockwise about a fulcrum positioned at the junction between the support surfaces 56*a*, 58*a* and the lower surfaces 60*a*, 62*a* until the pins 60*b*, 62*b* enter the respective grooves 35*e*, 35*f* (see FIG. 12). The pins 60*b*, 62*b* received in the respective grooves 35*e*, 35*f* are rotatable about their own axes in the grooves 35*e*, 35*f*. At this time, the downwardly projecting portions 60, 62 are positioned in the respective holes 35*c*, 35*d*, and the support surfaces 56*a*, 58*a* are held intimately against the upper surface of the tray support 35. The document tray 40 is now supported on the tray support 35.

The document tray 40 can be detached from the tray support 35 according to a procedure that is a reversal of the above process of installing the document tray 40 on the tray support 35. Consequently, the document tray 40 can quite simply be mounted on and removed from the upper housing 34. When the document tray 40 is mounted on the upper housing 34, the document tray 40 is stably and reliably maintained in its inclined position with respect to the tray support 35, and hence the upper housing 34. More specifically, when the document tray 40 is mounted on the upper housing 34, the support surfaces 56*a*, 58*a* are kept in intimate contact with the upper surface of the tray support 35 to prevent the document tray 40 from being turned back counterclockwise in FIG. 12. Therefore, the document tray 40 is kept in the inclined position with respect to the tray support 35 due to gravity. However,the document tray 40 can freely be turned forward clockwise, in FIG. 12, about the pins 60*b*, 60*b* because the holes 35*c*, 35*d* are sized to provide a space in front of the front surfaces 60*c*, 62*c* of the downwardly projecting portions 60, 62, as described above.

Figure 16:
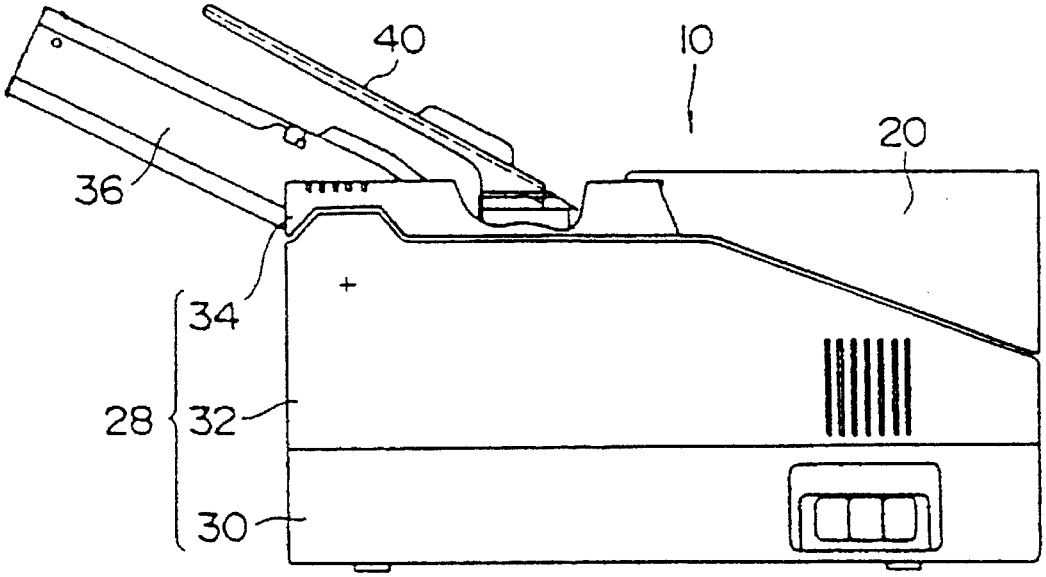
FIG. 16 is a side elevational view of the facsimile apparatus, as shown in FIG. 2, which is fully closed.
Figure 17:
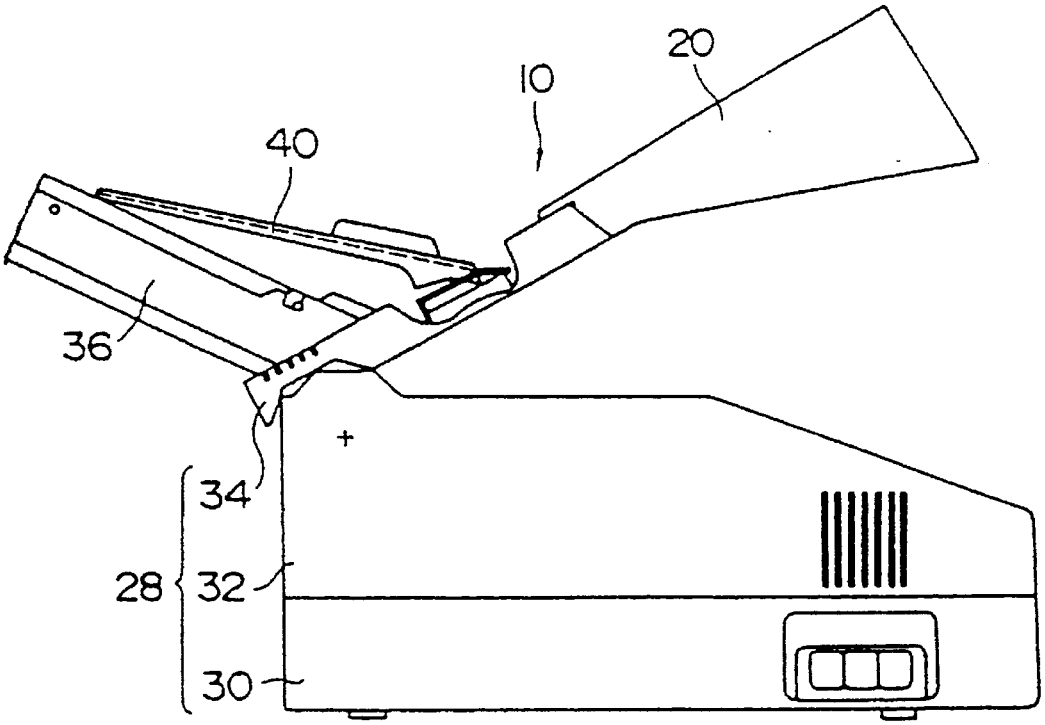
FIG. 17 is a side elevational view of the facsimile apparatus with the upper housing partly opened from the fully closed condition shown in FIG. 16.
Figure 18:
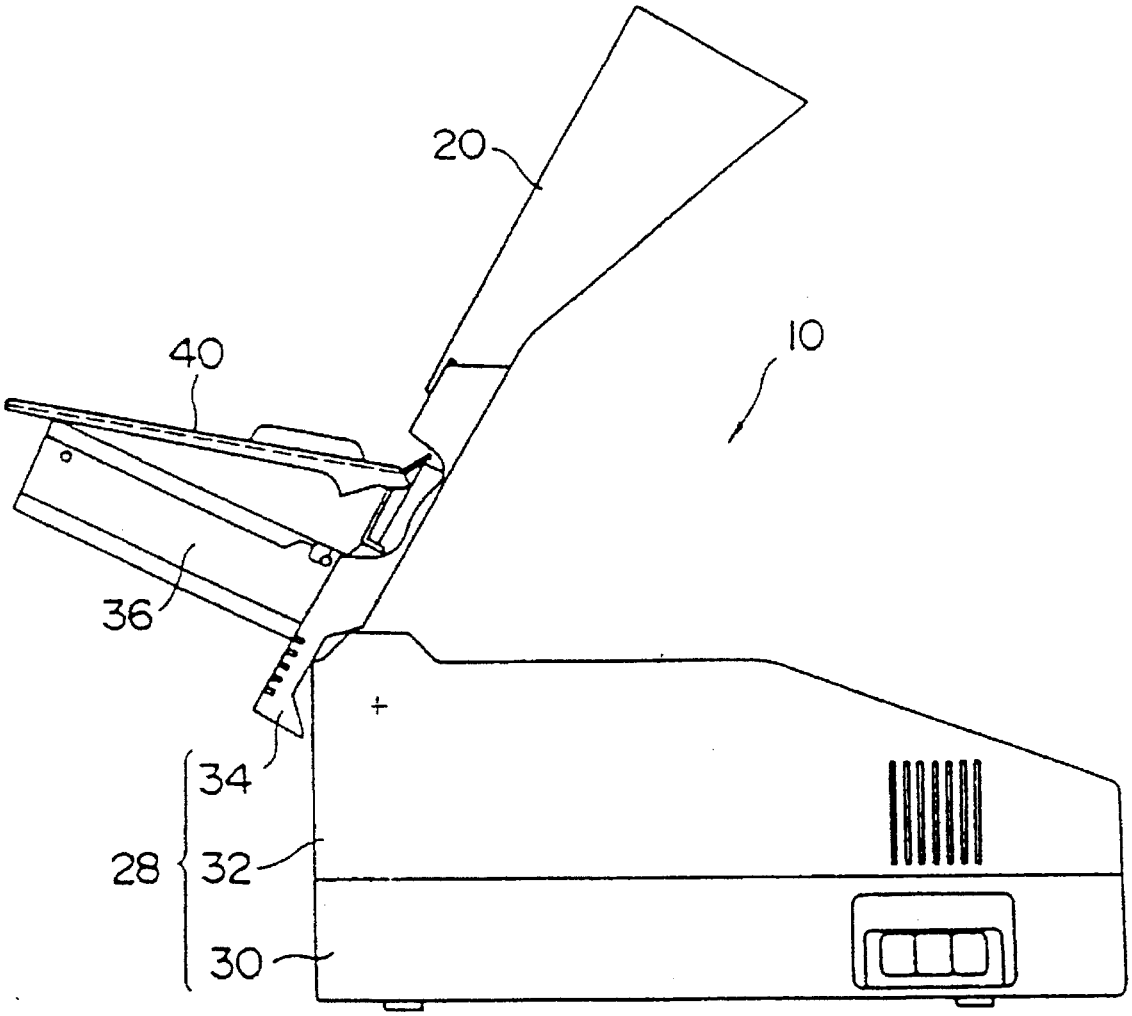
FIG. 18 is a side elevational view of the facsimile apparatus with the upper housing fully opened from the partly opened condition shown in FIG. 17.

As shown in FIG. 16, when the upper housing 34 is lowered to fully close the upper opening of the printer housing 32, the document tray 40, mounted on the upper housing 34, lies substantially parallel to the sheet cassette 36 which is coupled to the image printing mechanism 14 mounted on the main plate 12 for supplying a sheet to the image printing mechanism 14. At the time the upper housing 84 is turned upwardly with the swing frame 16 for servicing the image printing mechanism 14, for example, the document tray 40 is also turned with the upper housing 84, but the sheet cassette 86 remains in its position because it is coupled to the image printing mechanism 14. Therefore, when the upper housing 34 is partly opened, as shown in FIG. 17, the rear end of the document tray 40 abuts against the upper surface of the sheet cassette 36. However, as described above, since the document tray 40 is allowed to turn clockwise from the position shown in FIG. 12 with respect to the upper housing 34, continued upwardly opening movement of the upper housing 34 from the position shown in FIG. 17 causes the rear end of the document tray 40 to slide back on the upper surface of the sheet cassette 36, with the document tray 40 angularly moving clockwise with respect to the upper housing 34. Inasmuch as the document tray 40 angularly moves clockwise in sliding contact with the sheet cassette 36 in response to the upwardly opening movement of the upper housing 34, as described above, the document tray 40 is not damaged by the sheet cassette 36 and the opening movement of the upper housing 34 is not hindered by the sheet cassette 36.

Figure 19:
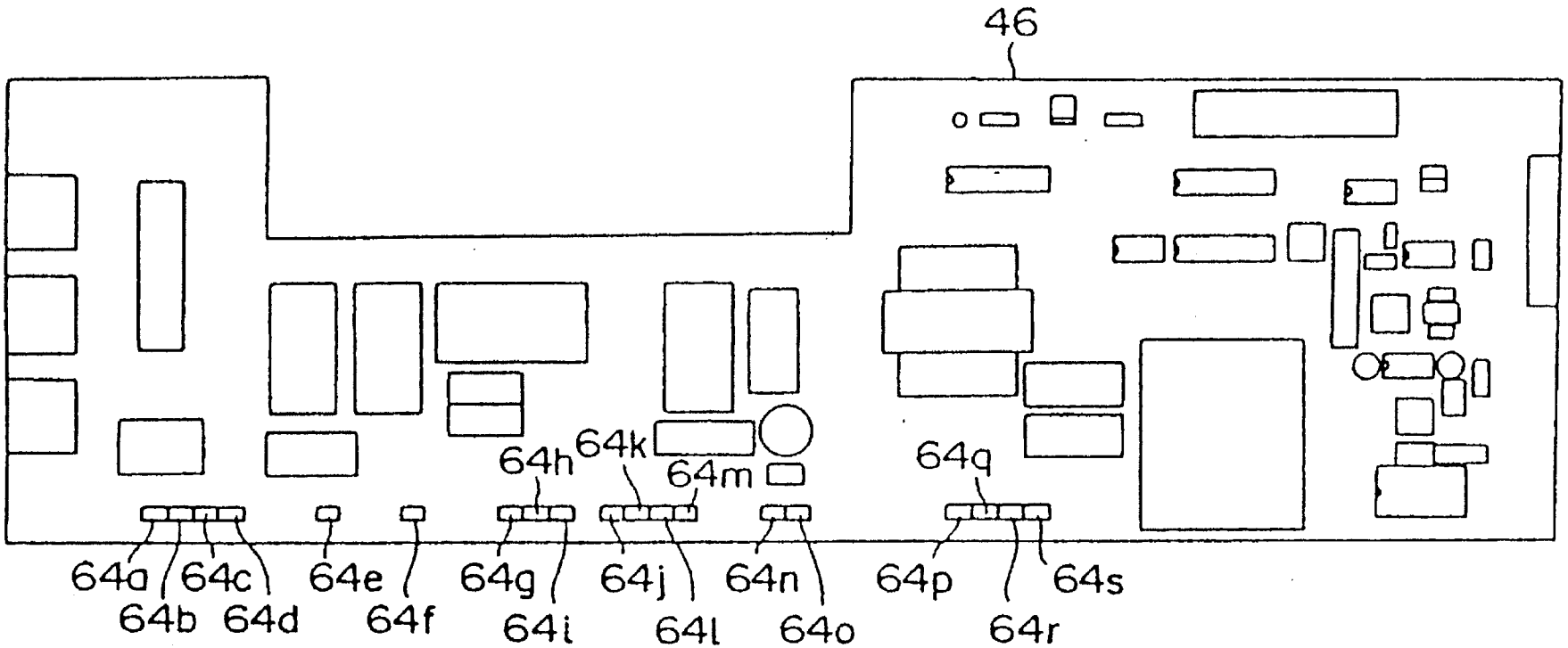
FIG. 19 is a plan view of an adjustment board of the facsimile apparatus shown in FIG. 1.
Figure 20:
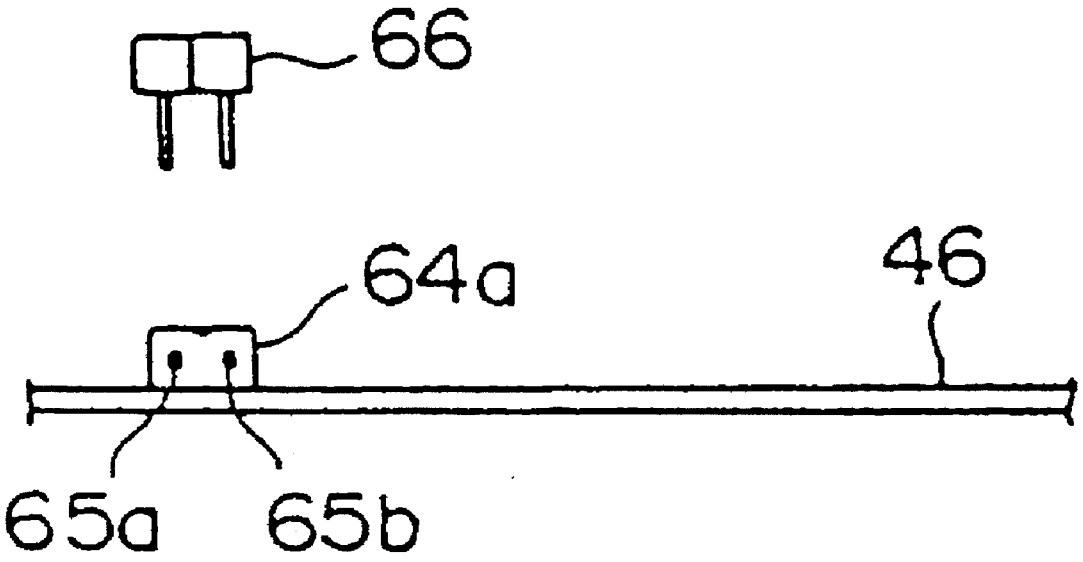
FIG. 20 is a front elevational view of a jumper terminal on the adjustment board and a connector that is about to be connected to the jumper terminal.

As described above, the adjustment board 46 is housed in the front interior space in the lower space surrounded by the lower housing 30. As shown in FIG. 19, the adjustment board 46 has a number of jumper terminals 64*a* through 64*s* mounted on a front edge thereof which is positioned in the front opening 30*b* in the lower housing 30. As shown in FIG. 20, each of the jumper terminals 64*a* through 64*s* comprises a pair of spaced connection terminals 65*a*, 65*b*, which may be electrically connected or short-circuited by a connector 66. When the connection terminals 65*a*, 65*b* of a jumper terminal are electrically connected or short-circuited by the connector 66, the electric state of the connection terminals 65*a*, 65*b* is set to "0" by a circuit corresponding to the jumper terminal. When the connection terminals 65*a*, 65*b* of a jumper terminal are not electrically connected or short-circuited by the connector 66, the electric state of the connection terminals 65*a*,65*b* is set to "1" by a circuit corresponding to the jumper terminal.

It is also possible to adjust the facsimile apparatus 10 to desired DC resistance values, electrostatic capacitance values, etc. according to the standards in a country to which the facsimile apparatus 10 is to be shipped, by short-circuiting selected ones of the jumper terminals 64*a* through 64*s* with corresponding connectors 64. More specifically, in order adjust the facsimile apparatus 10 to values according to desired electric standards, the front cover 30*c* is removed to open the front opening 30*b* to gain access to the front edge of the adjustment board 46, and then connectors 66 are connected to desired ones of the jumper terminals 64*a* through 64*s* in conformity with specifications in a country to which the facsimile apparatus 10 is to be shipped.

As a result, the manufacturer of the facsimile apparatus 10 is not required to have different production lines designed to meet electric standards in various countries, but only required to have common production lines for higher production efficiency. Therefore, it is not necessary for the manufacturer of the facsimile apparatus 10 to manufacture various components to different specifications according to various standards indifferent countries and also to keep an inventory of various many electric parts of different specifications which would otherwise be needed to be assembled in facsimile apparatus to be shipped to various countries. Consequently, the facsimile apparatus 10 can be manufactured with high productivity.

Connectors 66 can be connected to selected ones of the jumper terminals 64*a* through 64*s* by detaching the front cover 30*c* without removing either the lower housing 30 from the facsimile apparatus 10, or the adjustment board 46 from the enclosure 28. Accordingly, adjustments can easily be made simply by removing the front cover 30*c* and connecting connectors 66 to selected ones of the jumper terminals 64*a* through 64*s*. The adjustment procedure is thus highly simple and efficient to perform.

[SWING FRAME 16]

The structure of the swing frame 16 will be described in detail below with reference to FIG. 21.

Figure 21:
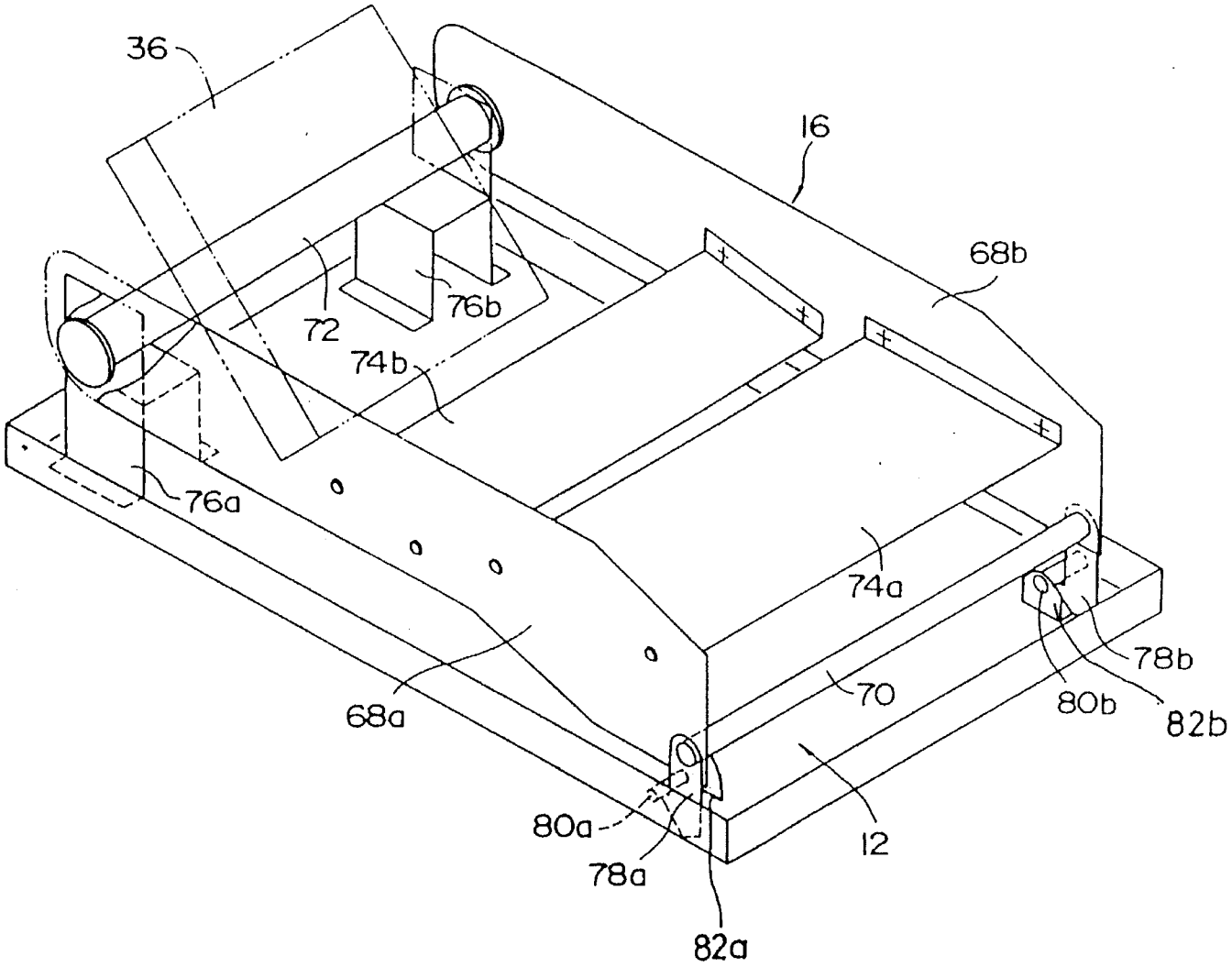
FIG. 21 is a perspective view of the swing frame of the facsimile apparatus shown in FIG. 1.

As shown in FIG. 21, the swing frame 16 includes a pair of laterally spaced parallel vertical side plates 68*a*, 68*b*, a solid front joint shaft 70 extending transversely and interconnecting front ends of the respective side plates 68*a*, 68*b* and, a solid rear joint shaft 72 extending transversely parallel to the front joint shaft 70 and interconnecting rear ends of the respective side plates 68*a*, 68*b* with, the rear joint shaft 72 serving as a pivot shaft for the swing frame 16. The swing frame 16 further includes a pair of front and rear flat mount bases 74*a*, 74*b* extending transversely and interconnecting front portions of the respective side plates 68*a*, 68*b*. The pivot shaft 72 is angularly movably supported on a pair of laterally spaced support brackets 76*a*, 76*b* mounted vertically on lateral edges of a rear portion of the upper surface of the main plate 12. The support brackets 76*a*, 76*b* are positioned adjacent to the side plates 68*a*, 68*b*, respectively.

Locking hooks 78*a*, 78*b* are connected to respective opposite ends of the front joint shaft 70 for angular movement in unison about the longitudinal axis of the front joint shaft 70. The locking hooks 78*a*, 78*b* have respective lower end surfaces inclined in a direction away from the upper surface of the main plate 12 in the rearward direction and having respective rear ends projecting rearwardly for engagement with respective pins 80*a*, 80*b* mounted on the main plate 12. The locking hooks 78*a*, 78*b* are normally resiliently urged to turn clockwise (FIG. 21) by torsion coil springs (not shown), and are held in respective stop positions in abutment against respective stoppers (not shown) under the bias of the torsion coil springs.

When the swing frame 16 is turned downwardly from the open position, the inclined lower end surfaces of the locking hooks 78*a*, 78*b*, that are biased to the respective stop positions, engage and slide against the respective pins 80*a*, 80*b*, forcing the locking hooks 78*a*, 78*b* to turn counterclockwise about the axis of the front joint shaft 70 against the bias of the torsion coil springs. Upon continued downward movement of the swing frame 16, the locking hooks 78*a*, 78*b* are further turned counterclockwise until the rear ends of the inclined lower end surfaces thereof disengage from the respective pins 80*a*, 80*b*. The locking hooks 78*a*, 78*b* are now snapped back clockwise under the bias of the torsion coil springs, placing the rear ends of the inclined lower end surfaces thereof below the respective pins 80*a*, 80*b*, whereupon the swing frame 16 is locked in the closed position over the main plate 12.

The locking hooks 78*a*, 78*b* are connected to the upper housing opening button 42 (see FIG. 2). When the upper housing opening button 42 is depressed, therefore, the locking hooks 78*a*, 78*b* are turned counterclockwise (FIG. 21) against the bias of the torsion coil springs, and released from locking engagement with the respective pins 80*a*, 80*b*. The pins 80*a*, 80*b* are fixed to respective laterally spaced brackets 82*a*, 82*b* that are securely mounted on respective lateral ends of a front portion of the upper surface of the main plate 12. The pins 80*a*, 80*b* are aligned with each other in the transverse direction of the main plate 12, and extend substantially parallel to the upper surface of the main plate 12.

The swing frame 16, thus arranged, is of a substantially rectangular shape as viewed in plan, and has a relatively rigid structure. The swing frame 16 is swingable with respect to the main frame 12 about the rear joint shaft 72 that extends transversely between, and is joined to the side plates 68*a*, 68*b*. The image reading mechanism 16 for reading an image from a document to be transmitted is mounted on the front and rear mount bases 74*a*, 74*b*. Even when the swing frame 16 is repeatedly turned about the axis of the pivot shaft 72, the swing frame 16 is prevented from being twisted and can always be held in a stable attitude in its closed position over the main frame 12. As described later on, the front and rear mount bases 74*a*, 74*b* have respective lower surfaces serving as an upper surface of a sheet feed path in the image printing mechanism 16. As the swing frame 16 is prevented from being twisted or distorted, the sheet feed path in the image printing mechanism 16 is defined with high accuracy.

When the swing frame 16 is opened, i.e., turned upwardly, the upper housing 34 fixed thereto is also opened. Since no positive drive forces other than those from the swing frame 16 are applied to the upper housing 34 when it is opened, the upper housing 34 is not subject to substantial forces tending to strain itself. Thus, the upper housing 34 may be of reduced wall thickness,allowing the facsimile apparatus 10 to be reduced in weight.

As shown in FIG. 21, the sheet cassette 36 has its front end inserted into a space that is defined between the side plates 68*a*, 68*b* behind the mount bases 74*a*, 74*b* and in front of the rear joint shaft 72.

[SWINGABLE SUPPORT STRUCTURE FOR SWING FRAME 16]

A structure by which the swing frame 16 is swingably supported will be described in detail below with reference to FIGS. 22 through 25.

Figure 22:
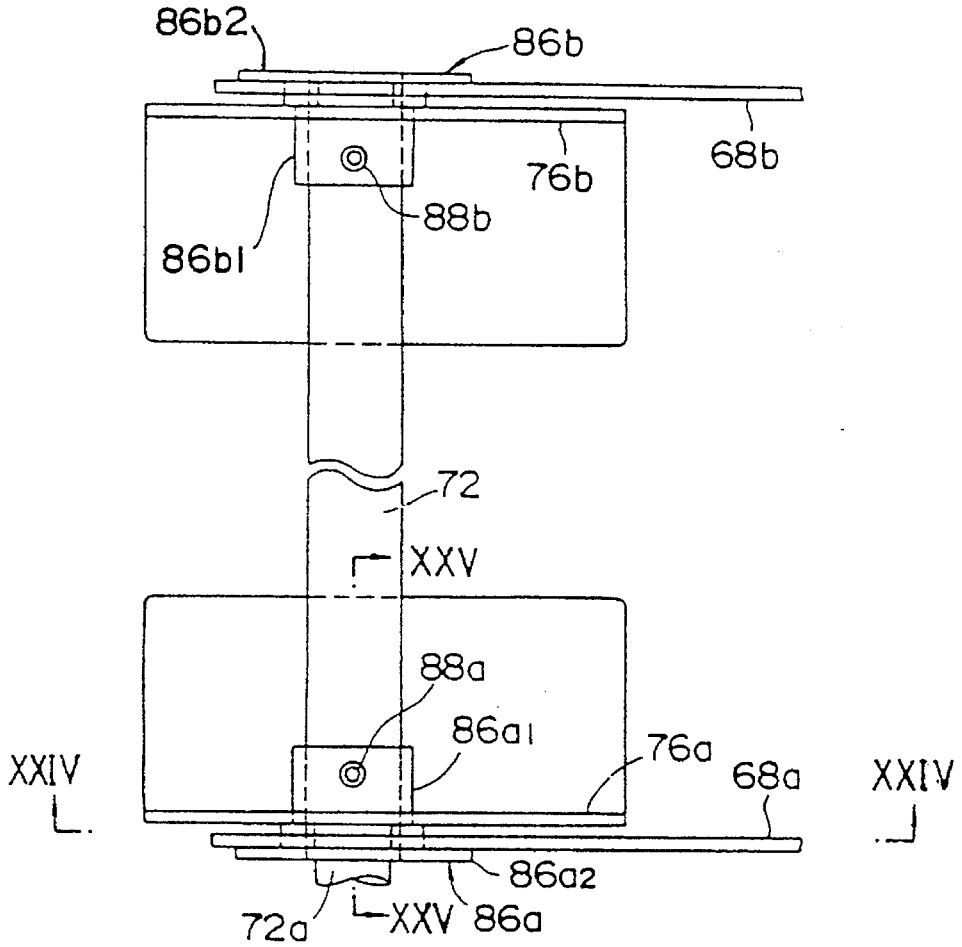
FIG. 22 is a fragmentary plan view of a structure by which the swing frame is swingably supported on a main frame.

The rear joint shaft or pivot shaft 72 has its opposite ends angularly movably supported by the respective support brackets 76*a*, 76*b* as follows: As shown in FIG. 22, one end (shown as the upper end) of the pivot shaft 72 extends through the support bracket 76*b* and terminates at the corresponding side plate 68*b*. The other end (shown as the lower end) of the pivot shaft 72 extends through the support bracket 76*a*, and also projects outwardly through the corresponding side plate 68*a*. The projecting end, denoted at 72*a*, of the pivot shaft 72 terminates at a position spaced a certain distance from an outer surface of the side plate 68*a*. As described later on, a damper 84 (see FIG. 26) is operatively coupled between the projecting end 72*a* of the pivot shaft 72 and the main plate 12 for holding the upper housing 34 in any desired angular open position with respect to the main plate 12.

Figure 23:
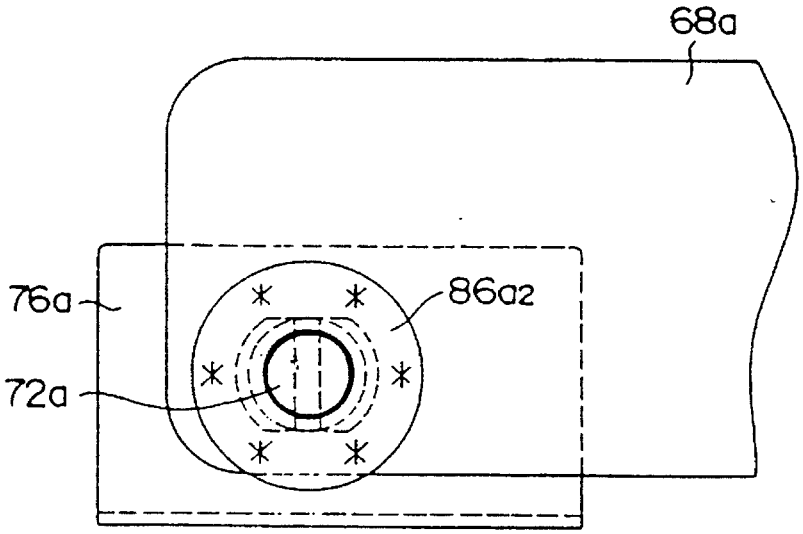
FIG. 23 is a fragmentary side elevational view of the structure shown in FIG. 22.
Figure 25:
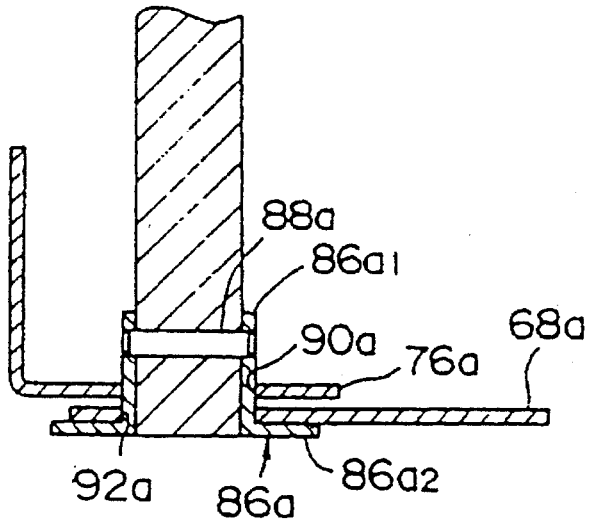
FIG. 25 is a cross-sectional view taken along line XXV—XXV of FIG. 22.

As shown in FIGS. 22 and 23, coupling bushings 86*a*, 86*b* are fitted respectively over opposite end portions of the joint shaft 72, the coupling bushings 86a being positioned inwardly of the projecting end 72*a*. The coupling bushings 86*a*, 86*b* includes respective hollow cylindrical sleeves 86*a*1, 86*b*1 fitted directly over the pivot shaft 72, and respective outer flanges 86*a*2, 86*b*2 integrally formed with respective outer ends of the sleeves 86*a*1, 86*b*1. The sleeves 86*a*1, 86*b*1 and the pivot shaft 72 are coupled to each other for co-rotation by respective spring pins 88*a*, 88*b* (see FIGS. 22 and 25) extending diametrically through the sleeves 86*a*1, 86*b*1 and the pivot shaft 72. As shown in FIG. 25, the sleeves 86*a*1, 86*b*1 have respective outer circumferential surfaces slidably held against and supported by respective inner circumferential surfaces of support holes 90*a*, 90*b* defined in vertical portions of the respective support brackets 76*a*, 76*b*.

Figure 24:
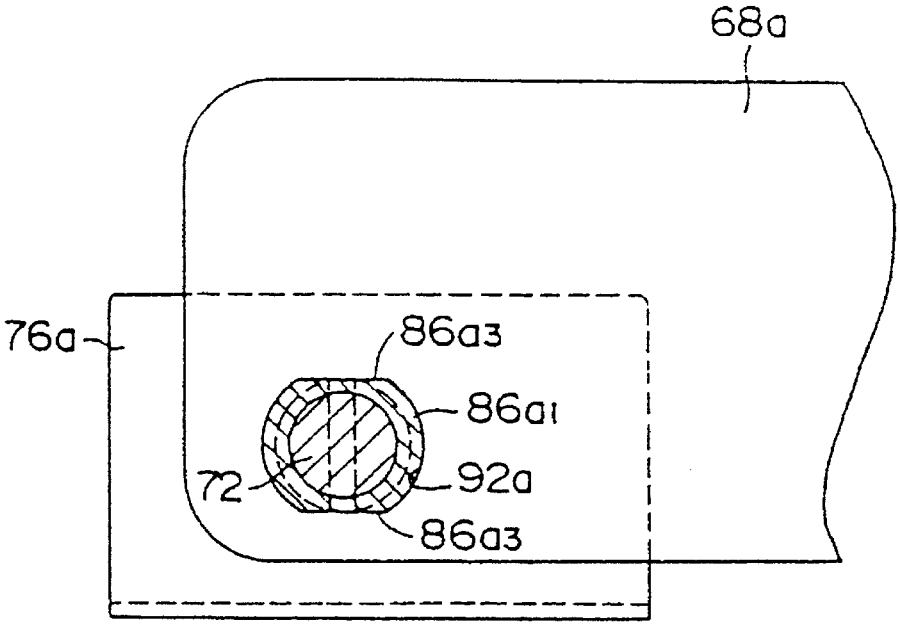
FIG. 24 is a cross-sectional view taken along line XXIV—XXIV of FIG. 22.

As shown in FIG. 24, the sleeves 86*a*1, 86*b*1 have respective pairs of diametrically opposite parallel flat surfaces 86*a*3, 86*b*3 positioned immediately outwardly of the respective support holes 90*a*, 90*b*. The side plates 68*a*, 68*b* have respective through attachment holes 92*a*, 92*b* defined therein which have respective pairs of diametrically opposite parallel flat surfaces. The portions of the sleeves 86*a*1, 86*b*1 which have the diametrically opposite parallel flat surfaces 86*a*3, 86*b*3 are complementarily fitted in the respective attachment holes 92*a*, 92*b*, so that the coupling bushings 86*a*, 86*b* are rotatably In unison with the side plates 68*a*, 68*b*.

To ensure co-rotation of the coupling bushings 86*a*, 86*b* and the side plates 68*a*, 68*b*, the outer flanges 86*a*2, 86*b*2 are spot-welded to the respective side plates 68*a*, 68*b*. Therefore, the side plates 68*a*, 68*b* are securely fixed to the respective ends of the pivot shaft 72 through the coupling bushings 86*a*, 86*b* for angular movement in unison with rotation of the pivot shaft 72 about its own axis. Since the side plates 68*a*, 68*b* are firmly fastened to the respective ends of the pivot-shaft 72, the swing frame 16 with the side plates 68*a*, 68*b* is swingable about the axis of the pivot shaft 72 while maintaining a stable attitude without mechanical distortion.

As the swing frame 16 is effectively prevented from being strained, the structure by which the swing frame 16 is swingably supported on the main plate 12 is also effectively prevented from being twisted. As a result, the swing frame 16 can be angularly moved to open and close the upper housing 34 with very small manual forces. Consequently, the upper housing 34 can easily be manipulated by the user of the facsimile apparatus 10.

[ATTACHMENT STRUCTURE FOR DAMPER 84]

Figure 26:
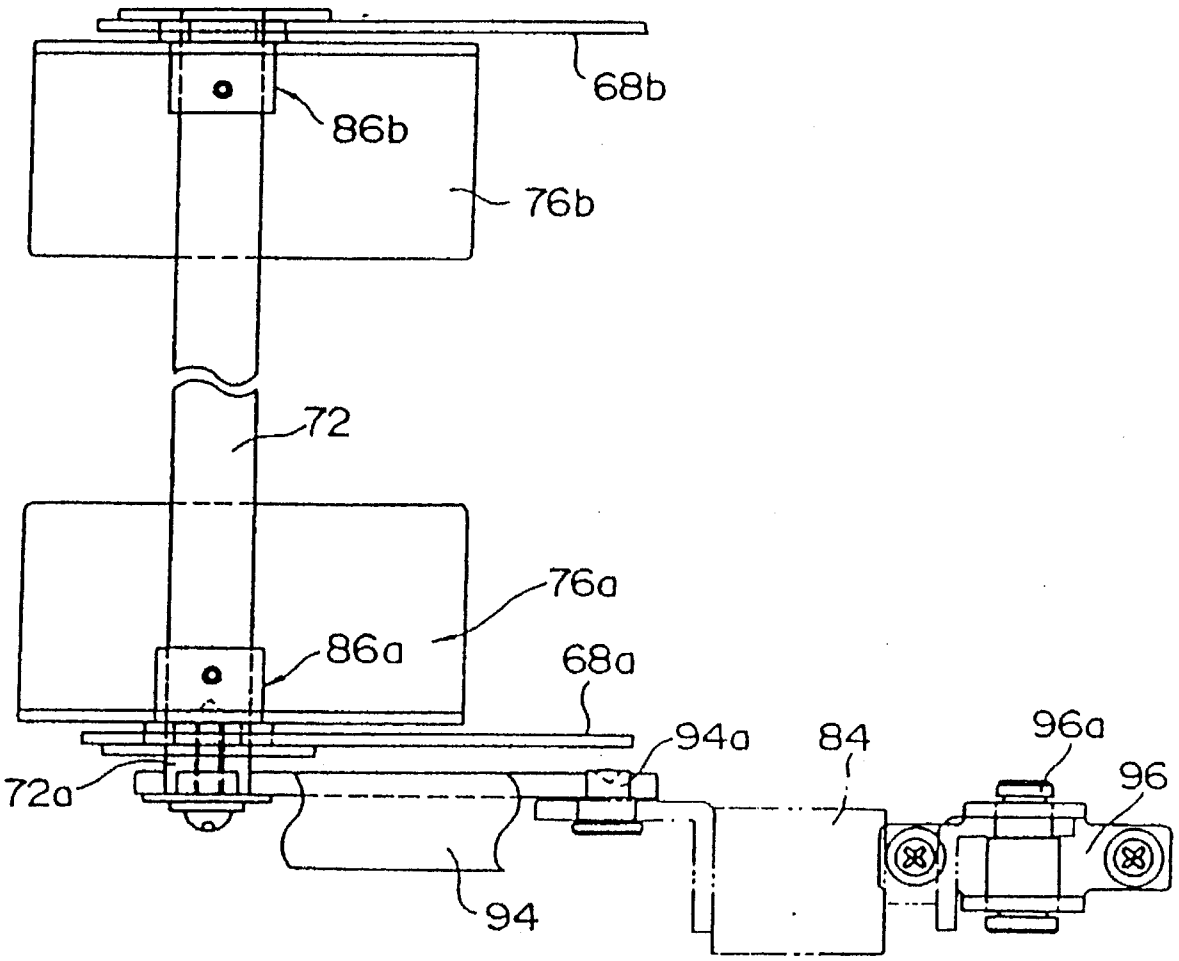
FIG. 26 is a fragmentary plan view of a damper as it is attached to the swing frame as shown in FIG. 21.
Figure 27:
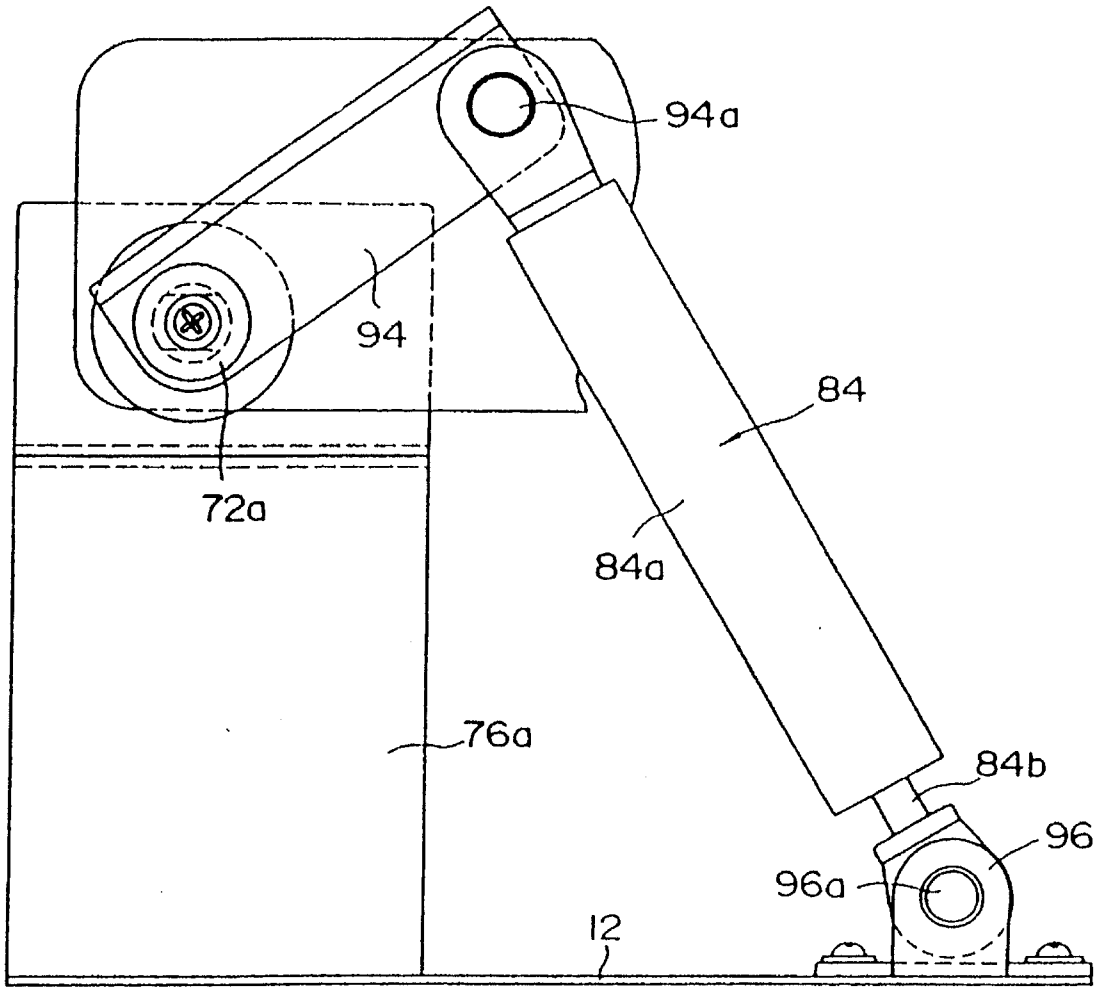
FIG. 27 is a side elevational view of the damper as it is attached to the swing frame as shown in FIG. 21.

An attachment structure for the damper 84 which is capable of holding the swing frame 16 in any desired angular position with respect to the main plate 12 will be described below with reference to FIGS. 26 and 27.

The damper 84 is operatively coupled between the projecting end 72*a* of the pivot shaft 72, which projects through the support bracket 76*a* and the side plate 68*a*, and the main plate 12. An attachment stem 94 that extends radially with respect to the pivot shaft 72 is fixed to the projecting end 72*a* of the pivot shaft 72 for rotation in unison therewith. To the distal end of the attachment stem 94, there is secured a support pin 94*a* having an axis extending parallel to the axis of the pivot shaft 72. The damper 84 has an end angularly movably connected to the support pin 94*a*. The other end of the damper 84 is angularly movably connected to a support pin 96*a* that is fixed to an attachment bracket 94 fixedly mounted on the upper surface of the main plate 12 with, the support pin 96*a* having an axis extending parallel to the axis of the support pin 94*a*.

The damper 84 includes a gas-filled cylinder unit having a cylinder 84*a* joined to its one end, coupled to the support pin 94*a* and a piston rod 84*b* joined to its other end, coupled to the support pin 96*a* with, the piston rod 84*b* being retractably and extensibly inserted in the cylinder 84*a*. More specifically, the cylinder 84*a* has one end angularly movably supported by the support pin 94*a*, and the piston rod 84*b* has one end angularly movably supported by the support pin 96*a*. The gas filled in the cylinder 84*a* is capable of damping forces tending to extend the piston rod 84*b* from and retract the piston rod 84*b* into the cylinder 84*a* for thereby keeping the piston rod 84*b* resiliently in its projected or retracted position with respect to, the cylinder 84*a*.

When forces tending to turn the swing frame 16 are dampened, forces tending to turn the pivot shaft 72 of the swing frame 12 are actually dampened. Therefore, reactive forces generated when the forces tending to turn the swing frame 16 are dampened do not act on the swing frame 16 as a whole, but act directly and partially on the pivot shaft 72. Stated otherwise, if one end of the damper 84 were coupled to the upper housing 34 attached to the swing frame 16, then reactive forces generated when the forces tending to turn the swing frame 16 are dampened are applied to the upper housing 34, which may possibly be torsionally deformed. To prevent the upper housing 34 from being torsionally deformed, it would be necessary to increase the thickness of the upper housing 34 for greater rigidity thereof. As a result, the facsimile apparatus would have an increased weight and cost.

According to the illustrated embodiment, however, the reactive forces generated when the forces tending to turn the swing frame 16 are dampened act on the pivot shaft 72, i.e., are borne by the pivot shaft 72. Inasmuch as the pivot shaft 72 which is solid has a very high torsional strength, the reactive forces generated on the damper 84 are reliably borne by the pivot shaft 72, which is protected against torsional deformation. Even with the damper 84 connected to hold the swing frame 16 resiliently in a desired angular position, the swing frame 16 is reliably prevented from being torsionally deformed or twisted, and can well be stopped in any desired angular position with respect to the main plate 12.

[STRUCTURE FOR OPENING AND CLOSING CONTROL PANEL 20]

A structure for opening and closing the control panel 20 with respect to the swing frame 16 will be described below with reference to FIGS. 28 and 29.

Figure 28:
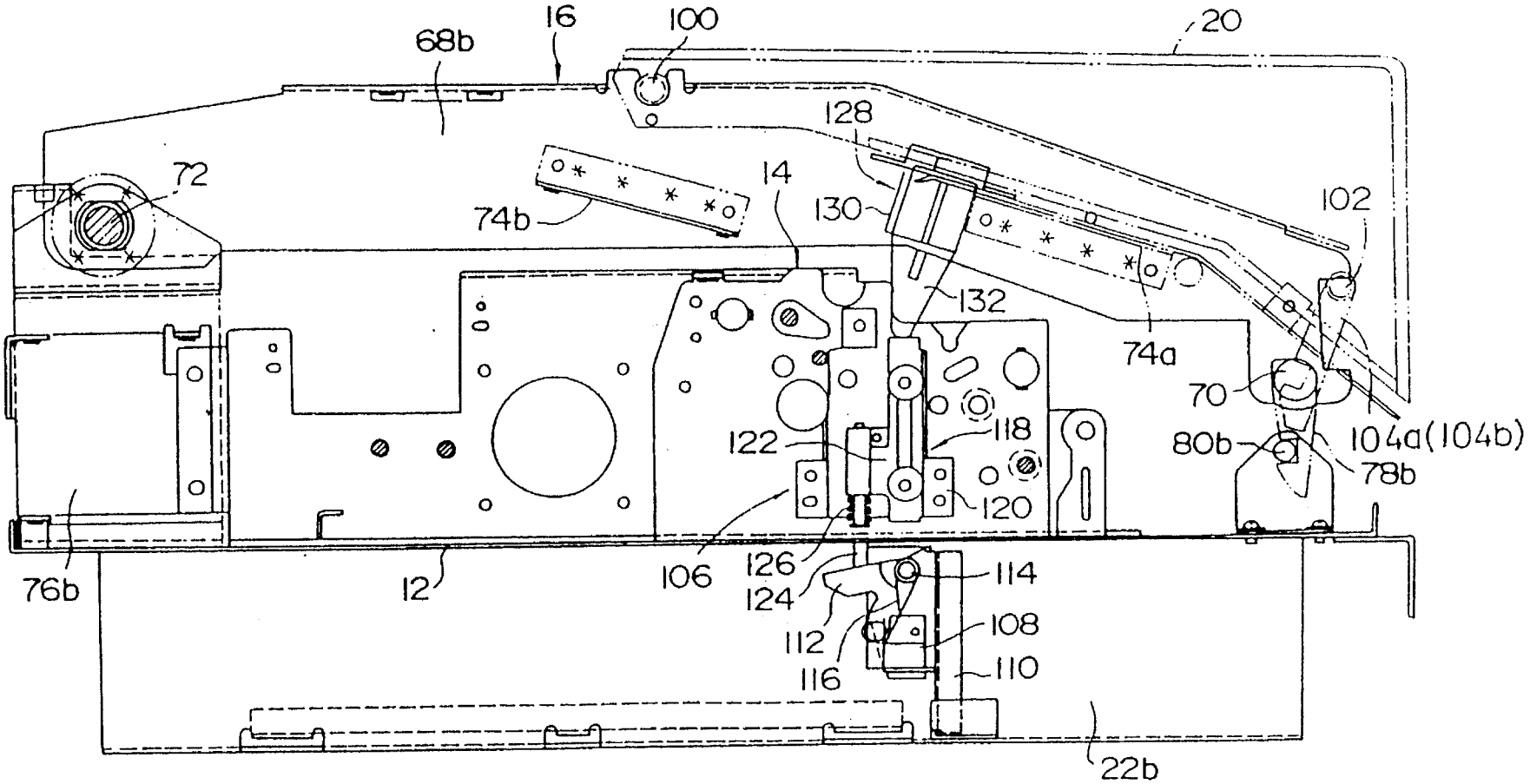
FIG. 28 is a side elevational view of an interlock mechanism and associated parts of the facsimile apparatus, as shown in FIG. 1, with the swing frame and a control panel closed.
Figure 29:
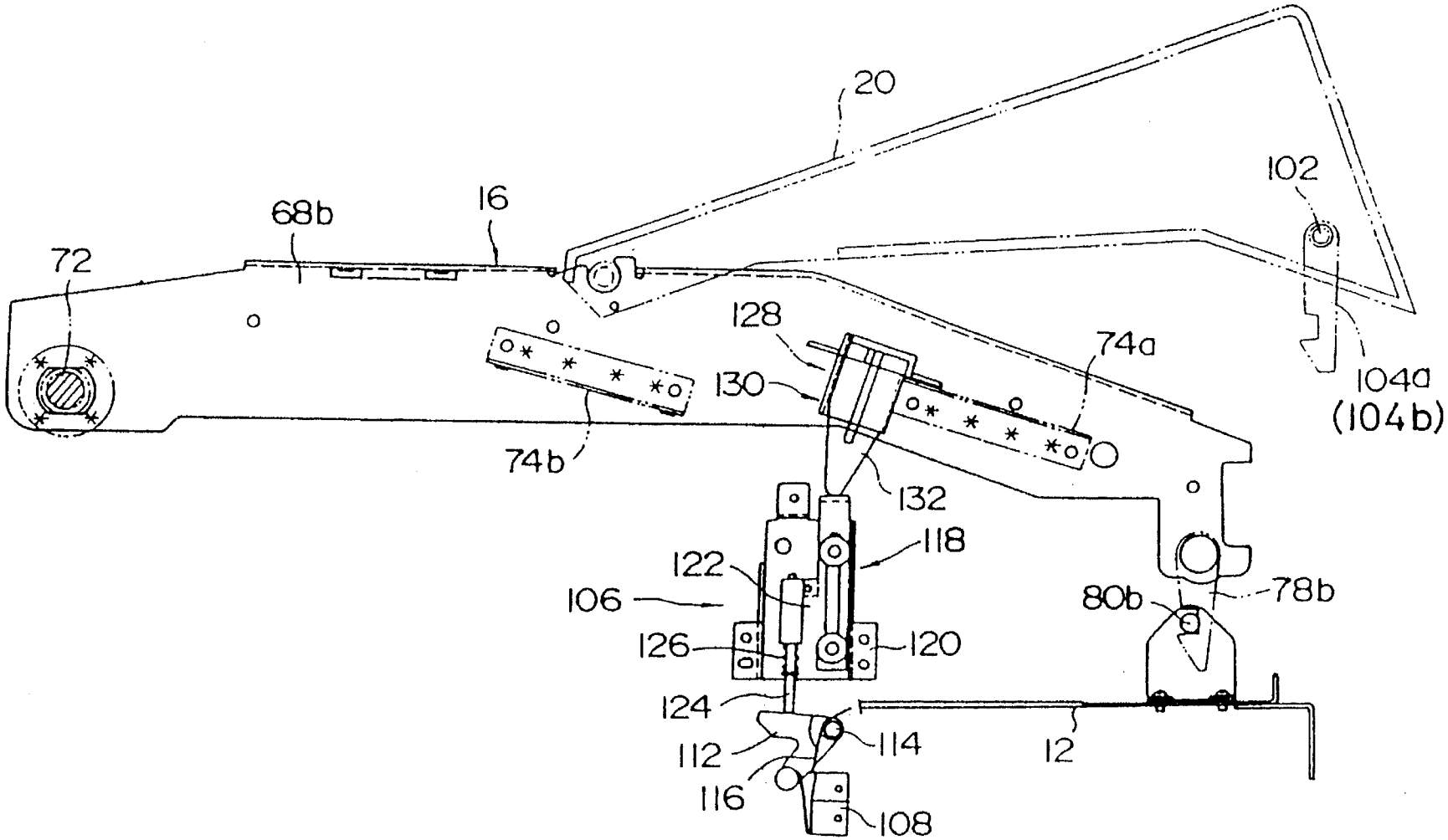
FIG. 29 is a side elevational view of the interlock mechanism and associated parts, as shown in FIG. 28, with only the control panel being open.

As shown in FIG. 28, a transversely extending pivot shaft 100 is attached to the rear end of the control panel 20, which is swingable about the pivot shaft 100 between a closed position (FIG. 28) in which it closes the front opening of the control panel 20 and an open position (FIG. 29) in which it opens the front opening of the control panel 20. A transversely extending lock shaft 102 is mounted on the front end of the control panel 20 for rotation about its own axis. Locking hooks 104*a*, 104*b*, for locking the control panel 20 to the swing frame 16, are integrally secured to the respective opposite ends of the lock shaft 102.

The locking hooks 104*a*, 104*b* have respective lower end surfaces inclined in a direction away from the upper surface of the main plate 12 in the rearward direction and have respective rear ends projecting rearwardly for simultaneous engagement with the front joint shaft 70. The locking hooks 104*a*, 104*b* are normally resiliently urged to turn clockwise (FIG. 28) by torsion coil springs (not shown), and are held in respective stop positions in abutment against respective stoppers (not shown) under the bias of the torsion coil springs.

When the control panel 20 is turned downwardly from the open position with the locking hooks 104*a*, 104*b* resiliently held in the stop positions, the inclined lower end surfaces of the locking hooks 104*a*, 104*b* engage and slide against the front joint shaft 70, forcing the locking hooks 104*a*, 104*b* to turn counterclockwise about the axis of the front joint shaft 70 against the bias of the torsion coil springs. Continued downward movement of the control panel 20 causes the locking hooks 104*a*, 104*b* to be further turned counterclockwise until the rear ends of the inclined lower end surfaces thereof disengage from the front joint shaft 70. The locking hooks 104*a*, 104*b* are now snapped back clockwise under the bias of the torsion coil springs, placing the rear ends of the inclined lower end surfaces thereof below the front joint shaft 70, whereupon the control panel 20 is locked in the closed position over the swing frame 16.

The locking hooks 104*a*, 104*b* are connected to the control panel opening button 44 (see FIG. 2). When the control panel opening button 44 is lifted, therefore, the locking hooks 104*a*, 104*b* are turned counterclockwise (FIG. 28) against the bias of the torsion coil springs, and released from locking engagement with the front joint shaft 70. When the locking hooks 104*a*, 104*b* are released,the control panel 20 is forcibly turned from the closed position toward the open position under the bias of a spring disposed around the pivot shaft 100, and subsequently resiliently held in the open position.

As described above, the locking hooks 104*a*, 104*b* for locking the control panel 20 in the closed position over the swing frame 16 are engageable with the front joint shaft 70 of the swing frame 16. The locking hooks 78*a*, 78*b* for locking the swing frame 16 in the closed position over the main plate 12 are mounted on the front joint shaft 70. Accordingly, no special parts are required for locking engagement with the locking hooks 104*a*, 104*b*. The total number of parts of the facsimile apparatus is thus reduced, resulting in a reduction in the cost thereof.

[INTERLOCK MECHANISM 106]

Figure 30:
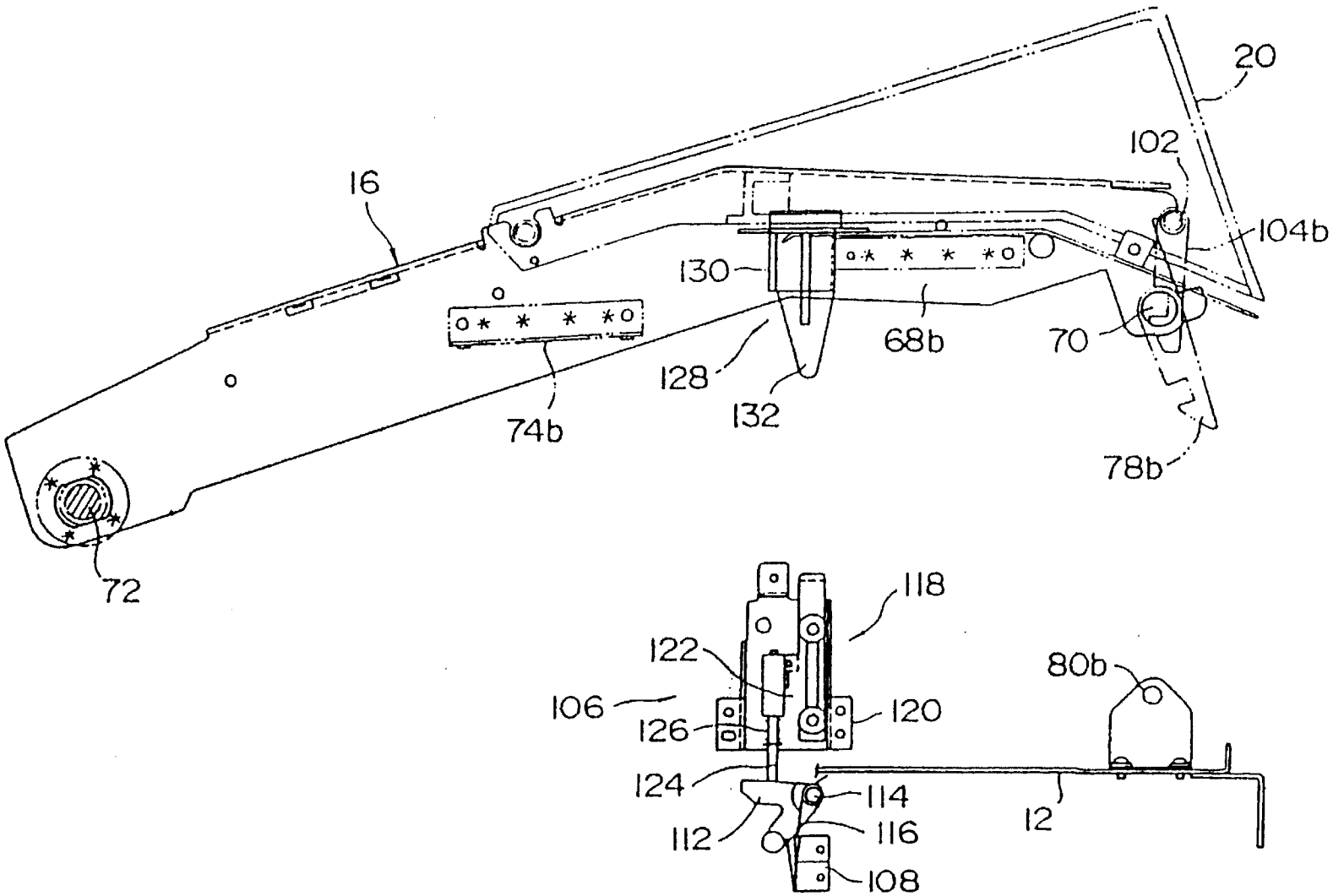
FIG. 30 is a side elevational view, similar to FIG. 29, showing the swing frame being open.

The structure and operation of an interlock mechanism 106 for simultaneously detecting when the swing frame 16 is closed over the main plate 12 and when the control panel 20 is closed over the swing frame 16 will be described below with reference to FIGS. 28 through 30.

As shown in FIG. 28, a detecting switch 108, which is turned on when pushed, is mounted on the lower frame 22*b* through an attachment stay 110. The detecting switch 108 has a trigger element which, when pushed in, turns on the detecting switch 108. Unless pushed in under external forces applied, the trigger element normally projects outwardly under the bias of a spring (not shown) of the detecting switch 108, turning off the detecting switch 108. A final actuator 112 is angularly movably supported by a shaft 114 on the attachment stay 110 for pushing in the trigger element of the detecting switch 108. The final actuator 112 is normally urged to turn clockwise (FIG. 28) away from the detecting switch 108 by a torsion spring 116 that is coiled around the shaft 114.

In FIG. 28, the control panel 20 is shown as being in the closed position closing the front opening of the upper housing 34 mounted on the swing frame 16, and the swing frame 16 is shown as being in the closed position closing the front opening of the upper housing 34. In this position, the trigger element of the detecting switch 108 is pushed in, turning on the detecting switch 108, by the final actuator 112 that has been turned counterclockwise against the bias of the torsion spring 116.

An intermediate actuator assembly 118 is disposed on the main plate 12 directly above the final actuator 112. The intermediate actuator assembly 118 includes an attachment plate 120 affixed to the main plate 12, a slider 122 slidably supported on the attachment plate 120 for vertical movement thereon, a pusher shaft 124 vertically slidably extending through one side of the slider 122, and a spring 126 for normally urging the pusher shaft 124 to project downwardly.

The pusher shaft 124 has a lower end extending downwardly through a through hole (not shown) defined vertically in the main plate 12, and positioned to push the final actuator 112 downwardly. The spring 124 is arranged to exert a biasing force greater than the sum of the biasing force of the torsion spring 116 and the biasing force of the spring of the detecting switch 108. Therefore, when the pusher shaft 124 is lowered as the slider 122 is lowered, the final actuator 124 is turned counterclockwise by the pusher shaft 124 against the bias of the torsion spring 116 and the bias of the spring of the detecting switch 108, pushing in the trigger element thereof, to turn on the detecting switch 108.

The slider 122 of the intermediate actuator assembly 118 can be pushed downwardly by an initial actuator assembly 128 (described in detail below) mounted on the swing frame 16. When the upper housing 34 on the swing frame 16 is turned from the open position to the closed position with the swing frame 16 in the closed position, or when the control panel 20 is turned from the open position to the closed position with the upper housing 34 in the closed position, the initial actuator assembly 128 moves downwardly into engagement with the slider 122 and pushes the slider 122 downwardly.

If something, i.e., a piece of foreign matter, happens to enter between the slider 122 and the initial actuator assembly 128, then, when the upper housing 34 is turned to the closed position, the slider 122 is lowered a stroke that is longer than the normal stroke by the thickness of the piece of foreign matter. In this embodiment, however, the pusher shaft 124 is vertically movably mounted on the slider 122 while being urged downwardly by the spring 126. Even if the slider 122 is additionally lowered by such a piece of foreign matter, after the pusher shaft 124 has lowered the final actuator 112 in response to downward movement of the slider 122, only the spring 126 is compressed, and the slider 122 is allowed to move downwardly relatively to the pusher shaft 124, thereby taking up the excessive downward displacement of the slider 122, which is thus not transmitted to the pusher shaft 124. Consequently, even if something undesirable gets between the slider 122 and the initial actuator assembly 128, the final actuator 112 is prevented from being turned excessively and hence from damaging the detecting switch 108. The detecting switch 108 is therefore operable with high reliability.

The initial actuator assembly 128 includes a pusher support 130 mounted on the side plate **68*b* of the swing frame 16 and positioned directly above the slider 122 when the swing frame 16 is in the closed position, and a pusher 132 vertically slidably mounted on the pusher support 130. The pusher 132 has a lower end projecting downwardly from the lower edge of the side plate 68*b* for engagement with the upper end of the slider 122, and an upper end engageable with one of laterally spaced vertical sidewalls of a panel body of the control panel 20**.

When the control panel 20 is closed over the upper housing 34 and the upper housing 34 is closed over the printer housing 32, i.e., when the facsimile apparatus 10 is fully closed, as shown in FIG. 28, the pusher 132 of the initial actuator assembly 128 is depressed by the control panel 20. Therefore, the slider 122 is lowered by the pusher 132, depressing the pusher 124 to turn the final actuator 112 counterclockwise against the bias of the torsion spring 116 and the bias of the spring of the detecting switch 108.

As a consequence, the trigger element of the detecting switch 108 is pushed in by the final actuator 112. The detecting switch 108 is now turned on, applying a signal to a control system (not shown) indicating that the control panel 20 is in the closed position over the upper housing 34 and the upper housing 34 is in the closed position over the printer housing 32.

When the control panel opening button 44 is lifted from the fully closed position shown in FIG. 28, the locking hooks **104*a*, 104*b* are released from locking engagement with the front joint shaft 70. As shown in FIG. 29, the control panel 20 is turned upwardly from the closed position to the open position. Upon opening movement of the control panel 20, it no longer depresses the pusher 132 of the initial actuator assembly 128. The pusher 132 is now allowed to slide upwardly under the bias of the torsion spring 116, that acts upwardly through the intermediate actuator assembly 118**.

As a result, the trigger element of the detecting switch 108 is permitted to project outwardly under the resiliency of the spring of the detecting switch 108. The detecting switch 108 is turned off, indicating to the control system that at least the control panel 20 is in the open position over the upper housing 34.

When the upper housing opening button 42 is lifted from the fully closed position shown in FIG. 28, the locking hooks **78*a*, 78*b* are released from locking engagement with the pins 80*a*, 80*b*. As shown in FIG. 30,the swing frame 16 and hence the upper housing 34 are turned upwardly from the closed position to the open position. Upon opening movement of the upper housing 34, the pusher 132 of the initial actuator assembly 128 is spaced upwardly from the slider 122 of the intermediate actuator assembly 118, i.e., the pusher 132 no longer depresses the slider 122. The slider 122 is now allowed to slide upwardly under the bias of the torsion spring 116 that acts upwardly through the intermediate actuator assembly 118**.

As a result, the trigger element of the detecting switch 108 is permitted to project outwardly under the resiliency of the spring of the detecting switch 108. The detecting switch 108 is turned off, indicating to the control system that at least the upper housing 34 is in the open position over the printer housing 32.

The facsimile apparatus 10 is capable of energizing, making the image printing mechanism 14 and the image reading mechanism 18 operational, only when the detecting switch 108 is turned on, i.e., the facsimile apparatus 10 is in the fully closed position shown in FIG. 28. When the control panel 20 is opened from the fully closed position shown in FIG. 28, the image reading mechanism 18 is exposed, and when the upper housing 34 is opened, the image printing mechanism 14 is exposed. Since the detecting switch 108 is turned off as soon as the image reading mechanism 18 and the image printing mechanism 14 are exposed, these mechanisms and the laser scanning unit 24 are immediately turned off when the facsimile apparatus 10 is opened. Therefore, the user of the facsimile apparatus 10 is protected against injuries which would otherwise result from continued operation of the facsimile apparatus 10, and the internal mechanisms thereof are also protected against damage.

[LAYOUT OF DRIVE MOTORS]

A layout of drive motors used to actuate various mechanisms of the facsimile apparatus 10 will be described below with reference to FIGS. 31 and 32.

The facsimile apparatus 10 has a total of three drive motors 140,142, 144. More specifically, as shown in FIGS. 31 and 32, the first drive motor 140, i.e., a document feed motor, is mounted on an outer surface of the side plate 68*a* for feeding a document in the image reading mechanism 18 disposed on the swing frame 16. The second drive motor 142, i.e., a pickup motor, is mounted on a rear portion of one side of the main plate 12 for picking up sheets, one at a time, from the sheet cassette 36 in the image printing mechanism 14 mounted on the main plate 12. The third drive motor 144, i.e., a printer motor, is mounted on a substantially central portion of the opposite side of the main plate 12 for performing image forming operation in the image printing mechanism 14. These drive motors 140, 142, 144 are arranged to actuate the image reading mechanism 18, a sheet pickup system in the image printing mechanism 14, and an image forming system in the image printing mechanism 14, independently of each other.

The image reading mechanism 18 can feed a document irrespectively and independently of the image printing mechanism 14, and the sheet pickup system and the image forming system in the image printing mechanism 14 can operate independently of each other. Therefore, the timing of the operation of the image reading mechanism 18, the sheet pickup system, and the image forming system can freely be selected independently of each other. Stated otherwise, the three drive motors 140, 142, 144 allow the image reading mechanism 18, the sheet pickup system, and the image forming system to start to operate at freely selected times. Hence, the image reading mechanism 18, the sheet pickup system, and the image forming system can be designed with greater freedom.

Systems for transmitting drive forces from the drive motors 140, 142, 144 will be described later on in connection with the image printing mechanism 14 and the image reading mechanism 18.

[ARRANGEMENT OF CIRCUIT BOARDS AND ELECTRIC WIRING]

An arrangement of circuit boards and an electric wiring in the facsimile apparatus 10 will be described below with reference to FIGS. 1 and 32.

Figure 32:
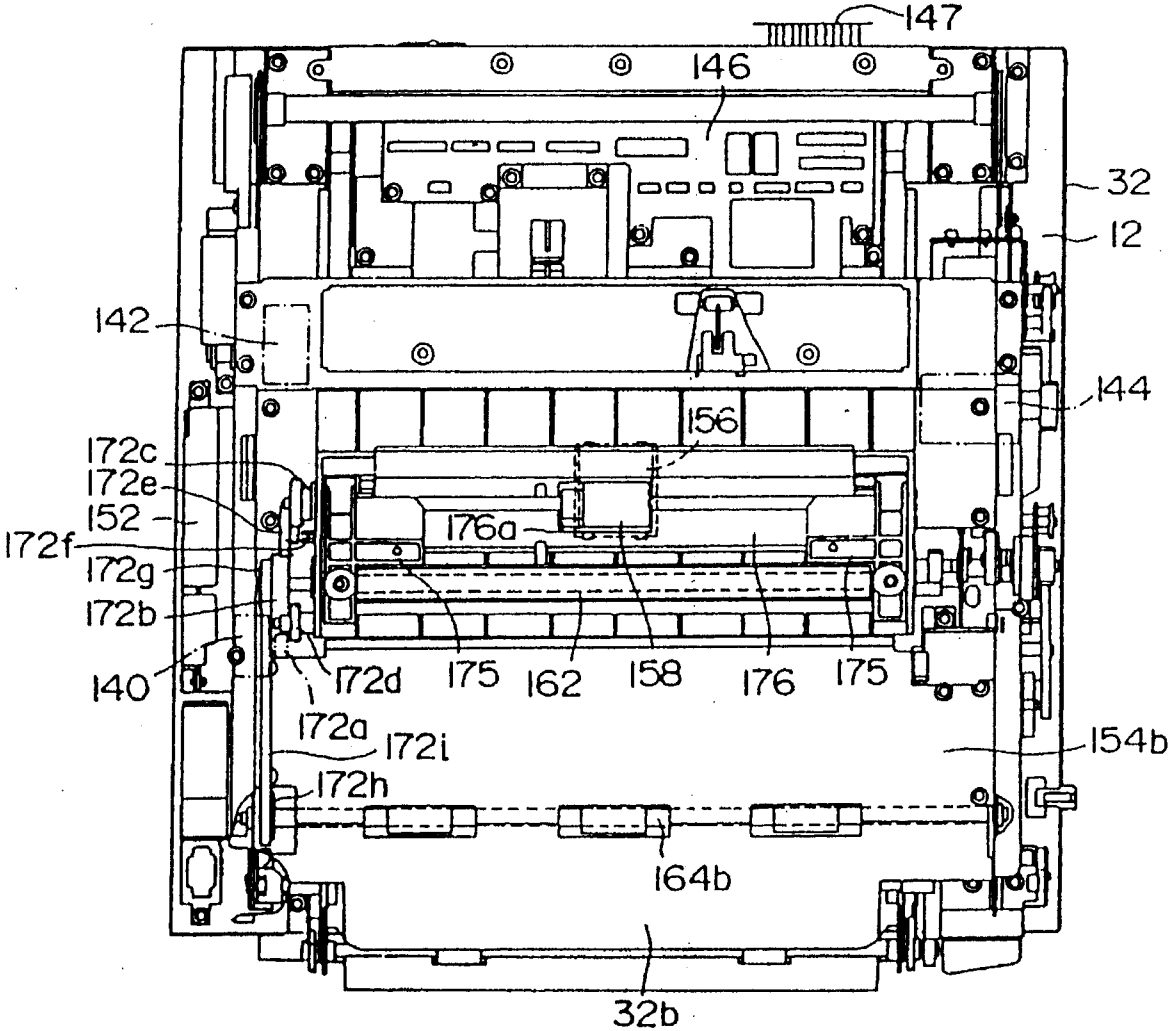
FIG. 32 is a plan view of the facsimile apparatus, as shown in FIG. 1, with the upper housing and the control panel omitted from illustration.

As shown in FIG. 32, a horizontal relay circuit board 146 is disposed in a space defined above the rear portion of the main plate 12 and surrounded by the printer housing 32. The relay circuit board 146 is supplied with image information read from a document and various items of detected information from the image reading mechanism 18, and also image information to be formed on a sheet and various items of detected information from the image printing mechanism 14, and transmits the supplied information through a single flat cable 147, which extends around the main plate 12, to the main control board 52 that serves to control overall operation of the facsimile apparatus 10.

If various signals were supplied through respective signal lines to the main control board 52, then many signal lines would have to extend around the main plate 12 to the main control board 52 that is positioned underneath the main plate 12. In the illustrated embodiment, however, signals representing information generated by and supplied to the mechanisms above the main plate 12 are first supplied to the relay circuit board 146 disposed above the main plate 12, and then electrically processed, e.g., converted into serial signals, by the relay circuit board 146. Then, the processed signals are supplied through the single flat cable 147 to the main control board 52. Therefore, various, many signals can be supplied to and from the main control board 52 neatly through the single flat cable 147. Use of the single flat cable 147 for transmitting many signals allows the facsimile apparatus 10 to be easily inspected and serviced for electric malfunctions or failures.

As shown in FIG. 1, a horizontal low-voltage power supply board 148 is disposed in a space between the main plate 12 and the relay circuit board 146, and mounted on the main plate 12. As described in detail later on, the space which accommodates the low-voltage power supply board 148 is part of a discharge passage of a discharge device 150 that discharges ozone, which is generated upon charging and transferring in the image printing mechanism 14, out of the enclosure 28 through a discharge opening 32*c* (see FIG. 3) defined in the rear panel of the printer housing 30. Since the low-voltage power supply board 148 which gives off a large amount of heat during operation is positioned in the ozone discharge passage, it is not necessary to employ a heat discharging device dedicated to discharge the heat from the low-voltage power supply board 148. The discharge device 150 thus doubles as a device for discharging ozone and a device for cooling the low-voltage power supply board 148. Inasmuch as the space in the enclosure 23 is effectively utilized, the overall structure of the facsimile apparatus 10 is made relatively compact. As shown in FIG. 32, a high-voltage power supply board 152 is vertically disposed on the main plate 12 on one side of the image printing mechanism 14.

[IMAGE READING MECHANISM 18]

The structure and operation of the image reading mechanism 18 will be described below with reference to FIGS. 1, 31, 32, and 33 through 53.

(OVERALL STRUCTURE OF IMAGE READING MECHANISM 18)

Figure 31:
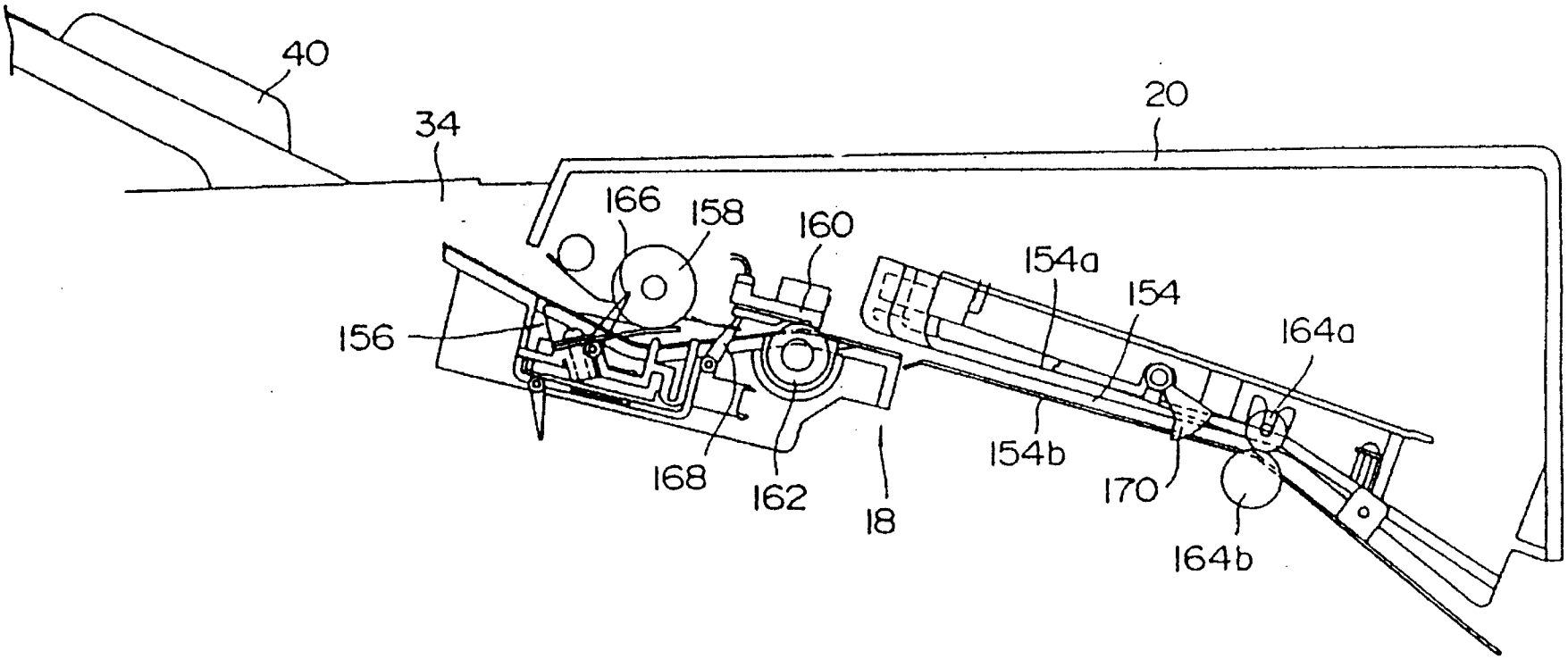
FIG. 31 is a side elevational view of an image reading mechanism of the facsimile apparatus shown in FIG. 1.

As shown in FIGS. 1 and 31, the image reading mechanism 18 has a document feed path 154 for feeding at least one document from the document tray 40 to the document discharge slot 32*b*. The image reading mechanism 18 operates to separate one document from a document stack on the document tray 40 with a document separating unit 156 and a document withdrawal roller 158. As the document withdrawal roller 158 rotates, it draws the separated document forwardly and feeds the document to a position between an image reader 160 and a white roller 162. The image reader 160 reads an image on the document that is to be transmitted or copied. Then, the document travels through the document feed path 154, and is fed forwardly by a pair of upper and lower document discharge rollers 164*a*, 164*b* and discharged out of the enclosure 28 through the document discharge slot 32*b*.

The image reading mechanism 18 has three document detecting switches 166, 168, 170 that are successively positioned along the document feed path 154 from the document tray 40 to the document discharge slot 32*b*. These document detecting switches 166, 168, 170 will successively be described below.

As shown in FIG. 31, the first document detecting switch 166 is positioned immediately upstream of the document withdrawal roller 158 with respect to the direction in which the document is fed through the document feed path 154. The first document detecting switch 166 serves to detect whether a document is present (or remains) on the document tray 40 or not. More specifically, the first document detecting switch 166 has a trigger element projecting into the document feed path 154. When no external force is applied to the trigger element of the first document detecting switch 166, i.e., when the trigger element is not engaged by a document, the first document detecting switch 166 is turned off. Conversely, when a document is fed from the inclined document tray 40 toward the document withdrawal roller 158 by gravity, the document engages the trigger element of the first document detecting switch 166, and pushes in the trigger element, thus turning on the first document detecting switch 166. The first document detecting switch 166 is electrically connected to the main control board 52. The main control board 52 determines that no document is present on the document tray 40 when the first document detecting switch 166 is turned off, and that at least one document is present on the document tray 40 when the first document detecting switch 66 is turned on.

The second document detecting switch 168 is positioned in the document feed path 154 between the document withdrawal roller 158 and the image reader 160. The second document detecting switch 168 detects when a document is withdrawn toward the image reader 160 upon rotation of the document withdrawal roller 158, and also determine the timing for the leading end of the document to reach the image reader 160. More specifically, the second document detecting switch 168 has a trigger element projecting into the document feed path 154. When no external force is applied to the trigger element of the second document detecting switch 168, i.e., when the trigger element is not engaged by a document, the second document detecting switch 168 is turned off. Conversely, when a document is fed by the document withdrawal roller 158, the document engages the trigger element of the second document detecting switch 168, and pushes in the trigger element, thus turning on the second document detecting switch 168. The second document detecting switch 168 is electrically connected to the main control board 52. The main control board 52 energizes the image reader 160 to start reading an image from the document a predetermined period of time after the second document detecting switch 168 is turned on. Specifically, the predetermined period of time, which is consumed before the leading end of the document reaches the image reader 160, is determined by the distance between the second document detecting switch 168 and the image reader 160 and the speed at which the document is fed through the document feed path 154 by the document withdrawal roller 158.

The third document reading switch 170 is positioned immediately upstream of the document discharge rollers 164*a*, 164*b* with respect to the direction in which the document is fed through the document feed path 154. The third document detecting switch 170 serves to detect whether a document that has been read by the image reader 160 is discharged without a jam in the document feed path 154. More specifically, the third document detecting switch 170 has a trigger element projecting into the document feed path 154. When no external force is applied to the trigger element of the third document detecting switch 170, i.e., when the trigger element is not engaged by a document, the third document detecting switch 170 is turned off. The third document detecting switch 170 is turned on by the leading end of the document fed through the document feed path 154 after it has been read by the image reader 160. The third document detecting switch 170 is turned off when the trailing end of the document passes the third document detecting switch 170. The third document detecting switch 170 is electrically connected to the main control board 52. The main control board 52 measures a period of time consumed after the second document detecting switch 168 is turned on and before the third document detecting switch 170 is turned off. The main control board 52 compares the measured period of time with a reference period of time that is determined by the distance between the second and third document detecting switches 168, 170 and the speed at which the document is fed through the document feed path 154 by the document withdrawal roller 158, and determines a jam of the document in the document feed path 154 if the measured period of time is longer than the reference period of time.

(DRIVE SYSTEM OF IMAGE READING MECHANISM 18)

Figure 33:
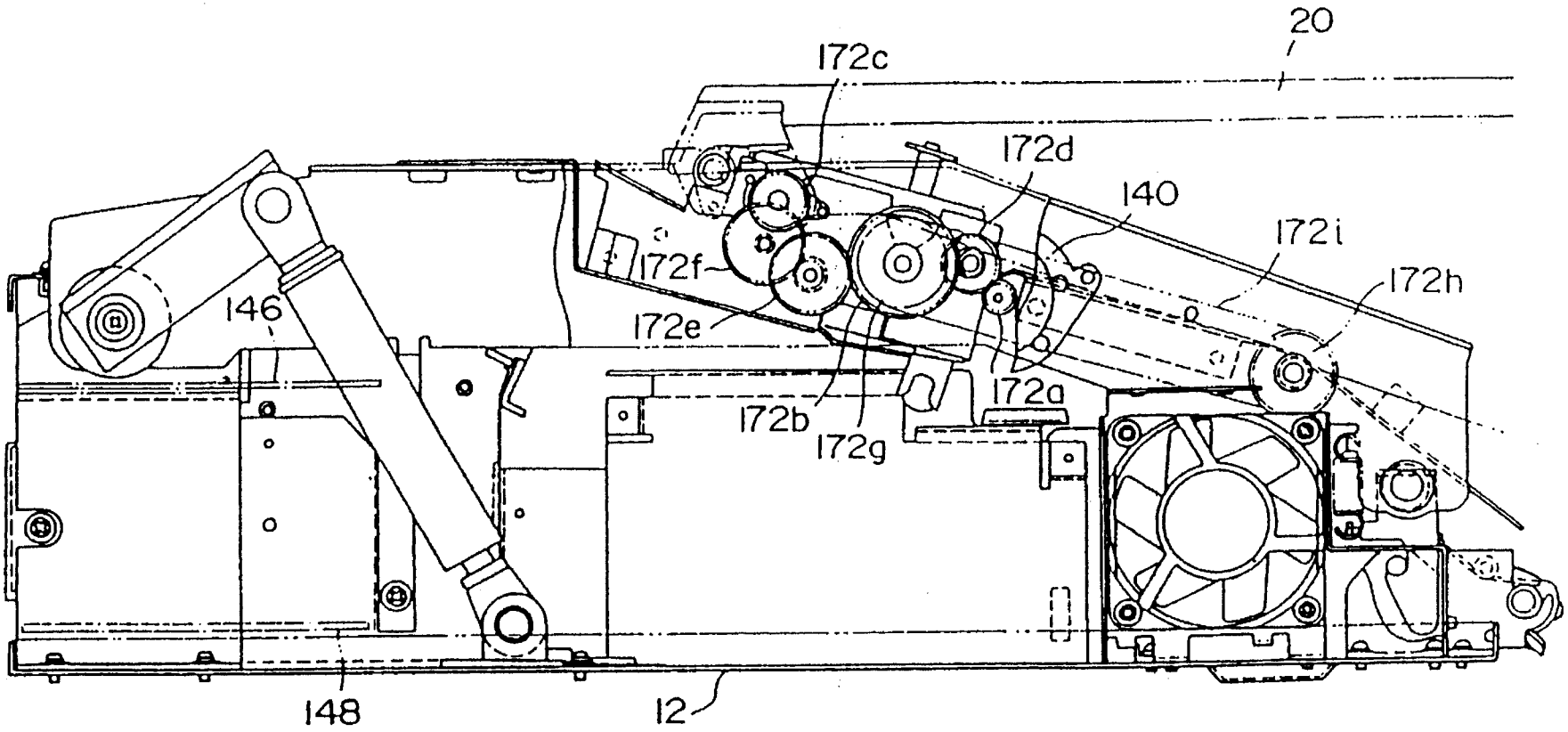
FIG. 33 is side elevational view of the facsimile apparatus shown in FIG. 32.

As shown in FIGS. 32 and 33, a drive system of the image reading mechanism 18 includes a drive gear 172*a* coaxially fixed to the output shaft of the document feed motor 140, a first driven gear 172*b* coaxially fixed to the white roller 162, a second driven gear 172*c* coaxially fixed to the document withdrawal roller 158 and, a first idle gear 172*d* held in mesh with the drive gear 172*a* and the first driven gear 172*b* for transmitting rotation from the drive gear 172*a* to the first driven gear 172. The drive system further includes a second and third idle gears 172*e*, 172*f* held in mesh with each other and also the first driven gear 172*b* and the second driven gear 172*e*, respectively, for transmitting rotation of the first driven gear 172*b* to the second driven gear 172*e*. An endless belt 172*i* is trained around a drive pulley 172*g* coaxially secured to the first driven gear 172*b* and a driven pulley 172*h* coaxially secured to the document discharge roller 164*b* which is positioned underneath the document discharge roller 164*a*.

When the document feed motor 140 is energized, the first and second driven gears 172*b*, 172*c* are rotated,causing the white roller 162 and the document withdrawal roller 158 to rotate at respective speed reduction ratios. As the first driven gear 172*b* rotates, the endless belt 172 rotates the driven pulley 172*h*, which then rotates the document discharge roller 164*b* at a predetermined speed reduction ratio. Therefore, the rollers 158, 162, 164*b*, for feeding documents, are synchronously rotated by the single document feed roller 140.

Figure 34:
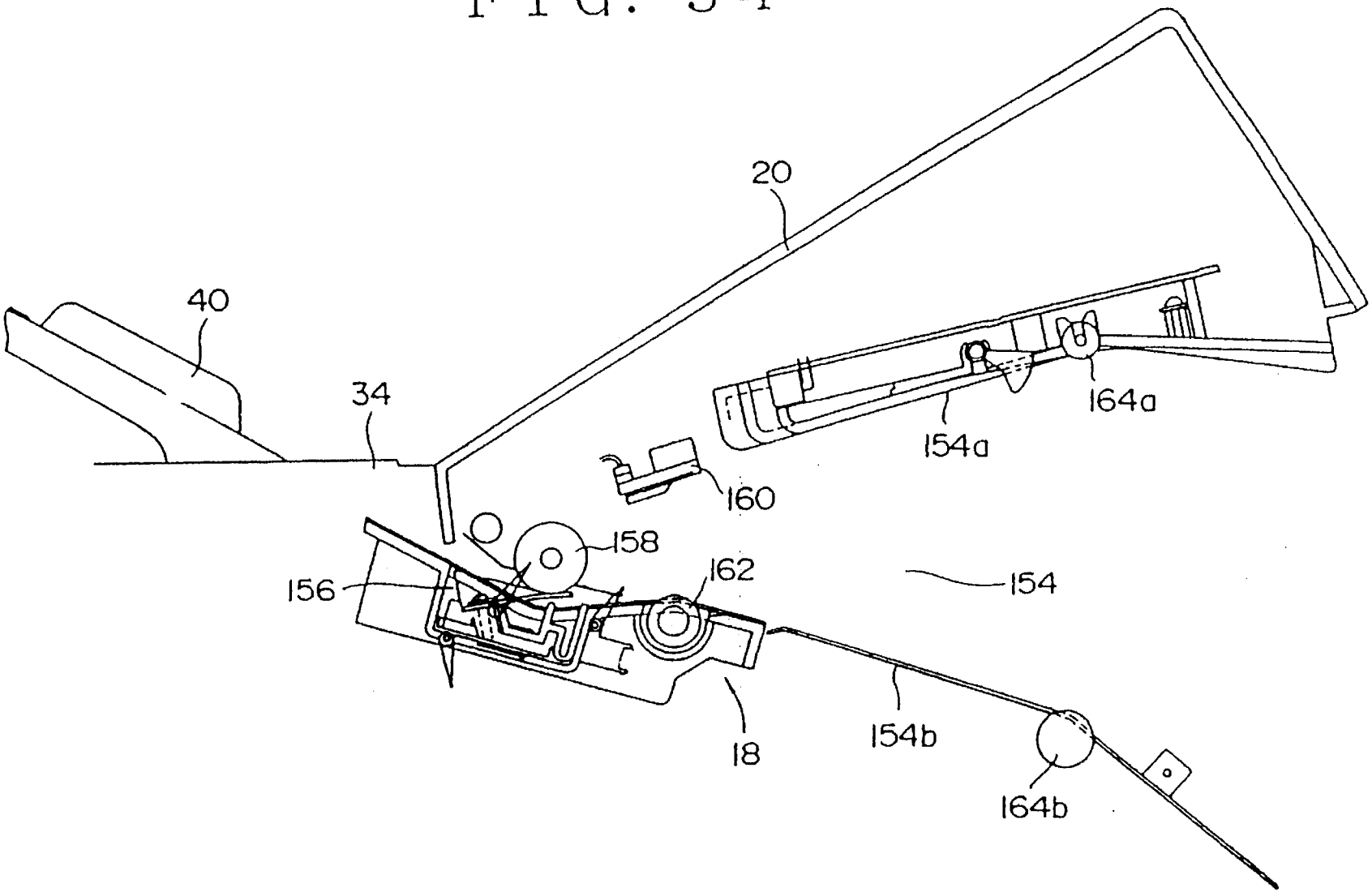
FIG. 34 is a side elevational view of the facsimile apparatus, as shown in FIG. 33, with the control panel being open.

The manner in which the control panel 20 is attached to the components of the image reading mechanism 18 will be described below with reference to FIGS. 31 and 34.

The image reader 160, an upper guide member 154*a* which defines the upper side of the document feed path 154, and the upper document discharge roller 164*a* are mounted on the control panel 20. When the controls panel 20 is opened with respect to the upper housing 32, as shown in FIG. 8, the image reader 160, the upper guide member 154*a*, and the document discharge roller 164*a* are spaced upwardly from the white roller 162, a lower guide member 154*b*, and the lower document discharge roller 164*b*, respectively, widely opening the document feed path 154,as shown in FIG. 34. Therefore, in the event that a document is jammed while it is being fed through the document feed path 154, the user may turn the control panel 20 from the closed position to the open position to widely open the document feed path 154 for easy and reliable removal of the jammed document from the document feed path 154.

The various components of the image reading mechanism 18 will be described in detail below.

(DOCUMENT SEPARATOR)

Figure 35:
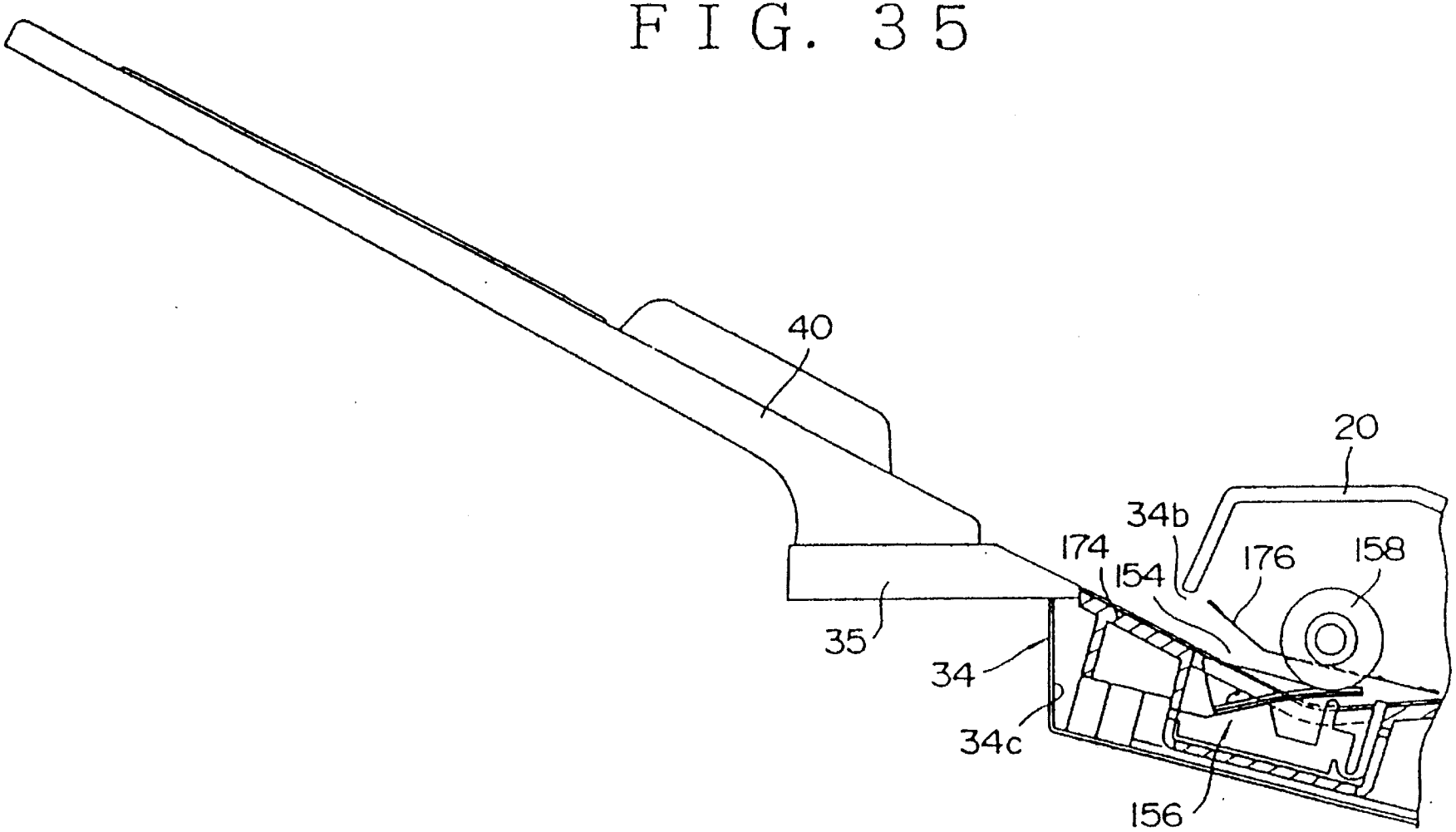
FIG. 35 is a fragmentary side elevational view, partly in cross section, of a document separator of the image reading mechanism shown in FIG. 31.

As shown in FIG. 35, documents on the inclined document tray 40 are introduced by gravity into the document feed path 154 through its inlet from the document inlet slot 34*b*, which is defined as a gap between an upper surface of the upper housing 34 and the rear edge of the control panel 20. The documents that have been introduced into the document feed path 154 are separated one by one by the co-action of the document separating unit 156 and the document withdrawal roller 158. A separated document is fed toward the image reader 160 as the document withdrawal roller 158 rotates. In the vicinity of the document separator, the document feed path 154 is defined as a gap between a lower document guide 174 and an upper document guide 176 that is spaced upwardly from the lower document guide 174.

Figure 36:
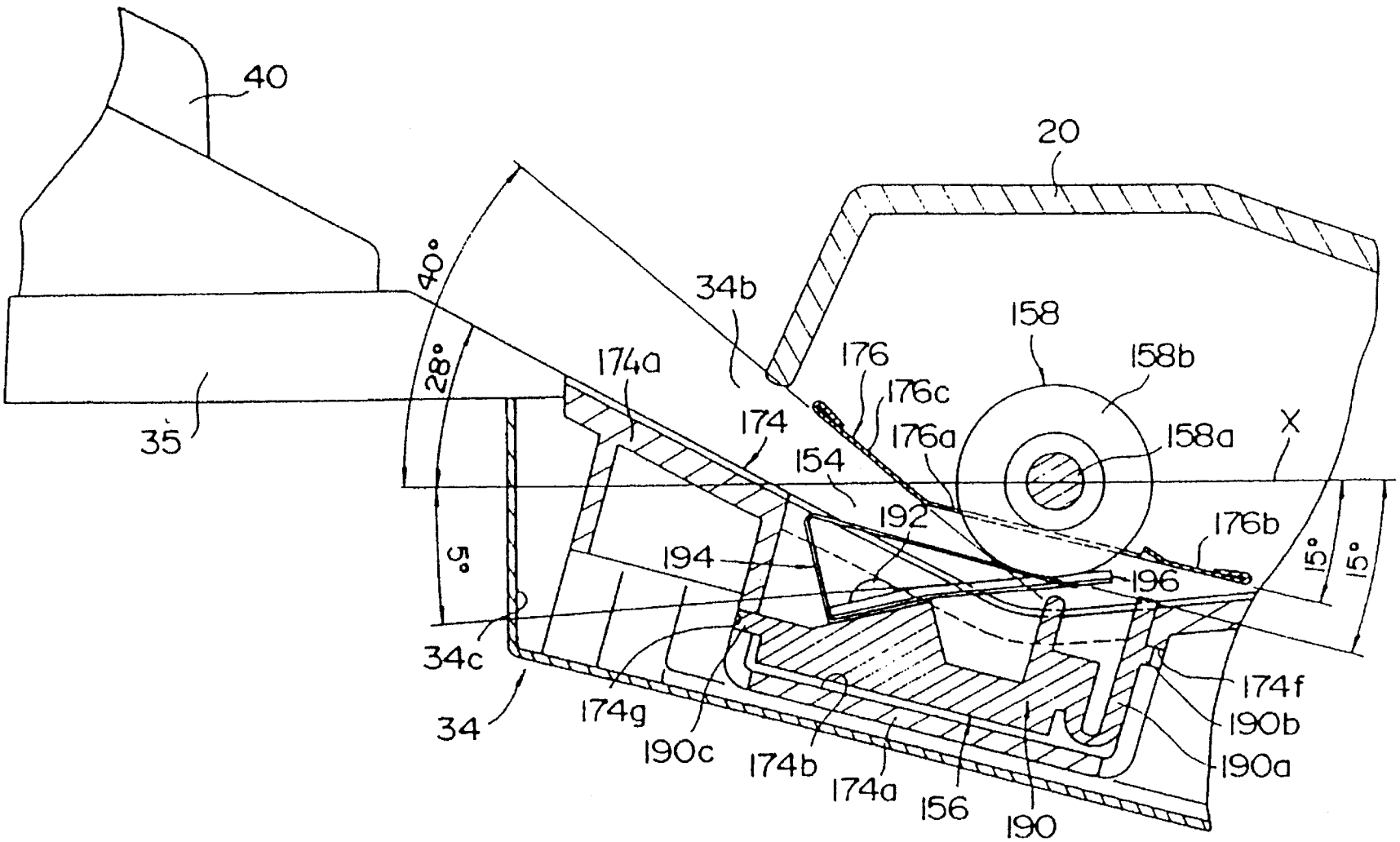
FIG. 36 is an enlarged cross-sectional view of the document separator shown in FIG. 35.
Figure 50:
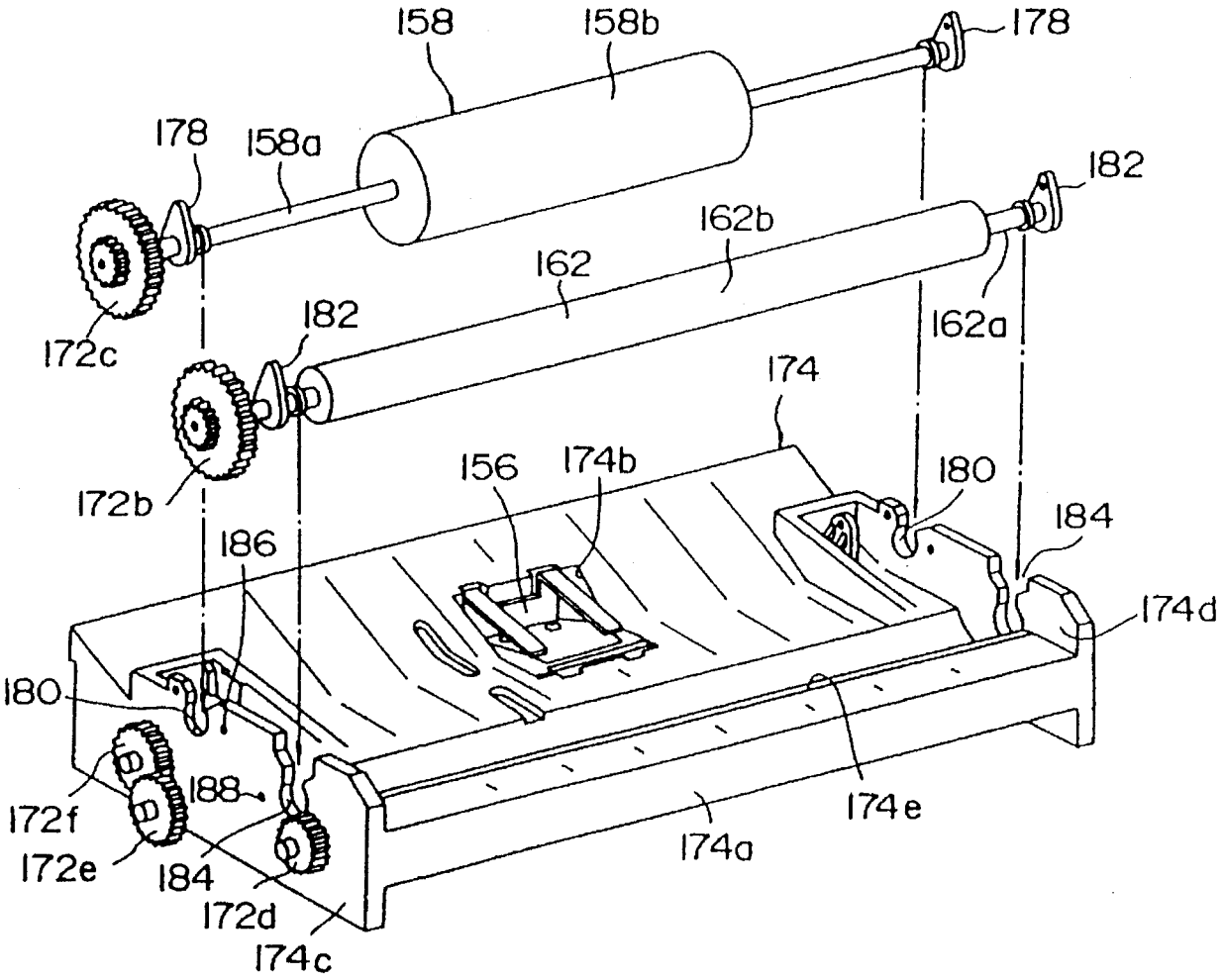
FIG. 50 is exploded perspective view of the lower document guide, the document withdrawal roller, and the white roller that are about to be installed on the lower document guide.

As shown in FIG. 36, the document withdrawal roller 158 includes a shaft 158*a* and a friction roller element 158*b* coaxially mounted on and around the shaft 158*a* and having an outer circumferential surface of a high coefficient of friction. Similarly, as shown in FIG. 50, the white roller 162 comprises a shaft 162*a* and a roller element 162*b* coaxially mounted on and around the shaft 162*a* and having an outer circumferential surface which is white in color.

<UPPER DOCUMENT GUIDE 176>

As shown in FIG. 36, the upper document guide 176 has a hole 176*a* defined substantially centrally therein and receiving a lower portion of the friction roller element 158*b* of the document withdrawal roller 158. As shown in FIG. 32, the upper document guide 176 is detachably attached to the lower document guide 174 by a plurality of snap pins 175. When the control panel 20 is turned to the open position, widely opening the document feed path 154, the user can remove the snap pins 175 from the lower document guide 174, and then can easily dismount the document withdrawal roller 158 and the document separating unit 156 from the image reading mechanism 18.

Specifically, the upper document guide 76 includes a guide body 176*b* with the hole 176*a* defined therein, and a bent portion 176*c* integrally joined to a rear edge of the guide body 176*b* and bent upwardly in the rearward direction. The bent portion 176*c* is bent with respect to the guide body 176*b* clockwise (FIG. 36) through 25°. The angle between the bent portion 176*c* and the guide body 176*b* is 25 degrees because the guide body 176*b* is inclined clockwise through 15° with respect to a reference line X passing through the central axis of the document withdrawal roller 158 which is parallel to the support surface on which the facsimile apparatus 10 is installed. The bent portion 176*c* is inclined clockwise through 40° with respect to the reference line X (40°−15°=25°).

The above angle of 25° is illustrated by way of example only. The angle between the bent portion 176*c* and the guide body 176*b* may be selected as desired insofar as the guide body 176*b* surrounds the document withdrawal roller 158 and is spaced upwardly from the lower document guide 174, and the rear end of the lower document guide 176, i.e., the bent portion 176*c* thereof, does not substantially obstruct the document inlet slot 36*b*, for thereby allowing a document coming in through the document inlet slot 36*b* to be guided between the lower document guide 174 and the guide body 176*b* of the upper document guide 176.

<LOWER DOCUMENT GUIDE 174>

Figure 37:
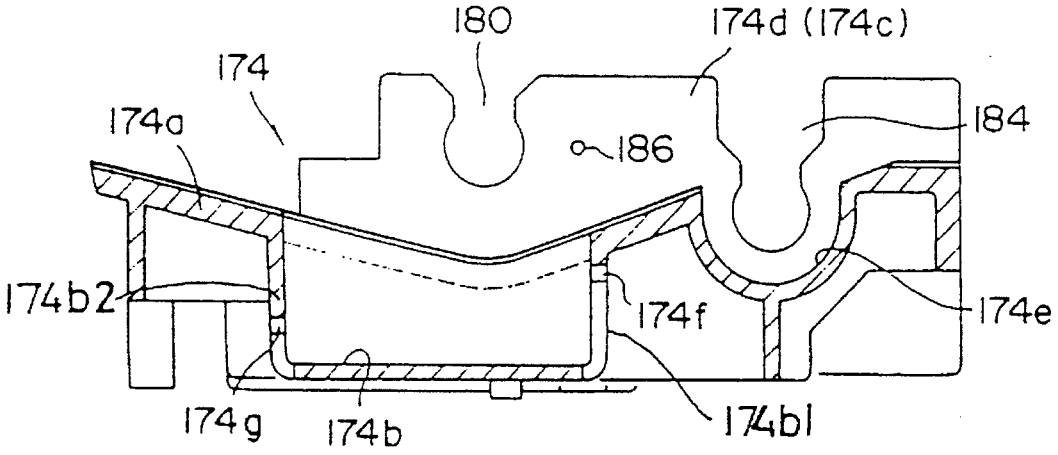
FIG. 37 is a side elevational view, partly in cross section, of a lower document guide of the image reading mechanism shown in FIG. 31.
Figure 38:
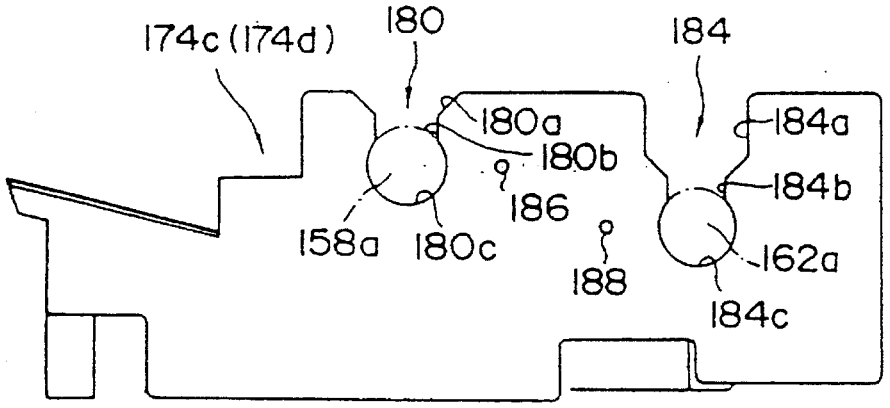
FIG. 38 is a side elevational view of a support plate of the lower document guide shown in FIG. 37.

As shown in FIG. 36, the lower document guide 174 is housed in a recess 34*c* defined in the upper housing 34 immediately in front of the tray support 35. As shown in FIGS. 37 and 38, the lower document guide 174 has a guide body 174*a* defining the lower side of the document feed path 154, a first cavity 174*b* defined substantially centrally in an upper surface of the guide body 174*a*, and a pair of laterally spaced support plates 174*c*, 174*d* integrally joined to respective opposite sides of the guide body 174*a* and extending vertically. The document separating unit 156 is removably disposed in the first cavity 174*b*. The support plates 174*c*, 174*d* define the respective lateral sides of the document feed path 154. The opposite ends of the document withdrawal roller 158 and the white roller 162 are rotatably and detachably supported by the support plates 174*c*, 174*d*.

As shown in FIG. 37, the guide body 174*a* has a second cavity 174*e* defined in a front potion of its upper surface, and the roller element 162*b* of the white roller 162 can be loosely fitted in the second cavity 174*e*. The first cavity 174*b* has its front and rear ends defined by respective front and rear walls 174*b*1, 174*b*2, which have respective grooves 174*f*, 174*g* defined therein for receiving locking bosses (described later on) on front and rear ends of the document separating unit 156.

As shown in FIG. 36, the lower document guide 174, as it is housed and fixed in the recess 34*c* in the upper housing 34, has a document entrance region on the left hand side (as viewed in FIG. 36) of the document withdrawal roller 158. The document entrance region has an upper surface lying substantially in alignment with the upper surface, i.e., the document support base 54, of the document tray 40 mounted on the tray support 35, and being inclined 28° clockwise with respect to the reference line X. The lower document guide 174 also has a document exit region on the right hand side (as viewed in FIG. 36) of the document withdrawal roller 158. The document exit region has an upper surface lying substantially parallel to the reference line X.

With the upper surface of the document entrance region being inclined 28°, since the bent portion 176*c* of the upper document guide 176 is inclined 40° with respect to the reference line X, the inlet of the document feed path 154 is tapered into a wedge shape at angle of 12°, i.e., has its width progressively reduced along the direction in which a document is fed through the document feed path 154. As a consequence, irrespective of the number of documents placed on the document tray 40, they can reliably be fed, one at a time, toward the document separator between the document separating unit 156 and the document withdrawal roller 158.

As shown in FIG. 38, each of the support plates 174*c*, 174*d* has first and second recesses 180, 184 defined therein in spaced relationship to each other and opening upwardly at its upper edge, the first recess 180 is positioned upwardly of the second recess 184 with respect to the direction in which a document is fed through the document feed path 154. The shaft 158*a* of the document withdrawal roller 158 is rotatably and detachably supported in the first recess 180 through first bearing bushings 178. The shaft 162*a* of the white roller 162 is rotatably and detachably supported in the second recess 184 through second bearing bushings 182.

Specifically, the first and second recesses 180, 184 have respective tapered portions 180*a*, 184*a* for guiding the respective bearing bushings 178, 182, respective constricted portions 180*b*, 184*b* continuing downwardly from the respective tapered portions 180*a*, 184*a* and having a width smaller than the diameter of the bearing bushings 178, 182, and respective retaining portions 180*c*, 184 continuing downwardly from the respective constricted portions 180*b*, 184*b* and having a diameter that is substantially the same as the diameter of the bearing bushings 178, 182, for retaining the respective bearing bushings 178, 182 therein.

When the document withdrawal roller 158 and the white roller 162 are to be brought into the respective recesses 180, 184 through the bearing bushings 178, 182, the bearing bushings 178, 182 are forcibly introduced through the respective constricted portions 180*b*, 184*b* into the respective retaining portions 180*c*, 184*c*. The document withdrawal roller 158 and the white roller 162, that are held in the respective bearing bushings 178, 182, are thus stably held in position against dislodgement from the retaining portions 180*c*, 184*c*.

Each of the support plates 174*c*, 174*d* also has first and second holes 186, 188 defined therein near the respective recesses 180, 184 for receiving respective convexities 178*d*, 182*d* (see FIG. 39) of the first and second bearing bushings 178, 182.

Figure 39:
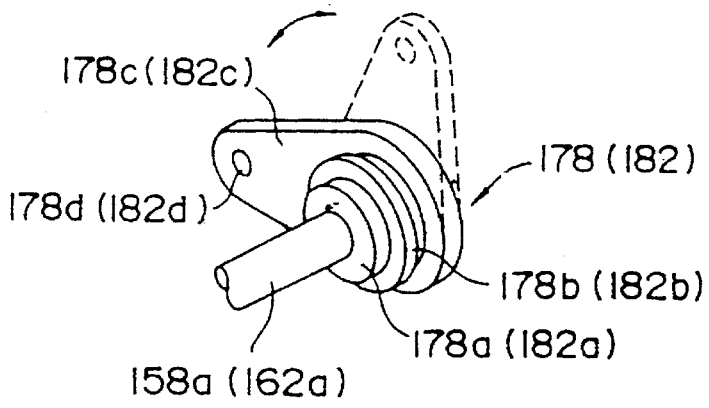
FIG. 39 is a perspective view of a bearing bushing for supporting each of a document withdrawal roller and a white roller that are rotatably supported by the lower document guide shown in FIG. 38.
Figure 51:
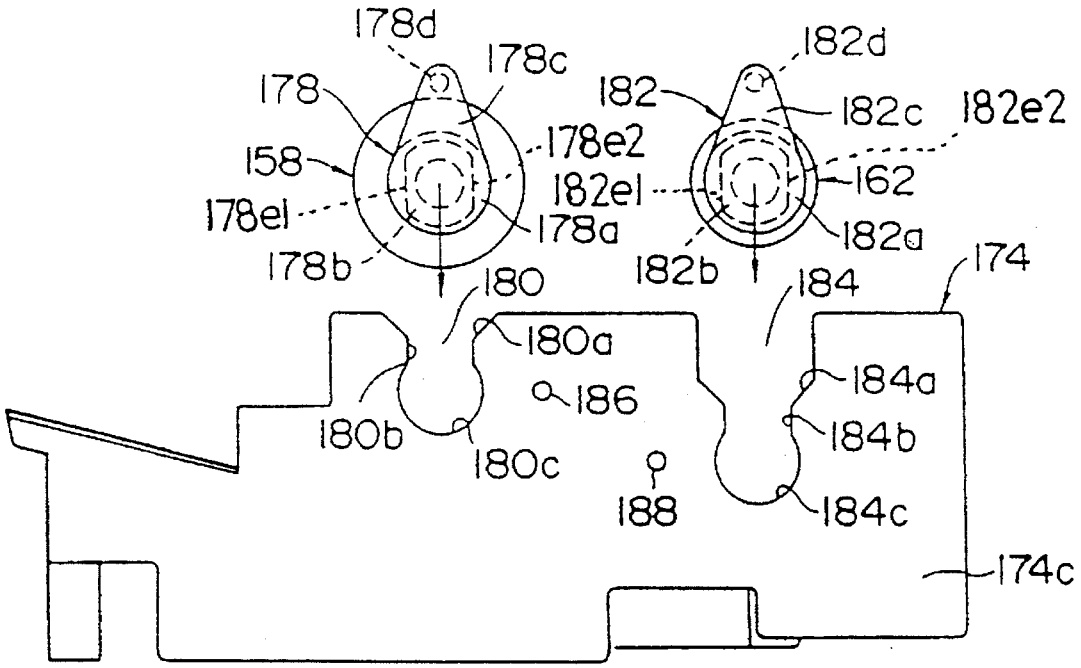
FIG. 51 is a side elevational view of the lower document guide, the document withdrawal roller, and the white roller that are about to be installed on the lower document guide.
Figure 52:
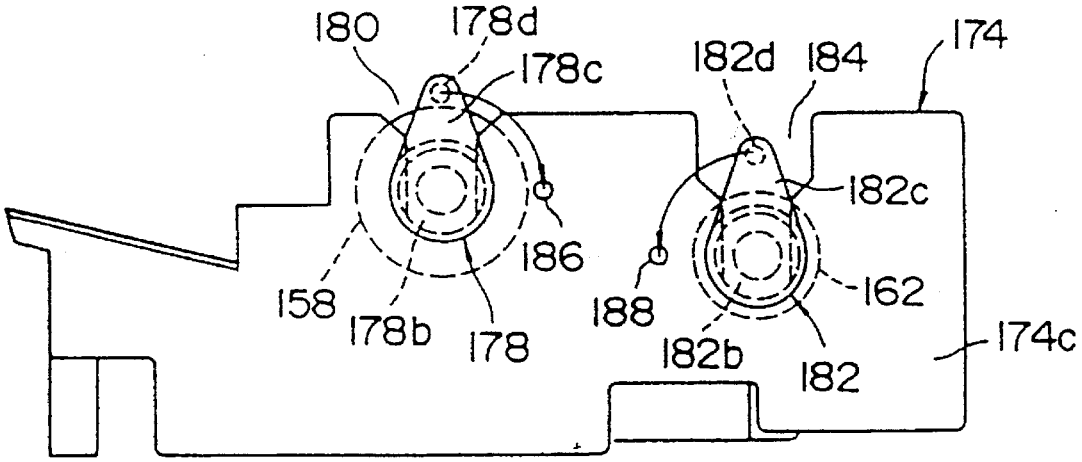
FIG. 52 is a side elevational view of the lower document guide, the document withdrawal roller, and the white roller that are installed on the lower document guide.

The first and second bearing bushings 178, 182 are identical in construction. As shown in FIG. 39, the first and second bearing bushings 178, 182 have respective bearing bodies 178*a*, 182*a* by which the corresponding shafts 158*a*, 162*a* are rotatably supported. Respective grooves 178*b*, 182*b* are defined in outer circumferential surfaces of the bearing bodies 178*a*, 182*a* and fitted in the respective holes 180*c*, 184*c*. Respective arms 178*c*, 182*c* are integrally joined to and extending radially outwardly from the respective bearing bodies 178*a*, 182*a*. The respective convexities 178*d*, 182*d* are formed on inner surfaces of the distal ends of the respective arms 178*c*, 182*c* and project slightly therefrom in the inward direction. As shown in FIG. 51, the bottoms of the grooves 178*b*, 182*b* of the first and second bearing bushings 178, 182 have respective pairs of parallel flat surfaces 178*e*1, 178*e*2 and 182*e*1, 182*e*2, which are spaced from each other by a distance slightly smaller than the width of the corresponding constricted portions 180*b*, 184*b*.

When the bearing bushings 178, 182 are introduced into the respective recesses 180, 184, they are oriented such that the parallel flat surfaces 178*e*1, 178*e*2 and 182*e*1, 182*e*2 pass along the constricted portions 180*b*, 184*b*. After the bearing bushings 178, 182 are inserted into the retaining portions 180*c*, 184*c*, respectively, the bearing bushings 178, 182 are turned therein by about 90°. Now, the horizontal width of the bearing bushings 178, 182 at the grooves 178*b*, 182*b* is greater than the width of the constricted portions 180*b*, 184*b*, and the convexities 178*d*, 182*d* on the arms 178*c*, 182*c* are snapped into the respective holes 180, 188. As a result, the bearing bushings 178, 182 are prevented from being removed upwardly from the recesses 180, 184 unless the convexities 178*d*, 182*d* are released from the respective holes 186, 188, and the bearing bushings 178, 182 are turned back by about 90°.

The document withdrawal roller 158 and the white roller 162 are therefore stably retained rotatably by the support plates 174*c*, 174*d*. The document withdrawal roller 158 and the white roller 162 can easily be detached from the lower document guide 174 by releasing the convexities 178*d*, 182*d* from the respective holes 186, 188, turning back the bearing bushings 178, 182 by about 90°, and pulling the rollers 158, 162 upwardly.

<DOCUMENT SEPARATING UNIT 56>

The document separating unit 156 will be described in detail below with reference to FIGS. 36, 40, and 41.

As shown in FIG. 36, the document separating unit 156 generally comprises a unit body 190 housed in the first cavity 174*b* of the lower document guide 174, and a leaf spring and a frictional member 196 that are fastened together to an upper surface of the unit body 190 by screws 192. The document separating unit 156 also has an upstanding resilient flap 190*a* integrally joined to a front end of the unit body 190. The resilient flap 190*a* has, on its front surface, a plurality of laterally spaced front locking bosses 190*b* projecting forwardly for engagement in a front locking groove 174*f* that is defined in the lower document guide 174. The resilient flap 190*a* also has, on its rear surface, a rear locking boss 190*c* projecting rearwardly for engagement in a rear locking groove 174*g* that is also defined in the lower document guide 174.

When the document separating unit 156 is placed in the first cavity 174*b* of the lower document guide 174, the front locking bosses 190*b* and the rear locking boss 190*c* are fitted respectively in the front locking groove 174*f* and the rear locking groove 174*g*. Since the unit body 190 is thus locked in the first cavity 174*b*, the document separating unit 156 is reliably and stably housed in the lower document guide 174. Particularly, inasmuch as the front locking bosses 190*b* are normally urged forwardly by the resiliency of the resilient flap 190*a*, the front locking bosses 190*b* are resiliently held in the front locking groove 174*f*, thereby keeping the unit body 190 securely fitted in the first cavity 174*b*. As described in detail later on, when the document separating unit 156 is to be removed for maintenance or the like, the resilient flap 190*a* is pushed back against its resiliency until the front locking bosses 190*b* are released out of the first locking groove 174*f*. Upon disengagement of the front locking bosses 190*b* from the first locking groove 174*f*, the document separating unit 156 can easily be detached from the lower document guide 174.

The leaf spring 194 is of a unitary structure made out of a metallic springy material. As illustrated in FIGS. 40 and 41, the leaf spring 194 includes a leaf spring body 194*a* that has a substantially L-shaped cross section, a pair of laterally spaced upstanding spring members 194*b*, 194*c* extending integrally from respective opposite sides of a vertical portion of the leaf spring body 194*a*, and a pair of laterally spaced support spring members 194*d*, 194*e* extending forwardly from the respective upper ends of the upstanding spring members 194*b*, 194*c*. The support spring members 194*d*, 194*e* are bent with respect to the upstanding spring members 194*b*, 194*c* at such an angle that when the unit body 190 is housed and locked in the first cavity 174*b* of the lower document guide 174, the support spring members 194*d*, 194*e* are inclined 15° clockwise with respect to the reference line X, as shown in FIG. 36. When the document separating unit 156 is accommodated in the lower document guide 174, the tip end portions of the support spring members 194*d*, 194*e* are held in contact with the document withdrawal roller 158.

As shown in FIG. 36, the document feed path 154 includes a first section sandwiched between the bent portion 176*c* of the upper document guide 176 and the guide body 174*a* of the lower document guide 174, and a second section sandwiched between the bent portion 176*c* of the upper document guide 176 and the support spring members 194*d*, 194*e* with, the first section being positioned immediately upstream of the second section. The first section of the document feed path 154 has a lower document support surface that lies more horizontally than the lower document support surface of the first section. Therefore, the document feed path 154 changes from a wedge shape of smaller angle in the first section into a wedge shape of larger angle in the first section along the direction in which a document is fed through the document feed path 154. Consequently, when a number of stacked documents are simultaneously fed from the first section into the first section, they are vertically squeezed by the first section.

When a predetermined number of stacked documents, i.e., three or four stacked documents, abut against the support spring members 194*d*, 194*e* and are stopped thereon, the support spring members 194*d*, 194*e* are angularly displaced downwardly due to the load or the stiffness of the documents placed thereon. That is, the support spring members 194*d*, 194*e* have such a modulus of elasticity that they are resiliently turned downwardly out of contact with the document withdrawal roller 158 when a number of stacked documents are placed on the support spring members 194*d*, 194*e*. When a smaller number of stacked documents abut against the support spring members 194*d*, 194*e* and are stopped thereon, however, the support spring members 194*d*, 194*e* are not angularly displaced downwardly by the load of the documents placed thereon, and hence remain in resilient contact with the document withdrawal roller 158. When a larger number of stacked documents, e.g., five or more stacked documents, abut against the support spring members 194*d*, 194*e* and are stopped thereon, their load is large enough to angularly displace the support spring members 194*d*, 194*e* downwardly out of contact with the document withdrawal roller 158.

As shown in FIG. 36, the document feed path 154 also has a third section sandwiched between the guide body 176*b* of the upper document guide 176 and the support spring members 194*d*, 194*e*, the third section being positioned immediately downstream of the first section. In the third section, the guide body 176*b* and the support spring members 194*d*, 194*e* extend substantially parallel to each other. When a number of stacked documents are squeezed by the first section of the document feed path 154, the uppermost one of the documents is supplied through the third section of the document feed path 154 toward the document separator where the document separating unit 156 and the document withdrawal roller 158 contact each other.

Figure 40:
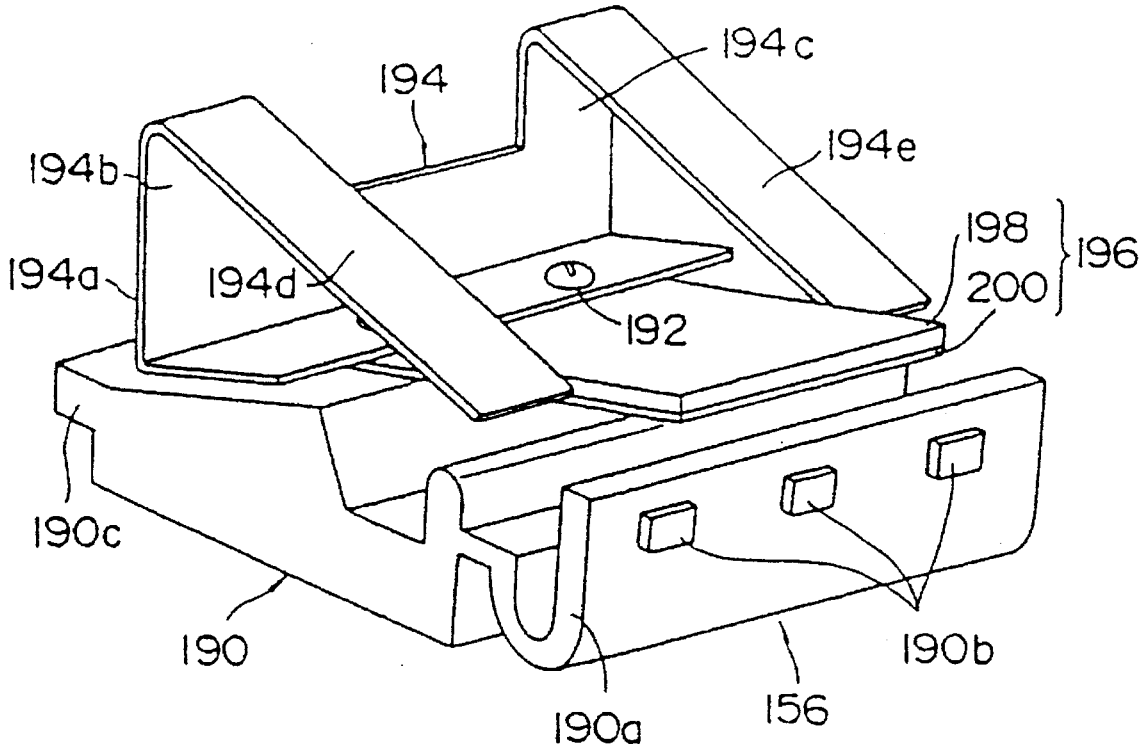
FIG. 40 is a perspective view of a document separating unit of the image reading mechanism shown in FIG. 31.
Figure 41:
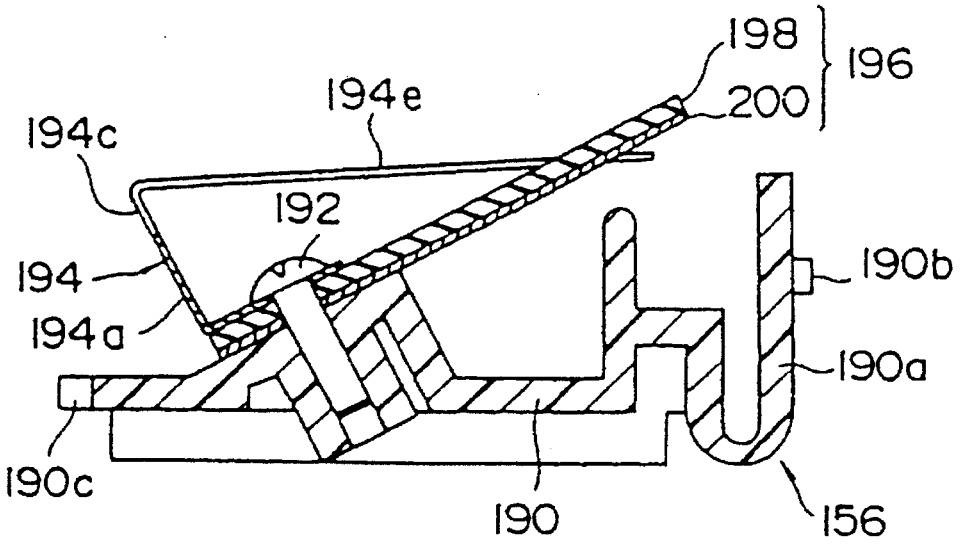
FIG. 41 is a cross-sectional view of the document separating unit shown in FIG. 40.

As illustrated in FIGS. 40 and 41, the frictional member 196 has one end, i.e., left hand end as shown, gripped and fastened between the lower surface of the leaf spring body 194*a* and the upper surface of the unit body 190. The frictional member 196, as it is fixed in position, extends forwardly in a cantilevered fashion. The frictional member 196 comprises a rubber leaf spring 198 made of synthetic rubber, having a predetermined coefficient of friction and a metallic leaf spring 200 made of a metallic material, and attached to the lower surface of the rubber leaf spring 198. The rubber leaf spring 198 alone cannot keep itself supported in the cantilevered manner although it has a desired frictional upper surface, and the metallic leaf spring 200 alone does not have a desired coefficient friction large enough to separate documents although it can keep itself cantilevered.

In this embodiment, the upper rubber leaf spring 198 and the lower metallic leaf spring 200, that are functionally different from each other, as described above, are combined into the frictional member 196. The frictional member 196 thus has a desired coefficient of friction on its upper surface and stably extends forwardly in the cantilevered manner. The coefficient of friction between the rubber leaf spring 198 and a document held in contact therewith is larger than the coefficient of friction between a document and the support spring members 194*d*, 194*e*, and smaller than the coefficient of friction between a document and the document withdrawal roller 158.

The lower end of the document withdrawal roller 158 is held in contact with, and displaces downwardly by a certain distance, the document separating unit 156, i.e., the upper surface of the rubber leaf spring 198 and the upper surface of the support spring members 194*d*, 194*e* of the leaf spring 194. As shown in FIG. 36, the frictional member 196 is attached to the unit body 190 in such a position and displaced downwardly by the document withdrawal roller 158 by such a distance that the frictional member 196 is inclined 5° counterclockwise with respect to the reference line X. The angle of 15°, between the support spring members 194*d*, 194*e* and the reference line X, is achieved with the support spring members 194*d*, 194*e* being displaced downwardly by the document withdrawal roller 158.

<DOCUMENT SEPARATION BY DOCUMENT SEPARATING UNIT 156 AND DOCUMENT WITHDRAWAL ROLLER 158>

Withdrawal of documents from the document tray 40 and separation of the documents will be described below with reference to FIGS. 42 through 44.

{WITHDRAWAL OF SINGLE DOCUMENT}

Figure 42:
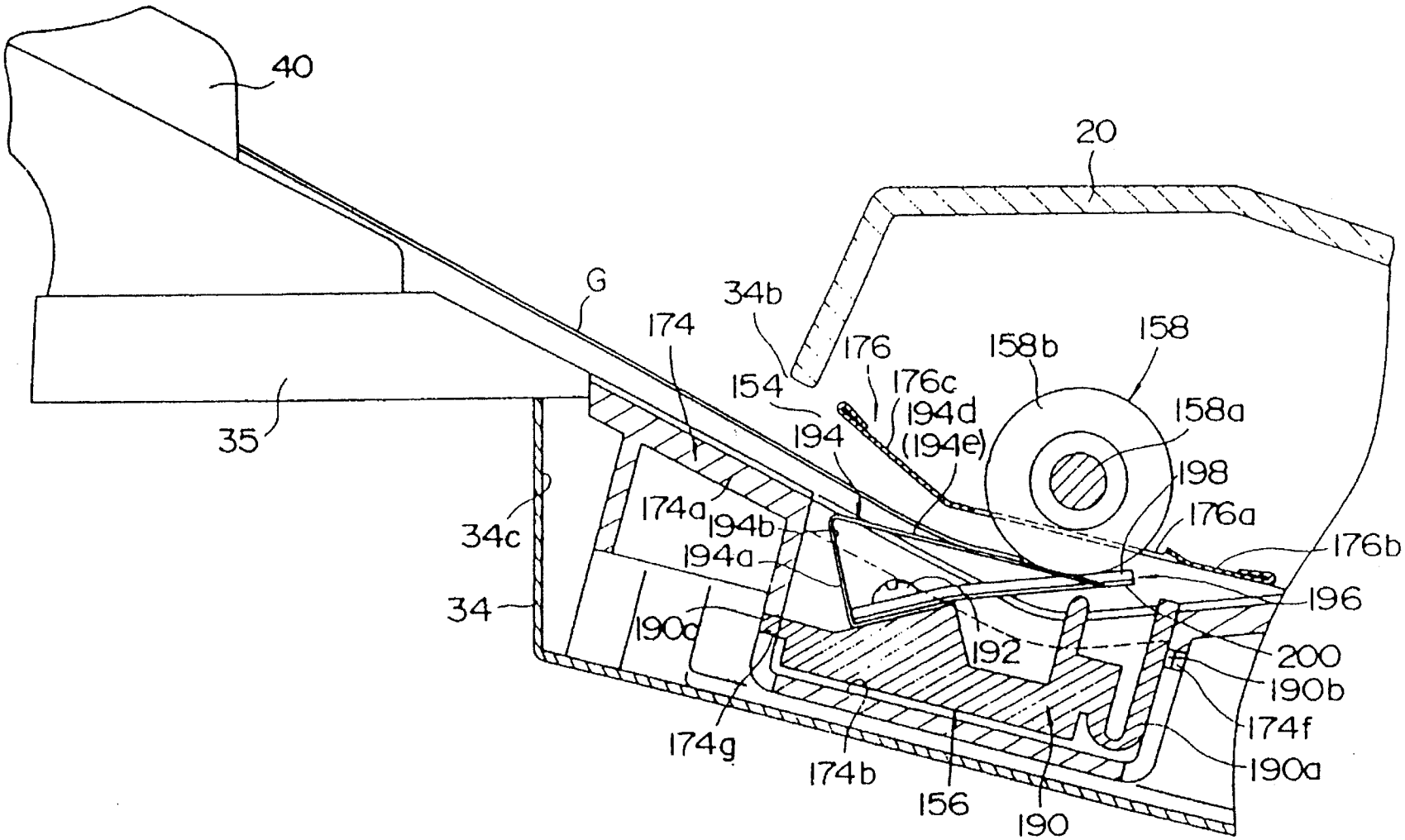
FIG. 42 is a fragmentary side elevational view, partly in cross section, showing the manner in which a single document is drawn from a document tray by the document withdrawal roller and the document separating unit.

FIG. 42 shows the withdrawal of a single document from the document tray 40.

As shown in FIG. 42, when a document, denoted at G, is placed on the document tray 40 with an image to be read being on the upper surface of the document G, the document G is fed by gravity down the inclined document support base 54 of the document tray 40, and introduced into the document feed path 154 through the document inlet slot 34*b* defined between the control panel 20 and the upper housing 34. The introduced document G introduced into the document feed path 154 turns on the document detecting switch 166, whereupon the image reading mechanism 18 is readied for reading the image on the document G. When the image reading mechanism 18 is readied, the document feed motor 140 is energized in readiness for driving the document withdrawal roller 158 and the white roller 162 and the image reader 160 is also energized in readiness for reading the image.

The gravity-induced introduction of the document G into the document feed path 154 will be described in greater detail below. First, the document G that has entered through the document inlet slot 34*b* is first introduced into the first section of the document feed path 154. The lower surface of the first section of the document feed path 154 is inclined 28° with respect to the reference line X as shown in FIG. 36. The document G, as it is fed by gravity forwardly down the inclined lower surface of the first section of the document feed path 154, is smoothly and reliably introduced into the second section of the document feed path 154.

The lower surface of the second section, i.e., the upper surface of the support spring members 194*d*, 194*e*, is inclined 15° with respect to the reference line X as shown in FIG. 36. The document G, which has been fed from the first section, is now fed by gravity down the inclined lower surface of the second section, and smoothly and reliably introduced into the third section of the document feed path 154. The document G is fed down the upper surface of the support spring members 194*d*, 194*e*, through the third section of the document feed path 154 toward the document separator. The document G, that has been fed successively through the first, second, and third sections of the document feed path 154, is now stopped with its leading end reaching the document separator, i.e., entering the region where the document withdrawal roller 158 is in abutment against the support spring members 194*d*, 194*e*, as shown in FIG. 42.

When the document withdrawal roller 158 is then rotated counterclockwise in FIG. 42, the document G is moved to the left in FIG. 42 and brought into a region between the document withdrawal roller 158 and the frictional member 196. Since the coefficient of friction between the document withdrawal roller 158 and the document G is greater than the coefficient of friction between the rubber leaf spring 198 and the document G, the force applied by the document withdrawal roller 158 to feed the document G overcomes the force applied by the frictional member 196 to stop the document G. As a result, the document G passes through the document withdrawal roller 158 and the frictional member 196, and smoothly and reliably enters a fourth section of the document feed path 154 which is defined downstream of the third section, i.e., between the lower surface of the guide body 176*b* of the upper document guide 176 and the upper surface of the lower document guide 174. Thereafter, the document G is fed through the fourth section toward a region between the image reader 160 and the white roller 162.

The withdrawal of the single document G from the document tray 40 is now completed.

While the document G is passing through the fourth section of the document feed path 154 upon rotation of the document withdrawal roller 158, the document G turns on the second document detecting switch 168. Upon elapse of a predetermined period of time, which is required for the leading end of the document G to arrive at the image reader 160, after the second document detecting switch 168 is turned on, the image reader 160 starts reading the image on the document G.

After the document G has passed through the fourth section of the document feed path 154, the second document detecting switch 168 is turned off. The document feed motor 140 remains energized as long as the first document detecting switch 166 is turned on. The document feed motor 140 is de-energized upon elapse of a sufficient period of time for the document G to be fully discharged out of the enclosure 28 through the document discharge slot 32*b*, after both the first and second document detecting switches 166, 168 are turned off. In the event that the third document detecting switch 170 remains still turned on after elapse of the above sufficient period of time, the document G is judged as being jammed in the document feed path 154, and a predetermined alarm signal is issued.

{WITHDRAWAL AND SEPARATION OF FEWER DOCUMENTS THAN PREDETERMINED NUMBER OF DOCUMENTS}

Figure 43:
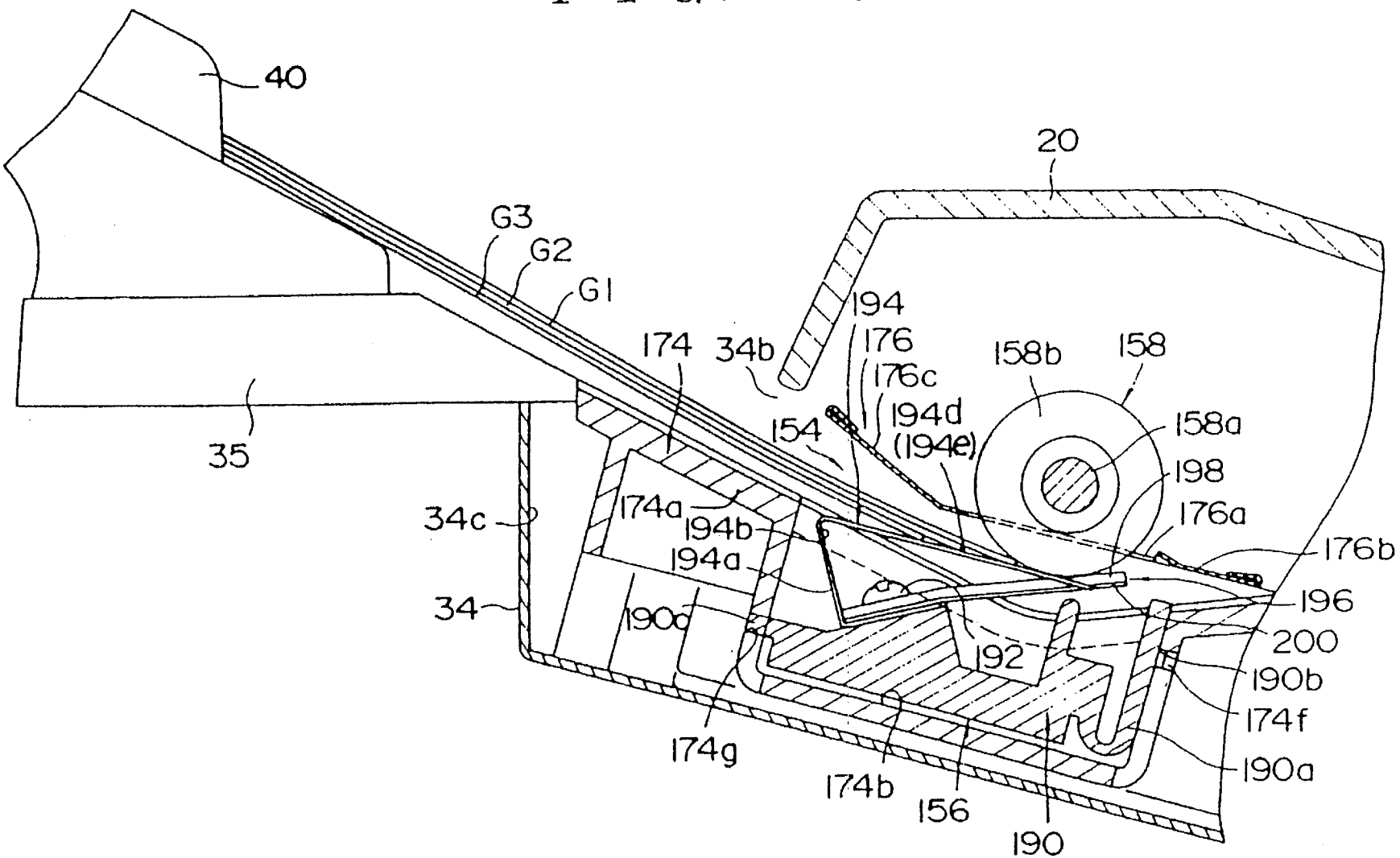
FIG. 43 is a fragmentary side elevational view, partly in cross section, showing the manner in which a plurality of documents, fewer than a predetermined number of documents, are drawn and separated by the document withdrawal roller and the document separating unit.

FIG. 43 shows the withdrawal and separation of a number of documents fewer than a predetermined number of documents.

As shown in FIG. 43, when a number of documents fewer than a predetermined number of documents, e.g., three stacked documents, i.e., first, second, and third documents G1, G2, G3, are placed on the document tray 40 with images to be read being on the upper surfaces of the documents whose page numbers are smaller upwardly, the documents G1, G2, G3 are fed together by gravity down the inclined document support base 54 of the document tray 40 toward the document separator. The first document G1, which is the uppermost one of all documents, has its leading end brought to the document separator, i.e., the region where the document withdrawal roller 158 and the support spring members 194*d*, 194*e* contact each other, due to the inclined document feed path 154.

The second document G2, which follows the uppermost first document G1, is limited by a wedge-shaped space defined between the first document G1 and the support spring members 194*d*, 194*e*, and stopped before the leading end of the second document G2 reaches the region where the document withdrawal roller 158 and the support spring members 194*d*, 194*e* contact each other, as shown in FIG. 43. Similarly, the third document G3, which follows the second document G2, is limited by a wedge-shaped space defined between the second document G2 and the support spring members 194*d*, 194*e*, and stopped before the leading end of the third document G3 reaches the region where the document withdrawal roller 158 and the support spring members 194*d*, 194*e* contact each other, as shown FIG. 43.

In this manner, the first document G1 is readied for being fed by the document withdrawal roller 158, and the second and third documents G2, G3 are held in a standby condition successively behind the first document G1.

When the document withdrawal roller 158 is then rotated counterclockwise in FIG. 43, only the first document G1, whose leading end has already been in the region where the document withdrawal roller 158 and the support spring members 194*d*, 194*e* contact each other, is fed forwardly. At this time, the rotational force of the document withdrawal roller 158 does not act on the second document G2, but only a frictional force produced as the first document G1 is fed is imposed on the second document G2. As a consequence, the second document G2 beneath the first document G1 is dragged forwardly by the frictional engagement with the first document G1. When the leading end of the second document G2 engages the surface of the frictional member 196, the frictional force developed between the second document G2 and the frictional member 196 is greater than the frictional force developed between the first and second documents G1, G2. Therefore, the second document G2 is stopped upon engagement with the frictional member 196, i.e., is separated from the first document G1. After the trailing end of the first document G1 leaves the document withdrawal roller 158, the second document G2 is brought into readiness for being fed forwardly in response to rotation of the document withdrawal roller 158.

When at least one document is readied to be fed by the document withdrawal roller 158, the first document detecting switch 166 is turned on. Insofar as the first document detecting switch 166 is turned on, the document feed motor 140 is continuously energized. Then, only after the trailing end of the first document G1 leaves the document withdrawal roller 158, the second document G2 is brought into frictional engagement with the document withdrawal roller 158. The second document G2, which follows the first document G1, can thus be fed by the document withdrawal roller 158 with a slight delay from the first document G1. There is a small gap existing between the first document G1 that is fed at first and the second document G2 that is fed behind the first document G1. Therefore, the second document detecting switch 168 is turned off when the trailing end of the first document G1 passes it, and immediately after the second document detecting switch 168 is turned off, it is turned on again by the leading end of the second document G2. Signals produced when the second document detecting switch 168 is alternately turned on and off are effective in distinguishing successively fed documents in an image reading process.

When the second document G2 is fed, the third document G3, beneath the second document G2, is dragged in the forward direction through the document feed path 154 by the frictional engagement with the second document G2. When the leading end of the third document G3 engages the surface of the frictional member 196, the frictional force developed between the third document G3 and the frictional member 196 is greater than the frictional force developed between the second and third documents G2, G3. Therefore, the third document G3 is stopped upon engagement with the frictional member 196, i.e., is separated from the second document G2. The separation of the third document G3 from the second document G2, and the withdrawal of the third document G3 subsequently to the second document are the same as those of the first and second documents G1, G2 as described above, and will not be described below.

{WITHDRAWAL AND SEPARATION OF MORE DOCUMENTS THAN PREDETERMINED NUMBER OF DOCUMENTS}

Figure 44:
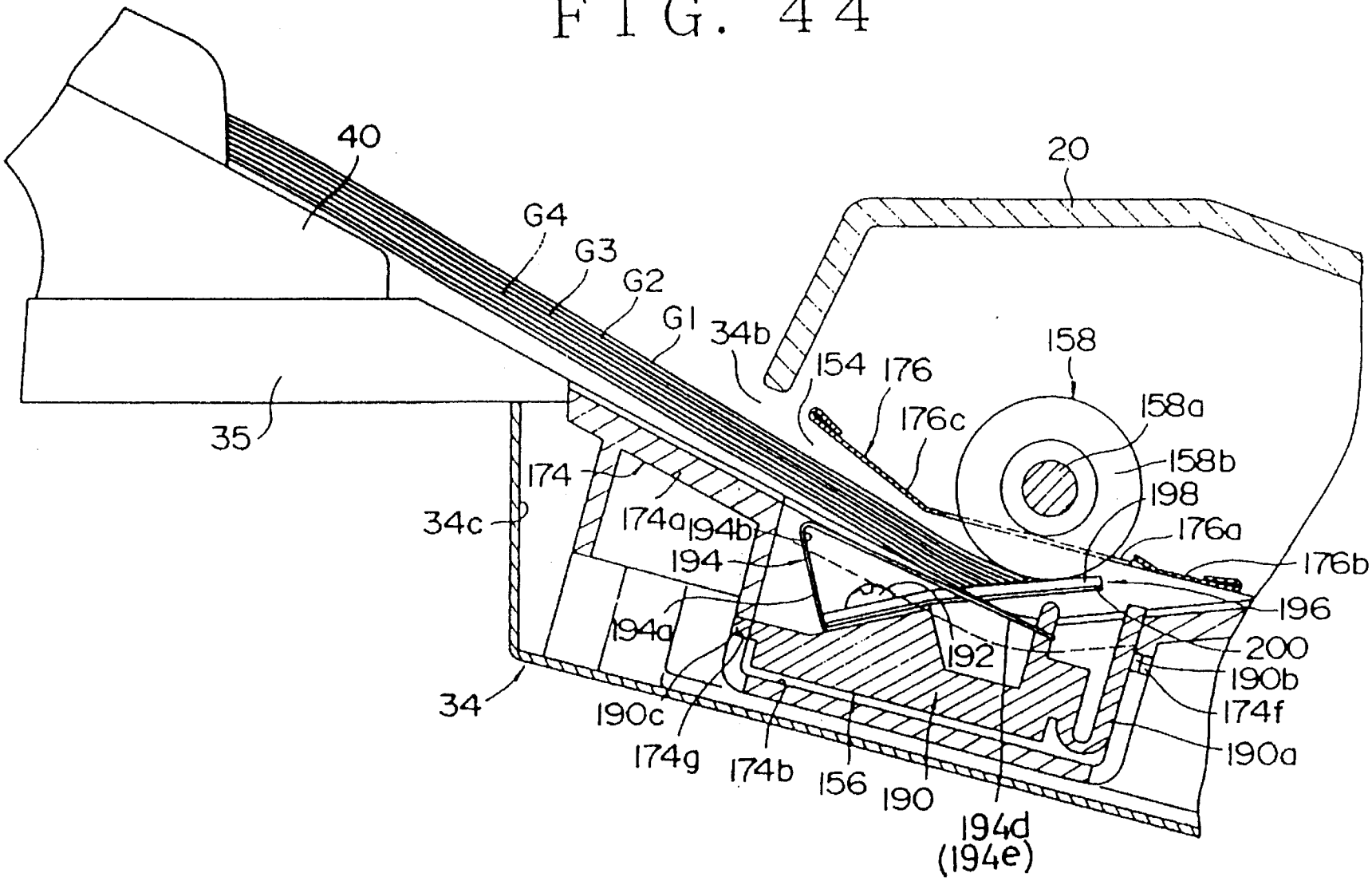
FIG. 44 is a fragmentary side elevational view, partly in cross section, showing the manner in which a plurality of documents, more than a predetermined number of documents, are drawn and separated by the document withdrawal roller and the document separating unit.

FIG. 44 shows the withdrawal and separation of a number of documents more than a predetermined number of documents.

As shown in FIG. 44, when a number of documents more than a predetermined number of documents, e.g., five or more stacked documents G1, G2, G3, G4, are placed on the document tray 40 with images to be read being on the upper surfaces of the documents whose page numbers are smaller upwardly, the documents G1, G2, G3, G4, are fed together by gravity down the inclined document support base 54 of the document tray 40 toward the document separator. The first document G1, which is the uppermost one of all documents, has its leading end brought to the document separator, i.e., the region where the document withdrawal roller 158 and the support spring members 194*d*, 194*e* contact each other, due to the inclined document feed path 154.

The second and following documents G2, G3, G4, underneath the first document G1, are also positioned on the support spring members 194*d*, 194*e*, which are pushed downwardly owing to the combined stiffness of the documents G1, G2, G3, G4. These documents G1, G2, G3, G4, are now stopped with their leading ends abutting against the upper surface of the rubber leaf spring 198 of the frictional member 196, as shown in FIG. 44. The uppermost first document G1 enters the region where the document withdrawal roller 158 and the frictional member 196 contact each other.

The second document G2, which follows the uppermost first document G1, is limited by a wedge-shaped space defined between the first document G1 and the frictional member 196, and stopped before the leading end of the second document G2 reaches the region where the document withdrawal roller 158 and the frictional member 196 contact each other. Similarly, the third document G3, which follows the second document G2, is limited by a wedge-shaped space defined between the second document G2 and the frictional member 196 contact each other, and stopped before the leading end of the third document G3 reaches the region where the document withdrawal roller 158 and the frictional member 196.

In this manner, the first document G1 is readied for being fed by the document withdrawal roller 158, and the second, third, and following documents G2, G3, G4, are held in a standby condition successively behind the first document G1.

When the document withdrawal roller 158 is then rotated counterclockwise, in FIG. 44, only the first document G1, whose leading end has been in the region where the document withdrawal roller 158 and the frictional member 196 contact each other, is fed forwardly because the frictional force developed between the first document G1 and the document withdrawal roller 158 is stronger than the frictional force developed between the first document G1 and the frictional member 196. At this time, the rotational force of the document withdrawal roller 158 does not act on the second document G2, but only a frictional force produced as the first document G1 is fed is imposed on the second document G2. As a consequence, the second document G2, beneath the first document G1, stays still and is not fed forwardly with the first document G1. Therefore, the second document G2 is separated from the first document G1. After the trailing end of the first document G1 leaves the document withdrawal roller 158, the second document G2 is brought into readiness for being fed forwardly in response to rotation of the document withdrawal roller 158.

After the first document G1 has been fed forwardly, the combined stiffness of the remaining documents G2, G3, G4, is reduced by the stiffness of the first document G1, and the support spring members 194*d*, 194*e* are slightly lifted under their own resilient forces. As a result, the uppermost second document G2 is now gripped between the document withdrawal roller 158 and the frictional member 196. In response to rotation of the document withdrawal roller 158, the second document G2 is then fed forwardly with a slight delay from the first document G1.

Likewise, the third document G3, underneath the second document, is fed forwardly in the same manner as the second document G2 is fed. When the number of documents that remain to be fed by the document withdrawal roller 158 becomes smaller than the above predetermined number of documents, the remaining documents are successively fed forwardly upon rotation of the document withdrawal roller 158 in substantially the same fashion as described above with reference to FIG. 43.

<ASSEMBLING PROCESS FOR DOCUMENT SEPARATOR>

A process of installing the document separating unit 156, the document withdrawal roller 158, and the white roller 162 onto the lower document guide 174 will be described in detail below with reference to FIGS. 45 through 53.

{ATTACHMENT OF DOCUMENT SEPARATING UNIT 156}

First, attachment of the document separating unit 156 to the lower document guide 174 will be described below with reference to FIGS. 45 through 49.

Figure 45:
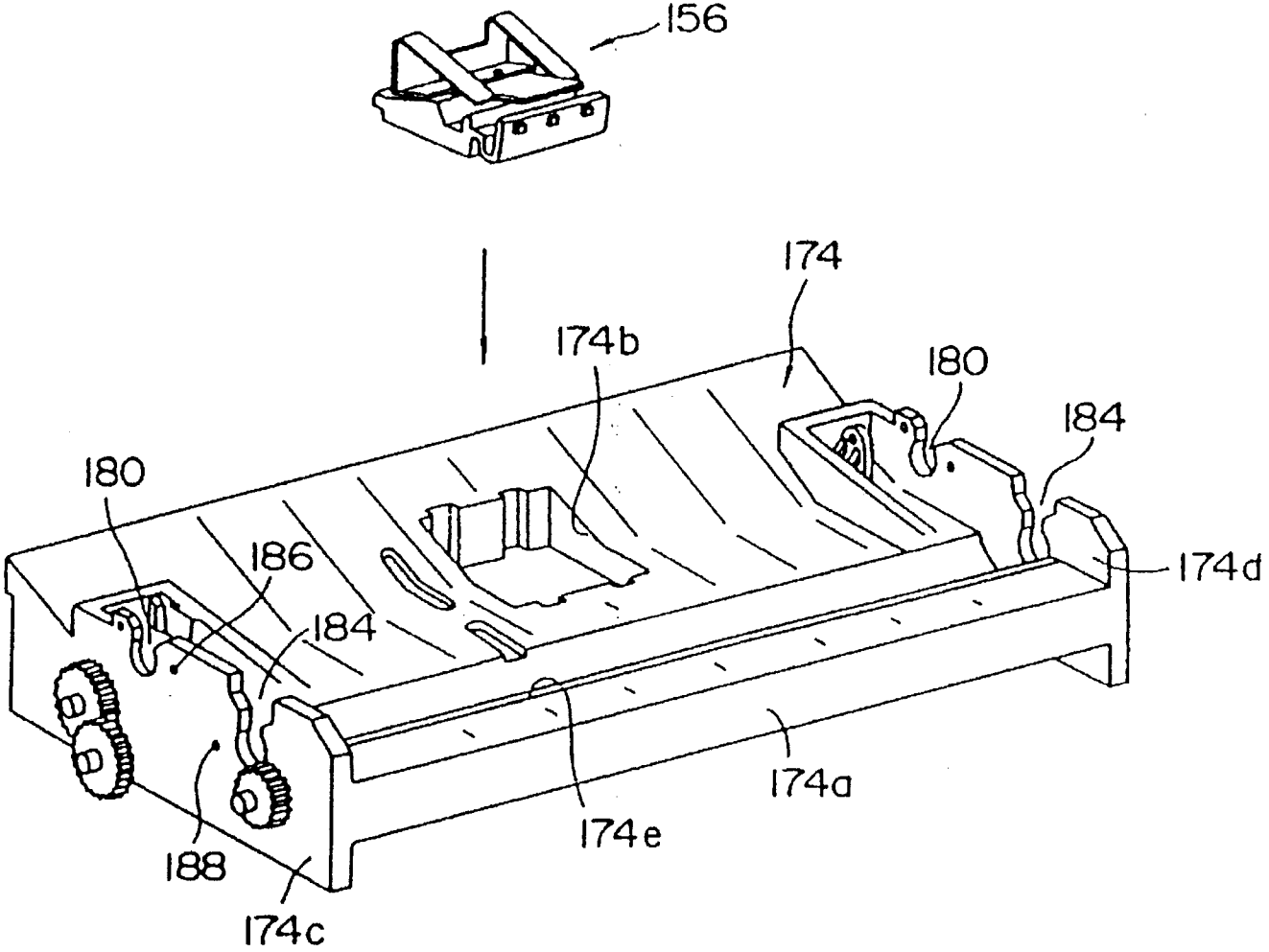
FIG. 45 is an exploded perspective view of the lower document guide and the document separating unit that is about to be installed on the lower document guide.
Figure 46:
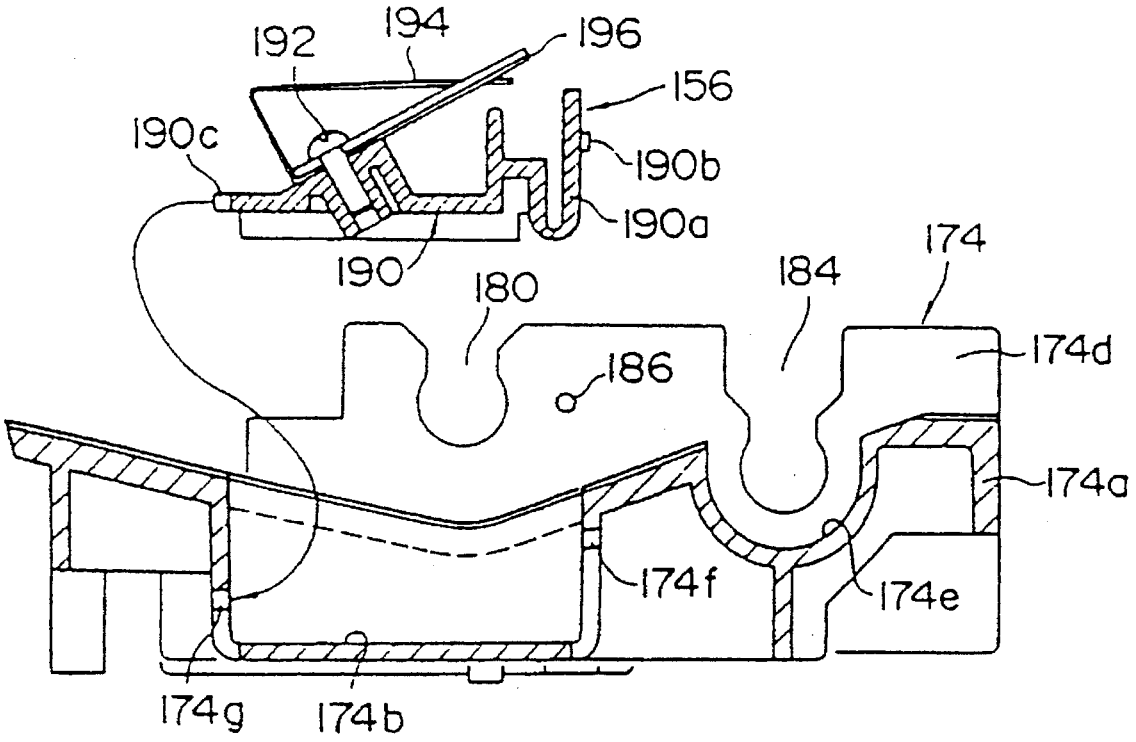
FIG. 46 is a side elevational view, partly in cross section, of the lower document guide and the document separating unit that is about to be installed on the lower document guide.
Figure 47:
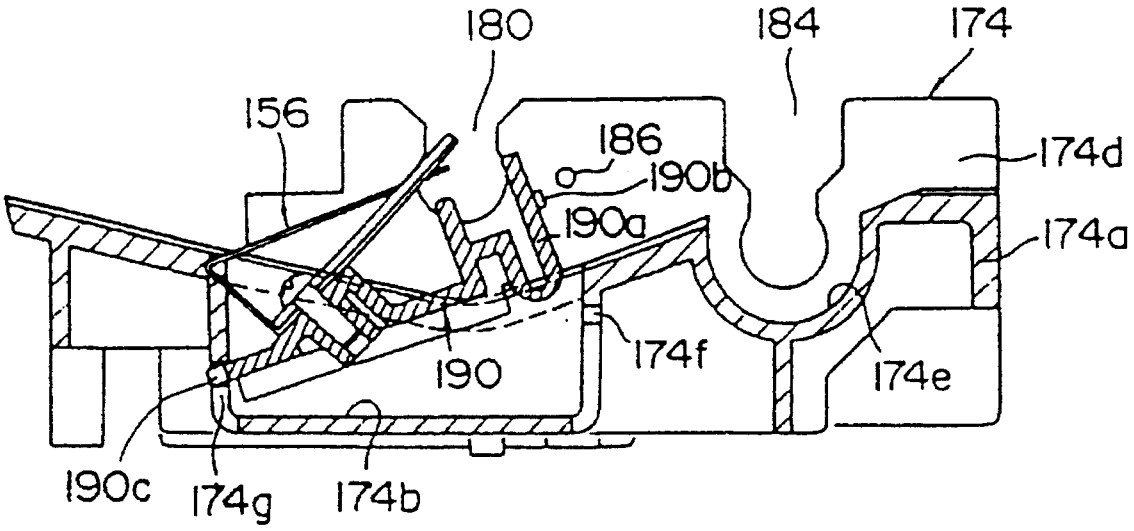
FIG. 47 is a side elevational view, partly in cross section, of the lower document guide and the document separating unit that is in the process of being installed on the lower document guide, with a rear locking boss fitted in rear locking groove.

As shown in FIG. 45, the document separating unit 156 is installed on the lower document guide 174 before the document withdrawal roller 158, the white roller 162, and the upper document guide 176 are installed thereon. When the document separating unit 156 is to be housed in the first cavity 174*b* of the lower document guide 174, the rear end of the unit body 190 of the document separating unit 156 is manually inserted into the first cavity 174*b* as shown in FIG. 46, and then the rear locking boss 190*c* of the unit body 190 is manually fitted into the rear locking groove 174*g* as shown in FIG. 47.

Figure 48:
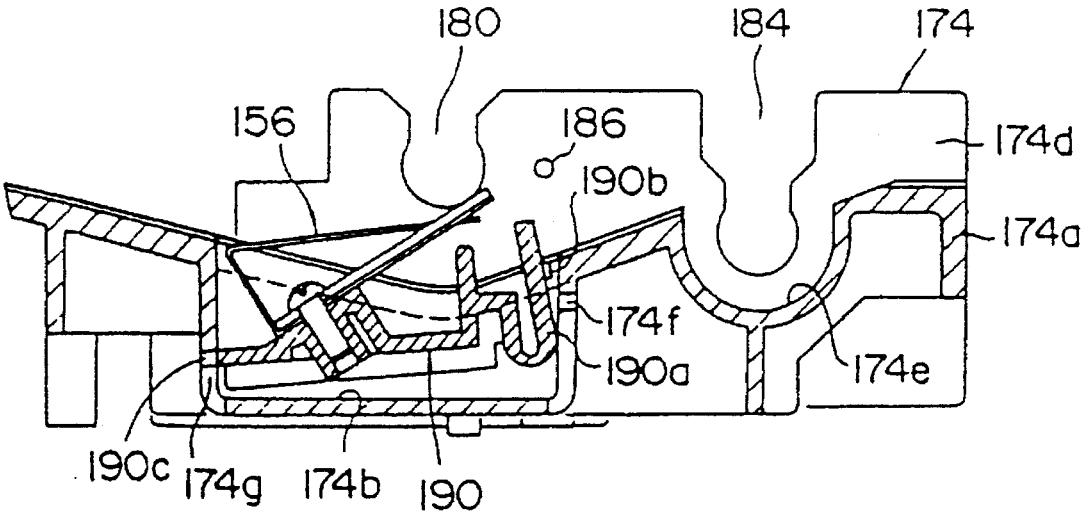
FIG. 48 is a side elevational view, partly in cross section, of the lower document guide and the document separating unit that is in the process of being installed on the lower document guide, with a resilient flap displaced rearwardly.

The front end of the unit body 190 is thereafter manually depressed into the first cavity 174*b* while the resilient flap 190*a* on the front end of the unit body 190 is being displaced rearwardly against its own resiliency, as shown in FIG. 48. Continued manual depression of the front end of the unit body 190 fully inserts the unit body 190 into the first cavity 174*b*. With the unit body 190 fully placed in the first cavity 174*b*, the front locking bosses 190*b* on the front end surface of the resilient flap 190*a* are snapped into the front locking groove 174*f*. Since the rear locking boss 190*c* is fitted in the rear locking groove 174*g* and the front locking bosses 190*b* are fitted in the front locking groove 174*f*, the document separating unit 156 is locked in the first cavity 174*b* and remains stably housed therein.

Figure 49:
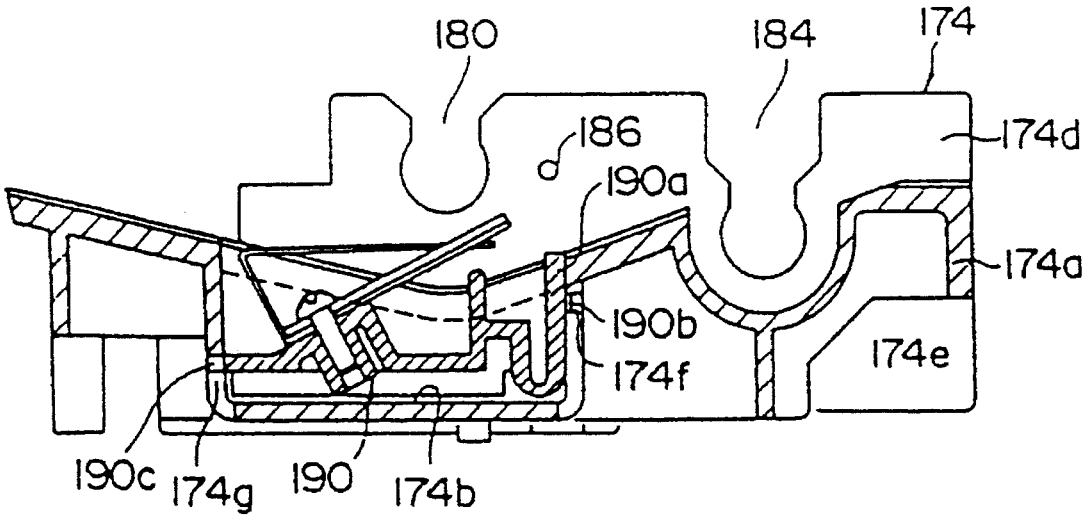
FIG. 49 is a side elevational view, partly in cross section, of the lower document guide and the document separating unit that has been installed on the lower document guide.

The document separating unit 156 may be removed from the lower document guide 174 in a process which is a reversal of the above installing process. More specifically, when the document separating unit 156 is housed, as shown in FIG. 49, the upper end of the resilient flap 190*a* is pushed back with a fingernail or a screwdriver tip until the front locking bosses 190*b* are released from the front locking groove 174*f*, and then pulled upwardly moving the front end of the unit body 190 upwardly out of the first cavity 174*b*, as shown in FIG. 47. The front end of the unit body 190 is thereafter pulled forwardly and upwardly until the document separating unit 156 is entirely detached from the lower document guide 174, as shown in FIG. 46.

{ATTACHMENT OF DOCUMENT WITHDRAWAL ROLLER 158 AND WHITE ROLLER 162}

Attachment of the document withdrawal roller 158 and the white roller 162 to the lower document guide 174 will be described below with reference to FIGS. 50 through 53.

After the document separating unit 156 is placed and locked in the first cavity 174*b* of the lower document guide 174, the upper document guide 176 (not shown in FIG. 50) is attached to the upper surface of the lower document guide 174 by the snap pins 175. The upper document guide 176 can easily be detached from the lower document guide 174 by pulling out the snap pins 175.

The document withdrawal roller 158 is attached as follows: With the arms 178*c* directed upwardly, as shown in FIG. 50, the grooves 178*b* of the first bearing bushings 178, on the respective opposite ends of the shaft 158*a* of the document withdrawal roller 158, are forced to fit downwardly into the respective first recesses 180 defined in the support plates 174*c*, 174*d* of the lower document guide 174. More specifically, the grooves 178*b* are first loosely placed in the respective tapered portions 180*a* of the first recesses 180, and then guided thereby into the upper ends of the respective constricted portions 180*b*. The first bearing bushings 178 are continuously pushed downwardly. At this time, the parallel flat surfaces 178*e*1, 178*e*2 are oriented to pass along the constricted portions 180*b*. Even if the parallel flat surfaces 178*e*1, 178*e*2 are not oriented to pass along the constricted portions 180*b*, the grooves 178*b*, as they are lowered forcibly spread the constricted portions 180*b*until the grooves 178*b* are snapped into the respective retaining portions 180*c*. The first bearing bushings 178 are now rotatably supported on the support plates 174*c*, 174*d*.

With the document withdrawal roller 158 being rotatably supported on the support plates 174*c*, 174*d* through the first bearing bushings 178, as shown in FIG. 36, the friction roller element 158*b* of the document withdrawal roller 158 has a lower portion projecting downwardly through the hole 176*a* of the upper document guide 176 into contact with the support spring members 194*c*, 194*d* of the leaf spring 194 of the document separating unit 156 and also with the rubber leaf spring 198 of the frictional member 196.

The white roller 162 is attached as follows: With the arms 182*c* directed upwardly as shown in FIG. 50, the grooves 182*b* of the second bearing bushings 182 on the respective opposite ends of the shaft 162*a* of the white roller 162 are forced to fit downwardly into the respective second recesses 184 defined in the support plates 174*c*, 174*d* of the lower document guide 174. More specifically, the grooves 182*b* are first loosely placed in the respective tapered portions 184*a* of the second recesses 184, and then guided thereby into the upper ends of the respective constricted portions 184*b*. The second bearing bushings 182 are continuously pushed downwardly. At this time, the parallel flat surfaces 182*e*1, 182*e*2 are oriented to pass along the constricted portions 184*b*. Even if the parallel flat surfaces 182*e*1, 182*e*2 are not oriented to pass along the constricted portions 184*b*, the grooves 182*b*, as they are lowered, forcibly spread the constricted portions 184*b* until the grooves 182*b* are snapped into the respective retaining portions 184*c*. The second bearing bushings 182 are now rotatably supported on the support plates 174*c*, 174*d*.

When the document withdrawal roller 158 and the white roller 162 are rotatably supported on the lower document guide 174, as shown in FIG. 50, the second driven gear 172*c*, coaxially fixed to one end (left hand end in FIG. 50) of the document withdrawal roller 158, are brought into mesh with the third idle gear 172*f*. The first driven gear 172*b*, coaxially fixed to one end (left hand end in FIG. 50) of the white roller 162, is brought into simultaneous mesh with the first and second idle gears 172*d*, 172*e*. Therefore, the gear train for transmitting the drive force from the document feed motor 140 to the first and second driven gears 172*b*, 172*c* is established as shown in FIG. 33.

With the white roller 162 being rotatably supported on the support plates 174*c*, 174*d* through the second bearing bushings 182, the roller element 162*b* of the white roller 162 is accommodated in the second cavity 174*e* of the lower document guide 174. When the control panel 20 is in the closed position, the white roller 162 is accurately positioned in a predetermined positional relation to the image reader 160 mounted on the lower surface of the control panel 20.

Subsequently, the arms 178*c* of the first bearing bushings 178 are turned about 90° clockwise (FIG. 53) until the convexities 178*d* on the arms 178*c* are snapped into the respective holes 186 of the support plates 174*c*, 174*d*. The first bearing bushings 178 are now fixedly attached to the support plates 174*c*, 174*d*, with the document withdrawal roller 158 being rotatably supported stably on the lower document guide 174.

Likewise, the arms 182*c* of the second bearing bushings 82 are turned about 90° counterclockwise (FIG. 53) until the convexities 182*d*, on the arms 182*c*, are snapped into the respective holes 188 of the support plates 174*c*, 174*d*. The second bearing bushings 182 are now fixedly attached to the support plates 174*c*, 174*d*, with the white roller 162 being rotatably supported stably on the lower document guide 174.

Figure 53:
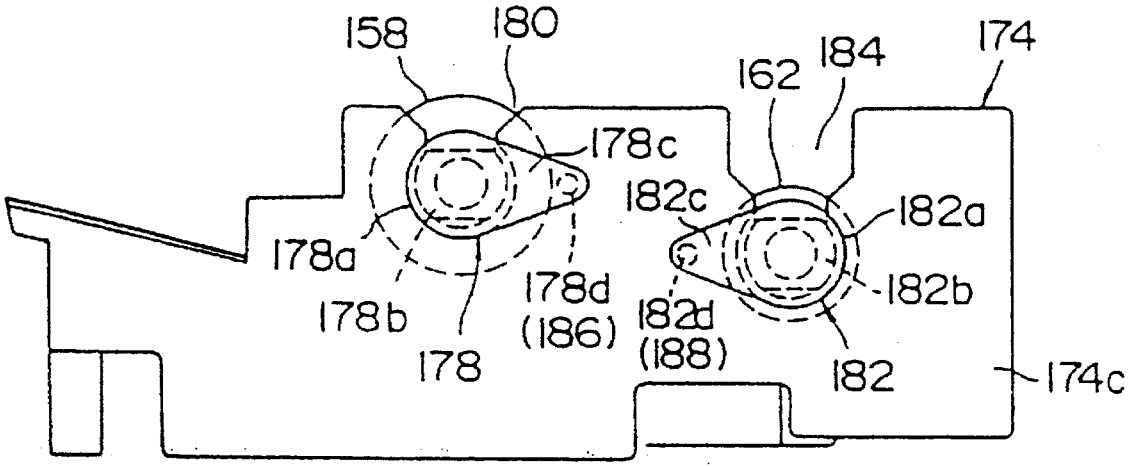
FIG. 53 is a side elevational view of the lower document guide, the document withdrawal roller, and the white roller that are installed and locked on the lower document guide.

The document withdrawal roller 158 and the white roller 162 may be removed from the lower document guide 174 in a process which is a reversal of the above installing procedure. More specifically, when the document withdrawal roller 158 and the white roller 162 are locked in place, as shown in FIG. 53, the distal ends of the arms 178*c*, 182*c* are displaced away from the side plates 174*c*, 174*d* with a fingernail or a screwdriver tip. Then the arms 178*c*, 182*c* are turned 90° counterclockwise and clockwise, respectively, to the position shown in FIG. 52. Thereafter, the first and second bearing bushings 178, 182 are lifted out of the recesses 180, 184 until the document withdrawal roller 158 and the white roller 162 are fully removed from the lower document guide 174, as shown in FIG. 51.

As described above, the document separator that is required to operate mechanically with high accuracy for separating documents one by one in the image reading mechanism 18 can be attached and detached highly easily in a simple process. Therefore, various replacements and adjustments can easily be carried out highly efficiently in periodic servicing operation for maintaining a desired document separating capability. For example, the document separating unit 158 may easily be replaced with a new one, the rubber leaf spring 198 may easily be replaced with a new one, and the angle of the support spring members 194*c*, 194*d* may easily be adjusted.

[IMAGE PRINTING MECHANISM 14]

The structure and operation of the image printing mechanism 14 will be described in detail below with reference to FIGS. 1, 7, and 54 through 75.

(OVERALL STRUCTURE OF IMAGE PRINTING MECHANISM 14)

As shown in FIG. 1, the image printing mechanism 14 serves to print an image on a sheet P fed from the sheet cassette 36 based on image information that has been read from a document by the image reading mechanism 18, or image information that has been transmitted over a communication line, or a telephone line in this embodiment.

Figure 54:
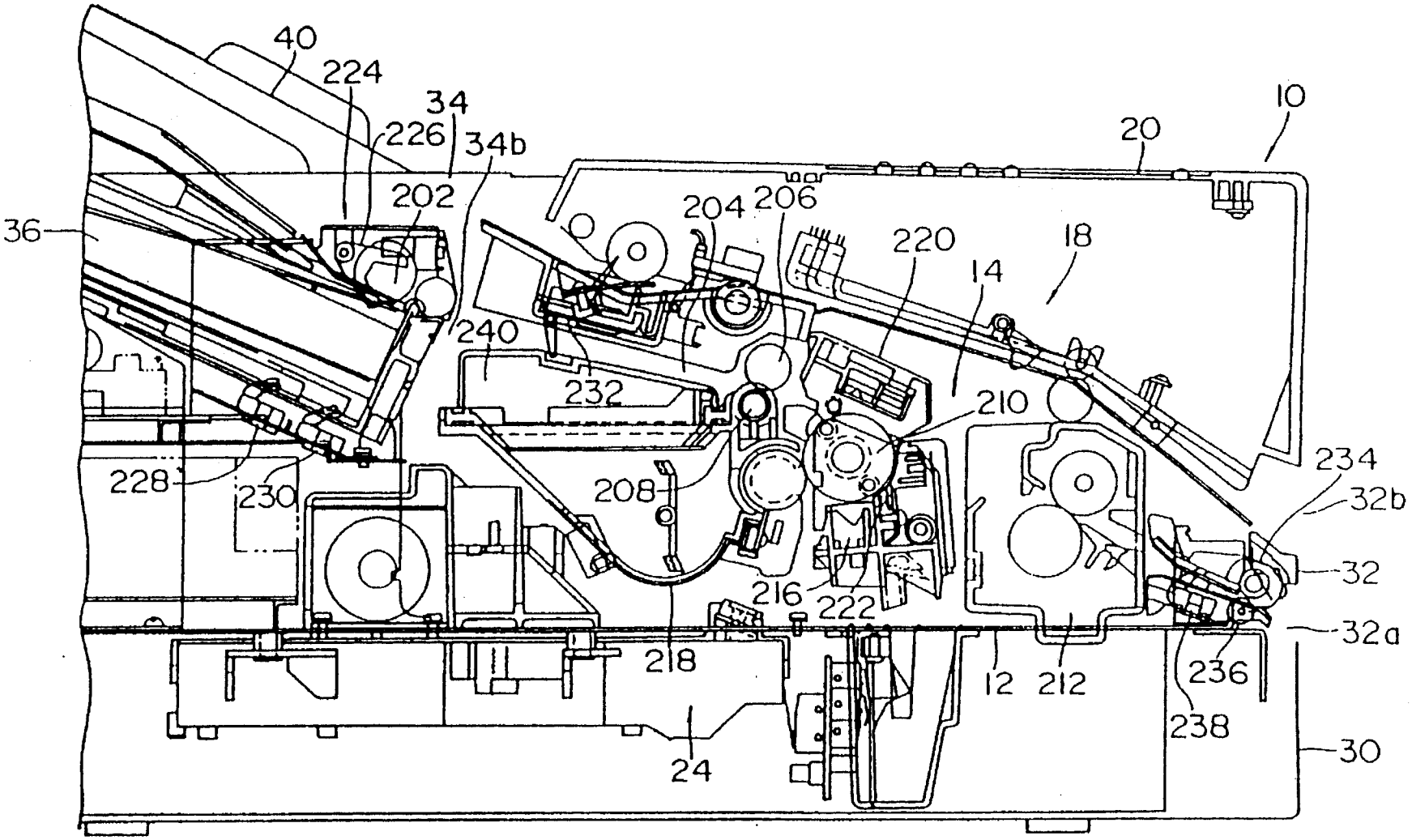
FIG. 54 is a side elevational view of an image printing mechanism of the facsimile apparatus.

As shown in FIG. 54, the image printing mechanism 14 has a sheet feed path 204 for feeding a sheet P drawn from the sheet cassette 36 by a sheet feed roller 202, from a sheet inlet slot 34*b* defined in an upper rear portion of the upper housing 34 toward a sheet discharge slot 32*a* defined in a front panel of the printer housing (middle housing) 32.

The image printing mechanism 14 also has a pair of upper and lower resist rollers 206, 208 for determining the timing to feed a sheet P. A photosensitive drum 210 has a photosensitive layer on its outer circumferential surface for forming thereon an electrostatic latent image upon exposure to a scanning laser beam emitted by the laser scanning unit 24. An image fixing unit 212 is provided for fixing a toner image transferred from the photosensitive drum 210 to a lower surface of a sheet P. The resist rollers 206, 208, the photosensitive drum 210, and the image fixing unit 212 are arranged successively downstream along the sheet feed path 204 in the direction in which a sheet P is fed through the sheet feed path 204.

Figure 55:
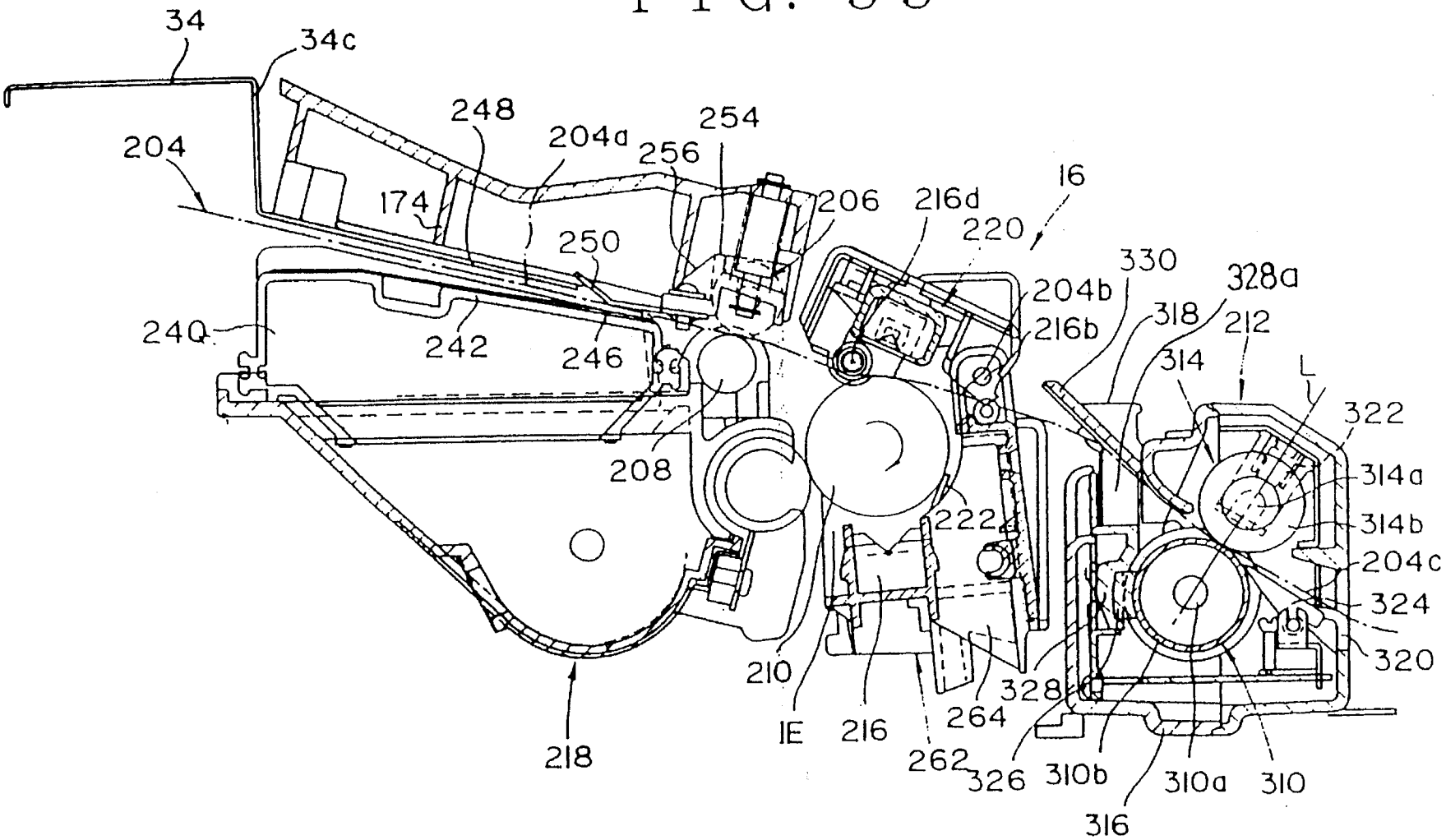
FIG. 55 is a side elevational view, partly in cross section, of a sheet feed path and various components positioned around the sheet path in the image printing mechanism.

The photosensitive drum 210 and the image fixing unit 212 are actuated by a printer driving mechanism 214 (described later on). The photosensitive drum 210 rotates clockwise in FIG. 54 when driven by the printer driving mechanism 214. As shown in FIG. 55, a drum charger 216, for uniformly charging the photosensitive layer of the photosensitive drum 210, is positioned immediately below the photosensitive drum 210. The image printing mechanism 14 includes an image exposure region IE where the photosensitive drum 210 is exposed to a scanning laser beam emitted by the laser scanning unit 24. The image exposure region IE is positioned downstream of the drum charger 216 in the direction in which the photosensitive drum 210 rotates. An image developing unit 218, for developing an electrostatic latent image on the photosensitive drum 210 into a toner image, is positioned downstream of the image exposure region IE in the direction in which the photosensitive drum 210 rotates.

The image printing mechanism 14 further includes a transfer charger 220 for transferring a toner image from the photosensitive drum 210 to a lower surface of a sheet P. The transfer charger 220 is positioned downstream of the image developing unit 218 in the direction in which the photosensitive drum 210 rotates, and immediately above the photosensitive drum 210. A cleaning blade 222 for retrieving residual toner from the photosensitive layer of the photosensitive drum 210 to clean the same is disposed downstream of the transfer charger 220 and upstream of the drum charger 216 in the direction in which the photosensitive drum 210 rotates. A filter 223 (see FIG. 1) for removing ozone generated by the drum charger 216 and the transfer charger 220 is disposed on the main plate 12 immediately rearwardly and downwardly of the image developing unit 218. The discharge device 150 described above is positioned immediately behind the filter 223. The discharge device 150 has a drive motor and a fan rotatable by the drive motor. When the fan is rotated, air around the photosensitive drum 210 is discharged through the filter 223 out of the enclosure 28 through its rear panel. At this time, ozone contained in the air is removed by the filter 223. The discharge passage for discharging ozone is defined between the discharge device 150 and the discharge opening 32*c* (see FIG. 3) defined in the rear panel of the printer housing 32.

As illustrated in FIG. 54, the sheet feed roller 202 is rotatable by a drive mechanism 224 which includes the pickup motor 142 and a drive force transmitting mechanism (not shown) for transmitting drive forces from the pickup motor 142 to the sheet feed roller 202. The sheet feed roller 202 can thus be driven independently of the printer driving mechanism 214 which actuates the photosensitive drum 210 and the image fixing unit 212, so that the sheet feed roller 202 can withdraw sheets P from the sheet cassette 36 with its own timing.

The drive mechanism 224 has a sheet detecting switch 226 positioned closely to the sheet feed roller 202 for detecting whether sheets P are left in the sheet cassette 36 or not, and a pair of sheet size detecting switches 228, 230 for detecting the size of sheets P stored in the sheet cassette 36. In this embodiment, the sheet size detecting switches 228, 230 are selectively turned on and off depending on the length of sheets along the sheet feed path that are stored in the sheet cassette 36, for detecting three different sheet sizes.

The sheet feed path 204 has a sheet feed detecting switch 232 positioned between the sheet feed roller 202 and the resist rollers 206, 208, and a sheet discharge detecting switch 238 positioned between the image fixing unit 212 and pairs of upper and lower sheet discharge rollers 234, 236 (described later on). According to this embodiment, only one sheet feed detecting switch 232 is employed to determine the timing to feed a sheet P along the sheet feed path 204.

More specifically, in order to determine the timing to feed a sheet P, it has been customary to use a first sheet detecting switch for detecting the timing of withdrawal of the sheet P from the sheet cassette 36, and a second sheet detecting switch for detecting the timing of departure of the sheet P from the resist rollers 206, 208. In this embodiment, only the timing of withdrawal of the sheet P from the sheet cassette 36 is detected by the sheet feed detecting switch 232. The timing to feed the sheet P from the resist rollers 206, 208 toward the photosensitive drum 210 is determined according to a control process described later on. Therefore, no second sheet detecting switch is required in the illustrated embodiment. As one sheet detecting switch that is relatively expensive is unnecessary, the cost of the facsimile apparatus is reduced.

(SHEET FEED PATH 204 OF IMAGE PRINTING MECHANISM 14)

Figure 56:
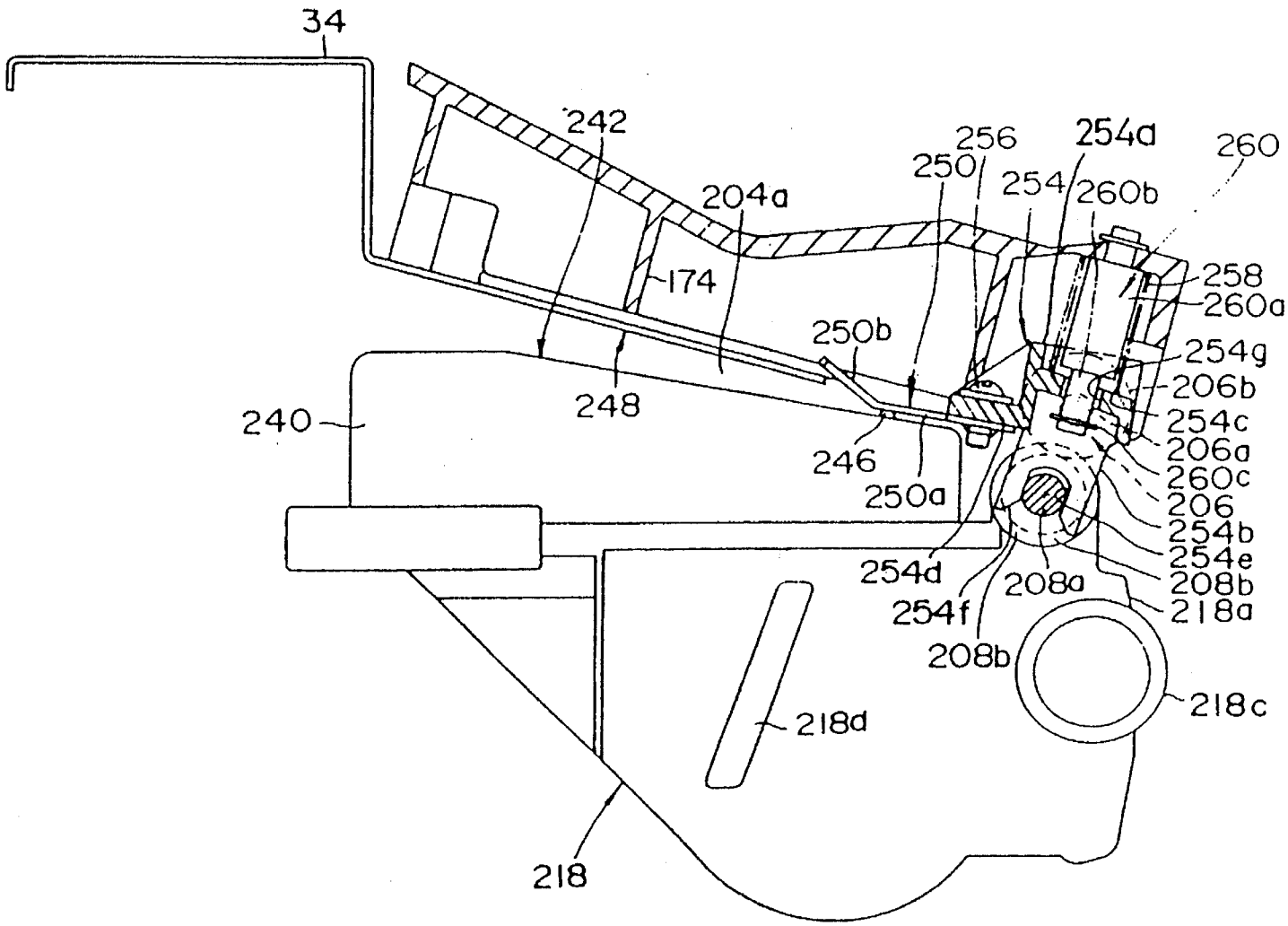
FIG. 56 is a side elevational view, partly in cross section, of an upstream portion of the sheet feed path in the image printing mechanism.

A portion 204*a* of the sheet feed path 204 which is positioned upstream of the photosensitive drum 210 in the direction in which a sheet P is fed, will be described below with reference to FIG. 56.

Figure 57:
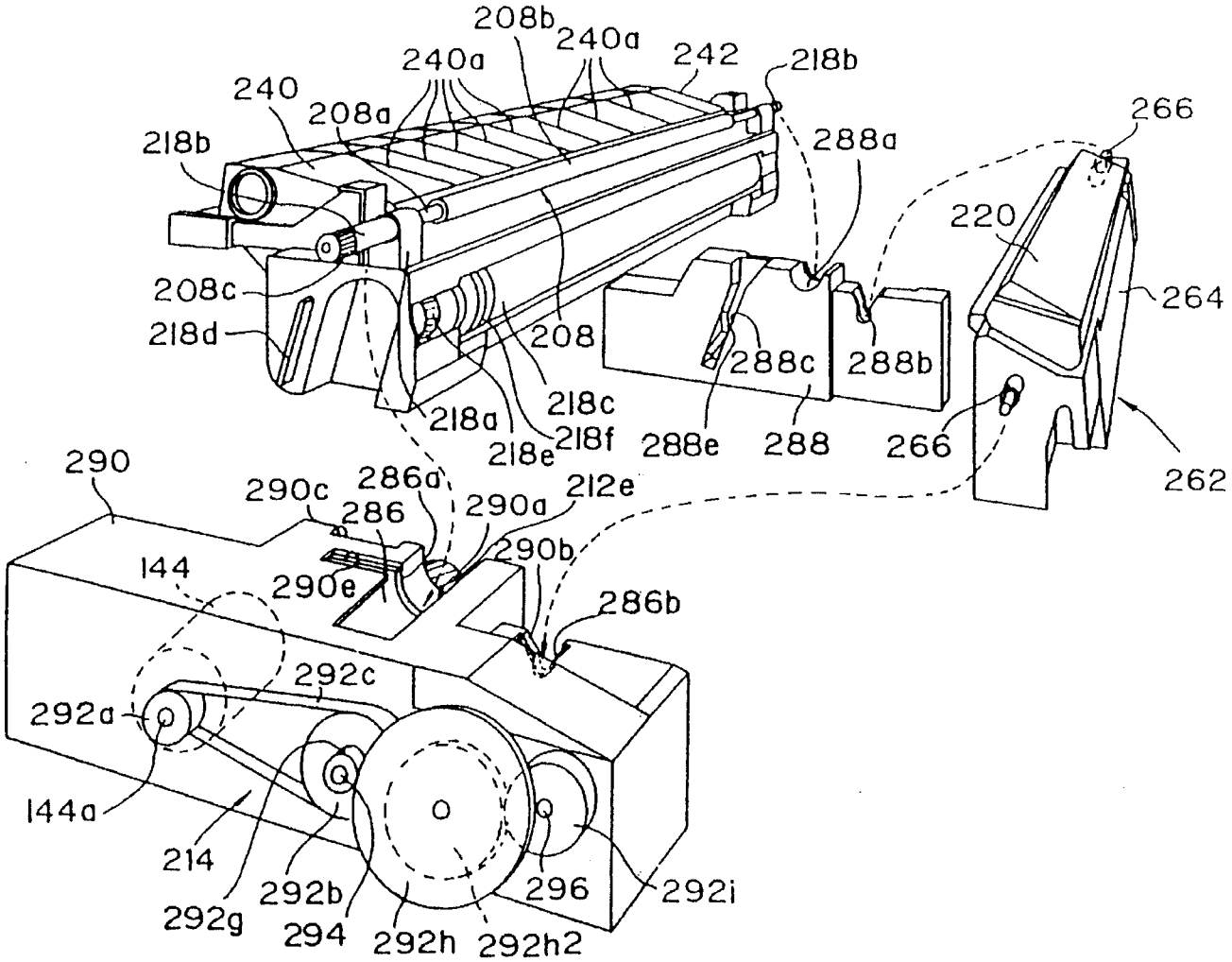
FIG. 57 is an exploded perspective view showing the manner in which an image developing unit and a drum unit are mounted on a gear box in the image printing mechanism.

The upstream portion 204*a* of the sheet feed path 204 has a lower surface defined by an upper surface of the image developing unit 218, i.e., an upper surface of a lower fixed sheet guide 242 that includes an upper portion of a toner cartridge 240 of the image developing unit 218. A pair of upwardly projecting protrusions 246 is integrally formed on a downstream portion of the upper surface of the lower fixed sheet guide 242 to accurately and reliably define a space between the lower fixed sheet guide 242 and an upper movable sheet guide 250 (described later on), which space is large enough to allow a single sheet P to pass therethrough. The protrusions 246 are laterally spaced from each other by a distance corresponding to the width of a largest sheet so that they will not obstruct the passage of a sheet P fed down the sheet feed path 204. As shown in FIG. 57, the upper surface of the toner cartridge 240 has a plurality of guide ridges 240*a* extending along the sheet feed path 204.

The upstream portion 204*a* of the sheet feed path 204 has an upper surface which includes an upstream section defined by a lower surface of an upper fixed sheet guide 248 integral with the upper housing 34, and a downstream section defined by a lower surface of the upper movable sheet guide 250 that is resiliently displaceably mounted on the swing frame 16. The upper movable sheet guide 250 as it abuts downwardly against the protrusions 246, is accurately positioned with respect to the lower fixed sheet guide 242. The upstream portion 204*a* of the sheet feed path 204 has an outlet that confronts the region where the resist rollers 206, 208 contact each other.

More specifically, when the upper housing 34 is in the closed position, the upper fixed sheet guide 248 is in a predetermined positional relationship to the lower fixed sheet guide 242, i.e., is roughly positioned with respect to the lower fixed sheet guide 242 at a relatively large distance from the upper surface of the lower fixed sheet guide 242. The upper surface of the upper fixed sheet guide 248 is fixed to the lower surface of the lower document guide 174 that accommodates the document separating unit 156 of the image reading mechanism 18. The upper movable sheet guide 250 is fastened to a support block 254 by a screw 256 at a position slightly upstream of the front end of the upper movable sheet guide 250, which front end is positioned most downstream in the direction in which a sheet P is fed. The support block 254 is resiliently displaceably attached to the lower surface of the front end of the lower document guide 174 with, the support block 254 supporting the upper resist roller 206.

The upper movable sheet guide 250 includes a guide body 250*a* which extends substantially parallel to the upper surface of the lower fixed sheet guide 242 when the swing frame 16 is in the closed position, and a bent member 250*b* joined to the guide body 250*a* and bent such that it is progressively spaced away from the upper surface of the lower fixed sheet guide 242 in an upstream direction from the upstream end of the guide body 250*a* in the sheet feed path 204 when the swing frame 16 is in the closed position. The guide body 250*a* and the bent member 250*b* are integrally formed of a leaf spring material. The protrusions 246 are held in abutment against a lower surface of the guide body 250*a*.

When the swing frame 16 and hence the upper housing 34 are turned to the open position, the upper fixed sheet guide 248 and the upper movable sheet guide 250 are angularly displaced upwardly with the upper housing 34, widely opening the upstream portion 204*a* of the sheet feed path 204. Therefore, any jammed sheet P can easily be removed from the sheet feed path 204, and the toner cartridge 240 which runs short of toner can easily be replaced with a new one.

When the swing frame 16 and hence the upper housing 34 are turned to the closed position, the upper fixed sheet guide 248 and the upper movable sheet guide 250 are angularly displaced downwardly with the upper housing 34, with the upstream portion 204*a* of the sheet feed path 204 being defined as a predetermined gap. A sheet P that has been fed through the lipstream section of the upstream portion 204*a* has its upper surface restricted by the upper movable sheet guide 240 when the sheet P reaches the downstream section of the upstream portion 204*a*. The downstream section of the upstream portion 204*a* has a very small gap, which is defined by the protrusions 246, only large enough to allow a single sheet P to pass therethrough. Even if the supplied sheet P is curled, therefore, it is progressively made flat as it is fed through the upstream portion 204*a* of the sheet feed path 204. When the upper surface of the sheet P is restricted by the upper movable sheet guide 250, the sheet P is corrected into a substantially flat shape, so that its leading end can be reliably guided into the region where the resist rollers 206, 208 contact each other.

Therefore, any sheet P which is curled can be corrected into a substantially flat configuration before it reaches the resist rollers 206, 208. The leading end of the sheet P can be reliably guided into the region where the resist rollers 206, 208 contact each other. Therefore, the sheet P is effectively prevented from being jammed in the sheet feed path 204.

(ATTACHMENT OF RESIST ROLLERS 206, 208)

Attachment of the upper and lower resist rollers 206, 208 will be described below with reference to FIG. 56. The lower resist roller 208 serves as a drive roller, and the upper resist roller 206 as a driven roller.

<LOWER RESIST ROLLER 208>

The lower resist roller 208 is fixedly mounted for rotation about its own axis on a downstream end of an upper surface of an image developing unit housing 218*a* which defines an outer surface of the image developing unit 218. The lower resist roller 208 includes a shaft 208*a* and a friction roller element 208*b* coaxially mounted on and around the shaft 208*a*. The shaft 208*a* has opposite ends projecting outwardly of respective opposite ends of the friction roller element 208*b*.

As shown in FIG. 57, a driven gear 208*c* is integrally fixed to one end of the shaft 208*a*, the driven gear 208*c* being disengageably coupled to the printer driving mechanism 214 for rotation thereby. Support sleeves 218*b* are fitted respectively over opposite end portions of the shaft 208*a* which project immediately outwardly from the housing 218*a*. The support sleeves 218*b* project outwardly from and are fixed to respective outer sides of the housing 218*a*. The opposite end portions of the shaft 208*a* are rotatably supported in the respective support sleeves 218*b* by respective bearings (not shown). Stated otherwise, the lower resist roller 208 is rotatably mounted on the image developing unit 218 by the support sleeves 218*b*.

<UPPER RESIST ROLLER 206>

The upper resist roller 206 is resiliently displaceably mounted on a lower surface of a downstream end of the lower document guide 174. As shown in FIG. 56, the upper resist roller 206 includes a shaft 206*a* and a friction roller element 206*b* coaxially mounted on and around the shaft 206*a*. The shaft 206*a* has opposite ends projecting outwardly of respective opposite ends of the friction roller element 206*b*. The opposite ends of the shaft 206*a* are rotatably mounted on respective opposite ends of the support block 254.

The support block 254 includes a block body 254*a* extending transversely across the sheet feed path 204, and a pair of laterally spaced vertical arms 254*b* attached to respective opposite ends of the block body 254*a* and having respective upper portions supporting the corresponding ends of the shaft 206*a* of the upper resist roller 206 and respective lower ends extending downwardly to positions immediately outward of the lower resist roller 208. A pair of holders 254*c* project outwardly from respective outer sides of the vertical arms 254*b* and supports respective lower ends of springs 258 (described later on). An attachment leg 254*d* extends upstream from an upstream end of the block body 254*a* and supports the upper movable sheet guide 250 on its lower surface.

The vertical arms 254*b* have respective recesses 254*e* defined in respective lower ends thereof and opening downwardly. The opposite end portions of the shaft 208*a*of the lower resist roller 208 are fitted respectively in the recesses 254*e*. The vertical arms 254*b* also have respective tapered surfaces 254*f* opening relatively widely in the downward direction. The tapered surfaces 254*f* are contiguous to respective lower open ends of the recesses 254*e* for allowing the opposite end portions of the shaft 208*a*of the lower resist roller 208 to be easily fitted into the recesses 254*e*.

A pair of suspensions 260 is interposed between the respective holders 254*c* and the lower document guide 174. Each holder 254 is suspended by one of the suspensions 260 for vertical movement by a predetermined stroke below the lower document guide 174. The springs 258 are also interposed between the respective holders 254*c* and the lower document guide 174. Each of the suspensions 260 includes a suspension body 260*a* having a lower end pivotally mounted on the lower end of the lower document guide 174 and, a shank 260*b* extending downwardly from a lower end of the suspension body 260*a* and projecting downwardly through a hole 254*g* that is defined vertically through the corresponding holder 254*c*. A retaining ring 260*c* is detachably mounted on the lower end of the shank 260*b* and has a size larger than the diameter of the hole 254*g* for preventing the holder 254*c* from dropping off the shank 260*b*.

When the swing frame 16 is in the open position, the lower surfaces of the holders 254*c*, of the support block 254, are held in abutment against the upper surfaces of the respective retaining rings 260*c* under the bias of the springs 258 and the weight of the support block 254. Stated otherwise, the upper resist roller 206 is pivotally suspended from the lower document guide 174 and hence the swing frame 16 by the suspensions 260.

When the upper housing 34 is turned toward the closed position, the recesses 254*e* of the support block 254 are fitted downwardly over the end portions of the shaft 208*a* of the lower resist roller 208, so that the support block 254 is precisely positioned with respect to the lower resist roller 208. At the time the recesses 254*e* start being fitted downwardly over the end portions of the shaft 208*a*, the upper resist roller 206 is either slightly spaced upwardly from or held in contact with the lower resist roller 208. Thereafter, when the swing frame 16 reaches the closed position, the upper resist roller 206 is brought and remains in full contact with the lower resist roller 208. Upon contact between the upper and lower resist rollers 206, 208, the distance between the lower document guide 174 and the holders 254*c* is reduced as the swing frame 16 is turned to the closed position. However, the reduction in the distance is taken up by the springs 258 as they are compressed. Accordingly, when the swing frame 16 is in the closed position, the upper resist roller 206 is resiliently held against the lower resist roller 208 under the bias of the springs 258.

Therefore, even when the friction roller elements 206*b*, 208*b* of the upper and/or lower resist rollers 206, 208 are subjected to localized wear due to repeated sheet resisting cycles, the upper and lower resist rollers 206, 208 are kept in good line-to-line contact with each other. The upper and lower resist rollers 206, 208 are thus capable of resisting a sheet P with high accuracy.

As the friction roller elements 206*b*, 208*b* of the upper and/or lower resist rollers 206, 208 are worn, the interaxial distance between the upper and lower resist rollers 206, 208 is reduced, resulting in a change in the position of the support block 254 relative to the image developing unit 218. As a consequence, the attitude of the upper movable sheet guide 250 mounted on the support block 254 also changes with respect to the image developing unit 218. However, such a change in the attitude of the upper movable sheet guide 250 is small, and can sufficiently be absorbed by the upper movable sheet guide 250 which is made of a leaf spring material. The upper movable sheet guide 250 is thus reliably kept in contact with the protrusions 246, accurately setting the sheet feed path 204 to a small gap between the upper movable sheet guide 250 and the toner cartridge 240.

(DRUM UNIT 262)

A drum unit 262 with the photosensitive drum 210 and the transfer charger 220 mounted on the drum unit 262 will be described below with reference to FIGS. 57 through 60.

Figure 58:
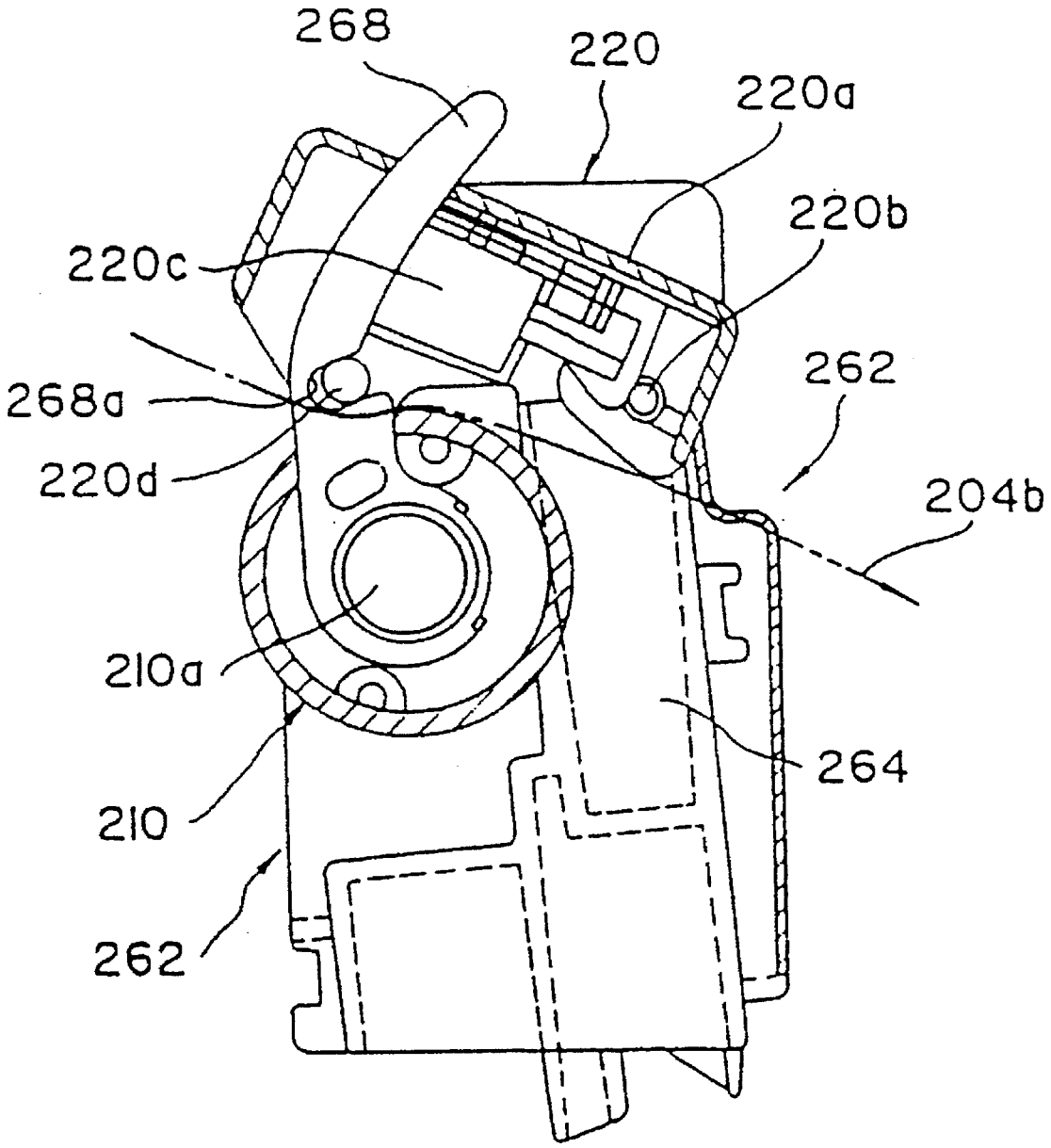
FIG. 58 is a side elevational view, partly in cross section, showing the drum unit, a transfer charger mounted on the drum unit, and a preroller mounted on the drum unit.

As shown in FIGS. 57 and 58, the drum unit 262 has a unit housing 262 in which the photosensitive drum 210 is rotatably mounted. The unit housing 262 has a fully open upper side and a fully open side which confronts the image developing unit 218. As shown in FIG. 57, outwardly projecting attachment rods 266 are mounted respectively on opposite lateral sides of the unit housing 262 for attachment to the printer driving mechanism 214. The photosensitive drum 210, which is of known nature, comprises includes a cylindrical drum body, a photosensitive layer mounted on the outer circumferential surface of the cylindrical drum body, and a pair of flanges press-fitted in and bonded to respective opposite axial ends of the drum body and having respective driven gears. Drum support shafts 210*a*, coaxial with the drum body, project from the opposite ends of the drum body and are inserted into the flanges. The drum support shafts 210*a* are supported on the unit housing 264 through attachment flanges (not shown).

As shown in FIG. 58, the transfer charger 220 is mounted on an upper portion of the unit housing 264 in covering relationship to the upper open side thereof. The sheet feed path 204 has an intermediate portion 204*b* (see also FIG. 55) defined between the photosensitive drum 210 and the transfer charger 220. The transfer charger 220 has a downwardly open charger housing 220*a*. The charger housing 220*a* is angularly movably supported at its downstream end with respect to the sheet feed path on a downstream end of the upper side of the unit housing 264 by a pivot shaft 220*b*.

A charging wire 220*c* which is attached to the charger housing 204*a* extends transversely across the intermediate portion 204*a* of the sheet feed path 204. When a sheet P is fed through the intermediate portion 204*b*, between the photosensitive drum 210 and the transfer charger 220, a toner image formed on the photosensitive drum 210 is transferred to the lower surface of the sheet P by the transfer charger 220.

<PREROLLER 220*d*>

A preroller 220*d* that is rotatable about its own axis substantially parallel to the charging wire 220*c* is attached to an upstream end of the charger housing 220*c*. The preroller 220*d* is spaced slightly upwardly from the outer photosensitive layer of the photosensitive drum 210 when the transfer charger 220 is in an image transfer position above the photosensitive drum 210. That is, when a sheet P is fed into the intermediate portion 204*b*, including an image transfer region, between the photosensitive drum 210 and the transfer charger 220, the preroller 220*d* can hold the sheet P in intimate contact with the photosensitive drum 210. It is necessary that the preroller 220*d* and the photosensitive drum 210 be positioned relative to each other such that a gap of predetermined dimension be defined therebetween. The preroller 220*d* cannot have a large outside diameter due to a layout limitation posed by the preroller 220*d*, the photosensitive drum 210, and the transfer charger 220. Therefore, the preroller 220*d* includes, for example, a shaft, having a diameter of 6 mm and a sleeve of urethane rubber coated on the shaft, the sleeve having a thickness ranging from 20 to 50 fm.

Since the preroller 220*d* is arranged to hold a sheet P intimately against the photosensitive drum 210, a toner image formed on the photosensitive drum 210 can reliably be transferred to the lower surface of the sheet P by the transfer charger 220. If the sheet feed path 204 were bent downwardly downstream of the transfer charger 220, the trailing end of a sheet P fed down the sheet feed path 204 would be directed upwardly in the image transfer region due to the stiffness of the sheet P. The instant that the trailing end of the sheet P passes through the image transfer region, the trailing end would jump up from the photosensitive drum 210, and the transfer of any toner image from the photosensitive drum 210 to the trailing end of the sheet P would be impaired. In the illustrated embodiment, since the preroller 220*d* holds the trailing end of a sheet P in close contact with the photosensitive drum 210 until the image transfer cycle ends, the trailing end of the sheet P is effectively prevented from being directed upwardly, and the toner image can reliably be transferred to the trailing end of the sheet P.

<LOCK LEVER 268>

A lock lever 268 is angularly movably mounted on one of the drum support shafts 210*a* for locking the transfer charger 220 exactly in the image transfer position and also for locking the preroller 220 in spaced relationship to the photosensitive layer of the photosensitive drum 210. The lock lever 268 has a laterally opening locking slot 268*a* defined in an edge thereof (right hand edge in FIG. 58) which faces the preroller 220*d* for receiving the preroller 220*d*. The locking slot 268*a* is in the form of an arcuate slot extending about the axis of the drum support shafts 210*a*.

When the preroller 220*d* is fitted in the locking slot 268*a* of the lock lever 268, as shown in FIG. 58, the charging wire 220*c* of the transfer charger 220 is upwardly spaced a predetermined distance from the photosensitive layer of the photosensitive drum 210. The preroller 220*d* itself is accurately positioned closely to the photosensitive layer of the photosensitive drum 210. With the charging wire 220*c* and the preroller 220*d* being thus precisely positioned with respect to the photosensitive drum 210, a toner image can reliably be transferred from the photosensitive drum 210 to a sheet P, and it can be transferred up to the trailing end of the sheet P.

The charger housing 220*a* serves as an upper cover for the photosensitive drum 210. When the upper housing 34 is opened for servicing the internal structure of the facsimile apparatus 10, the upper cover 220*a* effectively prevents light (natural light) from being applied to the photosensitive drum 210. In this embodiment, the photosensitive layer of the photosensitive drum 210 is made of an organic photosensitive material, and hence should not be exposed to natural light for a long period of time as it would be light-fatigued.

Figure 59:
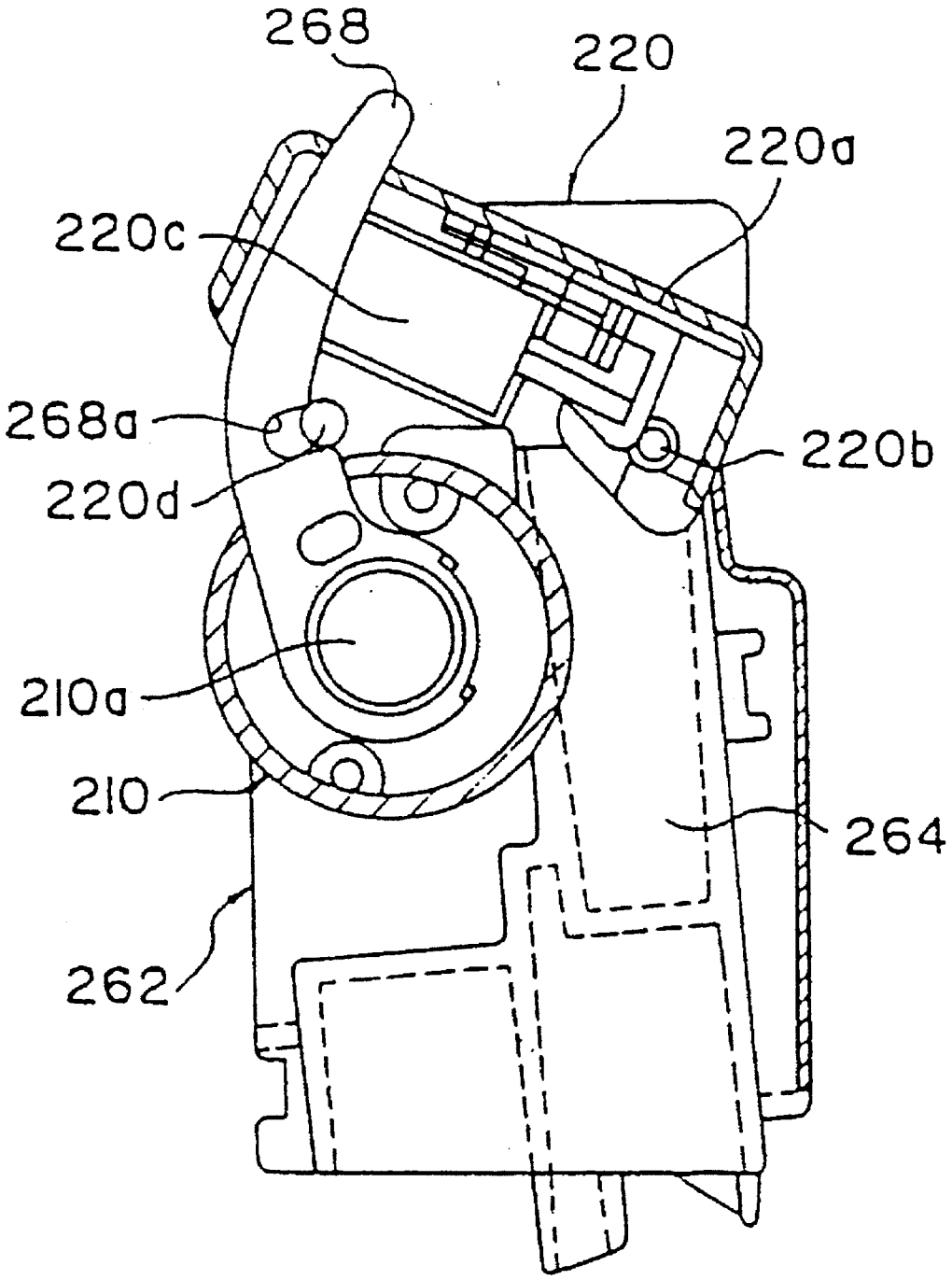
FIG. 59 is a side elevational view partly in cross section, showing the drum unit and the transfer charger as it is unlocked from the drum unit.

When the lock lever 268 is turned counterclockwise in FIG. 58, the preroller 220*d* is removed out of the locking slot 268*a* until the preroller 220*d* is unlocked from the lock lever 268 as shown in FIG. 59. When the preroller 220*d* is unlocked from the lock lever 268 the transfer charger 220 is freely angularly movable about the pivot shaft 220*b*. By then turning the transfer charger 220 clockwise, the intermediate portion 204*a* of the sheet feed path 204 is widely opened upwardly, leaving the photosensitive drum 210 open upwardly. Therefore, in the event that a sheet P is jammed in the intermediate portion 204*b*, the lock lever 268 is turned counterclockwise to unlock the transfer charger 220 and the transfer charger 220 is turned to open the intermediate portion 204*b*. Then, the jammed sheet P can easily be removed from the sheet feed path 204. The process of removing a sheet jam can thus be greatly simplified.

(WASTE TONER RETRIEVING MECHANISM 272)

A waste toner retrieving mechanism 272 for retrieving residual toner (hereinafter referred to as "waste toner") on the photosensitive layer of the photosensitive drum 210 into a waste toner container 270 after a toner image has been transferred from the photosensitive drum 210 will be described below with reference to FIGS. 60 through 63.

<CLEANING BLADE 222>

Figure 61:
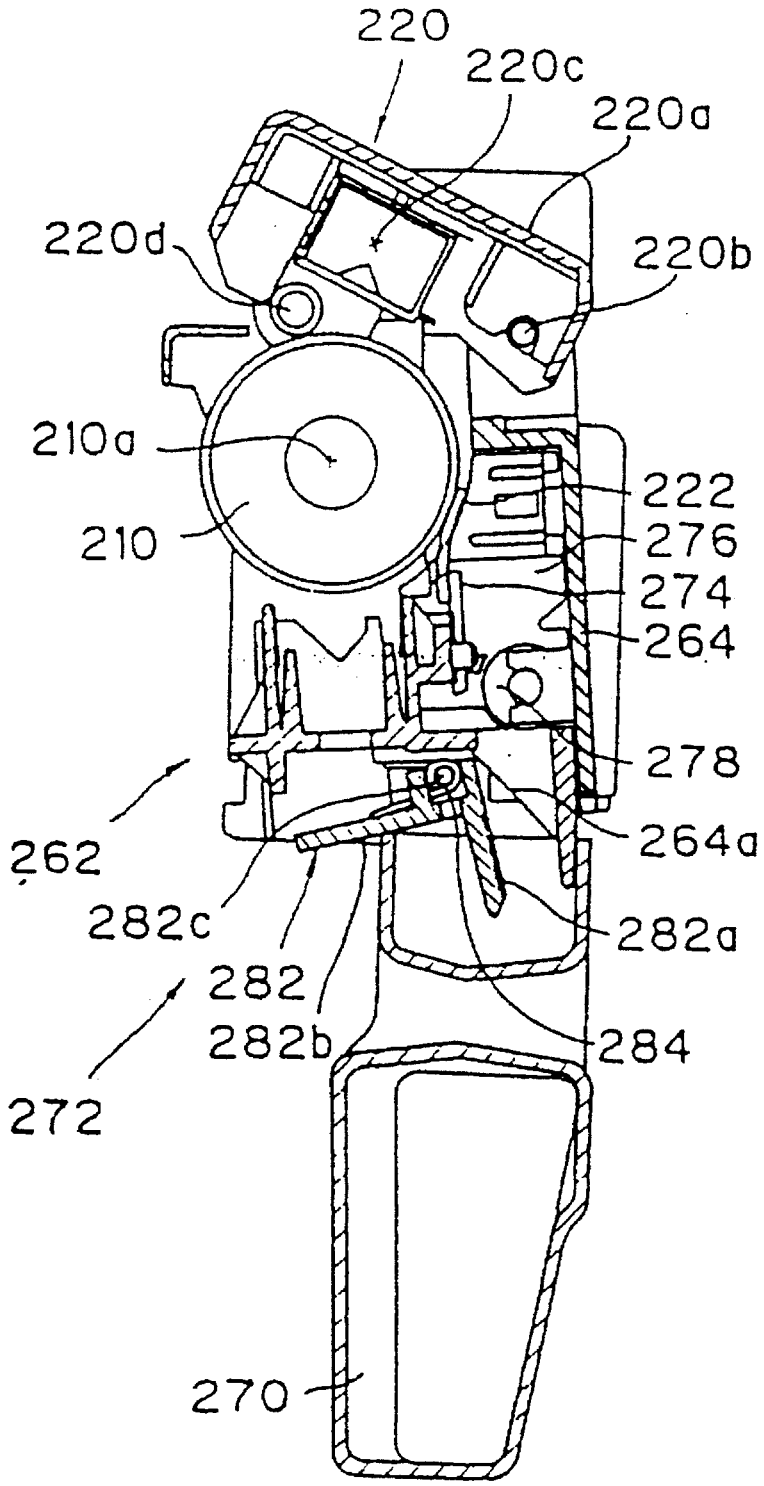
FIG. 61 is a side elevational view, partly in cross section, of the drum unit and the transfer charger as it is closed.

As shown in FIG. 61, the cleaning blade 222 which includes a rubber blade is positioned downstream of the image transfer region and upstream of a drum charging region (in which the photosensitive drum 210 is charged by the drum charger 216) with respect to the direction in which the photosensitive drum 210 rotates. The cleaning blade 222 is fixed to the unit housing 264 by a cleaning blade holder 274 such that the cleaning blade 222 is held counter against the photosensitive layer of the photosensitive drum 210. As the photosensitive drum 210 rotates, waste toner attached to the photosensitive layer of the photosensitive drum 210 is scraped off by the cleaning blade 222.

<AUGER 278>

Figure 62:
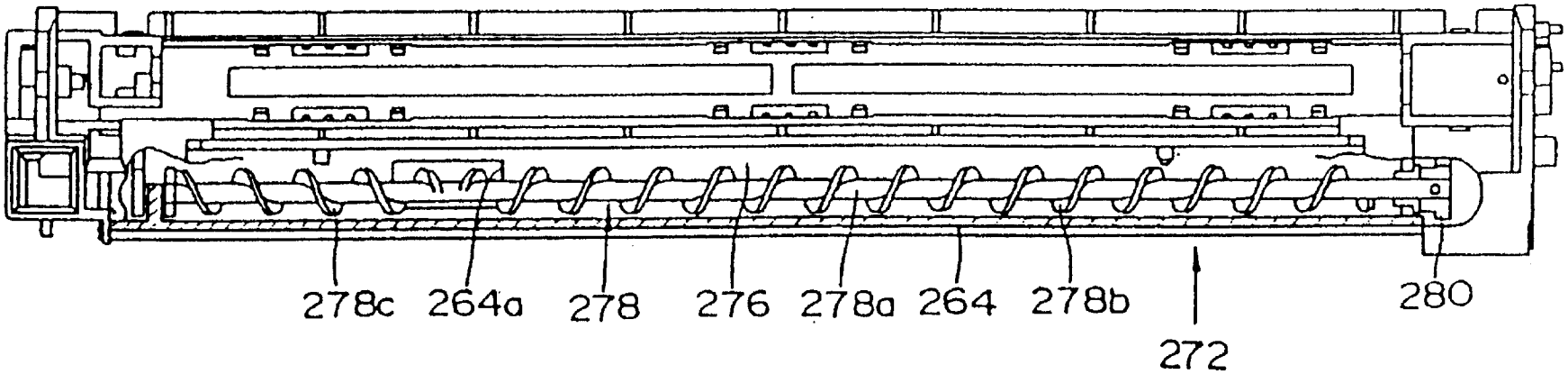
FIG. 62 is a plan view, partly cut away, of a waste toner retrieving mechanism with an auger in the drum unit.
Figure 63:
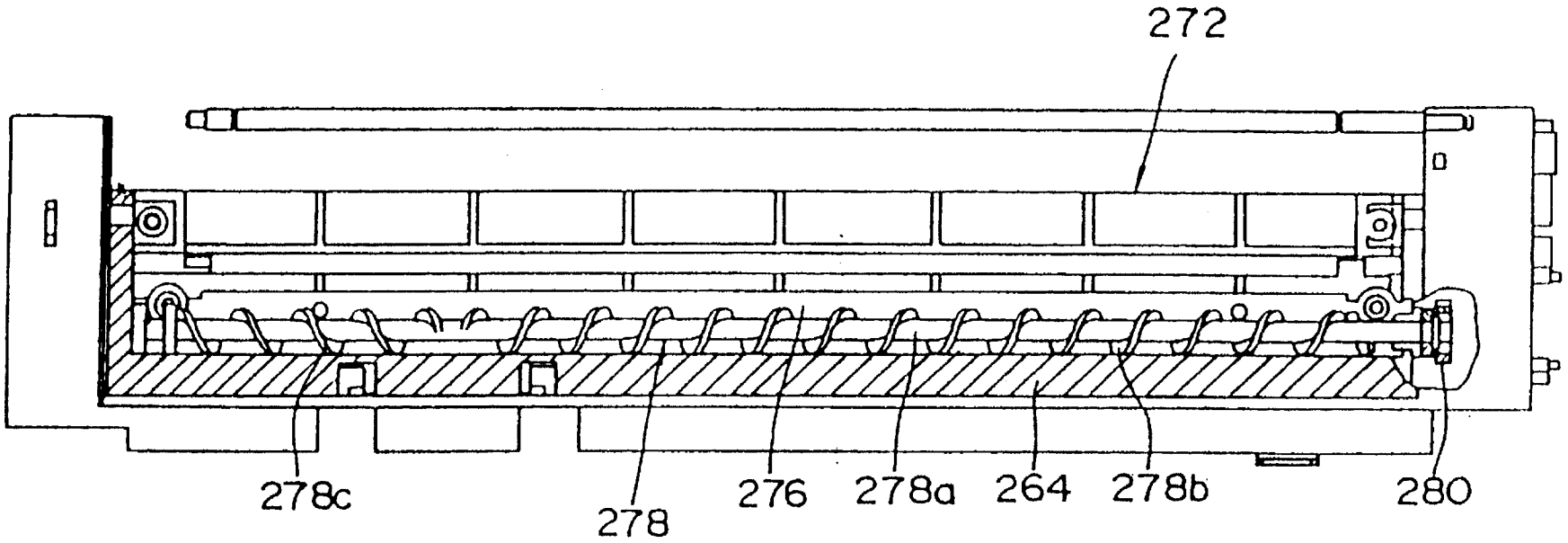
FIG. 63 is an elevational view, partly in cross section, of the waste toner retrieving mechanism with the auger in the drum unit.

The unit housing 264 includes a waste toner receiver 276 for temporarily storing waste toner scraped off the photosensitive drum 210. As shown in FIGS. 62 and 63, the waste toner receiver 276 extends fully along the axis of the photosensitive drum 210. To transfer the waste toner from the waste toner receiver 276 into the waste toner container 270 through a waste toner outlet 264*a* defined in a lower surface of the unit housing 264, an auger 278 is rotatably disposed on the bottom of the waste toner receiver 276 for displacing the waste toner toward the waste toner outlet 264*a*. The waste toner outlet 264*a* is positionally displaced from the center of the bottom of the unit housing 264 toward one end (left hand end in FIG. 62) thereof in the longitudinal direction.

The auger 278 is rotatably supported at its opposite ends on opposite ends of the unit housing 264 for rotation about its own axis parallel to the axis of the photosensitive drum 210. On one end (right hand end in FIG. 62) of the auger 278, there is coaxially mounted a driven gear 280 operatively coupled to the printer driving mechanism 214 so that the auger 278 can be rotated about its own axis in one direction by the printer driving mechanism 214.

The auger 278 includes a shaft 278*a* to which the driven gear 280 is attached at one end thereof, a first helical blade 278*b* mounted on a portion of the shaft 278*a* on one side of the waste toner outlet 264*a*, and a second helical blade 278*c* mounted on a portion of the shaft 278*a* on the other side of the waste toner outlet 264*a*. The first and second helical blades 278*a*, 278*b* are oriented in opposite directions such that when the auger 278 is rotated about its own axis, the first helical blade 278*b* displaces the waste toner in the waste toner receiver 276 toward the waste toner outlet 264*a*, i.e., to the left. The second helical blade 278*c* displaces the waste toner in the waste toner receiver 276 toward the waste toner outlet 264*a*, i.e., to the right. Consequently, upon rotation of the auger 278, the waste toner in the waste toner receiver 276 is displaced toward the waste toner outlet 264*a*.

<WASTE TONER OUTLET COVER 282>

Figure 60:
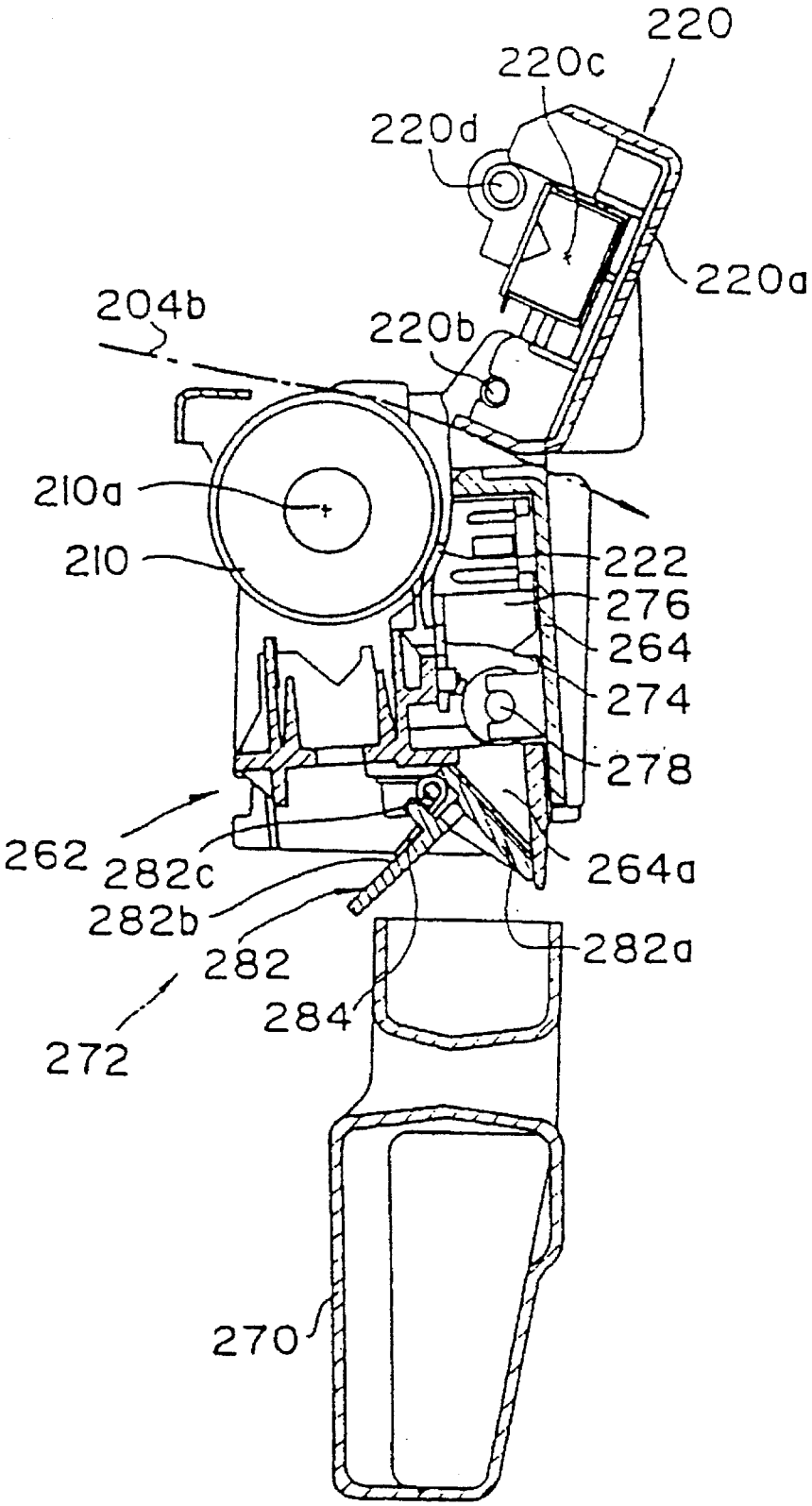
FIG. 60 is a side elevational view, partly in cross section, of the drum unit and the transfer charger as it is opened.

The drum unit 262 is sometimes required to be pulled out upwardly for cleaning a wire in the charging unit during periodic maintenance routines. When the drum unit 262 is pulled upwardly, the waste toner outlet 264*a* is automatically closed by a waste toner outlet cover 282. As shown in FIG. 60, the waste toner outlet cover 282 is of a substantially L-shaped cross section, and has an upwardly convex central corner rotatably attached to a lower portion of the unit housing 264, i.e., an upstream end of the waste toner outlet 264*a*, for rotation about an axis parallel to the axis of the photosensitive drum 210.

The waste toner outlet cover 282 includes a closure 282*a* for openably closing the waste toner outlet 264*a*, an opening member 282b integrally joined to and bent about 90° from the closure 282a for angularly displacing the closure 282a to open the waste toner outlet 264a when pushed by an upper edge of the waste toner container 270, and a pivot shaft 282c attached to the junction at the corner between the closure 282a and the opening member 282b. A torsion spring 284 is disposed around the pivot shaft 282c for normally urging the closure 282a to close the waste toner outlet 264a. A resilient seal, such as of urethane foam, is applied to a surface of the closure 282a which is separably held against the unit housing 264 for effectively preventing waste toner from leaking out of the waste toner outlet 264a when it is closed by the closure 282a.

When the drum unit 262 is installed in the image printing mechanism 14, the opening member 282b of the waste toner outlet cover 282 is engaged and pushed by the upper edge of the waste toner container 270, connected to the drum unit 262 against the resilient forces of the torsion spring 284. As a result, the closure 282a of the waste toner outlet cover 282 is turned in a direction to open the waste toner outlet 264a. Therefore, insofar as the drum unit 262 is installed in the image printing mechanism 14, the waste toner outlet 264a remains open as shown in FIG. 61. When the auger 278 is rotated, waste toner in the waste toner receiver 276 is collected toward the waste toner outlet 264a, and then retrieved through the waste toner outlet 264a into the waste toner container 270.

When the drum unit 262 is pulled upwardly from the image printing mechanism 14, the opening member 282b of the waste toner outlet cover 282 is disengaged from the waste toner container 270. The opening member 282b is thus depressed under the bias of the torsion spring 284, causing the closure 282a to close the waste toner outlet 264a. Therefore, insofar as the drum unit 262 is removed from the image printing mechanism 14, the waste toner outlet 264a remains closed as shown in FIG. 60. Since the waste toner outlet 264a is closed by the waste toner outlet cover 282 immediately when the drum unit 262 is pulled upwardly, waste toner is prevented from leaking out of the waste toner outlet 264a and contaminating surrounding components.

(PRINTER DRIVING MECHANISM 214)

The printer driving mechanism 214, for actuating the image printing mechanism 14, will be described below with reference to FIGS. 57, 64, and 65.

<SUPPORT STRUCTURE FOR IMAGE DEVELOPING UNIT 218 AND DRUM UNIT 26>

As shown in FIG. 57, the image printing mechanism 214 has a pair of laterally spaced support plates 286, 288 vertically mounted on opposite sides of the main plate 12. The support plates 286, 288 are made of a rigid material such as thick sheet steel. The support plates 286, 288 have respective first recesses 286a, 288a defined in upstream upper edges thereof for receiving and positioning the support sleeves 218b attached to the opposite sides of the housing 218a of the image developing unit 218, and respective second recesses 286b, 288b defined in upstream upper edges thereof for receiving and positioning the attachment rods 266 on the opposite sides of the drum unit 262.

When the support sleeves 218b are fitted in the respective first recesses 286a, 288a, the image developing unit 218 is suspended by the support plates 286, 288. When outwardly projecting guide ribs 218d, on the respective opposite sides of the housing 281a, are fitted downwardly into a guide groove 290c defined in an inner side of a gearbox 290 (described later on) which houses the corresponding support plate 286, and a guide groove 288c defined in an inner side of the support plate 288, the image developing unit 218 is accurately positioned in the image printing mechanism 14. Similarly, when the attachment rods 266 are fitted in the respective second recesses 286b, 288b, the drum unit 262 is also suspended by the support plates 286, 288. Gap rollers 218f are rotatably mounted on respective opposite ends of a developing sleeve 218c mounted in the image developing unit 218. When the gap rollers 218f are held against the photosensitive drum 210, the image developing unit 218 is accurately positioned in the image printing mechanism 14, i.e., the gap between the developing sleeve 218c and the photosensitive drum 210 is accurately defined. The guide ribs 218d of the image developing unit 218 are normally urged toward the photosensitive drum 210 by leaf springs 288e attached to the support plates 286, 288 for reliably holding the gap rollers 218f against the photosensitive drum 210.

The support plate 286 is integrally formed with the gearbox 290 which transfers drive forces from the printer motor 144 to the image developing unit 218, the drum unit 262, and the image fixing unit 212. The gearbox 290 has openings 290a, 290b defined in its upper panel for allowing the support sleeve 218a and the attachment rod 266 to be fitted downwardly into the first and second recesses 286a, 286b, respectively.

<DRIVE FORCE TRANSMITTING SYSTEMS>

Drive force transmitting systems (gear trains) for transmitting drive forces from the printer motor 144 to the image developing unit 218, the drum unit 262, and the image fixing unit 212 will be described below with reference to FIGS. 57 and 64.

{SYSTEM FOR TRANSMITTING DRIVE FORCES TO IMAGE DEVELOPING UNIT 218}

As shown in FIG. 57, the printer motor 144 is housed in the gear box 290 in a rear position that is upstream of a position confronting the image developing unit 218. To transmit drive forces from the printer motor 144 to the image developing unit 218, the drum unit 262, and the image fixing unit 212, the printer motor 144 has an output shaft 144a projecting out of a side panel of the gearbox 290, and a drive pulley 292a is coaxially mounted on the projecting end of the output shaft 144a. A first drive shaft 294 is rotatably supported in the gearbox 290 at a front position downstream of the printer motor 144, with the first drive shaft 294 having an end projecting out of the gearbox 290. A driven pulley 292b is coaxially mounted on the projecting end of the first drive shaft 294. An endless belt 292c is trained around the drive pulley 292a and the driven pulley 292b. The drive forces of the printer motor 144 can thus be transmitted to the first drive shaft 294 through the endless belt 292c.

Figure 64:
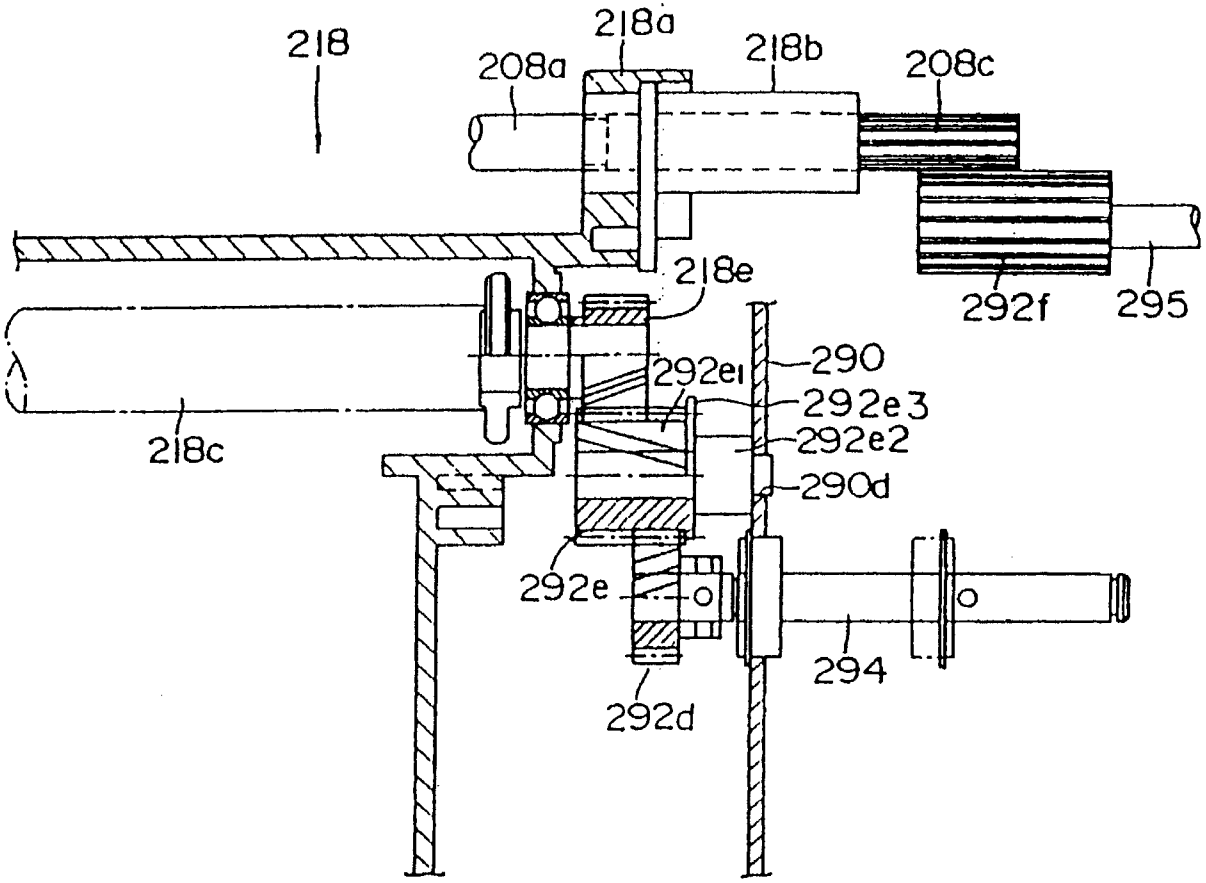
FIG. 64 is a vertical cross-sectional view of a system for transmitting drive forces to the image developing unit in the image printing mechanism.

As shown in FIG. 64, a first drive gear 292d is coaxially mounted on the inner end of the first drive shaft 294. The first drive gear 292d is held in mesh with a coupling gear 292e rotatably supported on an inner side surface of the gearbox 290. The coupling gear 292e includes a gear body 292e1 and an attachment shaft 292e2 having a diameter smaller than the diameter of the gear body 292e1. The attachment shaft 292e2 is fitted in a hole 290d defined in the inner side surface of the gearbox 290.

To prevent the coupling gear 292e from coming off the inner side surface of the gearbox 290, the first drive gear 292d and the coupling gear 292e include helical gears, respectively. The teeth of these helical gears 292d, 292e are inclined such that the meshing forces applied by the first drive gear 292d are directed as thrust forces outwardly (to the right in FIG. 64) with respect to the coupling gear 292e. As a result, as long as the first drive gear 292d is rotated, the coupling gear 292e meshing therewith is subject to outward thrust forces, and hence is effectively prevented from being disconnected inwardly from the inner side surface of the gearbox 290. A flange 292e3 is integrally mounted on an inner end of the coupling gear body 292e1 for preventing the coupling gear body 292e1 from being dislodged from the attachment shaft 292e2, when the first drive gear 292d is not rotated. The flange 292e3 engages the tips of the teeth of the first drive gear 292d to prevent the coupling gear body 292e1 from being detached from the attachment shaft 292e2 when the first drive gear 292d is not rotated.

Since no additional locking means is used to prevent the coupling gear 292e from coming off, and only the attachment shaft 292e2 is fitted in the hole 290d in mounting the coupling gear 292e, the number of parts required is relatively small, and the parts can be assembled efficiently.

A driven gear 218e is mounted on one end of the developing sleeve or roller 218c for rotation therewith. When the image developing unit 218 is suspended by the support plates 286, 288, the drive gear 218e is downwardly brought into mesh with the coupling gear 292e. With the image developing unit 218 installed on the image printing mechanism 14, the developing roller 218c is operatively connected to the printer motor 144, and can be driven as long as the printer motor 144 is energized.

A second drive shaft 295 is operatively coupled to the output shaft 144a of the printer motor 144 through a clutch mechanism (not shown) disposed in the gearbox 290. A second drive gear 292f is coaxially mounted on one end of the second drive shaft 295. When the image developing unit 218 is suspended by the support plates 286, 288, the driven gear 208c, on one end of the shaft 208a of the lower resist roller 208, is downwardly brought into mesh with the second drive gear 292f.

The second drive gear 292f is operatively connected to the printer motor 144 through the non-illustrated clutch mechanism. When the printer motor 144 is continuously energized, the clutch mechanism is controlled to rotate the second drive gear 292f intermittently. The clutch mechanism is controlled by connection and disconnection control signals from the main control board 52. When the connection control signal is supplied from the main control board 52, the clutch mechanism is engaged to transmit the drive forces from the printer motor 144 to the lower resist roller 208. When the disconnection control signal is supplied from the main control board 52, the clutch mechanism is disengaged to interrupt the drive forces transmitted from the printer motor 144 to the lower resist roller 208.

{SYSTEM FOR TRANSMITTING DRIVE FORCES TO DRUM UNIT 262}

As shown in FIG. 57, a smaller-diameter first speed reduction gear 292g is coaxially fixed to the drive pulley 292b, and held in mesh with a larger-diameter second speed reduction gear 292h rotatably supported on the outer side of the gearbox 290. The second speed reduction gear 292h is combined with a smaller-diameter coaxial speed reduction gear 292h2 that is in mesh with a third speed reduction gear 292i rotatably supported on the outer side of the gearbox 290. The third speed reduction gear 292i is mounted on an outwardly projecting end of a third drive shaft 296 that is rotatably supported in the gearbox 290. As shown in FIG. 65, a first idle gear 292j is coaxially fixed to the third drive shaft 296 within the gearbox 290. The third drive shaft 296 has an inner projecting end to which there is coaxially fixed a third drive gear (not shown) held in mesh with a driven gear mounted on one of the drum support shafts 210a of the photosensitive drum 210. When the drum unit 262 is suspended by the support plates 286, 288, the driven gear mounted on one of the drum support shafts 210a is downwardly brought into mesh with the third drive gear. Thus, the drive forces of the printer motor 144 can be transmitted to the photosensitive drum 210.

{SYSTEM FOR TRANSMITTING DRIVE FORCES TO IMAGE FIXING UNIT 212}

A system for transmitting drive forces to the image fixing unit 212 will be described below with reference to FIGS. 65 and 66.

Figure 65:
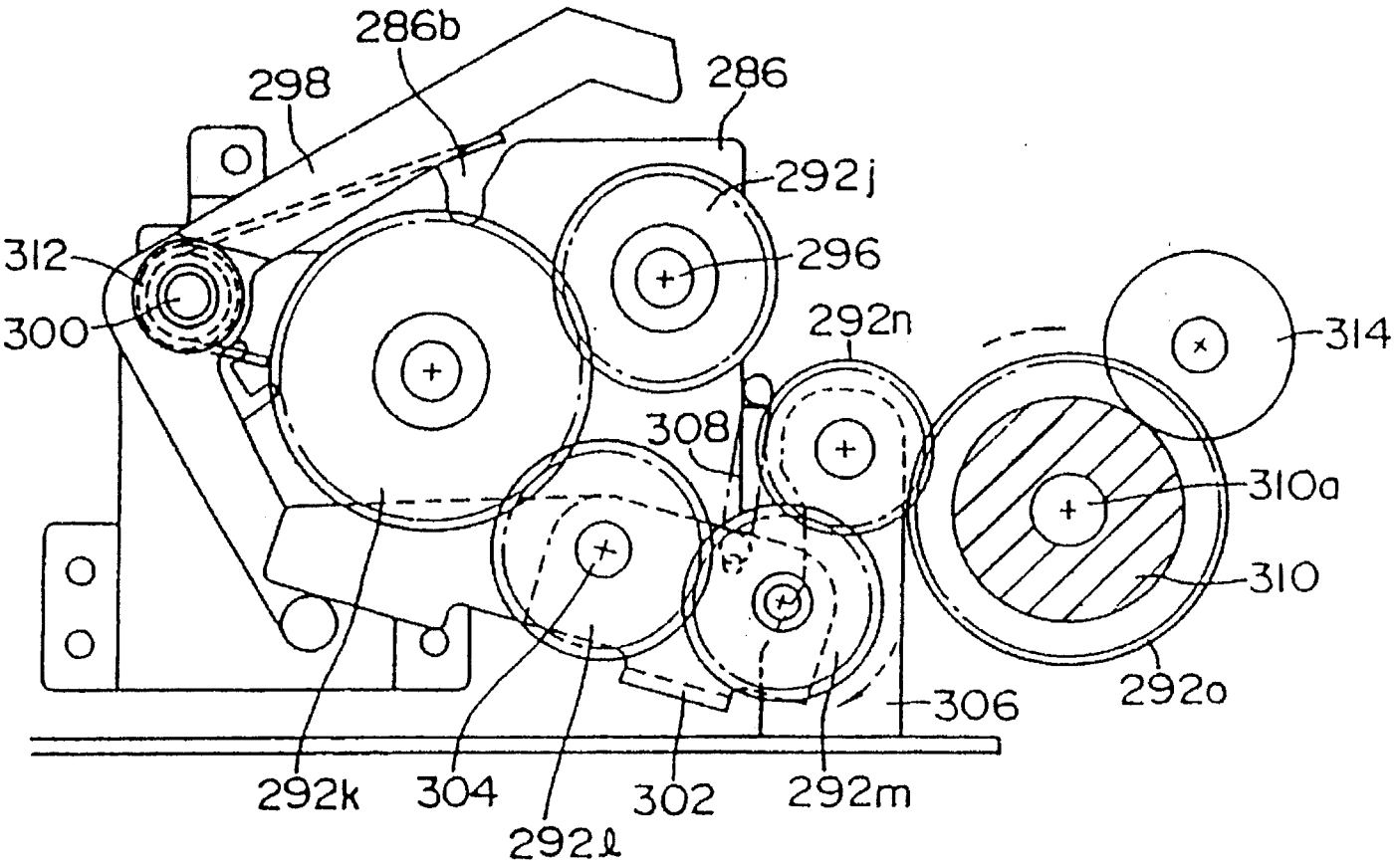
FIG. 65 is a side elevational view of a system for transmitting drive forces to the image fixing unit in the image printing mechanism, with the system being shown as connected.

As shown in FIG. 65, a larger-diameter second idle gear 292k is rotatably supported on the inner side surface of the gearbox 290 and always held in mesh with the first idle gear 292j. A substantially L-shaped control lever 298, for transmitting and interrupting drive forces to the image fixing unit 212, is angularly movably supported on an inner side surface of the support plate 286 immediately upstream of the second idle gear 292k by a first pivot shaft 300 on a bent corner of the control lever 298. A swing lever 302 is swingably supported on the support plate 286 below the second idle gear 292k for angular movement about a second pivot shaft 304 on a substantially intermediate portion of the swing lever 302. A third idle gear 292l held in mesh with the second idle gear 292k is rotatably mounted on the second pivot shaft 304. A fourth idle gear 292m held in mesh with the third idle gear 292l is rotatably mounted on the swing lever 302 downstream of the third idle gear 292l.

A fifth idle gear 292n is rotatably supported on a vertical stay 306 that is mounted on the main plate 12 downstream of the swing lever 302. When the swing lever 302 is angularly moved, the fourth idle gear 292m is brought into and out of mesh with the fifth idle gear 292n. The swing lever 302 is normally urged to turn counterclockwise by a coil spring 308 acting between the swing lever 302 and the gearbox 290 for maintaining the fourth and fifth idle gears 292m, 292n in mesh with each other. The fifth idle gear 292n is always held in mesh with a driven gear 292o that is coaxially fixed to one end of a shaft 310a of a lower fixing roller 310 of the image fixing unit 212. The image fixing unit 212 also has an upper fixing roller 314 held in rolling contact with the lower fixing roller 310 for sandwiching a sheet P therebetween to fix a toner image thereon.

The control lever 298 has one end projecting upwardly out of the gearbox 290 through an opening 290e (see FIG. 57) defined in the gearbox 290. The opposite end of the control lever 298 engages a lower surface of an upstream portion of the swing lever 302. The control lever 298 is angularly movable about the pivot shaft 300 between a lower position shown in FIG. 65, and an upper position, as shown in FIG. 66. When the control lever 298 is turned into the lower position, as shown in FIG. 65, the opposite end thereof is spaced from the lower surface of the swing lever 302, which is turned under the bias of the coil spring 308 to cause the fourth idle gear 292m to mesh with the fifth idle gear 292n. When the control lever 298 is turned into the upper position, as shown in FIG. 66, the opposite end thereof engages the lower surface of the swing lever 302 and pushes it upwardly against the bias the coil spring 308 to bring the fourth idle gear 292m out of mesh with the fifth idle gear 292n.

A torsion spring 312, that is disposed around the first pivot shaft 300, engages the control lever 298 for normally urging the control lever 298 to turn counterclockwise toward the upper position. The upper end of the control lever 298 is engageable with the upper housing 34 as it is lowered. More specifically, when the upper housing 34 is in the closed position, the upper housing 34 depresses the control lever 298 from the upper position to the lower position against the bias of the torsion spring 312. When the upper housing 34 is in the open position, the control lever 298 is allowed to turn from the lower position to the upper position under the resiliency of the torsion spring 312.

The biasing force of the torsion spring 312 is stronger than the biasing force of the coil spring 308. Therefore, when the control lever 298 is not depressed by the upper housing 34, the force tending to turn the control lever 298 to the upper position under the bias of the torsion spring 312, which causes the lower end of the control lever 298 to engage and turn the swing lever 302 clockwise, is stronger than the force tending to turn the swing lever 302 counterclockwise under the bias of the coil spring 308, for thereby bringing the fourth idle gear 292*m* out of mesh with the fifth idle gear 292*n*.

Consequently, when the upper housing 34 is in the closed position, the control lever 298 is lowered to the lower position, as shown in FIG. 65, removing the force tending to turn the swing lever 302 clockwise. The fourth idle gear 292*m* now comes into mesh with the fifth idle gear 292*n* under the resiliency of the coil spring 308. The drive forces from the printer motor 144 are then transmitted through the gear train, thus established, to the drive gear 292*o* coupled to the image fixing unit 212, which is actuated.

In the event of a sheet jam in the image fixing unit 212, or the like, the upper housing 34 is lifted to the open position, opening the sheet feed path 204 in order to remove a jammed sheet P. When the upper housing 34 is lifted to the open position, since no forces are present for depressing the control lever 298, the control lever 298 is turned about the first swing shaft 300 from the lower position to the upper position under the bias of the torsion spring 312. As a consequence, the swing lever 302 is pushed by the lower end of the control lever 298, and turned clockwise against the bias of the coil spring 308.

Figure 66:
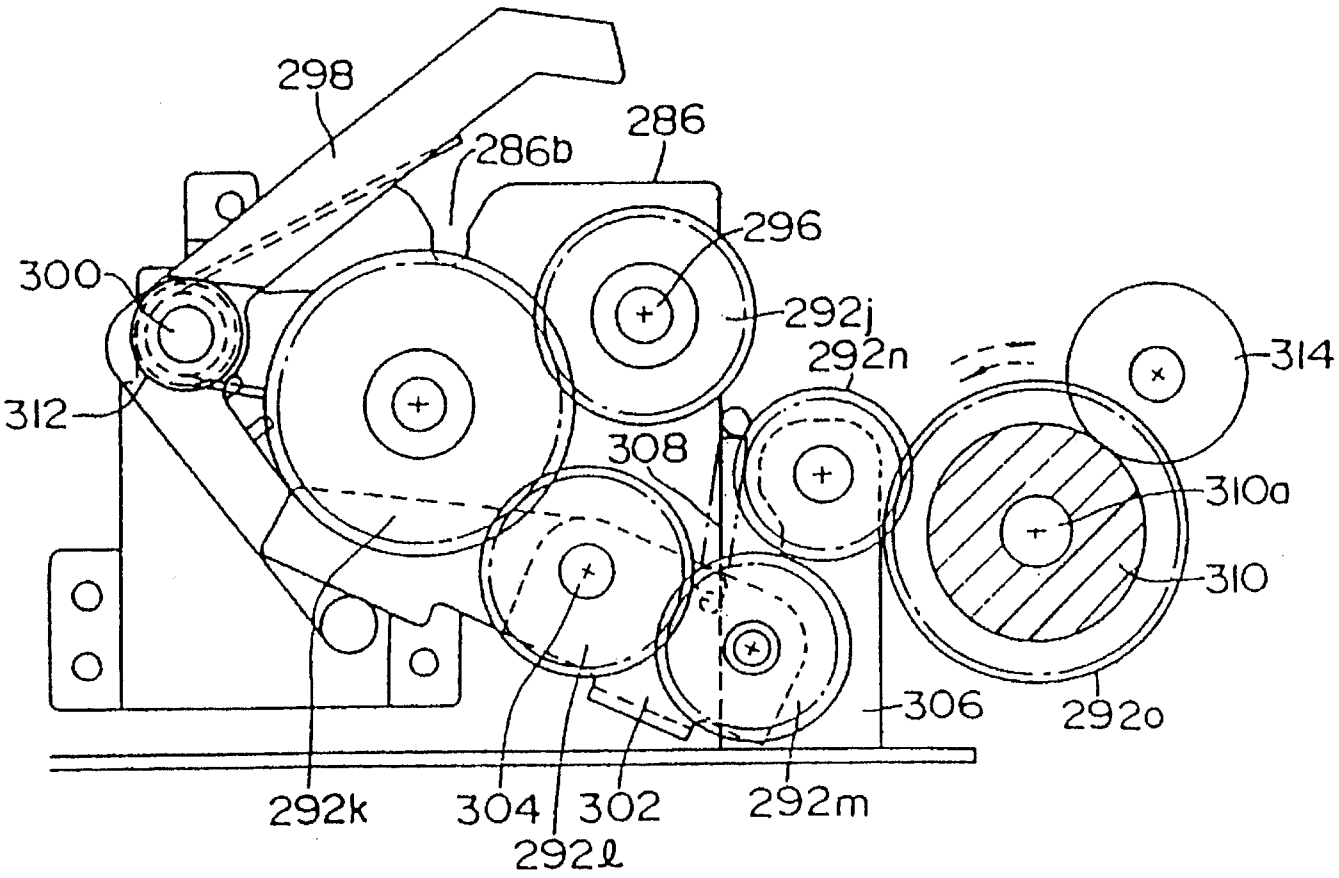
FIG. 66 is a side elevational view of the system for transmitting drive forces to the image fixing unit in the image printing mechanism, with the system being shown as disconnected.

As shown in FIG. 66, the fourth idle gear 292*m* is spaced away from the fifth idle gear 292*n* against the bias of the coil spring 208. Therefore, the drive forces from the printer motor 144 are interrupted at the fourth and fifth motors 292*m*, 292*n*, and not transmitted to the driven gear 292*o* coupled to the image fixing unit 212. Since the lower fixing roller 310 of the image fixing unit 212 is not coupled to the gear train, it can be freely rotated. Even if a jammed sheet P remains gripped between the upper and lower fixing rollers 314, 310, the lower fixing roller 310 is rotated when the jammed sheet P is pulled out, and hence does not impose an undue load on the jammed sheet P as it is pulled out. Consequently, a jammed sheet P, in the image fixing unit 212, can easily be removed efficiently simply by opening the upper housing 34.

(IMAGE FIXING UNIT 212)

The image fixing unit 212 will be described below with reference to FIG. 55.

<GENERAL ARRANGEMENT OF IMAGE FIXING UNIT 212>

As shown in FIG. 55, the image fixing unit 212 has a housing 316 fixedly mounted on the main plate 12 and accommodating the upper and lower fixing rollers 314, 130. The sheet feed path 204 has a downstream portion 204*c* positioned in the image fixing unit 212 and inclined such that it is progressively lowered in the direction in which a sheet P is fed through the sheet feed path 204. The downstream portion 204*c* has an inlet opening 318 defined in an upstream portion of an upper panel of the housing 316 and an outlet opening 320 defined in a lower portion of a front panel of the housing 316. The downstream portion 204*c* is substantially straight and inclined at a certain angle with respect to the plane of the main plate 12.

The lower fixing roller 310 is rotatably supported in a fixed position underneath the downstream portion 204*c* in the housing 316. The lower fixing roller 310 includes a shaft (not shown) to which the driven gear 292*o* is fixed, a hollow sleeve 310*b* coaxially disposed around the shaft, and a heating lamp 310*a* located in the hollow sleeve 310*b* for heating the hollow sleeve 310*b*. The upper fixing roller 314 which is rotatable as an idle roller, includes a shaft 314*a* rotatably supported at its opposite ends by the housing 316 and a resilient roller element 314*b* coaxially mounted on and around the shaft 314*a*.

{ROLLING CONTACT BETWEEN UPPER AND LOWER FIXING ROLLERS 314, 310}

A straight line segment L which passes through the central axes of the upper and lower fixing rollers 314, 310 extends substantially perpendicularly to the downstream portion 204*c* of the sheet feed path 204. Stated otherwise, the central axis of the upper fixing roller 314 is positioned on the line segment L that passes through the central axis of the lower fixing roller 310 and extends substantially perpendicularly to the downstream portion 204*c*. The upper fixing roller 314 is normally urged to move into pressing contact with the lower fixing roller 310 by a coil spring 322 that is interposed between the shaft 314*a* and the housing 316. When a sheet P with a toner image transferred to its lower surface is introduced into the image fixing unit 212 through the inlet opening 318, the sheet P is pressed against the lower fixing roller 310 by the upper fixing roller 314 with the lower surface of the sheet P being held against the lower fixing roller 310. As the lower fixing roller 310 rotates, the sheet P passes between the upper and lower fixing rollers 314, 310. At this time,the toner image on the lower surface of the sheet P is fixed thereto by the heat from the lower fixing roller 310. After the toner image is fixed, the sheet P is discharged through the outlet opening 320 out of the housing 316.

The toner image on the lower surface of the sheet P is fixed thereto by heating the lower surface of the sheet P with the lower fixing roller 310. Therefore, the lower surface of the sheet P, heated by the lower fixing roller 310, is drier than the upper surface of the sheet P. As a result, the sheet P tends to curl into an upwardly convex shape. To peel the curled sheet P reliably from the lower fixing roller 310, a peeling finger 324 is disposed whose tip end is held in contact with the outer circumferential surface of the lower fixing roller 310 for supporting the lower surface of the sheet P with the fixed toner image and defining the lower surface of the downstream portion 204*c*. Even when the sheet P is curled by the applied heat, it can reliably be discharged through the outlet opening 320 out of the housing 316 by the peeling finger 324.

<OIL FELT MEMBER 326>

As described above, the lower fixing roller 310 serves as a heating roller to thermally fix a toner image to the lower surface of a sheet P in direct contact therewith. After toner images are repeatedly fixed to sheets P, toner particles of those toner images are attached to the outer circumferential surface of the lower fixing roller 310, which is therefore smeared by the deposited toner particles. To prevent the lower fixing roller 310 from being contaminated by toner particles and also to reliably peel sheets P off the lower fixing roller 310, an oil felt member 326 is pressed against the outer circumferential surface of the lower fixing roller 310. The oil felt member 326 is made of felt and impregnated with lubricating oil.

Since the oil felt member 326 is pressed against the outer circumferential surface of the lower fixing roller 310, toner particles attached to the lower fixing roller 310 are scraped therefrom by the oil felt member 326. Consequently, the outer circumferential surface of the lower fixing roller 310 is kept clean of toner particles at all times, preventing sheets P from being smeared by toner particles.

<INSERT 328>

Inasmuch as the oil felt member 326 removes toner particles from the lower fixing roller 310, the oil felt member 326 is smeared by removed toner particles, and therefore should be replaced or cleaned periodically. The oil felt member 326 is attached to a lower end portion an insert 328 that is detachably inserted in the housing 316. The insert 328 can be inserted downwardly into the housing 316 through the inlet opening 318 across the downstream portion 204*c* of the sheet feed path 204. The insert 328 has an opening 328*a* defined transversely therein across the downstream portion 204*c* in registry therewith for passage of a sheet P therethrough.

<GUIDE 330>

As shown in FIG. 55, the angle at which the intermediate portion 204*b* of the sheet feed path 204, in the drum unit 262, is inclined, with respect to the main plate 12, is different from the angle at which the downstream portion 204*c* of the sheet feed path 204, in the image fixing unit 212, is inclined with respect to the main plate 12. More specifically, the former angle is smaller than the latter angle. To reliably introduce a sheet P with a transferred toner image from the drum unit 262 into the image fixing unit 212, a guide 330 is integrally joined to the insert 328. The guide 330 extend downstream from a position immediately above the opening 328*a* toward the downstream portion 204*c*.

A sheet P with a transferred toner image, which has been fed from the drum unit 262 out of the intermediate portion 204*b* of the sheet feed path 204, is fed along the guide 330 after its leading end abuts against the guide 330, so that the sheet P is smoothly guided into the downstream portion 204*c* of the sheet feed path 204. Consequently, the sheet P, that has been introduced into the image fixing unit 212 through the inlet opening 218, is reliably fed along the downstream portion 204*c* to the region where the upper and lower fixing rollers 314, 310 contact each other.

Though the angle at which the intermediate portion 204*b* inclined with respect to the main plate 12 is different from the angle at which the downstream portion 204*c* is inclined with respect to the main plate 12, a sheet P can reliably be fed to the upper and lower fixing rollers 314, 310 by the guide 330 on the insert 328 without getting jammed in the image fixing unit 212.

(SHEET DISCHARGING MECHANISM 332)

After a sheet P with a toner image fixed thereto has been discharged from the outlet opening 320 of the image fixing unit 212, the sheet P is discharged onto the sheet tray 38 by a sheet discharging mechanism 332 (see FIG. 54) that is positioned downstream of the image fixing unit 212. The sheet discharging mechanism 332 will be described in detail below with reference to FIGS. 67 through 75.

<GENERAL ARRANGEMENT OF SHEET DISCHARGING MECHANISM 332>

Figure 67:
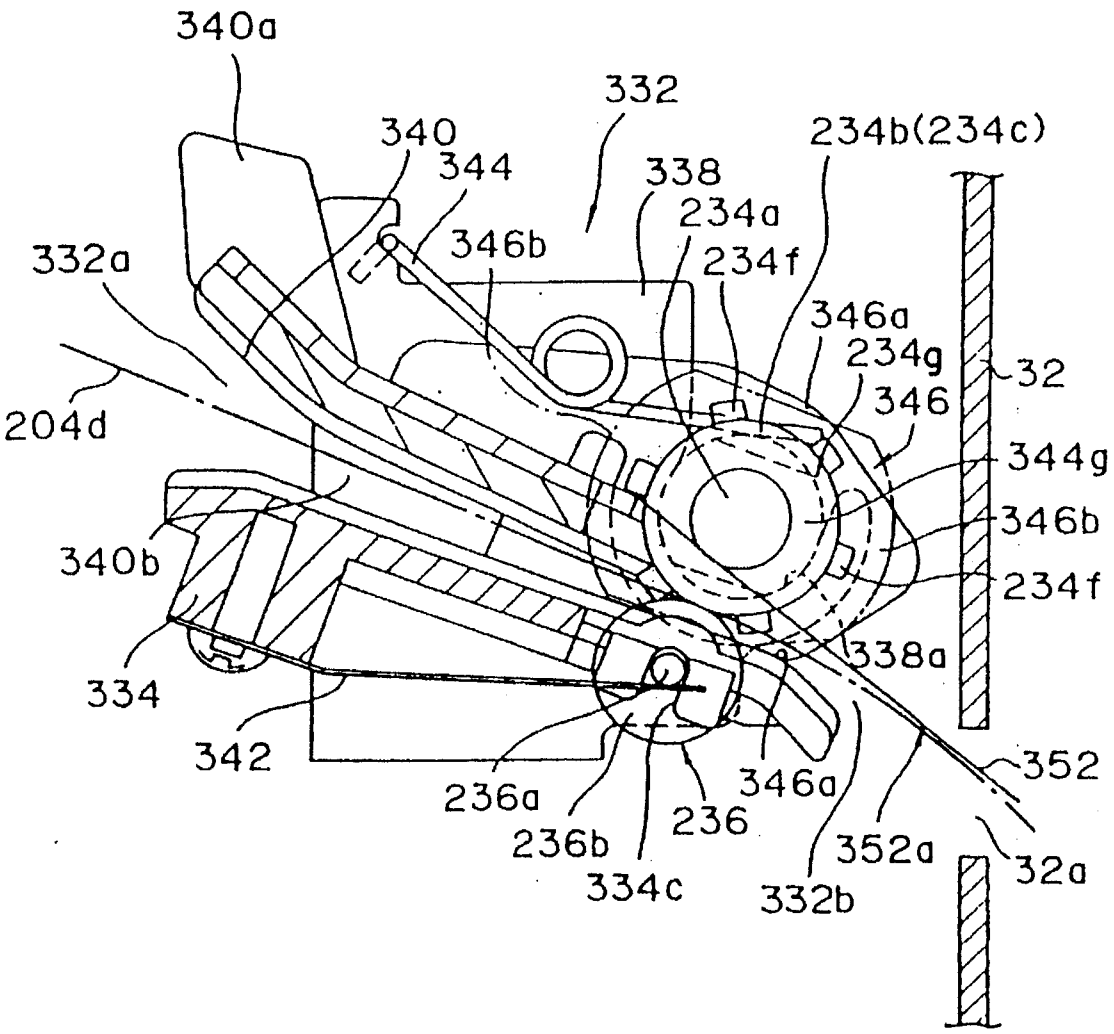
FIG. 67 is a side elevational view, partly in cross section, of a sheet discharging mechanism with an upper movable sheet discharge guide in a closed position.

As shown in FIG. 67, the sheet discharging mechanism 332 is disposed in the printer housing 32, and has a sheet inlet 332*a* facing the outlet opening 320 of the image fixing unit 212 and a sheet outlet 332*b* facing the sheet discharge slot 32*a* of the printer housing 32. The sheet discharging mechanism 332 is positioned above the main plate 12, and includes a lower fixed sheet discharge guide 334 which defines a lower surface of an outlet portion 204*d* of the sheet feed path 204. A pair of laterally spaced end plates 336, 338 (see also FIG. 68) are vertically attached to respective opposite ends of the lower fixed sheet discharge guide 334 and fixedly mounted on the main plate 12. An upper movable sheet discharge guide 340 extends between the end plates 336, 338 and movable angularly and vertically, with the upper movable sheet discharge guide 340 having a lower surface which defines an upper surface of an outlet portion 204*d* of the sheet feed path 204. When the upper movable sheet discharge guide 340 is positioned closely to the lower fixed sheet discharge guide 334, they define the outlet portion 204*d* therebetween. When the upper movable sheet discharge guide 340 is positioned away from the lower fixed sheet discharge guide 334, the outlet portion 204*d* is widely opened.

<LOWER SHEET DISCHARGE ROLLERS 286>

Figure 69:
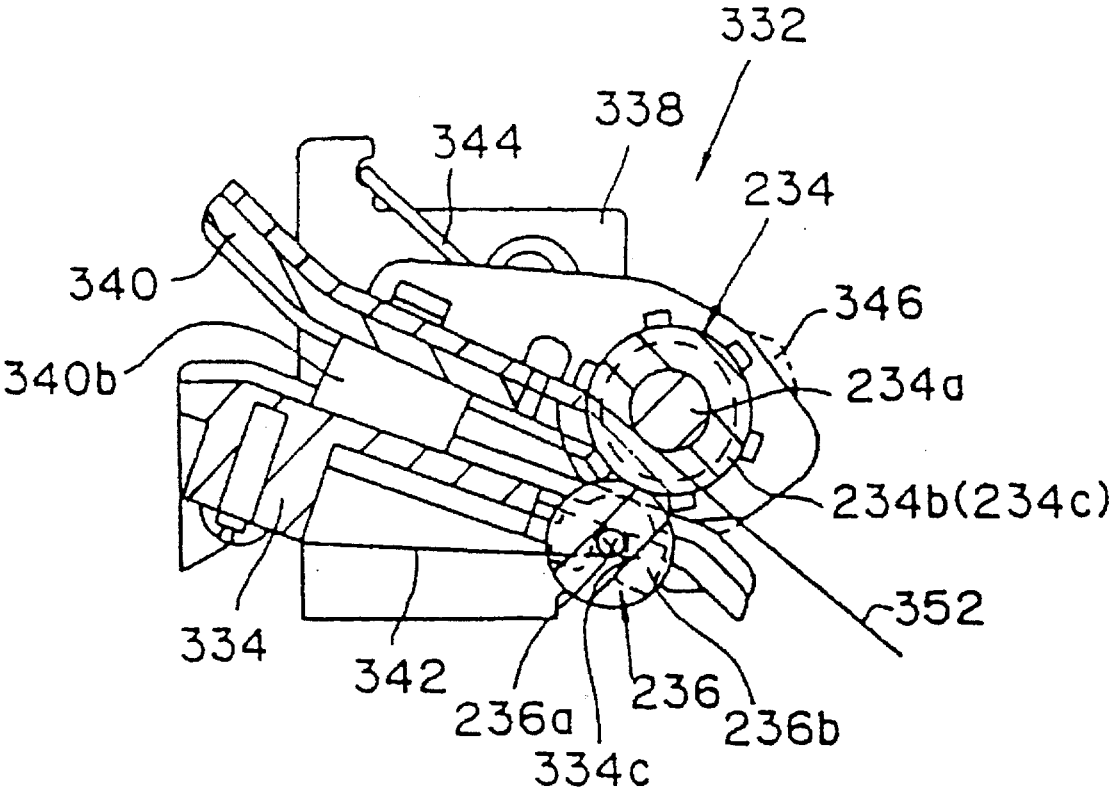
FIG. 69 is a cross-sectional view taken along line LXIX—LXIX of FIG. 68.

As shown in FIGS. 67 and 68, the lower fixed sheet discharge guide 834 has a pair of laterally spaced openings 334*a*, 334*b* defined in respective opposite end portions thereof so as to be compatible to all sizes of sheets P to be discharged. The lower sheet discharge rollers 236 are mounted on the lower surface of the lower fixed sheet discharge guide 334 such that they are partly inserted upwardly in the respective openings 334*a*, 334*b*. As shown in FIGS. 67 and 69, each of the lower sheet discharge rollers 236 includes a shaft 236*a* and a rubber roller element 236*b* mounted on and around the shaft 236*a* and having a portion extending upwardly through one of the openings 334*a*, 334*b*. The lower surface of the lower fixed sheet discharge guide 334 has downwardly open recesses 334*c* positioned on opposite sides of each of the openings 334*a*, 334*b* and receiving respective opposite ends of the shafts 236*a* of the lower sheet discharge rollers 236. Leaf springs 342 are fixed to the lower surface of the lower fixed sheet discharge guide 334 for resiliently supporting the shafts 236*a* upwardly to keep the shafts 236*a* resiliently held in the recesses 334*c*.

The lower sheet discharge rollers, 236 thus supported, serve as backup rollers for resiliently engaging the upper sheet discharge roller 234 upwardly. The leaf springs 342 serve as backup springs for holding the lower sheet discharge rollers 236 resiliently against the upper sheet discharge roller 234.

<UPPER SHEET DISCHARGE ROLLER 234>

Figure 70:
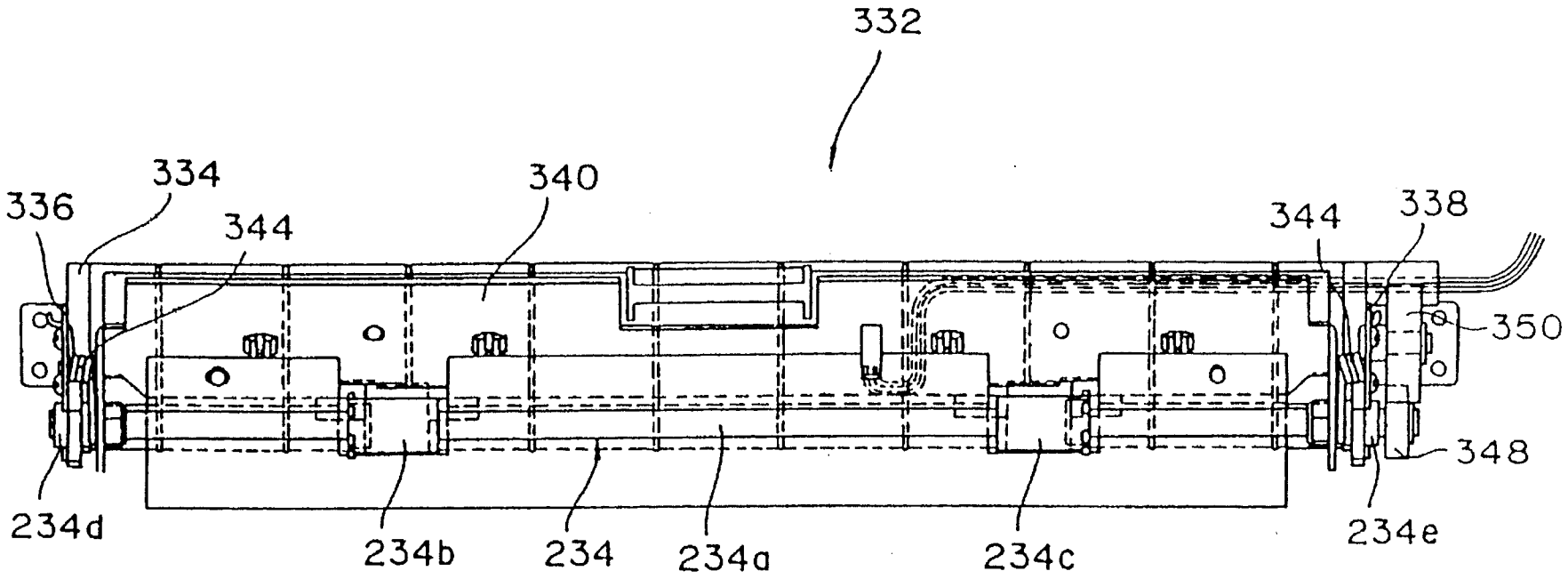
FIG. 70 is a plan view of the sheet discharging mechanism.

As shown in FIGS. 67, 68, and 70, the upper sheet discharge roller 234 includes a shaft 234*a* extending between the end plates 336, 338, a pair of rubber roller elements 234*b*, 234*c* mounted on and around the shaft 234*a* in vertical alignment with the respective lower sheet discharge rollers 236, and bearings 234*d*, 234*e* attached to respective opposite ends of the shaft 234*a* and supporting the shaft 234*a* rotatably on the end plates 336, 338. The end plates 336, 338 have an upwardly open recess 336*a* (see FIG. 71) and an upwardly open recess 338*a* (see FIG. 67) defined respectively in upper end surfaces thereof, the bearings 234*d*, 234*e* being fitted respectively in these recesses 336*a*, 338*b*. The upper sheet discharge roller 234 can be displaced upwardly as a whole when the bearings 234*d*, 234*e* are lifted from the recesses 336*a*, 338*b*.

To keep the bearings 234*d*, 234*e* retained resiliently in the recesses 336*a*, 338*b*, ends of torsion springs 344, mounted on inner side surfaces of the end plates 336, 338, engage respective upper portions of the bearings 234*d*, 234*e*. The other ends of the torsion springs 344 engage respective upper edges of the end plates 336, 338. The bearings 234*d*, 234*e* are thus resiliently held against bottom surfaces of the respective recesses 336*a*, 338*a* under the bias of the torsion springs 344.

<UPPER MOVABLE SHEET DISCHARGE GUIDE 340>

As illustrated in FIGS. 67 and 70, the upper movable sheet discharge guide 340 has a front or downstream end terminating short of the rubber roller elements 234*b*, 234*c* to avoid interference therewith. As shown in FIG. 70, the upper movable sheet discharge guide 340 is integrally joined to the bearings 234*d*, 234*e*. A grip 340*a* that can be gripped by the user is integrally joined to and extends obliquely rearwardly from a rear or upstream end of the upper movable sheet discharge guide 340.

As shown in FIGS. 67 and 72, stoppers 340*b* are attached to the lower surface of the upper movable sheet discharge guide 340 at respective positions outwardly of the sheet feed path. When the stoppers 340*b* abut against the upper surface of the lower fixed sheet discharge guide 334, an upstream portion of the outlet portion 204*d* of the sheet feed path 204, defined between the upper movable sheet discharge guide 340 and lower fixed sheet discharge guide 334, is set to an accurate gap. A downstream portion of the outlet portion 204*d* of the sheet feed path 204 is set to a desired gap with the bearings 234*d*, 234*e* received in the respective recesses 336*a*, 336*b*.

<CONTROL MEMBERS 346>

As shown in FIG. 72, control members 346, for controlling the rolling contact between the upper and lower sheet discharge rollers 234, 236, are integrally mounted on and around the respective bearings 234*d*, 234*e*. The control members 346 lie parallel to each other with the central axis of the shaft 234*a* extending therebetween. Each of the control members 346 has a pair of diametrically opposite flat surfaces 346*a* each spaced from the central axis of the shaft 234*a* by a distance r1, and a pair of diametrically opposite arcuate surfaces 346*b* each having a radius r2 of curvature from the central axis of the shaft 234*a* with, the radius r2 being longer than the distance r1. When the bearings 234*d*, 234*e* are received in the respective recesses 336*a*, 336*b*, the distance r1 is substantially the same as or slightly smaller than the distance from the central axis of the shaft 234*a* to the upper surface of the lower fixed sheet discharge guide 334, and the radius r2 is longer than the distance from the central axis of the shaft 234*a* to the upper surface of the lower fixed sheet discharge guide 334.

<DRIVE SYSTEM FOR SHEET DISCHARGING MECHANISM 332>

As shown in FIG. 73, one end of the shaft 234*a* of the upper sheet discharge roller 234 extends outwardly through the end plate 338, and a driven gear 348 is coaxially mounted on the projecting end of the shaft 234*a*. The driven gear 348 is held in mesh with an idle gear 350 rotatably supported on an outer side surface of the end plate 338. The idle gear 350 is held in mesh with the driven gear 292*o* of the image fixing unit 212, so that the idle gear 350 can be rotated when the drive forces from the printer motor 144 are transmitted thereto. The upper sheet discharge roller 234 serves as a drive roller, and when rotated by the printer motor 144, discharges a sheet P from the region, where the upper and lower sheet discharge rollers 234, 236 are positioned toward the sheet discharge slot 32*a*.

The recesses 336*a*, 338*a* in the respective end plates 336, 338 are in the form of arcuate grooves whose bottom surfaces extend around the axis of the idle gear 350. As a result, even when the upper sheet discharge roller 234 is displaced upwardly, the driven gear 348, mounted on the upper sheet discharge roller 234, is well maintained in mesh with the idle gear 350.

When the upper movable sheet discharge guide 340 is located closely to the lower fixed sheet discharge guide 334, the outlet portion 204*d* of the sheet feed path 204 is set to a predetermined gap, with the upper and lower sheet discharge rollers 234, 236 rollingly contacting each other. Therefore, in response to rotation of the upper sheet discharge roller 234, a sheet P, with a fixed toner image, can be discharged out of the sheet discharge slot 32*a*.

<REMOVAL OF JAMMED SHEET FROM SHEET DISCHARGING MECHANISM 332>

When the grip 340*a* is gripped by the user and pulled up lifting the upper movable sheet discharge guide 340, one of the flat surfaces 346*a* of each of the control members 346 is moved away from the upper surface of the lower fixed sheet discharge guide 334, and one of the arcuate surfaces 346*b* thereof faces and engages the upper surface of the lower fixed sheet discharge guide 334, as shown in FIG. 74.

As a result, the central axis of the upper sheet discharge roller 234 is spaced from the upper surface of the lower fixed sheet discharge guide 334 by a distance corresponding to the radius r2 of curvature of the arcuate surfaces 346*b*. The bearings 234*d*, 234*e* are now lifted from the corresponding recesses 336*a*, 336*b*, spacing the upper sheet discharge roller 234 upwardly from the lower sheet discharge roller 236. Accordingly, while the driven gear 348 remains in mesh with the idle gear 350, the upper and lower sheet discharge rollers 234, 236 are released from rolling contact with each other. When a sheet P is jammed in the sheet discharging mechanism 332, the grip 340*a* is gripped and lifted to turn the upper movable sheet discharge guide 340 upwardly, releasing the upper and lower sheet discharge rollers 234, 236 that has clamped the sheet P from rolling contact with each other. Therefore, the jammed sheet P can easily be pulled out forwardly. Any jammed sheets can thus be efficiently removed from the sheet discharging mechanism 332.

<SHEET DISCHARGE DETECTING SWITCH 238>

As shown in FIG. 75, the sheet discharge detecting switch 238 for detecting a sheet jam in the sheet discharging mechanism 332 is housed in a recess 334*d* defined in the lower fixed sheet discharge guide 334 that defines the lower surface of the outlet portion 204*d* of the sheet feed path 204. The sheet discharge detecting switch 238 has a trigger element 238*a* projecting into the outlet portion 204*d* such that the trigger element 238*a* can be pushed downwardly by a sheet P that is fed through the outlet portion 204*d*.

A main controller on the main control board 52 measures a period of time that has elapsed after the sheet feed detecting switch 232 was turned on by a sheet P fed through the sheet feed path 204. If the sheet discharge detecting switch 238 is not turned on even after elapse of a calculated period of time determined, from the speed of the sheet P and the distance between the sheet feed detecting switch 232 and the sheet discharge detecting switch 238, to indicating the absence of any sheet jam, then the main controller determines that the sheet P is jammed in the sheet feed path 204 at least upstream of the image fixing unit 212. The main controller then carries out an alarm process to display the sheet jam on the display window 20*b* of the control panel 20. Furthermore, if the sheet discharge detecting switch 238 is not turned off even after elapse of a period of time that is required for a sheet P to pass the sheet discharge detecting switch 238, then the main controller also determines that the sheet P is jammed in at least the sheet discharging mechanism 332, and carries out the alarm process to display the sheet jam on the display window 20*b* of the control panel 20.

<RUBBER ROLLER ELEMENTS 234*b*, 234*c* OF UPPER SHEET DISCHARGE ROLLER 234>

As shown in FIG. 67, each of the rubber roller elements 234*b*, 234*e* of the upper sheet discharge roller 234 has, on an axially outer end thereof, a plurality of teeth 234*f* circumferentially equally spaced around its outer circumferential surface and projecting radially outwardly therefrom. Each of the rubber roller elements 234*b*, 234*c* also has a circular recess 234*g* defined in the axially outer end thereof radially inwardly of the teeth 234*f*, leaving an annular flange beneath the teeth 234*f*. When the teeth 234*f* engage the upper surface of a sheet P being fed, the circular recess 234*g* allows the teeth 234*f* to be resiliently displaced radially inwardly without undue stresses being imposed on the upper surface of the sheet P.

The teeth 234*f* on each of the rubber roller elements 234*b*, 234*c* offer the following advantages: Forces that feed a sheet P in the sheet discharging mechanism 332 are generated by rotation of the upper sheet discharge roller 234. Even when the sheet P disengages from the upper sheet discharge roller 234, i.e., even when the sheet P leaves the region where the upper and lower sheet discharge rollers 234, 236 are held in rolling contact with each other, the radially outer surfaces of the teeth 234*f* still remain in frictional contact with the sheet P, and the teeth 234*f* still push the trailing end of the sheet P. Therefore, active forces for feeding the sheet P are not immediately eliminated, i.e., certain feeding forces are maintained when the sheet P leaves the upper sheet discharge roller 234. In addition, since the sheet P is also subject to inertial forces due to its continued movement and a component of gravitational forces due to the inclined sheet feed path, the sheet P is continuously fed even after it disengages from the upper sheet discharge roller 234.

As described above, the sheet discharging mechanism 332 is housed in the enclosure 28. The sheet outlet 332*b* of the sheet discharging mechanism 332 is positioned inwardly of the sheet discharge slot 32*a* of the printer housing 32. If the trailing end of a sheet P engages an edge of the sheet outlet 332*b* with a frictional force that is greater than the inertial force and the gravitational component on the sheet P, then the sheet P would stop and not be discharged onto the sheet tray 38. In this embodiment, however, the teeth 234*f* of the upper sheet discharge roller 234 frictionally engage the sheet P to push the trailing end of the sheet P, thereby reliably discharging the sheet P onto the sheet tray 38.

More specifically, even after the sheet P leaves the region where the upper and lower sheet discharge rollers 234, 236 are held in rolling contact with each other, since the radially outer ends of the teeth 234*f* are positioned radially outwardly of the outer circumferential surfaces of the rubber roller elements 234*b*, 234*c*, the trailing end of the sheet P is engaged and pushed forwardly by these teeth 234*f*. Consequently, the sheet P is forcibly discharged out of the sheet outlet 332*b*. The sheet P is reliably discharged forwardly from the sheet discharging mechanism 332 onto the sheet tray 38.

In the sheet discharging mechanism 332, therefore, when the upper movable sheet discharge guide 340 is positioned in the vicinity of the lower fixed sheet discharge guide 334 with the stoppers 340*b* abutting against the upper surface of the lower fixed sheet discharge guide 334, a sheet P, with a toner image fixed thereto, is fed forwardly through the sheet outlet 332*b* onto the sheet tray 38 in response to rotation of the upper sheet discharge roller 234.

<CHARGE ERASER SHEET 352>

Sheets P that are discharged from the sheet discharging mechanism 332 have been electrically charged when images are printed thereon. When the charged sheets P are discharged, they would tend to be attached to the enclosure 28 or stick together on the sheet tray 38 under electrostatic forces. An electric discharge would also be caused between an electrically charged sheet P on the sheet tray 38 and a finger of the user, making the user feel uncomfortable. It is therefore necessary to erase or remove any electric charge from a sheet P which is discharged from the sheet outlet 332*b*. According to this embodiment, as shown in FIG. 67, a charge eraser sheet 352 is fastened at one end thereof to an upper surface of the movable sheet discharge guide 340 with, the charge eraser sheet 352 doubling as a sheet guide for guiding a sheet P into the sheet discharge slot 32*a*. The charge eraser sheet 352 has a distal end extending downwardly into and across the outlet portion 204*d* of the sheet feed path 204 at a certain angle with respect thereto. A sheet P, as it is discharged from the sheet outlet 332*b*, contacts a lower surface of the charge eraser sheet 352, and is directed downwardly toward the sheet tray 38 through the sheet discharge slot 32*a*. At the same time, any electric charge developed in the sheet P is removed by the charge eraser sheet 352 while in contact therewith.

The charge eraser sheet 352 includes a film of synthetic resin having a predetermined rigidity and an electrically conductive layer 352*a* applied to the lower surface of the film. The upper surface of the upper movable sheet discharge guide 340, which is held in contact with the electrically conductive layer 352*a* of the charge eraser sheet 352 is made of an electrically conductive metal. Therefore, the electrically conductive layer 352*a* and the upper movable sheet discharge guide 340 are electrically connected to each other. The upper movable sheet discharge guide 340 is also electrically connected to the bearing 234*e*, which is of a metallic material. The bearing 234*e* is electrically connected through the torsion spring 344, which is made of a metallic material, to the end plate 338, which is made of an electrically conductive synthetic resin. The electrically conductive layer 352*a* of the charge eraser sheet 352 is therefore electrically connected to the end plate 338. With the end plate 338 grounded, any electric charge in the sheet P that is held in contact with the lower surface of the charge eraser sheet 352 is reliably erased or drained to ground.

[CONTROL OPERATION]

Various processes of control operation for the facsimile apparatus 10 will be described below.

(CONTROL OF SHEET PICKUP AND SHEET FEED TO IMAGE FIXING UNIT 212)

A control process for picking up a sheet P from the sheet cassette 36 upon rotation of the sheet feed roller 202 and feeding the sheet P to the image fixing unit 212 will be described below.

<GENERAL CONTROL OF SHEET PICKUP AND SHEET FEED TO IMAGE FIXING UNIT 212>

The sheet feed path 204 in the image printing mechanism 14 has a single sensor, i.e., the sheet feed detecting switch 232, for determining the timing to feed a sheet P. The sheet feed path 204 does not have a sensor which has heretofore been provided between the region where the upper and lower resist rollers 206, 208 rollingly contact each other (hereinafter referred to as a "resist roller contact region") and the image transfer region between the photosensitive drum 210 and the transfer charger 220. Nevertheless, the pickup motor 142 and the clutch mechanism are controlled in a sequence, described below, to bring the leading end of a sheet P to the image transfer region in timed relationship to the movement of a leading end area, to be transferred at first, of a toner image on the photosensitive drum 210 to the image transfer region. Specifically, after the leading end of the sheet P reaches the resist roller contact region, the feeding of the sheet P is resumed.

<DETAILED CONTROL OF SHEET FEED>

A control sequence for feeding a sheet P to the image transfer region will be described below with reference to FIGS. 76 and 77.

As shown In FIG. 76, a step S10 waits for a print start signal from a print controller on the main control board 52. If a print start signal is issued, then the printer motor 144 is energized in a step S12 to rotate the developing roller 218*c* in the developing unit 218, the photosensitive drum 210 and the auger 278 in the drum unit 262, the lower fixing roller 310 in the image fixing unit 212, and the upper sheet discharge roller 234 in the sheet discharging mechanism 322. Then, in a step S14, the clutch mechanism is disengaged to interrupt drive forces transmitted from the printer motor 144 to the lower resist roller 208, thereby stopping the upper and lower resist rollers 206, 208.

Thereafter, control proceeds to a step S16 to determine whether a pickup signal, indicating that a sheet P is picked up is outputted or not. If a pickup signal is outputted, the pickup motor 142 is energized in a step S18 to pick up, a sheet P from the sheet cassette 36 and feed the sheet P through the sheet feed path 204 to the resist roller contact region. Then, a step S19 determines whether the sheet feed detecting switch 232 is turned on by the leading end of the sheet P fed through the upstream portion 204*a* of the sheet feed path 204. If the sheet feed detecting switch 232 is turned on, then a timer measures a first predetermined period of time T1 from the time when the sheet feed detecting switch 232 is turned on. A step S20 determines whether the first predetermined period of time T1 has elapsed or not. If the first predetermined period of time T1 has elapsed, then the pickup motor 142 is de-energized in a step S22.

The first predetermined period of time T1 is defined by dividing the distance along the sheet feed path 204, between the sheet feed detecting switch 232 and the resist roller contact region by the peripheral speed of the sheet feed roller 202 as it rotates, i.e., defined as a period of time required for the leading end of the sheet P, that has been picked up, to reach the resist roller contact region after the sheet feed detecting switch 232 has been turned on. Therefore, when the pickup motor 142 is de-energized upon elapse of the first predetermined period of time T1, theoretically the sheet P is stopped with its leading end arriving at the resist roller contact region.

Thereafter, a step S24 waits for a sheet feed resume signal to be outputted as a print start signal. The sheet feed resume signal is issued when the leading end area, to be transferred at first, of a toner image on the photosensitive drum 210 arrives, upon rotation of the photosensitive drum 210, at a position that is spaced counterclockwise (in FIG. 55) around the photosensitive drum 210 from the image transfer region by a distance corresponding to the sum of a period of time (hereinafter referred to as an "image transfer region arrival time") required for the leading end of the sheet P to move from the resist roller contact region to the image transfer region and a second predetermined period of time T2, which is a very short interval such as of about 50 msec.

If a sheet feed resume signal is outputted in the step S24, the pickup motor 142 is energized again in a step S26. A step S28 measures the second predetermined period of time T2 with a timer. The pickup motor 142 is continuously energized until the second predetermined period of time T2 elapses.

When the pickup motor 142 is energized again, the lower resist roller 208 is not energized, but remains de-energized. Therefore, the sheet P is forcibly fed toward the resist roller contact region. Theoretically, the leading end of the sheet P should have reached the resist roller contact region when the pickup motor 142 has been energized for the first predetermined period of time T1. Actually, however, the pickup motor 142 is energized for the second predetermined period of time T2, irrespectively of whether the leading end of the sheet P has reached the resist roller contact region or not. If the leading end of the sheet P has actually reached the resist roller contact region, then the trailing end of the sheet P is forcibly fed forwardly with the leading end located at the resist roller contact region, with the result the sheet P is warped in the upstream portion 204*a* of the sheet feed path 204. On the other hand, if the leading end of the sheet P has not actually reached the resist roller contact region but been positioned immediately short of the resist roller contact region, then the leading end of the sheet P is advanced into the resist roller contact region when the pickup motor 142 is energized in the short, second predetermined period of time T2. Therefore, even if the sheet P has been skewed, it is corrected out of the skewed condition.

Consequently, even in the event that the leading end of the sheet P, picked up from the sheet cassette 36, has not yet reached the resist roller contact region upon rotation of the sheet feed roller 202, the leading end of the sheet P can be reliably brought into the resist roller contact region in response to rotation of the pickup motor 142 for the second predetermined period of time T2 prior to rotation of the lower resist roller 208.

Upon elapse of the second predetermined period of time T2, the pickup motor 142 is de-energized in a step S30. In synchronism with the de-energization of the pickup motor 142, the clutch mechanism is engaged in a step S32 to transmit drive forces from the printer motor 144 to the lower resist roller 208 to rotate the same. As the lower resist roller 208 rotates, the sheet P, whose leading end has been positioned in the resist roller contact region is fed through the sheet feed path upstream portion 204*a* toward the image transfer region. The leading end of the sheet P arrives at the image transfer region upon elapse of the image transfer region arrival time after the lower resist roller 208 has started to rotate. In synchronism with the arrival of the leading end of the sheet P at the image transfer region, the end area of a toner image on the photosensitive drum 210 reaches the image transfer region as the photosensitive drum 210 rotates. Thereafter, the transfer charger 220 is energized to transfer the toner image to the lower surface of the sheet P.

If a step S34 determines whether a third predetermined period of time T3 has elapsed, as measured by a timer, then the clutch mechanism is disengaged in a step S36. The predetermined period of time T3 is a period of time required for the sheet P to travel from the resist roller contact region to the region where the upper and lower fixing rollers 314, 310 rollingly contact each other upon rotation of the lower resist roller 208, i.e., a period of time consumed until the leading end of the sheet P, fed by rotation of the lower resist roller 208, is gripped by the upper and lower fixing rollers 314, 310 and readied for being fed forwardly by the lower fixing roller 310.

As described above, in this control sequence, the sheet P is picked up from the sheet cassette 36. A toner image is transferred to the lower surface of the sheet P. Then, leading end of the sheet P reaches the image fixing unit 212, and the sheet P is gripped by the upper and lower fixing rollers 314, 310 and fed forwardly through the sheet feed path 204 by the lower fixing roller 310.

When the above control sequence is carried out, the timing to feed the sheet P is determined only by the sheet feed detecting switch 232 in the sheet feed path 204, which is turned on by the leading end of the sheet P. The time at which the leading end of the sheet P reaches the image transfer region and the time at which the leading end area of the toner image on the photosensitive drum 210 reaches the image transfer region can be brought into conformity with each other by the above control process. Since only one sensor, i.e., the sheet feed detecting switch 232, is employed rather than two sensors that have been used heretofore, the number of parts used is reduced, and the cost of the facsimile apparatus 10 is lowered.

(CONTROL OF ROTATION OF PHOTOSENSITIVE DRUM 210)

A control process for controlling rotation of the photosensitive drum 210 of the printer driving mechanism 214 will be described below.

<GENERAL CONTROL OF ROTATION OF PHOTOSENSITIVE DRUM 210>

While the printer motor 144 of the printer driving mechanism 214 is energized to rotate the photosensitive drum 210 under steady conditions, i.e., while the photosensitive drum 210 is rotated at constant speed, a print permit condition is achieved. When the leading end area of a toner image on the photosensitive drum 210 arrives, upon rotation of the photosensitive drum 210, at a position that is spaced counterclockwise around the photosensitive drum 210 from the image transfer region by a distance corresponding to the sum of the image transfer region arrival time and the second predetermined period of time T2, a sheet feed resume signal is issued as a print start signal. The print permit condition is achieved when a print request is issued from the print controller. Specifically, when the print controller issues a print request, the printer motor 144 is energized. In the absence of a print request from the print controller, the printer motor 144 is de-energized, and the photosensitive drum 210 is stopped.

Therefore, when a plurality of pages are to be printed, each time a print request for printing a page is completed, the printer motor 144 would be de-energized, and upon issuance of a print request for printing a next page, the printer motor 144 would be energized again. A print permit condition is reached when the photosensitive drum 210 rotates steadily, and the next page would start being printed when a print start signal is issued to print the next page. The overall time required to print all pages would be long because the photosensitive drum 210 would be rotated and stopped each time a page is printed.

According to the illustrated embodiment, however, when a plurality of pages are to be printed, a drum rotation command is issued to continuously rotate the photosensitive drum 210 without interruptions for continuing a print permit condition between pages. Inasmuch as the time to be consumed idly, until the rotation of the photosensitive drum 210 reaches steady conditions is no longer necessary, the overall time required to print a plurality of pages is shortened.

<DETAILED CONTROL OF ROTATION OF PHOTOSENSITIVE DRUM 210>

A control sequence for supplying print data to output a drum rotation command and then a control sequence for printing print data using the drum rotation command will be described below with reference to FIGS. 78 and 79.

{PRINT DATA SUPPLY CONTROL}

Print data is transmitted over a communication line and stored in a buffer memory of the facsimile apparatus, and then the print data is supplied from the buffer memory to the print controller.

When the print data starts to be supplied, a step S40 waits until one page of print data becomes available. In this embodiment, the image printing mechanism 14 serves as a page printer for starting printing data when one page of print data is available and ready for printing. If one page of print data becomes available in the step S40, a print start signal is outputted to the print controller in a step S42. In response to the print start signal, the control sequence for picking up a sheet P and feeding it to the image fixing unit 212, as described above, with reference to FIGS. 76 and 77 starts being executed. After the control sequence for picking up and feeding a sheet P has begun, a step S46 waits for a print permit signal to be issued. The print permit signal is issued when the rotational speed of the photosensitive drum 210 reaches a constant speed in a printing process described later on.

If a print permit signal is issued in a step S46, then the print data is supplied to the laser scanning unit 24 in a step S48. If the supply of the print data is not completed in a step S50, then a step S52 determines whether a next page of print data is available or not.

If a next page of print data is not available in the step S52 and the supply of print data for a page being printed is completed, indicating that the supply of all print data is completed, then control goes back to the step S50, waiting for the completion of print data supply. If a next page of print data is available in the step S52, then control goes to a step S54 in which a drum rotation command is issued. Thereafter, control returns to the step S46, starting the control sequence following the step S46 again. If the supply of print data is completed in the step S50, then control jumps to a step S56 in which the drum rotation command is disabled, and control comes to an end.

When print data is supplied to the laser scanning unit 24, the laser scanning unit 24 applies a scanning laser beam, representing the print data, to the photosensitive layer of the photosensitive drum 210 for image exposure in the image exposure region IE while the photosensitive drum 210 is being rotated by the printer motor 144 that is energized in the step S12. As a result, an electrostatic latent image based on the print data is formed on the photosensitive drum 210. Prior to the image exposure, the entire surface of the photosensitive layer of the photosensitive drum 210 is uniformly charged by the drum charger 216 in response to a print start signal. Upon continued rotation of the photosensitive drum 210, the electrostatic latent image thereon is developed into a toner image by the image developing unit 218. Simultaneously with the arrival of the leading end of the sheet P at the image transfer region, the leading end area of the toner image on the photosensitive drum 210 reaches the image transfer region. As described above, the sheet feed resume signal is issued when the leading end area of the toner image on the photosensitive drum 210 arrives, upon rotation of the photosensitive drum 210, at a position that is spaced counterclockwise around the photosensitive drum 210 from the image transfer region, by a distance corresponding to the sum of the image transfer region arrival time and the second predetermined period of time T2.

{PRINT OPERATION CONTROL}

A control sequence for controlling printing operation of the image printing mechanism 14 will be described in detail below with reference to FIG. 79.

A step S60 waits for a print start signal. If a print start signal is issued, then a step S62 determines whether the photosensitive drum 210 is rotating or not. If the photosensitive drum 210 is not rotating in the step S62, then the printer motor 144 is energized to rotate the photosensitive drum 210 in a step S64. A step S66 then waits until the rotational speed of the photosensitive drum 210 reaches a constant speed. If the rotational speed of the photosensitive drum 210 reaches a constant speed, then a print permit signal is issued in a step S68. In response to the print permit signal, print data starts being supplied in the step S48 and the laser scanning unit 24 starts an image exposure process.

After the print permit signal has been issued in the step S68, a step S70 waits for the completion of printing of one page. If the printing of one page is completed, then a step S72 determines whether there is a drum rotation command issued or not. If no drum rotation command is issued, then since the completed printing of one page is judged as the printing of a single page or a final page, the printer motor 144 is de-energized to stop rotating the photosensitive drum 210 in a step S74. A step S76 then waits for a next print start signal. If a next print start signal is issued, control goes back to the step S62, starting the control sequence following the step S62 again. If no print start signal is issued in the step S76, then control goes to a step S78 in which the printing operation is finished.

If a drum rotation command is issued in the step S72, then since there is a next page of print data, the step S74 is skipped, and control goes to the step S76 while keeping the photosensitive drum 210 in continuous rotation. The step S76 waits for a next print start signal, and when a next print start signal is issued, control goes back to the step S62, starting the control sequence following the step S62 again to print a next page.

As described above, if a drum rotation command is issued when the printing of one page is completed in the step S70, then there is a next page of print data, and the printing process has to be continuously performed. Therefore, the start of the printing of a next page is awaited while keeping the photosensitive drum 210 in continuous rotation. The time which would otherwise have to be consumed until the rotational speed of the photosensitive drum 210 reaches a constant speed after the photosensitive drum 210 is stopped and rotated again to print a next page of print data, is therefore unnecessary, resulting in a reduction in the overall time required to print a plurality of pages.

(HEATING CONTROL FOR IMAGE FIXING UNIT 212)

A control sequence for controlling the heating of the lower fixing roller 310 of the image fixing unit 212 will be described below.

<GENERAL HEATING CONTROL FOR IMAGE FIXING UNIT 212>

The hollow sleeve **310*b* of the lower fixing roller 310 is heated by the heating lamp or heater 310*a* disposed in the hollow sleeve 310*b* when the heating lamp is energized. Heretofore, while the image printing mechanism 14 is in a standby condition, the temperature of the image fixing unit 212 is not kept at a fixing temperature HEATF, but at a standby temperature HEATS lower than the fixing temperature HEATF for energy saving purpose. According to this embodiment, however, if the standby temperature HEATS is continued for a predetermined period of time (second predetermined value Tb described below), the temperature is further lowered to an energy-saving temperature HEATE that is lower than the standby temperature HEATS for saving more energy. The heating control sequence is executed as an interrupt routine at interrupt intervals of 100 msec., for example, during the execution of a main control sequence or routine, describe above, for controlling the printer driving mechanism 214**.

<DETAILED HEATING CONTROL FOR IMAGE FIXING UNIT 212>

The heating control sequence is divided into a basic heating control sequence including a process of generating an energy-saving command for setting an energy-saving temperature, and a heating control sequence for controlling the heater **310*a*** using the energy-saving command.

{BASIC HEATING CONTROL}

When the facsimile apparatus 10 is switched on, the basic heating control sequence is executed. As shown in FIG. 80, a step S80 determines whether print data is being supplied or not. If print data is being supplied, then control goes to a step S82 in which a counter (described later on) is reset and an energy-saving command is disabled, i.e., an energy-saving mode is reset or inhibited, for allowing print data to be printed quickly. Then, the basic heating control sequence is ended.

If no print data is being supplied at present in the step S80, then control proceeds to a step S84 which determines whether one page of print data is available or not. If one page of print data is available, then control goes to the step S82 to inhibit the energy-saving mode to allow quick print data printing.

If one page of print data is not available in the step S84, then since no print data to be printed is present, a counter for giving a reference count for entering an energy-saying mode is incremented by "1". Thereafter, a step S88 determines whether the count of the counter has reached the sum of a first predetermined value Ta and a second predetermined value Tb. If not reached, then the basic heating control sequence is ended. If reached, then control proceeds to a step S90 in which an energy-saving command SAVE is issued to set the energy-saving mode. Then, the basic heating control sequence is brought to an end.

{HEATING CONTROL FOR HEATER **310*a***}

A control sequence for controlling the heating of the heater **310*a* using the energy-saving command will be described below with reference to FIGS. 81 and 82**.

When the control sequence for controlling the heating of the heater **310*a* is initiated, a step S92 determines whether or not the present temperature (detected temperature) TEMP of the lower fixing roller 310 is equal to or higher than a standby temperature lower limit value HEATSL. If the present temperature TEMP is lower than the standby temperature lower limit value HEATSL, then control goes to a step S94 in which a standby command WAIT is issued to cause the print controller to wait rather than starting a printing process. If the present temperature TEMP is equal to or higher than the standby temperature lower limit value HEATSL, then control goes to a step S96** in which the standby command WAIT is disabled.

After the standby command WAIT is issued in the step S94 or disabled in the step S96, control goes to a step S98 which determines whether an error command ERROR is issued or not. If an error command ERROR is issued, indicating a certain error that prevents an image fixing process, then control goes to a step S100 in which the heater **310*a* is turned off, and control leaves the control sequence for the main routine. Specifically, the image fixing process in the image fixing unit 310 is interrupted, and an error condition is displayed on the display window 20*b* of the control panel 20** based on the error command ERROR, indicating to the user that the printing operation is disabled.

If no error command ERROR is issued in the step S98, then control proceeds to a step S102 which determines whether an energy-saving command SAVE is issued or not. If an energy-saving command SAVE is issued, then control enters a control loop for heating the lower fixing roller 310 to the energy-saving temperature HEATE.

Control goes from the step S102 to a step S104 which determines whether the present temperature TEMP is lower than an energy-saving temperature lower limit value HEATEL or not. If the present temperature TEMP is lower than the energy-saving temperature lower limit value HEATEL, then the heater 310*a* is turned on in a step S106. Thereafter, a step S108 determines whether or not the present temperature TEMP is equal to or higher than an energy-saving temperature upper limit value HEATEH. If the present temperature TEMP is equal to or higher than the energy-saving temperature upper limit value HEATEH, then the heater 310*a* is turned off in a step S110. Then, control leaves the control sequence for the main routine.

If the present temperature TEMP is equal to or higher than the energy-saving temperature lower limit value HEATEL in the step S104, then control skips the step S106, does not turn on the heater 310*a*, and goes to the step S108. If the present temperature TEMP is lower than the energy-saving temperature upper limit value HEATEH in the step S108, then control skips the step S110, i.e., does not turn off the heater 310*a*, and leaves the control sequence for the main routine.

If no energy-saving command SAVE is issued in the step S102, then control goes to a step S112 which determines whether a heating control flag HEATHI is set to "1" or not. The heating control flag HEATHI is set to "1" when a print start signal is issued by the print controller, and reset to "0" after the counter has counted up to the first predetermined value Ta since no print start signal was issued. With the heating control flag HEATHI set to "1", a fixing mode is established for heating the lower fixing roller 310 to the fixing temperature HEATF, and with the heating control flag HEATHI set to "0", a standby mode is established for heating the lower fixing roller 310 to the standby temperature HEATS. The second predetermined value Tb is defined as a period of time that has to elapse before the energy-saving mode is established.

If the heating control flag HEATHI is set to "0", entering the standby mode, in the step S112, then control enters a control loop for heating the lower fixing roller 310 to the standby temperature HEATS.

Control goes from the step S112 to a step S114 which determines whether the present temperature TEMP is lower than a standby temperature lower limit value HEATSL or not. If the present temperature TEMP is lower than the standby temperature lower limit value HEATSL, then the heater 310*a* is turned on in a step S116. Thereafter, a step S118 determines whether or not the present temperature TEMP is equal to or higher than a standby temperature upper limit value HEATSH. If the present temperature TEMP is equal to or higher than the standby temperature upper limit value HEATSH, then the heater 310*a* is turned off in a step S120. Then, control leaves the control sequence for the main routine.

If the present temperature TEMP is equal to or higher than the standby temperature lower limit value HEATSL in the step S114, then control skips the step S116, i.e., does not turn on the heater 310*a*, and goes to the step S118. If the present temperature TEMP is lower than the standby temperature upper limit value HEATSH in the step S118, then control skips the step S120, i.e., does not turn off the heater 310*a*, and leaves the control sequence for the main routine.

If the heating control flag HEATHI is set to "1", entering the fixing mode, in the step S112, then control enters a control loop for heating the lower fixing roller 310 to the fixing temperature HEATF.

Control goes from the step S112 to a step S122 which determines whether the present temperature TEMP is lower than a fixing temperature lower limit value HEATFL or not. If the present temperature TEMP is lower than the fixing temperature lower limit value HEATFL, then the heater 310*a* is turned on in a step S124. Thereafter, a step S126 determines whether or not the present temperature TEMP is equal to or higher than a fixing temperature upper limit value HEATFH. If the present temperature TEMP is equal to or higher than the fixing temperature upper limit value HEATFH, then the heater 310*a* is turned off in a step S128. Then, control leaves the control sequence for the main routine.

If the present temperature TEMP is equal to or higher than the fixing temperature lower limit value HEATFL in the step S122, then control skips the step S124, i.e., does not turn on the heater 310*a*, and goes to the step S126. If the present temperature TEMP is lower than the fixing temperature upper limit value HEATFH in the step S126, then control skips the step S128, i.e., does not turn off the heater 310*a*, and leaves the control sequence for the main routine.

According to the heating control sequence for the image fixing unit 212, as described above, insofar as a print start signal is issued from the print controller, the lower fixing roller 310 is heated to the fixing temperature HEATF. Upon elapse of a period of time defined by the first predetermined value Ta after no print start signal has been issued from the print controller,the lower fixing roller 310 is heated to the standby temperature TEMPS, i.e., its temperature is lowered to the standby temperature TEMPS, for saving energy. When the lower fixing roller 310 is continuously kept at the standby temperature TEMPS for a period of time defined by the sum (Ta+Tb) of the first and second predetermined periods of time Ta, Tb, the lower fixing roller 310 is heated to the energy-saving temperature TEMPE, i.e., its temperature is lowered to the energy-saving temperature TEMPE, for saving more energy.

The present invention has been described and Illustrated as being embodied in a facsimile apparatus, the principles of the present invention are also applicable to a printer apparatus with no communication capability.

The present disclosure relates to subject matters contained in Japanese Utility Model Applications Nos. HEI 4-24499 (filed Mar. 24, 1992), HEI 4-29934 (filed on Apr. 8, 1992) and HEI 4-29967 (filed on Apr. 8, 1992) which are expressly incorporated herein by reference in their entireties.

What is claimed is:

1. An electrophotographic apparatus which comprises:

upper and lower original guide members which define a feed path for an original therebetween and which include an inlet port and an outlet port;

an original pick-up roller, disposed on an upper side of said inlet port of said feed path, for picking up an original and moving said original in a feeding direction along said feed path one by one; and original separation means, disposed on a lower side of said inlet port of said feed path and facing said original pick-up roller, for separating one original, which contacts the original pick-up roller, from at least one following original, said original separation means comprising:

a unit body;

a friction member attached to an upper surface of said unit body, extending in a downstream direction and intersecting said feed path at a predetermined angle, and having an upper surface with a predetermined friction coefficient; and a pair of supporting members attached to both sides of said unit body with respect to said friction member and extending in a downstream direction, each of said pair of supporting members formed of a spring material having an upper surface which extends so as to intersect the upper surface of said lower original guide member at a variable angle, each of said supporting members intersecting said friction member near a distal end thereof;

wherein said variable angle varies with a number of stacked originals inserted in said inlet port to enable said friction member to contact said stacked originals only when at least a predetermined number of stacked originals is inserted in said inlet port, said predetermined number of stacked originals being greater than one.

2. The apparatus according to claim 1, wherein the upper surface of the friction member is pressed to contact the original pick-up roller when no original exists between the friction member and the original pick-up roller.

3. The apparatus according to claim 2, wherein the friction member includes a first leaf spring formed of a rubber having an upper surface with the predetermined frictional coefficient, and a second leaf spring formed of a metal, closely contacting the undersurface of the first leaf spring, with a predetermined elasticity.

4. The apparatus according to claim 3, wherein the friction member is arranged so as to contact the original pick-up roller located midway in the feed path.

5. The apparatus according to claim 1, wherein each of the supporting members is formed of a metallic leaf spring.

6. The apparatus according to claim 5, wherein each of the supporting members is arranged so as to contact the original pick-up roller on the upstream side of the feeding direction with respect to a position where the friction member contacts the original pick-up roller.

7. An electrophotographic apparatus which comprises:

upper and lower original guide members which define a feed path for an original therebetween and which include an inlet port and an outlet port;

an original pick-up roller, disposed on an upper side of said inlet port of said feed path, for picking up an original and moving said original in a feeding direction along said feed path one by one; and original separation means, disposed on a lower side of said inlet port of said feed path and facing said original pick-up roller, for separating one original, which contacts the original pick-up roller, from at least one following original, said upper original guide member comprising a through hole through which said original pick-up roller is to be inserted;

said original pick-up comprising a lower part adapted to protrude into said feed path through said through hole; and said original separation means comprising a separation surface contacting an outer peripheral surface of said lower part of said original pick-up roller;

wherein said original separation means comprises means for preventing the originals from contacting said separation surface unless at least a predetermined number of originals are supported on said original separation means, said predetermined number of originals being greater than one.

8. The apparatus according to claim 7, wherein the lower original guide member includes:

a lower guide body having a lower guiding surface; and a pair of supporting walls which stand on both sides of the lower guide body, and the original pick-up roller is rotatably supported to the supporting walls at both ends thereof, and the separation means is received in a recess which is formed to the lower guiding surface of the lower guide body of the lower original guide member.

9. The apparatus according to claim 8, wherein the upper original guide member includes an upper guide body to which the through hole is formed, and a bend portion integrally connected to the upper guide body on an upstream side of the feeding direction, and being slant to the upper guide body by a predetermined angle.

10. The apparatus according to claim 9, wherein the upper guide body is arranged to be slant to a mounting surface on which the electrophotographic apparatus is disposed.

11. The apparatus according to claim 9, wherein the bend portion is arranged to be slant to the upper guide body so as to intersect the lower guide surface of the lower original guide member which defines a lower surface of the inlet port of the feed path by a predetermined angle.

12. An electrophotographic apparatus which comprises:

upper and lower original guide members which define a feed path for an original therebetween and which include an inlet port and an outlet port;

an original pick-up roller, disposed on an upper side of the inlet port of the feed path, for picking up the original in a feeding direction along the feed path one by one;

original separation means, disposed on a lower side of the inlet port of the feeding path, being pressed to the original pick-up roller, for separating one original, which contacts the original pick-up roller, from at least one following original;

image reading means, arranged on the downstream side of a feeding direction relative to the original pick-up roller, for reading an image of the original fed thereto;

a white roller disposed on an opposite side of the image reading means interposing the feed path therebetween; and attaching means for detachably attaching the original pick-up roller and the white roller to the lower original guide member, wherein the lower original guide member includes:

a lower guide body having a lower guiding surface;

a pair of supporting walls which stand on both sides of the lower guide body;

a first recess formed to an upper edge of each of the supporting walls on the upstream side of the feeding direction, for supporting the original pick-up roller; and a second recess formed to the upper edge of each of the supporting walls on the downstream side of the feeding direction, for supporting the white roller;

wherein the original pickup roller includes a shaft portion and a frictional roller portion attached to an outer periphery of the shaft portion; and wherein both ends of the shaft portion of the original pick-up roller are rotatably received in respective first recesses through respective first bearing bushes.

13. The apparatus according to claim 12, wherein each of said first bearing bushes includes a bearing bush body through which a corresponding end of the shaft portion of the original pick-up roller is inserted, and engagement means, provided between the bearing bush body and the supporting wall, for releasably engaging the bearing bush body with the supporting wall.

14. The apparatus according to claim 13, wherein the engagement means includes:

an extending member integrally formed to the bearing bush body, and extending in a direction intersecting a direction of a rotating axis of the shaft portion;

at least one protrusion formed on a side surface of the extending member, protruding to a corresponding supporting wall; and at least one engaging hole formed in the supporting wall, for receiving a corresponding protrusion so as to engage the bearing bush body in the first recess.

15. The apparatus according to claim 12, wherein said white roller comprises a shaft portion and a white roller portion attached to an outer periphery of said shaft portion, and both ends of said shaft portion of said white roller are rotatably received in the respective second recesses through respective second bearing bushes.

16. The apparatus according to claim 15, wherein each of the second bearing bushes includes a bearing bush body through which the corresponding end of the shaft portion of the white roller is inserted, and engagement means, provided between the bearing bush body and the supporting wall, for releasably engaging the bearing bush body with the supporting wall.

17. The apparatus according to claim 16, wherein said engagement means comprises:

an extending member integrally formed to the bearing bush body, and extending in a direction intersecting a direction of a rotating axis of the shaft portion;

at least one protrusion formed on a side surface of the extending member, protruding to a corresponding supporting wall; and at least one engaging hole formed in the supporting wall, for receiving a corresponding protrusion so as to engage the bearing bush body in said respective second recess.

18. The apparatus according to claim 12, wherein the upper original guide member is attached to the lower original guide member in such a manner that the upper original guide member is detachable from the lower original guide member upward.

19. An electrophotographic apparatus which comprises:

upper and lower original guide members which define a feed path for an original therebetween and which include an inlet port and an outlet port;

an original pick-up roller, disposed on an upper side of the inlet port of the feed path, for picking up the original in a feeding direction along the feed path one by one;

original separation means, disposed on a lower side of the inlet port of the feeding path, being pressed to the original pick-up roller, for separating one original, which contacts the original pick-up roller, from at least one following original; and attaching means for detachably attaching the original separation means to the lower original guide member;

wherein said lower original guide member includes a guide body having an upper surface defining the lower surface of the feed path, said original separation means includes a front portion to which a first protrusion is formed and a rear portion to which a second protrusion is formed, and said attaching means includes:

a recess which is formed on the upper surface of the guide body, in which said original separation means is to be received, and which has a front wall portion and a rear wall portion;

a first engaging groove which is formed to the front wall portion of the recess, and with which said first protrusion is to be engaged; and a second engaging groove which is formed to the rear wall portion of the recess, and with which said second protrusion is to be engaged.

20. The apparatus according to claim 19, wherein the original separation means includes a unit body, the front portion of the original separation means is defined by an elastic stopper member which is integrally formed to the front surface of the unit body, the first protrusion is formed to the front surface of the elastic stopper member so as to protrude forward, and said second protrusion is formed to the rear surface of the unit body so as to protrude rearward.

21. The apparatus according to claim 20, wherein said first protrusion is disengaged from the first engaging groove when the elastic stopper member is pressed rearward.

22. The apparatus according to claim 21, wherein said front surface of the elastic stopper member is elastically contacted with the front wall portion of the recess while the unit body is received in the recess.

23. The apparatus according to claim 1, wherein said predetermined number of originals is five.

24. The apparatus according to claim 1, wherein said friction member separates a predetermined number of originals upon contact therewith.

25. The apparatus according to claim 1, wherein said pair of supporting members intersect said friction member between a cantilever base of said friction member and said distal end of said friction member.

26. The apparatus according to claim 1, wherein said pair of supporting members comprise a predetermined spring constant so that said pair of supporting members deflect only when at least said predetermined number of originals are supported on said pair of supporting members.

27. The apparatus according to claim 7, wherein said predetermined number of originals is five.

28. An electrophotographic apparatus comprising:

upper and lower original guide members which define a feed path for an original therebetween and which include an inlet port and an outlet port;

an original pick-up roller, disposed on an upper side of said inlet port of said feed path, for picking up originals in a feeding direction along said feed path one by one; and an original separator, contacting said original pick-up roller, for separating one original, which contacts said original pick-up roller, from at least one following original;

said original separator comprising:

a friction member extending toward a downstream side of the feeding direction of the original so as to intersect said feed path at a predetermined angle, said friction member contacting a peripheral surface of said original pick-up roller; and a supporting mechanism having an upper surface which extends so as to intersect said feed path at a variable angle, said supporting mechanism contacting said peripheral surface of said original pick-up roller at a location upstream of a location in which said friction member contacts said peripheral surface of said original pick-up roller;

wherein said variable angle varies with a number of stacked originals inserted in said inlet port to enable said friction member to contact said stacked originals only when at least a predetermined number of stacked originals is inserted in said inlet port, said predetermined number of stacked originals being greater than one.

29. The apparatus according to claim 28, wherein said supporting mechanism separates a number of originals upon contact therewith, without deflection of said supporting mechanism when the number of originals is less than a predetermined number, said predetermined number being at least greater than two.

30. The apparatus according to claim 29, wherein said supporting mechanism includes a predetermined spring constant so that said supporting mechanism deflects only when at least said predetermined number of originals are supported on said supporting mechanism, wherein said originals then contact said friction member.

* * * * *

UNITED STATES PATENT AND TRADEMARK OFFICE

CERTIFICATE OF CORRECTION

PATENT NO. : 5,528,352

DATED : June 18, 1996

INVENTOR(S) : K. ICHINOKAWA et al.

It is certified that error appears in the above-indentified patent and that said Letters Patent is hereby corrected as shown below:

At column 63, line 48 (claim 7, line 17), after "pick-up" insert ---roller---.

At column 68, line 4( claim 30, line 2), change "includes" to ---comprises---.

Signed and Sealed this

Eighteenth Day of February, 1997

*Attest:*

*Attesting Officer*

BRUCE LEHMAN

*Commissioner of Patents and Trademarks*